US007736081B2

(12) United States Patent
Taylor et al.

(10) Patent No.: US 7,736,081 B2
(45) Date of Patent: Jun. 15, 2010

(54) COLLAPSIBLE RING BINDER AND USES THEREOF

(75) Inventors: Curtis Patrick Taylor, Chagrin Falls, OH (US); Anthony J. DeCarlo, Parma, OH (US)

(73) Assignee: Ideastream Consumer Products, LLC, Cleveland, OH (US)

( * ) Notice: Subject to any disclaimer, the term of this patent is extended or adjusted under 35 U.S.C. 154(b) by 57 days.

(21) Appl. No.: 11/544,465

(22) Filed: Oct. 6, 2006

(65) Prior Publication Data

US 2007/0086837 A1 Apr. 19, 2007

Related U.S. Application Data

(60) Provisional application No. 60/724,135, filed on Oct. 6, 2005, provisional application No. 60/742,561, filed on Dec. 5, 2005, provisional application No. 60/809,332, filed on May 31, 2006.

(51) Int. Cl.
*B42F 13/02* (2006.01)
*B42F 13/00* (2006.01)

(52) U.S. Cl. ..... 402/22; 402/19; 402/73

(58) Field of Classification Search ..... 402/5, 402/18, 19, 21, 71, 22, 23, 72, 8, 14, 46, 402/49, 55, 60, 80 R, 500, 70
See application file for complete search history.

(56) References Cited

U.S. PATENT DOCUMENTS

| | | | |
|---|---|---|---|
| 484,268 | A | 10/1892 | Westrup |
| 1,046,181 | A | 12/1912 | Hale |
| 1,269,764 | A | 6/1918 | Weaver |
| 1,344,971 | A | 6/1920 | Allison |
| 1,507,547 | A | 9/1924 | Gunewald |
| 1,837,424 | A | 12/1931 | Gannon |
| 1,840,743 | A | 1/1932 | Schade |
| 2,093,041 | A | 9/1937 | Emery |
| 2,206,317 | A | 7/1940 | Behn |
| 2,832,348 | A | 4/1958 | Demarest, Jr. |
| 2,878,816 | A | 3/1959 | Panfil |
| 3,251,364 | A | 5/1966 | Goldman |

(Continued)

FOREIGN PATENT DOCUMENTS

| | | |
|---|---|---|
| CH | 220225 | 3/1943 |

(Continued)

OTHER PUBLICATIONS

International Search Report from PCT/US07/01290, mailed Apr. 1, 2008.

(Continued)

*Primary Examiner*—Dana Ross
*Assistant Examiner*—Pradeep C Battula
(74) *Attorney, Agent, or Firm*—Calfee, Halter & Griswold LLP

(57) ABSTRACT

A collapsible ring binder includes a plurality of selectively openable and closable rings that releasably retain hole-punched documents within the binder. The rings may be collapsed and/or detached from the binder to flatten the binder for transportation and/or storage. The rings are easily moved from their collapsed and/or detached configuration to their upright and usable configuration so that an end user can easily ready the collapsed binder for use.

43 Claims, 89 Drawing Sheets

U.S. PATENT DOCUMENTS

| | | | | | |
|---|---|---|---|---|---|
| 3,313,303 | A | | 4/1967 | Beyer | |
| 3,313,304 | A | | 4/1967 | Beyer | |
| 3,331,373 | A | | 7/1967 | Lohmeier | |
| 3,748,051 | A | | 7/1973 | Frank | |
| 3,842,463 | A | | 10/1974 | Wehner | |
| 3,854,650 | A | | 12/1974 | Hanaue | |
| 3,927,949 | A | * | 12/1975 | Clinch | 402/22 |
| 4,127,340 | A | | 11/1978 | Almgren | |
| 4,180,341 | A | | 12/1979 | Langhorst | |
| 4,312,488 | A | | 1/1982 | Pierron | |
| 4,486,113 | A | | 12/1984 | Cummins | |
| 4,569,613 | A | | 2/1986 | Thomas | |
| 4,577,985 | A | * | 3/1986 | Beyer | 402/22 |
| 4,744,689 | A | | 5/1988 | Sternberg | |
| 4,842,434 | A | | 6/1989 | Ferreira-Godinho | |
| 4,886,390 | A | | 12/1989 | Silence et al. | |
| 5,213,429 | A | | 5/1993 | Johnson | |
| 5,333,962 | A | | 8/1994 | Johnson | |
| 5,423,624 | A | | 6/1995 | Richards | |
| 5,642,954 | A | | 7/1997 | Hudspith | |
| 5,667,323 | A | * | 9/1997 | Whaley | 402/26 |
| 6,099,187 | A | | 8/2000 | Youngs | |
| 6,200,057 | B1 | | 3/2001 | Youngs et al. | |
| 6,345,924 | B1 | | 2/2002 | Whaley | |
| 6,514,000 | B2 | | 2/2003 | Youngs et al. | |
| 6,913,408 | B2 | | 7/2005 | Tsujino | |
| 7,063,477 | B2 | | 6/2006 | Busam et al. | |
| 2003/0044221 | A1 | | 3/2003 | To et al. | |

FOREIGN PATENT DOCUMENTS

| | | |
|---|---|---|
| DE | 65113 | 1/1892 |
| DE | 367487 | 1/1923 |
| DE | 392790 | 3/1924 |
| FR | 1562059 | 4/1969 |
| WO | 2005/042270 | 5/2005 |
| WO | 2007/044550 | 4/2007 |
| WO | 2007/143070 | 12/2007 |

OTHER PUBLICATIONS

International Search Report from PCT/US06/039203, mailed May 30, 2007.

National (R) storm window clip (shown in attached Declaration of Curtis P. Taylor).

Non-Final Office Action mailed Sep. 14, 2009, for U.S. Appl. No. 11/544,472.

International Preliminary Report on Patentability for International Patent Application Serial No. PCT/US2006/039203 dated Apr. 9, 2008.

Office Action mailed Nov. 17, 2009, for Canadian Patent Application Serial No. 2,624,526.

* cited by examiner

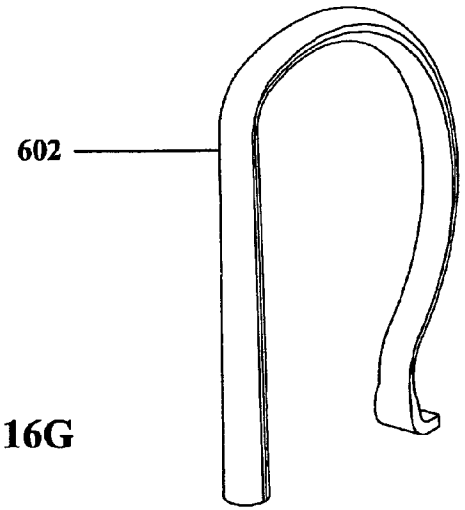
Fig. 16G
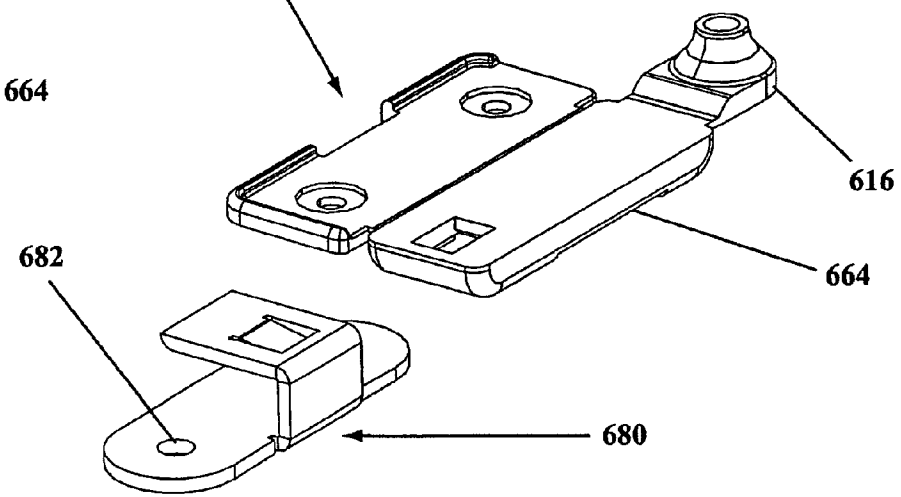
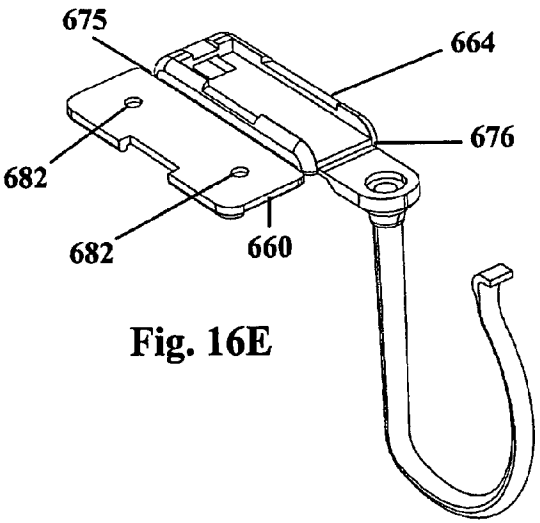
Fig. 16E
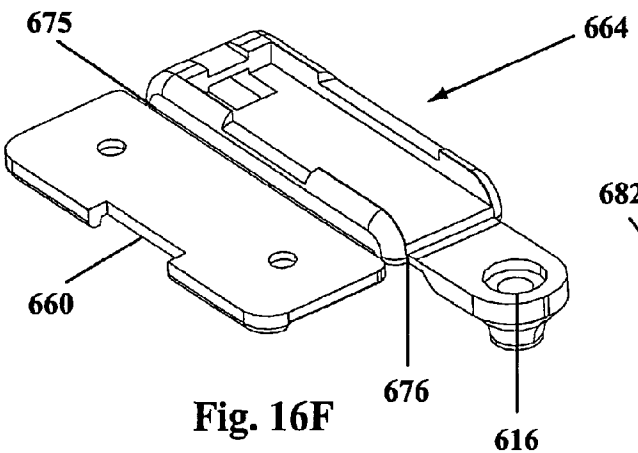
Fig. 16F

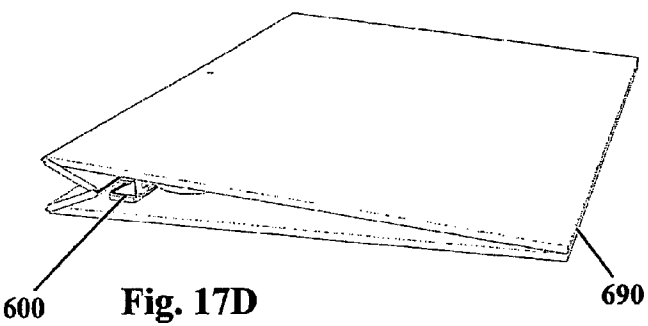
Fig. 17D
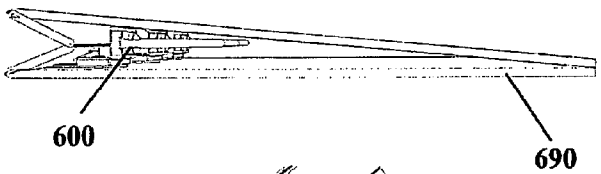
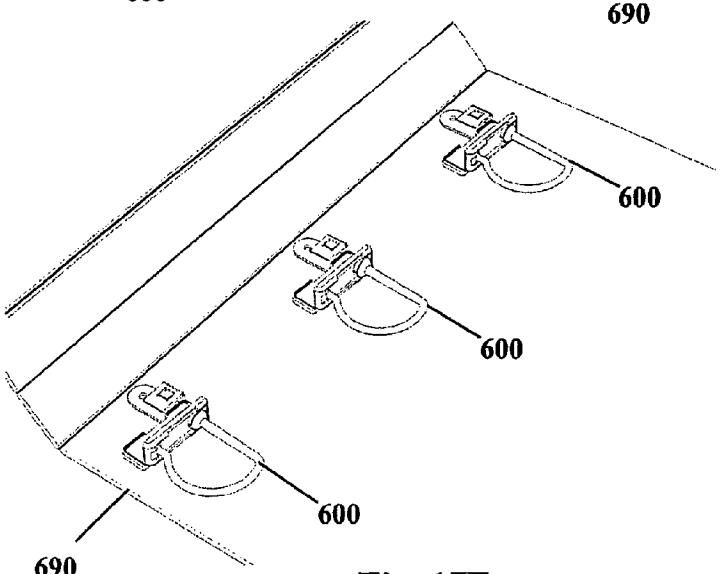
Fig. 17E
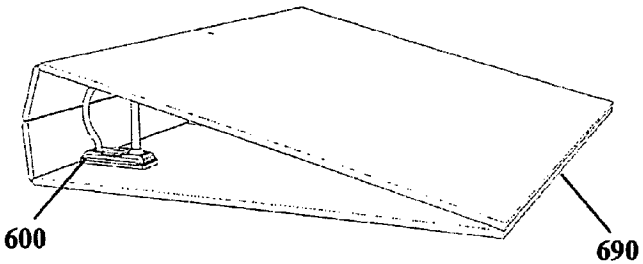
Fig. 17B
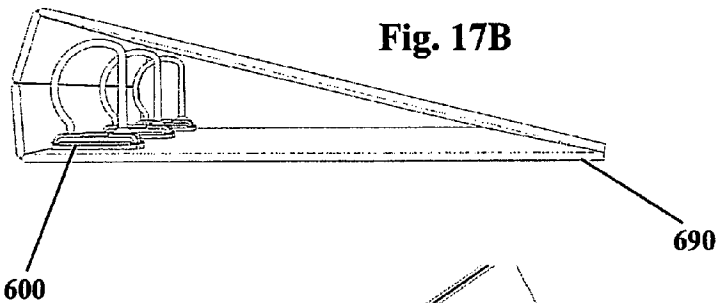
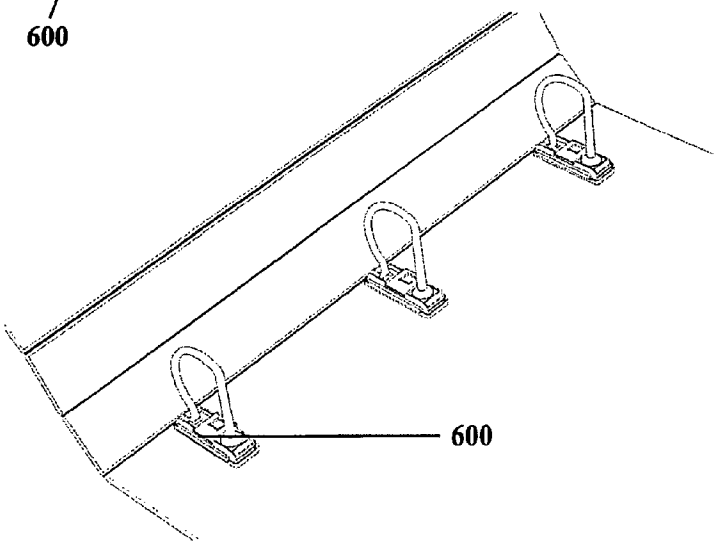
Fig. 17C

COLLAPSIBLE RING BINDER AND USES THEREOF

CROSS-REFERENCE TO RELATED APPLICATIONS

The present application claims priority to, and any other benefit of, U.S. Provisional Patent Application Ser. No. 60/724,135, filed Oct. 6, 2005, and entitled Collapsible Binder Device and Uses Thereof; U.S. Provisional Patent Application Ser. No. 60/742,561, filed Dec. 5, 2005, and entitled Collapsible Ring Binder and Uses Thereof; and U.S. Provisional Patent Application Ser. No. 60/809,332, filed May 31, 2006, and entitled Collapsible Ring Binder and Uses Thereof, the entire contents of all of which are hereby incorporated by reference. The present application is related to U.S. patent application Ser. No. 11/544,472, filed herewith on Oct. 6, 2006, and entitled Collapsible Binder Device and Uses Thereof and to International Application No. PCT/US2006/039203, filed herewith on Oct. 6, 2006, and entitled Collapsible Binder Device and Uses Thereof, the entire contents of both of which are hereby incorporated by reference.

BACKGROUND

1. Field of the Invention

The present invention relates to ring binders adapted to releasably hold together articles, such as documents (e.g., sheets of paper, card stock, scrapbook pages, etc.) and other articles (e.g., media storage pages, photograph storage pages, etc.) having one or more holes in locations corresponding to rings of the ring binder. More particularly, the present invention relates to binder mechanisms and collapsible ring binders with rings adapted to be disposed in either an upright configuration for holding articles together or a collapsed configuration for flattening the binder.

2. Description of Related Art

A ring binder is a device for holding together documents, such as sheets of paper, for storage, transport, etc. As known, conventional ring binders generally include a binder casing having a front cover, a rear cover and an interconnecting spine. The front cover and the rear cover are typically pivotal relative to the spine for providing book-like opening of the binder. The binder also includes a binder device, typically a tandem array of two to five rings, that are movable between an open configuration and a closed configuration. Documents to be attached to the binder are typically provided with a number of holes disposed along one side thereof, which number generally corresponds to the number of rings present in the binder device. To attach documents to the ring binder, a user opens the rings and passes the rings through the documents' holes. Thereafter the binder device is returned to a closed configuration, thereby securely retaining the documents to the binder.

Conventional ring binders occupy a large volume of space relative to the actual dimensions of the binder. The upright position of the rings of the binder device within the binder causes conventional binders to be thick even when empty, especially in the case of larger binders (e.g., binders with 3, 4, or more inch high rings). The thicknesses of the binders wastes space in packaging, shipping, retail display, user storage, and the like. Regardless of the various packaging schemes employed for conventional binders, a large amount of space remains unutilized when a plurality of binders are packaged or stored together.

SUMMARY

An aspect of one or more embodiments of the present invention provides a collapsible binder that includes rings that either flatten into a collapsed position or detach from the binder, depending on the embodiment. With the rings collapsed or detached, the binder is significantly flatter, which facilitates denser packaging of similar collapsible binders.

According to a further aspect of one or more of these embodiments, the collapsing and/or detachment mechanism is easily operated such that an end user can easily position the rings in an upright, usable position to use the binder.

Additional and/or alternative advantages, objects, and/or salient features of the invention will become apparent from the following detailed description, which, taken in conjunction with the annexed drawings and claims, disclose preferred embodiments of the invention.

BRIEF DESCRIPTION OF THE DRAWINGS

Referring now to the drawings which form a part of this original disclosure:

FIG. 14 is a rear perspective view of the exemplary binding device of FIGS. 14A-14N, wherein the housing is removed from the binder device and the ring is in an open and collapsed position;

FIG. 16E is a bottom perspective view of the binding device of FIGS. 16A-16D, wherein a ring base thereof is in an open state;

FIG. 16F is a perspective view of the base of the binding device of FIG. 16E;

FIG. 16G is a perspective and exploded view of the binding device of FIGS. 16A-16F, exemplarily illustrating a ring, the ring base and the stabilizing member thereof;

FIG. 17B is perspective view of the exemplary ring binder and associated binding devices of FIG. 17A, wherein the binding devices are in a closed, fastened, and upright configuration;

FIG. 17C is a side and partially perspective view of the exemplary ring binder and associated binding devices of FIG. 17B.

FIG. 17D is a perspective view of the of the exemplary ring binder and associated binding devices of FIG. 17A, wherein the binding devices are in a collapsed configuration;

FIG. 17E is a side and partially perspective view of the exemplary ring binder and associated binding devices of FIG. 17D;

DETAILED DESCRIPTION OF EXEMPLARY EMBODIMENTS OF THE INVENTION

Collapsible ring binders according to various embodiments of the present invention provide conventional ring binder functionality (i.e., releasably holding together hole-punched documents (e.g., sheets of paper, card stock, scrapbook pages, etc.) and other hole-punched articles (e.g., media storage pages, photograph storage pages, etc.) for organized storage, ready access and/or related use). The ring binders generally include a casing (e.g., a typically unitary structure with a front cover, a back cover and a spine interconnecting the covers), and one or more binder devices secured to the casing. The binder devices may be secured to the spine or one of the covers. If the binder devices are secured to one of the covers, the binder devices may extend close to or entirely to the pivotal connection between the cover and the spine. The binder devices each include a ring configured to extend through a hole punched or otherwise present in the documents or other articles. The ring(s) are adapted to open and close for adding or removing documents. As will also be more fully explained hereinafter, the binder device is also configured to collapse to flatten the ring binder for storage, shipping, retail display and the like.

Figure 1B:
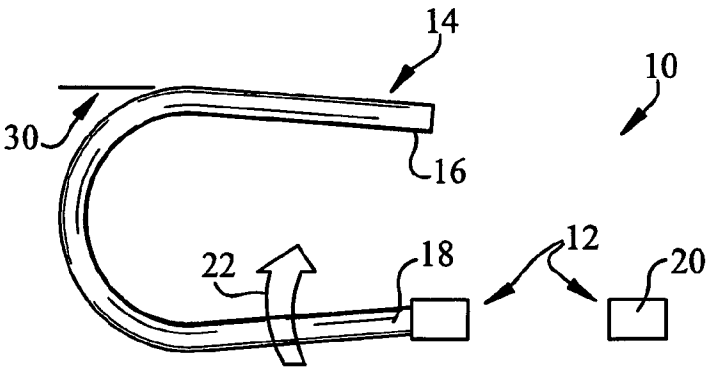
FIG. 1B is a schematic side view of the exemplary binder device of FIG. 1, wherein the binder device is in an upright and open position.
Figure 1D:
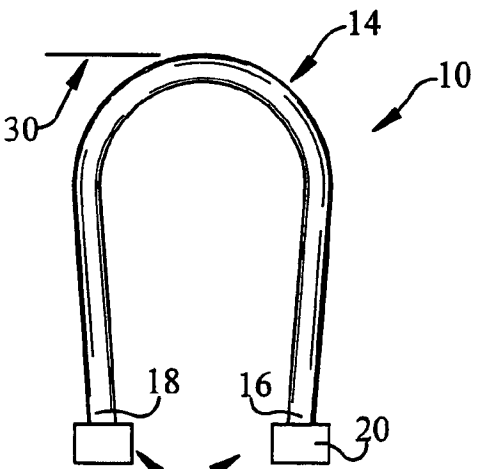
FIG. 1D is a schematic side view of the exemplary binder device of FIGS. 1A-1C, wherein the binder device is in an upright, fastened, and closed position.
Figure 1A:
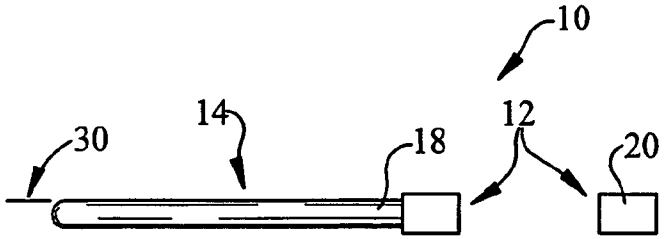
FIG. 1A is a schematic side view of an exemplary binder device for a ring binder according to an embodiment of the present invention, wherein the binder device is in a collapsed position.
Figure 1C:
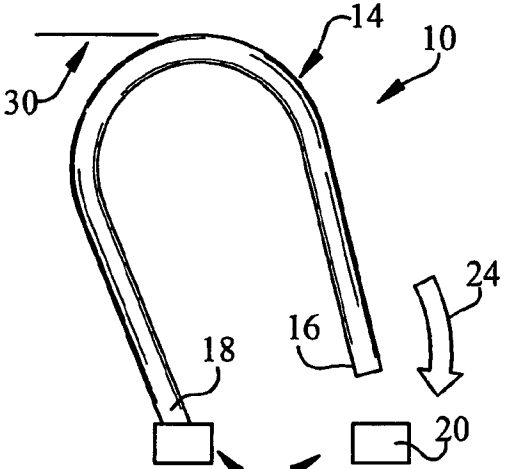
FIG. 1C is a schematic side view of the exemplary binder device of FIGS. 1A-1B, wherein the binder device is in a neutral position that is also an upright and open position.

FIGS. 1A-1D show an exemplary binder mechanism 10, which may be used in a binder. Exemplary binder mechanism 10 comprises a base 12 and a ring 14 for securing documents and other suitable articles. Exemplary ring 14 comprises a free end 16 and a secured end 18, with the secured end 18 being movably secured to the base 12. Base 12 comprises a base connector 20 for fastening the free end 16 of the ring. In this exemplary embodiment, the secured end 18 of the ring 14 is movably secured to the base 12 so as to provide at least a first degree of freedom (e.g., shown at arrow 22) permitting the ring 14 to move into an upright position (FIGS. 1B-1D). Also, the secured end 18 of the ring 14 is movably secured to the base 12 so as to also provide at least a second degree of freedom (e.g., shown at arrow 24) permitting movement of the free end 16 of the ring toward the base connector 20 so that the free end 16 of the ring 14 can be fastened to the base connector 20 with the ring 14 fastened in the upright position (FIG. 1D). Thus, FIG. 1D may be referred to as the fastened and upright position of the ring 14 or the binder mechanism 10. Also, in FIG. 1D the ring 14 or the binder mechanism 10 may be referred to as being closed or in a closed configuration; in FIGS. 1A-1C, the ring 14 or the binder mechanism 10 may be referred to as being open or in an open configuration.

The ring 14 may be moved from the collapsed position of FIG. 1A into the fastened and upright position of FIG. 1D via the positions of FIGS. 1B and 1C. More specifically, the ring may be moved from the position of FIG. 1A to the position of FIG. 1B, then moved from the position of FIG. 1B to the position of FIG. 1C, and then moved from the position of FIG. 1C to the position of FIG. 1D. The position of FIG. 1C may be just an intermediate position between the positions of FIGS. 1B and 1D. In the alternative, the position of FIG. 1C may be a neutral position or at rest position that the ring 14 assumes naturally after the free end 16 of the ring 14 is unfastened from base connector 20 and released. The free end 16 of the ring 14 is spaced from the base connector 20 in the position of FIG. 1C, which may facilitate loading documents or other articles into a binder utilizing one or more binder devices 10. The ring 14 may be spring-biased into the position of FIG. 1C such that a slight force (or larger force) is required to move the ring 14 toward either the position of FIG. 1B or the position of FIG. 1D. Similarly, the secured end 18 of the ring 14 ring 14 may be coupled to the base 12 in such a manner that a slight force (or larger force) is required to move the free end 16 of ring 14 out of alignment with the base connector 20.

In this exemplary embodiment, the base 12 may be in one piece or a plurality of pieces. In FIGS. 1A-1D, the base 12 is shown as two pieces. In many of the other exemplary embodiments herein, the bases are shown as one piece, which may be an assembly. Base connector 20 may permanently fasten the free end 16 of the ring 14. In the alternative, the connector 20 may releasably fasten the free end 16 of the ring 14 permitting the free end 16 of the ring 14 to be repeatedly connected to the base 12 to put the binder mechanism 10 in a closed configuration and repeatedly disconnected from the base 12 to put the binder mechanism 10 in an open configuration. The secured end 18 of the ring 14 may be movably secured to the base 12 so that the free end 16 of the ring 12 can be moved away from the base connector 20 when unfastened. Additionally, the secured end 18 of the ring 14 may also be movably secured to the base 12 so that the ring 14 can be moved out of the upright position and into a collapsed position (FIG. 1A) that significantly reduces the height of an upper portion 30 of the ring relative to the base 12.

The secured end 18 of the ring 14 may be pivotally connected to the base 12 via first and second pivotal connections. Generally speaking, the first pivotal connection may permit pivotal movement of the free end 16 of the ring 14 away from the base connector 20 and the second pivotal connection may permit the ring 14 to pivot into a collapsed position that significantly reduces the height of an upper portion 30 of the ring 14 relative to the base 12. Many of the exemplary embodiments herein have such dual pivotal connections.

Many different configurations are possible for the base 12, ring 14, ring free end 16, ring secured end 18, base connector 20. For example, the base connector 20 may magnetically fasten the free end of the ring. Similarly, the base connector 20 may cooperate with the free end 16 of the ring 14 to form a latch. As another example, an axis of the ring in the upright position may be substantially perpendicular to the axis of the ring in the collapsed position. The base may comprises a base unit having (a) a portion movably securing the secured end of the ring to the base and (b) a portion including the base connector. The ring may comprise an arcuate portion between the free end and the secured end. More specifically, the ring may comprise a unitary U-shaped structure having the free end and the secured end at opposite ends of the U. The base connector may be positioned at the end of a stem extending from the base and rigidly or pivotally affixed to the base. The base connector 20 may comprises a keyhole opening having a narrow portion that accepts a narrow portion at the free end 16 of the ring 14 to fasten the free end 16 of the ring 14 to the base connector 20. The ring 14 may be substantially rigid with the ability to flex slightly to permit the free end of the ring to be fastened to and/or unfastened from the base connector 20. The ring 14 may have a circular cross-sectional shape or a different cross-sectional shape.

Preferably, but not necessarily, the base connector 20 and the free end 16 of the ring 14 may be configured so that a user desiring to dispose the ring 14 in an upright, fastened and closed configuration need only pivot the ring 14 upward, ensure that the ring 14 free end 16 is positioned generally over the base connector 20, and push down on the ring 14 (or rotate the ring by its top so the free end 16 moves toward the base connector 20) until the free end is fastened to the base connector 20, and release the ring.

In exemplary embodiments herein where the free end 16 of the ring 14 is fastened (directly or indirectly) to the base 12, the ring(s) may be locked in the upright position (e.g., 90 degrees or about 90 degrees with respect to a surface—such as a binder casing portion—supporting the base) thus giving strength to the structure. This may be found particularly in mechanisms herein having one or more pivotal connections between the base and the secured end of the ring. In all of the embodiments herein with the free end 16 of the ring 14 fastened to the base 12, the mechanisms may optionally be configured so that the rings in a closed, fastened, and upright configuration together can support the weight of a loaded binder standing on edge. Once the free ends 16 of the rings 14 are unfastened from the base, they may be weak but when locked (fastened), the rings may be configured to be firmly fastened, resisting all directions of force acting on the top of the ring. In embodiments where the ring 14 is flexed during fastening, the load that is exerted to fasten the ring may help to lock the rings in place, permitting the rings to resist forces in all directions acting on the top of the ring, i.e., the rings do not become unfastened from the base.

Figure 2:
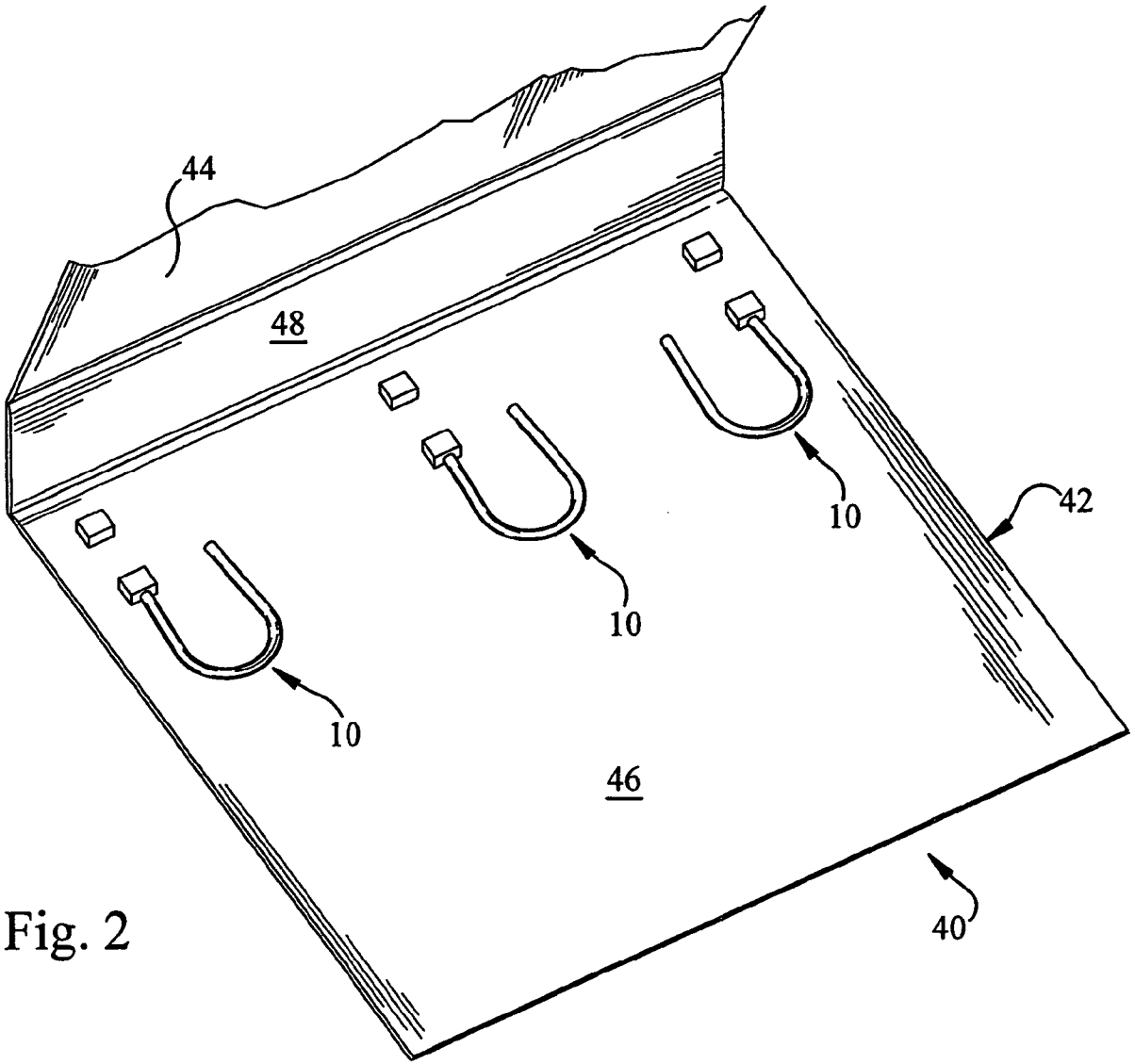
FIG. 2 is a perspective view of an exemplary binder using the binder device of FIGS. 1A-1D, wherein the binder device is in a collapsed position inside the binder.

FIG. 2 shows an exemplary binder 40 comprising a binder casing 42 and a plurality of binder mechanisms 10 affixed to the binder casing 42. Each binder mechanism 10 may be configured as described above, or as any of the other binder mechanisms or binder devices described and/or shown herein. The binder mechanisms 10 shown in FIG. 2 are in the collapsed position of FIG. 1A. A quick comparison of the height of an upper portion 30 of the ring relative to the base 12 in FIG. 1A to the height of an upper portion 30 of the ring relative to the base 12 in any of FIGS. 1B-1D shows how exemplary binder 40 can collapse to a much thinner configuration than it would otherwise be able to collapse if the ring 14 were locked in the positions of any of FIGS. 1B-1D.

The casing 42 of exemplary binder 40 comprises a front cover 44, a rear cover 46, and an interconnecting spine 48, all hingedly connected as known to those skilled in the art. The specific construction of the casing 42 is not pertinent to the examples herein. Any suitable fastener (not shown in FIG. 2), such as a rivet, a screw, an adhesive, and the like, may be employed to secure each binder device 10 to the exemplary binder 40. As an optional alternative, it may be possible to mold the base or a portion of the base into position on a surface of the binder without the ring, and attach the ring and any remaining components of the base in any suitable means. It may also is also possible to insert mold the base by molding a cover over some or all of the metal components instead of adding the cover as a second part. One, two, three, or more such devices 10 may be used in exemplary binder 40. Other structures, such as metal stampings and the like, may optionally be used to provide additional support between the binder mechanisms 10 and the binder casing 42. Such additional structures may be particularly helpful in supporting rings in binders having relatively tall rings, e.g., about 4 inches or taller in the upright and fastened position.

FIGS. 3A-3G illustrate an exemplary binder device 100 according to an embodiment of the present invention. As will be more fully described hereinafter, the binder device 100 is preferably (the term "preferably" is used herein to indicate exemplary structure of specific implementations and does not mean "necessarily") provided as a ring-bearing member adapted to be secured to a casing either alone or in a tandem array with other binder devices 100. For example, a casing may suitably feature a single binder device 100, thereby providing a single ring binder. By way of additional example, a casing may suitably feature two or three binder devices 100, thereby providing a two or three ring binder. The exemplary binder 100 illustrated is often referred to as an archival type binder. In general, a binder may be configured to feature any number of binder devices 100, and the present invention is not to be construed as limited to the exemplary arrangements provided herein.

Each binder device 100 is preferably (but not necessarily) an independent element. In contrast to conventional ring binders wherein the rings thereof collectively act together as a single unit, the illustrated binder device 100 is actuable (e.g., openable, closable, collapsible, etc.) separately from adjacent binder devices 100 of a binder. Thus, with reference to an exemplary casing incorporating three binder devices 100, when a user wishes to bind documents together, the user opens each individual binder device 100, positions the rings through the holes in each document, and then recloses each individual binder device 100. Similarly, each binder device 100 is separately collapsible, as will be more fully described hereinafter.

Figure 3A:
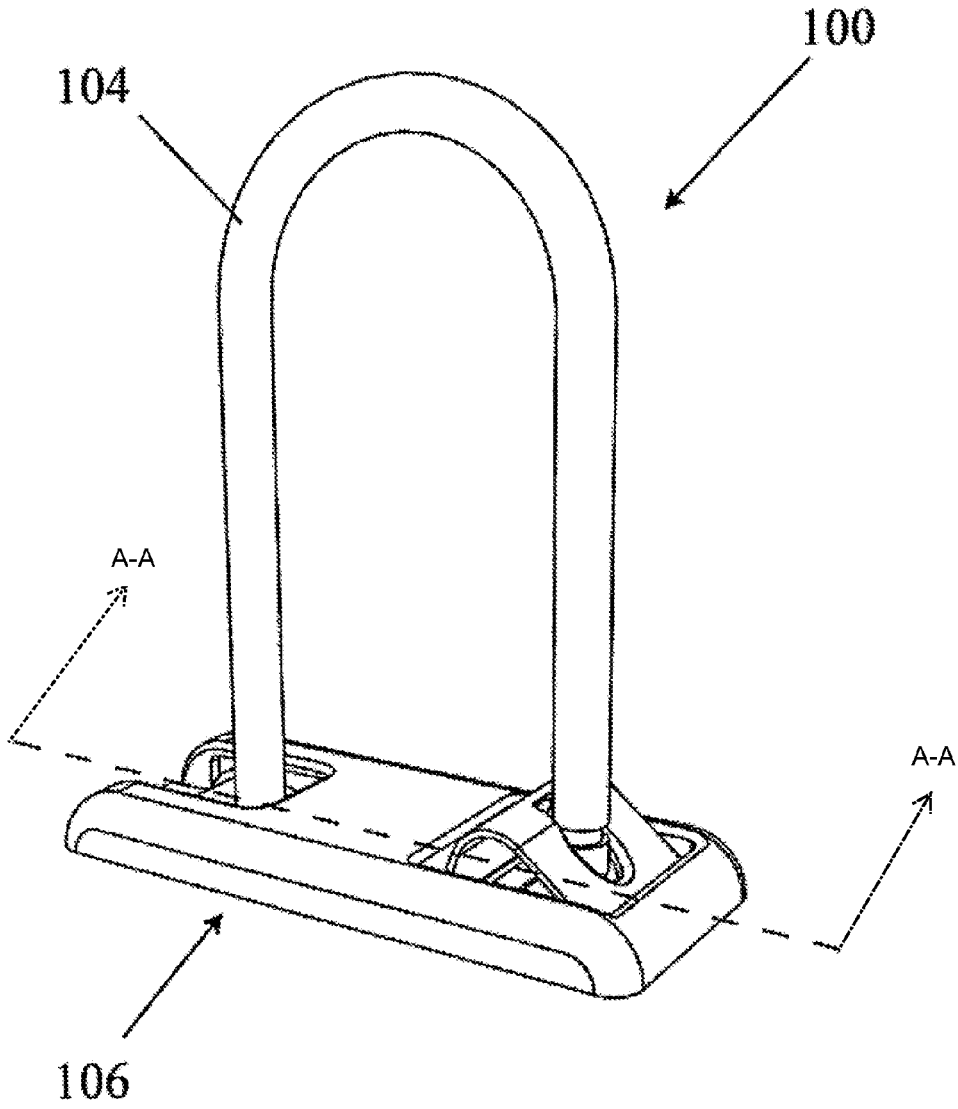
FIG. 3A is a perspective view of an exemplary binder device for an exemplary ring binder, wherein the binder device is in a closed, fastened, and upright configuration.

With continued reference to FIG. 3A, the binder device 100 generally includes a binding ring 104 and a ring base 106. The ring 104 is movably secured to the base 106. The ring 104 binds documents to the device 100 by extending through holes formed through the documents. A free end 108 of the ring 104 engages with the ring base 106, thereby closing the ring 104 and preventing separation of documents from the device 100. Accordingly, the ring 104 is adapted to move relative to the base 106 between a closed configuration for binding documents and an open configuration for adding/removing documents to/from the ring 104. Additionally, the ring base 106 generally secures the ring 104 to a casing such that the ring 104 may be opened and closed, and disposed in either an upright or a collapsed configuration.

Figure 3B:
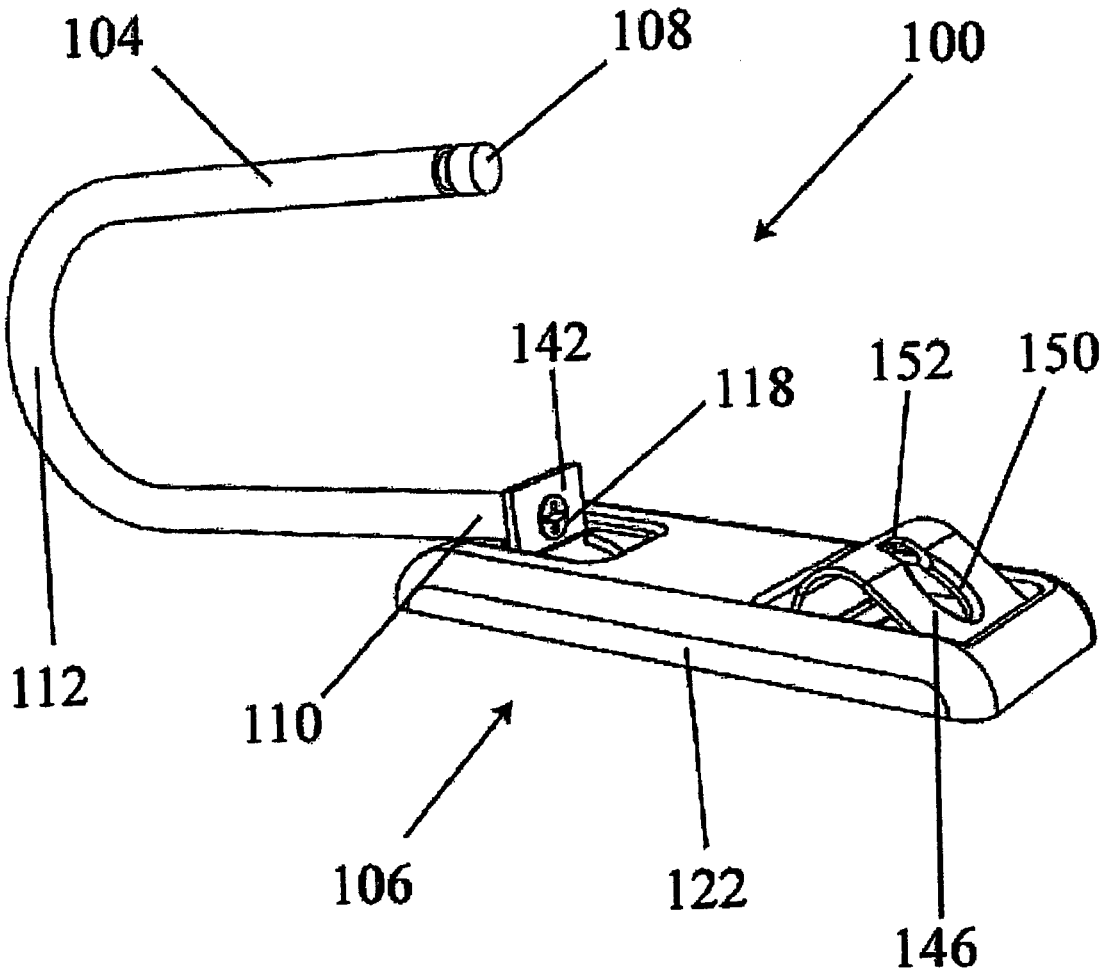
FIG. 3B is a perspective view of the binder device of FIG. 3A, wherein the device is in an open, partially collapsed configuration.
Figure 3C:
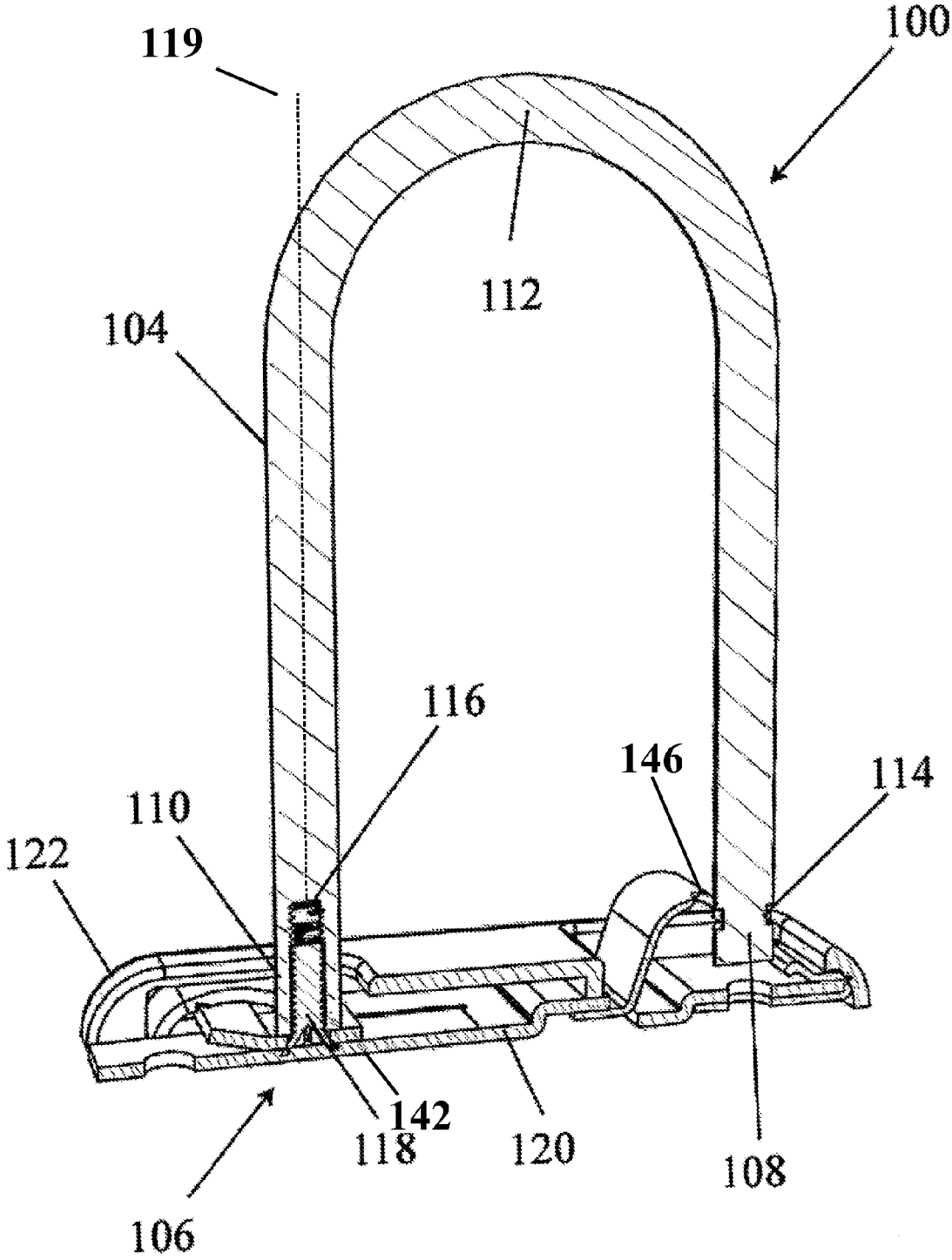
FIG. 3C is a cross sectional view of the binder device of FIG. 3A, taken along line A-A thereof.
Figure 3D:
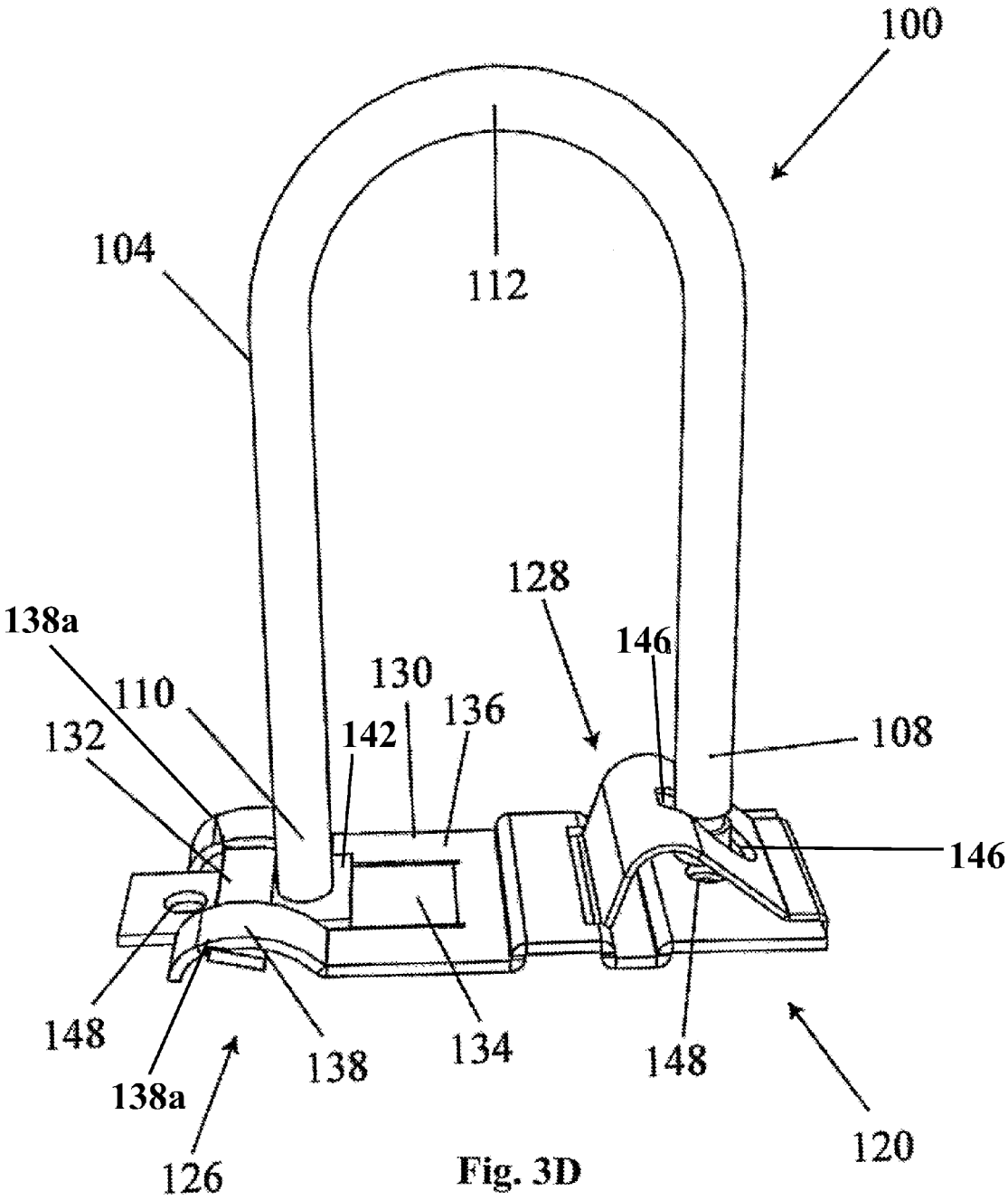
FIG. 3D is a perspective view of structural components of the binder device of FIGS. 3A-3C, wherein the device is in closed, fastened, and upright configuration.
Figure 3E:
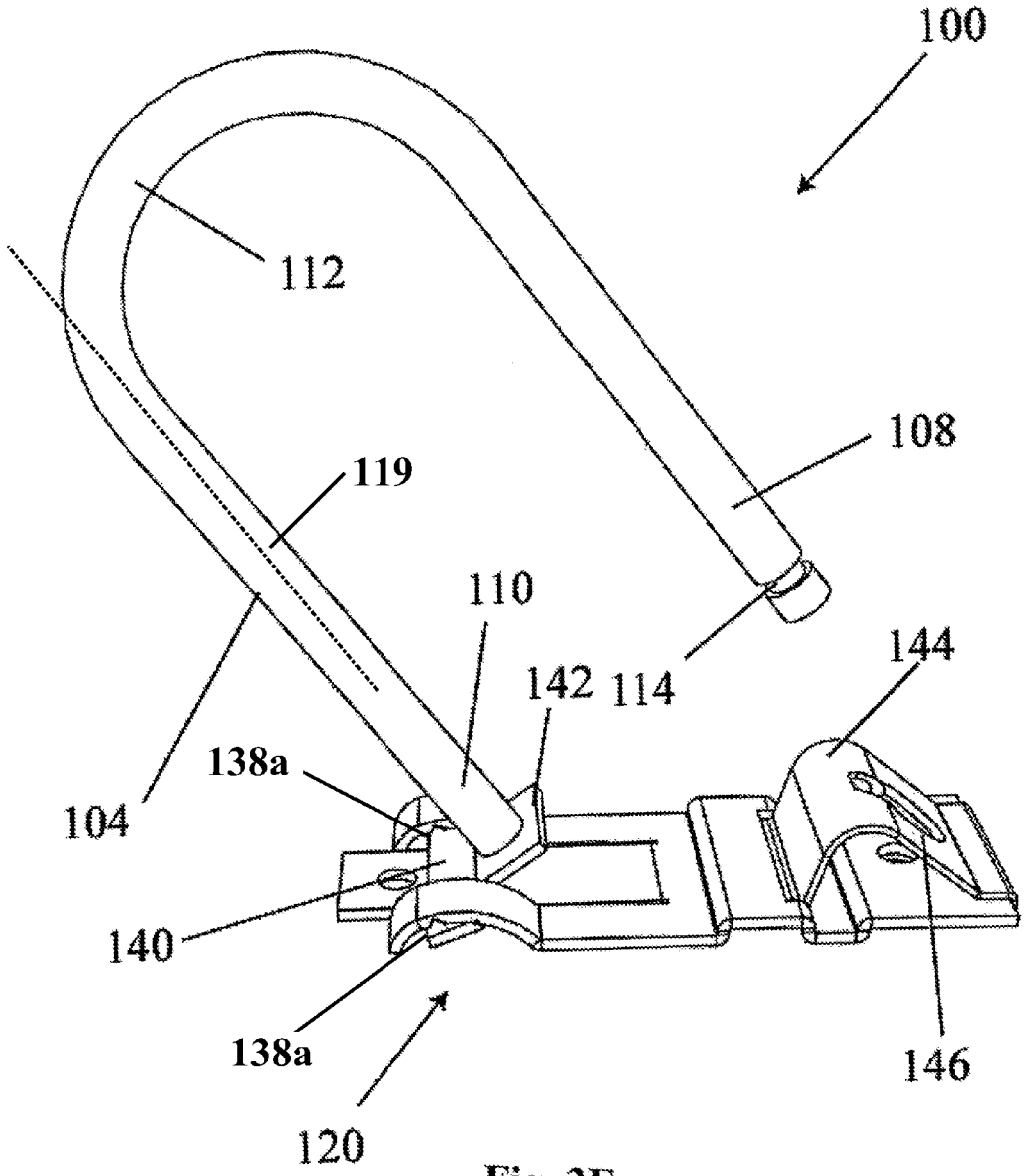
FIG. 3E is a perspective view of the binder device of FIG. 3D, wherein the device is in an upright configuration.

As shown in FIGS. 3C and 3E, the ring 104 is preferably configured as a generally unitary and preferably cylindrically cross-sectioned structure having a first end 108, a second end 110, and an arcuate portion 112 interconnecting the ends 108, 110. Thus, in contrast to rings of conventional ring binders that typically include two opposed arcuate structures that move relative to each other, the ring 104 is preferably configured as a unitary U-shaped structure movable relative to the base 106 as a unit. The use of the unitary structure of the ring 104 avoids the ring alignment problems associated with some split-ring conventional binders.

The first end 108 is generally adapted to releasably engage the ring base 106 for opening and closing of the ring 104. The first end 108 may be adapted to engage the ring base 106 through any suitable mechanism, preferably a mechanism that permits the first end 108 to repeatedly engage with and disengage from the base 106. In a preferred embodiment, the first end 108 includes a circumferentially reduced portion 114 (e.g., an annular groove) that, as described below, is adapted to securely engage a complementary receiving structure on the base 106.

While the first end 108 is adapted to releasably engage the base 106, the second end 110 is generally adapted to remain in constant engagement with the base 106 to anchor the ring 104 to the base 106. As best shown in FIGS. 3B and 3C, the second end 110 includes a threaded bore 116 extending therein. As will be more fully explained hereinafter, the bore 116 generally receives a fastener 118 (e.g., a threaded screw, a rivet, etc.) therein, which secures the ring 104 to the base 106 while allowing the ring 104 to rotate relative to the base 106 about an axis of the second end 110 (e.g., axis 119). Various aspects of the second end 110 and the means by which it remains secured to the base 106 will be more fully described hereinafter.

Returning to a general discussion of the overall configuration of the ring 104, the ring 104 is preferably configured in a generally loop-like or "U" shape that facilitates manipulation of documents bound in the device 100. The loop configuration generally provides a path through which the documents may pass in a book-like page-turning manner.

Furthermore, the ring 104 is preferably constructed of a resilient, somewhat flexible material, such as a polymer, a metal, spring steel, an alloy, and the like. Thus, in operation, when the first end 108 and/or circumferentially reduced portion 114 is engaged with the base 106, the first end 108 is flexed and/or generally pulled away from the second end 110 to disengage the first end 108 from the base 106 and permit opening of the ring 106. When the first end 108 is released, the ring 104 elastically returns to its resting state configuration by virtue of the flexibility of the ring 104. In the alternative, the base may be configured so that the first end 108 is generally pulled toward the second end 110 to disengage the first end 108 from the base 106 and permit opening of the ring 106.

The base 106 in this exemplary embodiment is generally rectangular and includes a structural member 120 (FIG. 3D) and a housing 122 (FIG. 3B). As will be more fully explained hereinafter, in this example the structural member 120 generally enables the functionality of the ring base 106, while the housing 122 is generally adapted to be disposed about the ring base 106 and increase the aesthetic appeal of the same. Of course the base 106 may be constructed differently and have many different configurations.

Turning now to the base 106 structural member 120 and FIG. 3D, the exemplary structural member 120 generally includes a ring securing portion 126 and a ring engaging portion 128. The ring securing portion 126 is generally a component of the structural member 120 that is configured to secure the ring 104 and retain the same to the base 106.

The exemplary ring securing portion 126 preferably includes a base portion 130 and a ring support member 132. The exemplary base portion 130 is generally a structure adapted to movably support the ring support member 132. The ring support member 132 is generally a structure to which the ring 104 is secured. With continued reference to FIG. 4, the exemplary base portion 130 is provided as a generally planar member with a central planar portion 134, a flange 136, and a pair of arcuate portions 138. The central planar portion 134 generally provides a surface relative to which the ring support member 132 pivots, as will be more fully explained hereinafter. The flange 136 preferably extends about a front edge and portions of side edges of the central planar portion 134, as generally shown in FIG. 3D, and is preferably slightly vertically offset relative to the central planar portion 134. The arcuate portions 138 are preferably disposed generally parallel to the longitudinal axis of the base 106, and extend rearward from terminal portions of the flange 136. The positioning of the arcuate portions 138 generally creates a channel defined by bottom faces of the arcuate portions 138 and a top face of the central planar portion 134, in which channel the ring support member 132 is generally pivotally disposed.

Turning now to a discussion of the ring support member 132, and as previously mentioned, the ring support member 132 generally provides a structure to which the ring 104 is secured, and which enables the ring 104 to move for, e.g., ring 104 opening, closing, collapsing, etc. The ring support member 132 is preferably "T" shaped with a transverse bridge 140 and a shoulder 142 extending from a midportion of the bridge 140 (FIG. 3E). The bridge 140 is preferably a generally rectangular planar member having a longitudinal dimension sufficient to enable opposite ends of the bridge 140 to be disposed within the arcuate portions 138.

Figure 3F:
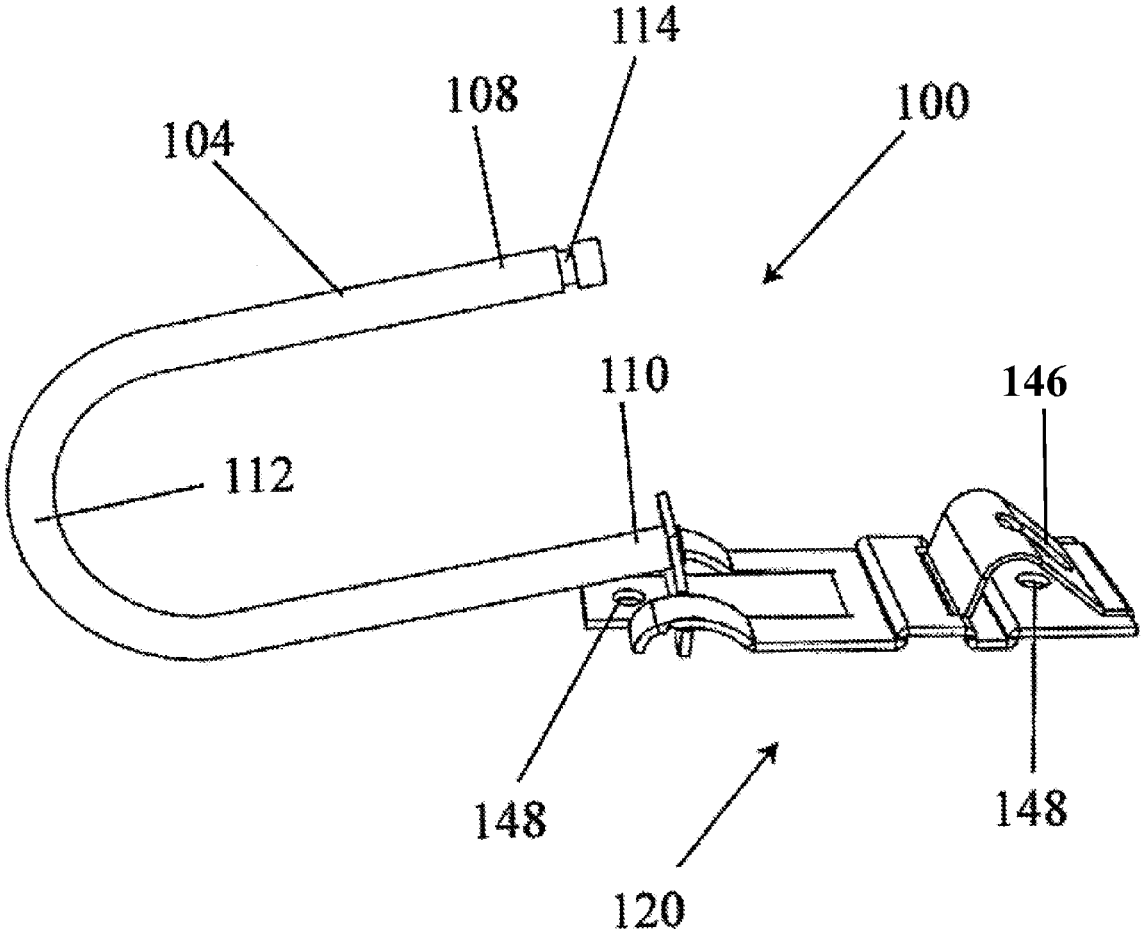
FIG. 3F is a perspective view of the binder device of FIGS. 3D and 3E, wherein the device is in a collapsed configuration.
Figure 3G:
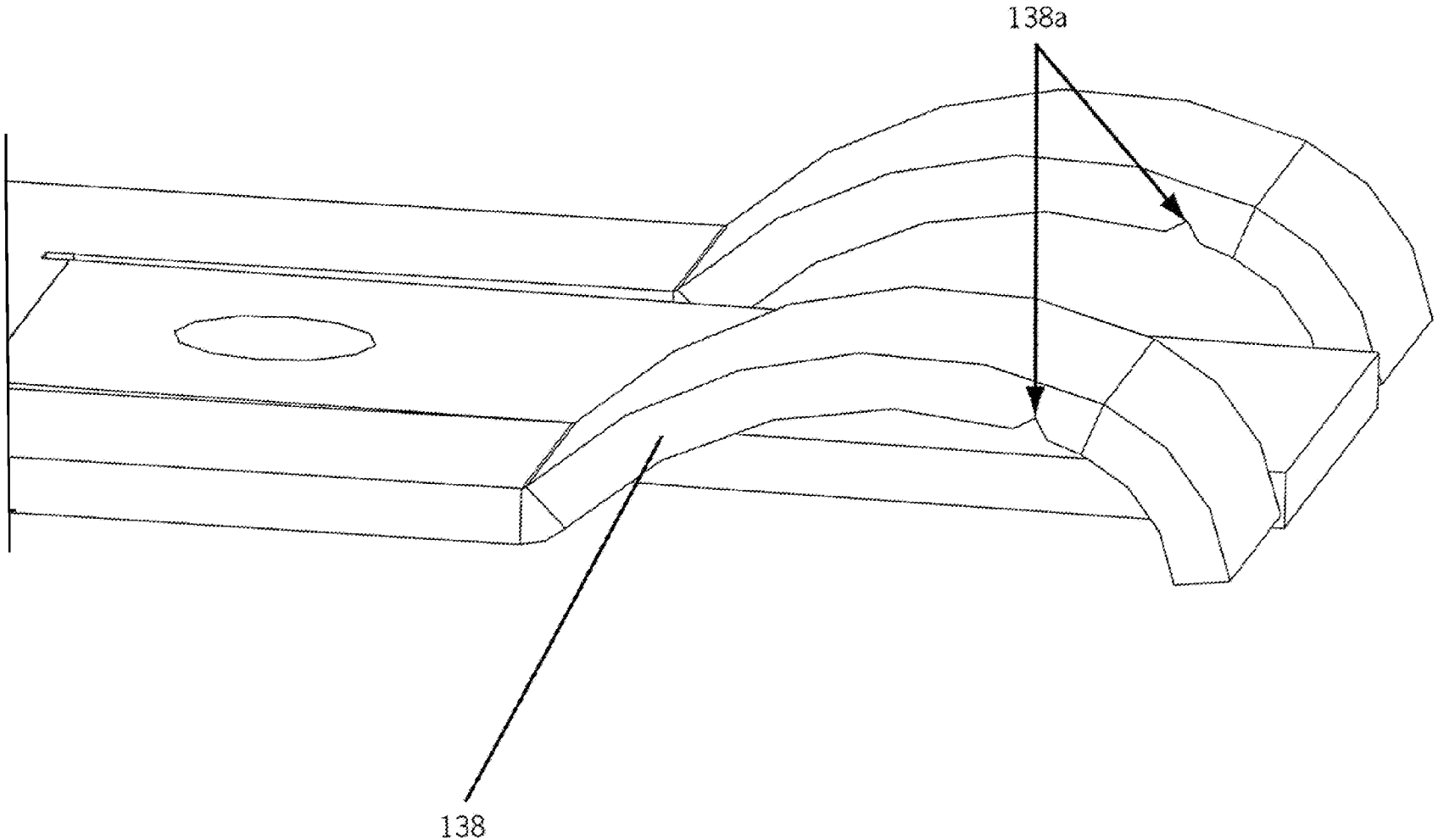
FIG. 3G is a partial perspective view of a binder device of FIGS. 3D and 3E according to an alternative embodiment of the present invention.

As shown in FIGS. 3D, 3E, and 3G, a notch 138*a* is formed in the bottom face of each of the arcuate portions 138. As shown in FIG. 3D, when the ring support member 132 is in its closed position, its bridge 140 extends into the notches 138*a*, which tends to prevent the ring support member 132 from sliding relative to the base 106 when the ring support member 132 is in its closed or open positions. The notch 138*a* may act as a pivot point between the ring support member 132 and the base 106.

Figure 4A:
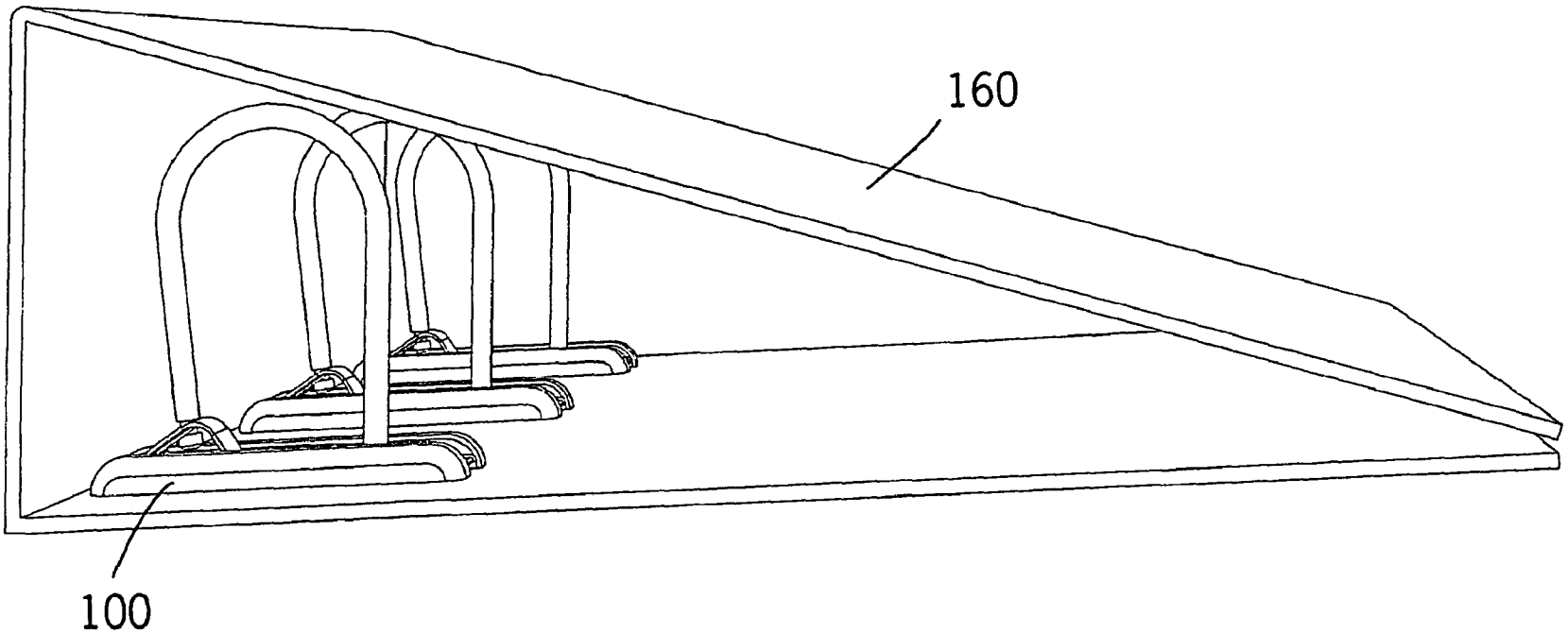
FIG. 4A is a perspective view of an exemplary binder using a plurality of the exemplary binder device of FIGS. 3A-3G, wherein the binder devices are in an upright position inside the binder.
Figure 4B:
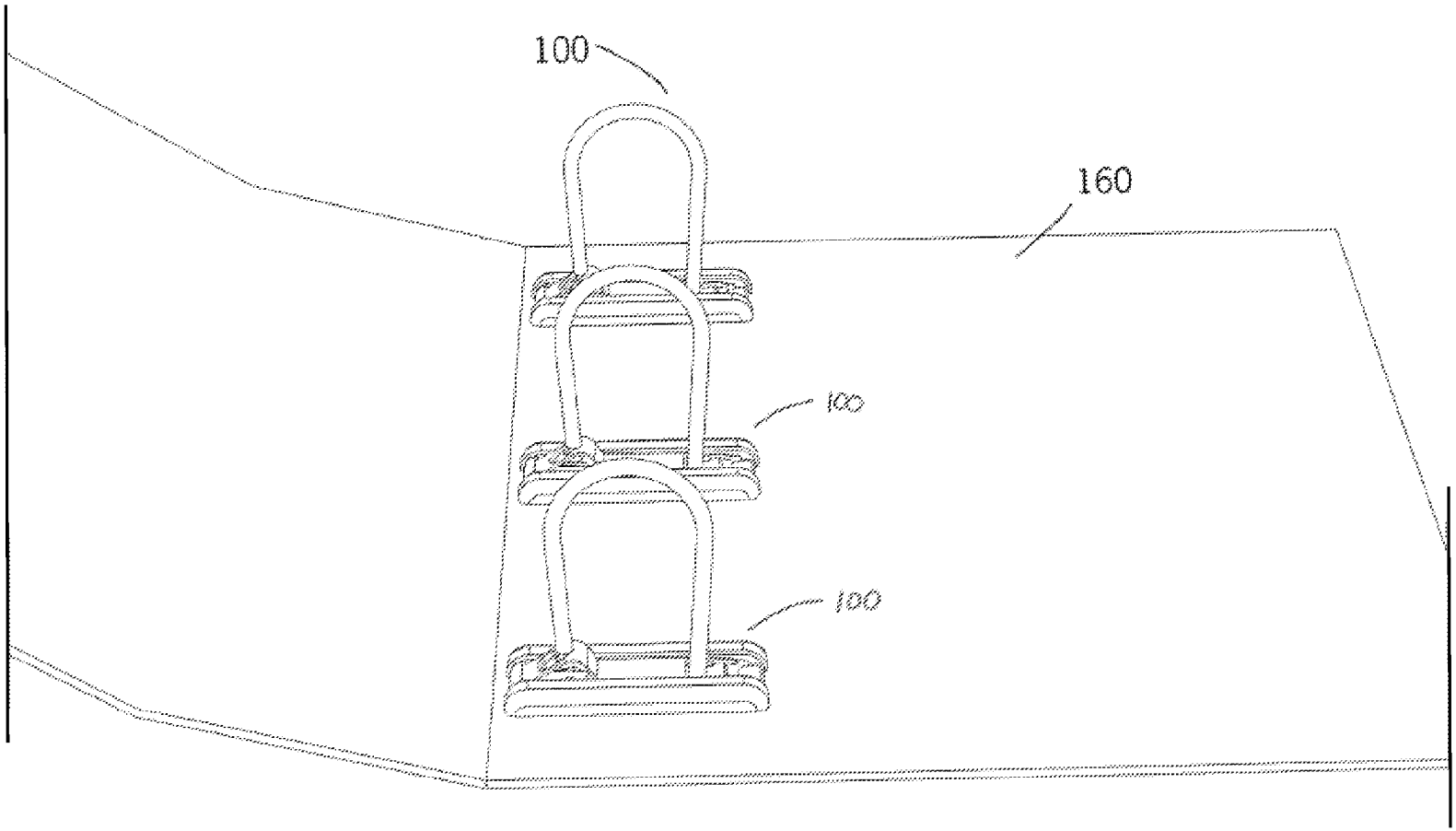
FIG. 4B is another perspective view of an exemplary binder using a plurality of the exemplary binder device of FIGS. 3A-3G, wherein the binder device is in an upright position inside the binder.
Figure 4C:
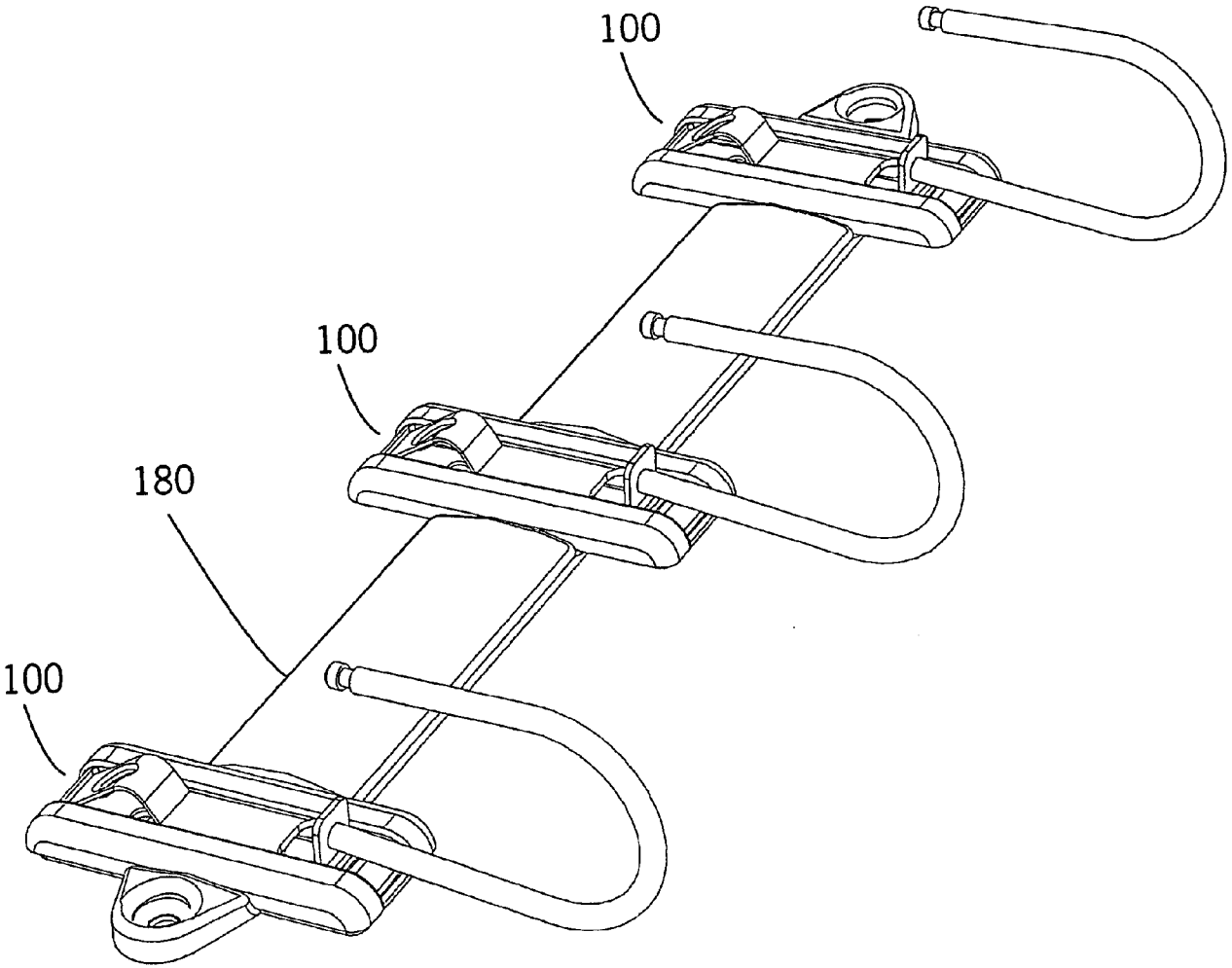
FIG. 4C is a perspective view of an exemplary binder using a plurality of the exemplary binder device of FIGS. 3A-3G, wherein the binder device is attached to a base.
Figure 4E:
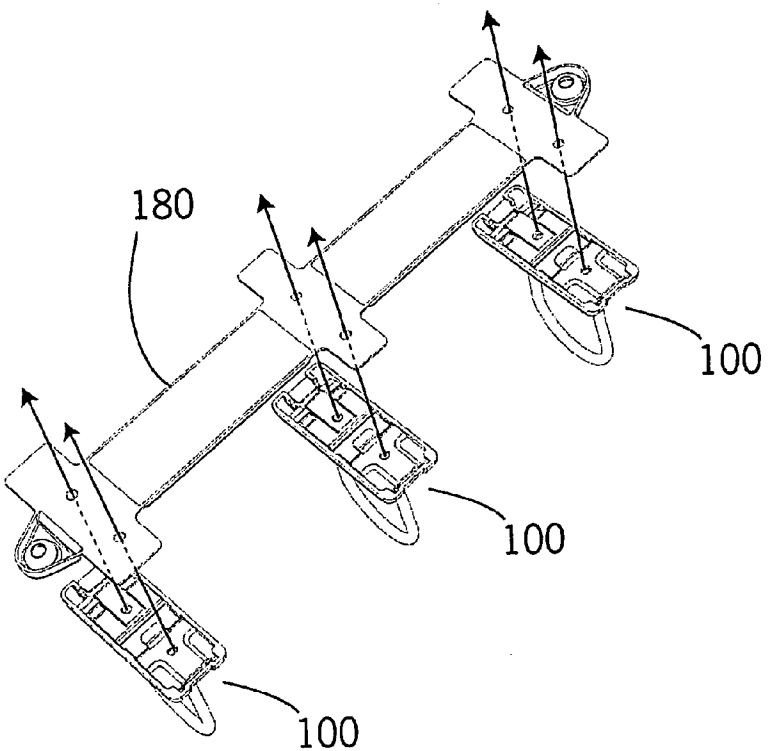
FIG. 4E is a bottom view of the base shown in FIG. 4C.
Figure 4D:
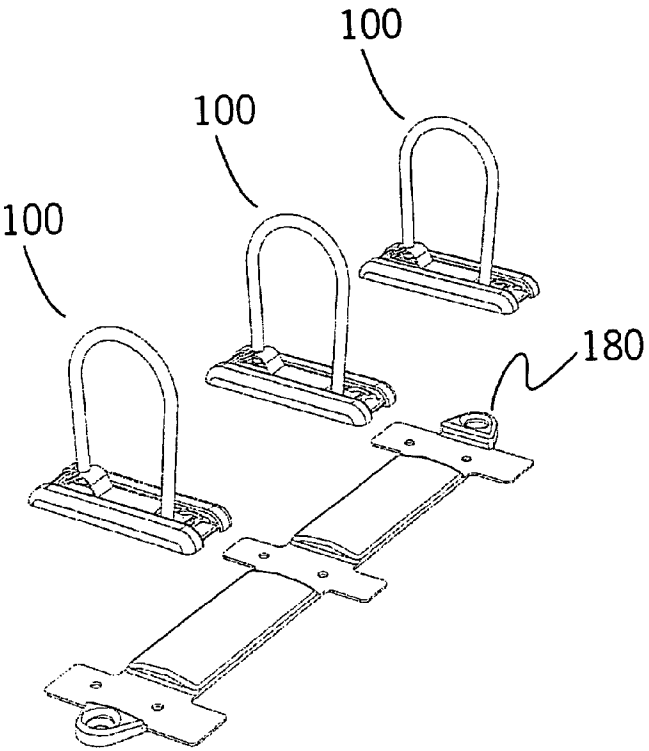
FIG. 4D is a top view of the base shown in FIG. 4C.
Figure 4F:
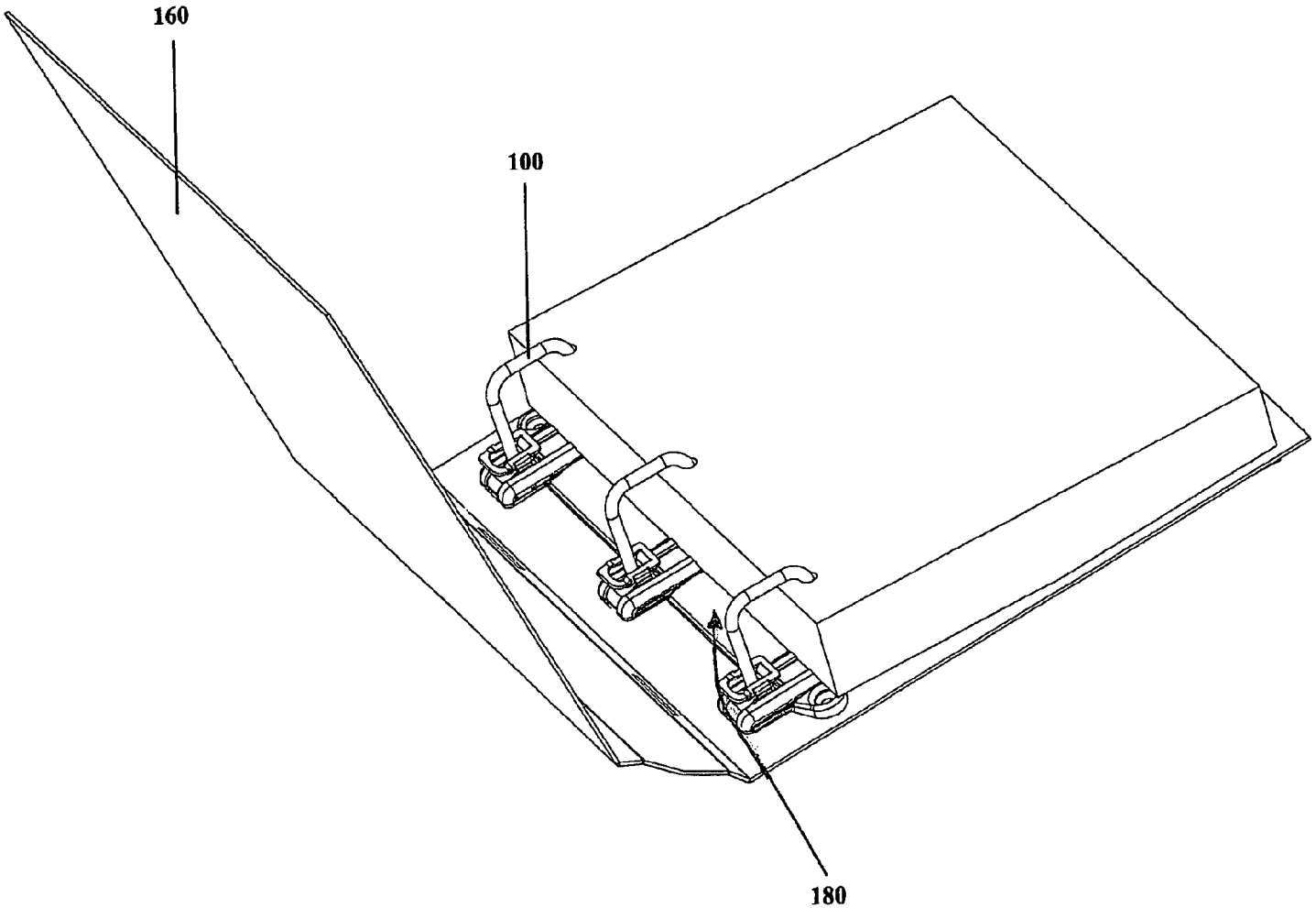
FIG. 4F is a perspective view of an exemplary binder using a plurality of the exemplary binder device of FIGS. 3A-3G, wherein the binder device is attached to a base inside the binder.

FIGS. 4A-4F show exemplary binders using the exemplary binder device 100 of FIGS. 3A-3G. FIG. 4A is a perspective view of an exemplary binder wherein the binder device 100 is in an upright position inside the binder 160 and the front cover of the binder is closed. FIG. 4B is another perspective view of the binder device 100, wherein the binder device 100 is in an upright position inside a binder 160 and the front cover is open. FIG. 4C is a perspective view of the binder device 100, wherein the binder device 100 is attached to an optional base 180. The base 180 may be made of any suitable material, such as stamped metal or molded plastic. The base 180 may be secured to the binder 160 by any suitable means, such as a rivet, a screw, an adhesive, or the like. In addition, the binding devices 100 may be secured to the base 180 by any suitable means, such as a rivet, a screw, an adhesive, or the like. One advantage of the base 180 is to help keep the binding devices 100 stable, particularly for binders having rings that are 4" or taller in the closed, fastened, and upright position. In the exemplary embodiment shown, the base 180 is made out of one piece of stamped metal and comprises flat portions sized to seat and retain a plurality of binding devices 100 spaced along its length. Apertures in the base 180 permit fasteners to pass therethrough and fasten the devices 100 to the base 180 and the binder 160. In an alternative embodiment, the apertures in the base 106 of the binding devices 100, the base 180, and the binder 160 are aligned so the same fastener may pass therethrough and fasten the devices 100 to both the base 180 and the binder 160. In another embodiment, the base 180 is fastened to the binder 160 by fasteners passing through apertures on each end of the base 180. As such, the binding devices 100 are fastened to the base 180 by a separate set of fasteners. FIG. 4D is a top view of the base 180 shown in FIG. 4C and FIG. 4E is a bottom view of the base 180 shown in FIG. 4C. Finally, FIG. 4F is a perspective view of an exemplary binder device 100, wherein the binder device 100 is attached to a base 180 inside the binder 160.

Figure 5A:
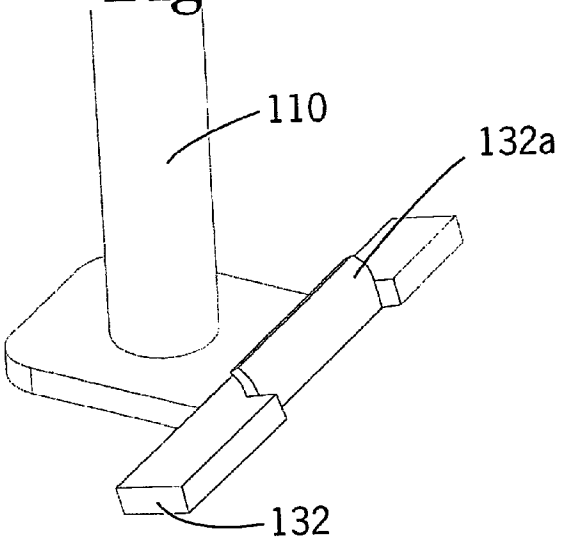
FIG. 5A is a partial perspective view of a binder device.

As shown in FIG. 5A, according to an alternative of the embodiment of FIGS. 3A-3G, a tab 132*a* may extend upwardly from the ring support member 132. When the ring support member 132 is moved into its open position, the tab 132*a* abuts the base portion 130 to discourage the ring support member 132 from pivoting beyond its open position. The tab 132*a* helps provide the ring with a slightly open neutral or at rest position, that the ring 104 assumes naturally after the free end 108 of the ring 104 is unfastened from base connector 144, 146 and released. The free end 108 of the ring 104 is spaced from the base connector 144, 146 in the position of FIG. 3E, which may facilitate loading documents or other articles into a binder utilizing one or more binder devices 100. The ring 104 may be spring-biased into the position of FIG. 3E such that a slight force (or larger force) is required to move the ring 104 toward either the position of FIG. 3B or the position of FIG. 3D.

Figure 6B:
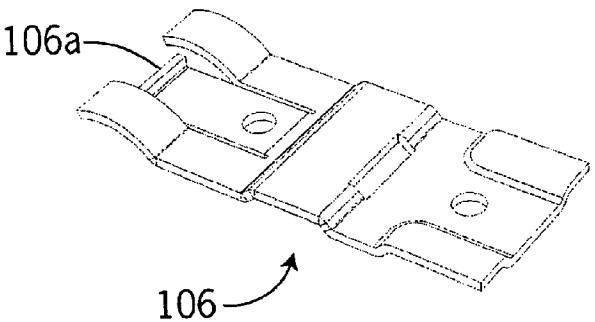
FIG. 6B is a perspective view of a base of the binder device of FIG. 6A.
Figure 6A:
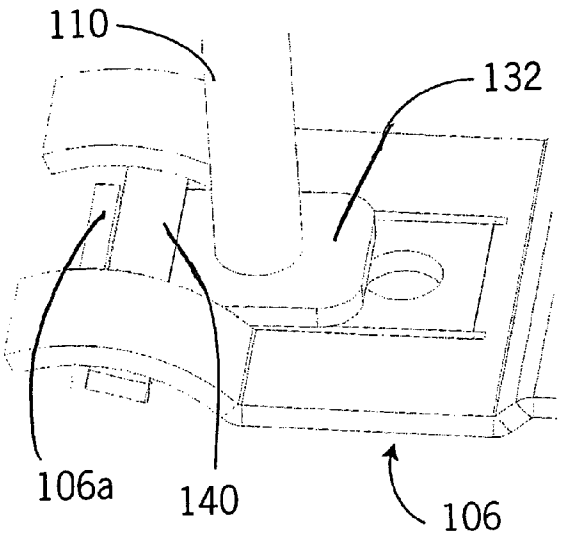
FIG. 6A is a partial perspective view of a binder device.

As shown in FIGS. 6A and 6B, according to a further alternative of the embodiment of FIGS. 3A-3G, a tab 106*a* extends upwardly from the base 106. The tab 106*a* is positioned to abut the transverse bridge 140 and stabilize the ring support member 132 when the ring support member 132 is in its closed or open positions. The tab 106*a* helps provide the ring with a slightly open neutral or at rest position, that the ring 104 assumes naturally after the free end 108 of the ring 104 is unfastened from base connector 144, 146 and released. The free end 108 of the ring 104 is spaced from the base connector 144, 146 in the position of FIG. 3E, which may facilitate loading documents or other articles into a binder utilizing one or more binder devices 100. The ring 104 may be spring-biased into the position of FIG. 3E such that a slight force (or larger force) is required to move the ring 104 toward either the position of FIG. 3B or the position of FIG. 3D.

Referring back to FIGS. 3B-3E, the exemplary ring support member 132 preferably also includes the shoulder 142 that extends from a side edge of the bridge 140 and generally transverse to the longitudinal axis of the bridge 140. The shoulder 142 is preferably a generally rectangular planar member that (in this exemplary embodiment) provides a substrate to which the ring 104, preferably the second end 110 thereof, is secured. More specifically, the shoulder 142 preferably includes a bore that permits the fastener 118 to pass therethrough. As best shown in FIGS. 3B and 3C, the ring 104 second end 110 is preferably flushly disposed against the shoulder 142 so that the second end 110 threaded bore 116 is aligned with the shoulder 142 bore. The fastener 118 preferably extends through the shoulder 142 bore and into the ring 104 threaded bore 116, thereby physically securing the ring 104 to the shoulder 142. Accordingly, the fastener 118 connects the ring 104 to the base 106 via the ring support member 132 and arcuate portion 138.

According to one embodiment, the fastener 118 and the ring support member 132 to which it is attached are provided in a manner that permits the ring 104 to rotate relative to the base 106 about an axis of the fastener 118. As will be more fully explained hereinafter, the ring 104 is collapsible by first disengaging the ring 104 first end 108 from the base 106, pivoting the ring 104 rearward, and then rotating the ring 104 so that it comes into general abutting contact with the casing, as shown in FIG. 3F. The use of a threaded fastener 118 suitably provides a means by which the ring 104 may rotate relative to the base 106. However, it is to be appreciated that any suitable means may be employed for enabling the rotatability of the ring 104. Accordingly, the ring 104 second end 110 is preferably rotatably retained relative to the shoulder 142 so that the ring 104 may be repeatedly rotated relative thereto.

With continued reference to the ring support member 132, the shoulder 142 and bridge 140 are preferably provided as a unitary structure. Even more preferably, the shoulder 142 and the bridge 140 are angularly offset relative to each other. With best reference to FIGS. 3C and 3D, the bridge 140 is preferably disposed at an upward angle relative to the shoulder 142. For example, FIG. 3D illustrates the ring 104 in an upright and closed configuration in which the shoulder 142 rests in substantially abutting contact with the central planar portion 134. In this state, the bridge 140 preferably slopes upward away from the shoulder 142, and is releasably engaged in notches 138*a*. Thus, when the ring 104 first end 108 is disengaged from the base 106 and the ring 104 is pivoted rearward, the bridge 140 disengages from the notches 138*a* and begins to rotate within the arcuate portions 138 along a rotational axis generally parallel to the bridge 140 longitudinal axis. Thereafter, as the ring 104 continues to be pivoted rearward, the bridge 142 rotates within the arcuate portion 138 until side faces of the bridge 142 simultaneously contact both the central planar portion 134 and bottom surfaces of the arcuate portions 138. Further, the arcuate portions 138 are preferably dimensioned with a vertical profile that is slightly reduced relative to the width of the bridge 142, and are also preferably constructed of a flexible material (e.g., spring steel, etc.). Accordingly, once the bridge 142 contacts both the central planar portion 134 and the arcuate portions 138, the relatively reduced vertical profile of the arcuate portions 138 provides an impediment or resistance to the free rotation of the bridge 140 relative to the base 106. Applied force to continue the pivoting of the ring 104 suitably overcomes the impediment by causing the arcuate portions 138 to flex, thereby permitting the bridge 140 to continue its rotation within the arcuate portions 138 and dispose the ring 104 in a fully pivoted and collapsed configuration. The rotation impediment suitably provides a biasing effect that urges the ring 104 to remain in either an upright configuration or a collapsed configuration, absent a force directing the ring 104 otherwise.

The structural member 120 also includes the ring engaging portion 128. As previously mentioned and as best shown in FIGS. 3B-3D, the ring engaging portion 128 generally provides a structure against which the ring 104 first end 108 is releasably engageable for ring 104 opening and closing. In a preferred embodiment, the ring engaging portion 128 generally includes a face 144 (FIG. 3E) that is angularly offset relative to the structural member 120, and which face 144 is adapted to engage the ring 104 first end 108 for securely closing the ring 104. Even more preferably, a front edge of the face 144 is disposed in proximity to a front portion of the structural member 120, with the remainder of the face 144 extending upward therefrom. Additionally, as best shown in FIG. 3B, the face 144 preferably includes an aperture 146 therein, into which aperture 146 the ring 104 first end 108 is positionable. In a preferred embodiment, the aperture 146 is defined by a lower circular portion 150 and an upper channel portion 152 extending from the lower circular portion 150. As such, the aperture 146 has a keyhole type configuration. As previously mentioned, the ring 104 is preferably configured generally cylindrically. Accordingly, in operation, when a user wishes to dispose the ring 104 in an upright and closed configuration, the user pivots the ring 104 upward and ensures that the ring 104 first end 108 is in general proximity to the ring securing portion 128. Thereafter, the user pulls the first end 108 away from the second end 110 (suitably possible because of the flexible nature of the ring 104) and then releases the first end 108 into the aperture 146 lower circular portion 150. Again, because of the resilient nature of the ring 104, the first end 108 rearwardly biases toward the second end 110, thereby bringing the ring's circumferentially reduced portion 114 within the aperture 146 upper channel portion 152. When the ring 104 first end 108 is so engaged with the upper channel portion 152, the ring 104 remains in an upright and closed configuration, thereby preventing release of documents from the ring 104.

To disengage the first end 108 from the ring engaging portion 128 so as to move the ring 104 into its open position, the user pulls the first end 108 away from the second end 110 so that the first end 108 can be pulled out of the aperture 146. Alternatively, a release clip may facilitate disengagement of the first end 108 from the ring engaging portion 128. Once the free end 108 of the ring 104 is unfastened from the base, it may be weak but when locked (fastened), the rings may be configured to be firmly fastened to the base, resisting all directions of force acting on the top of the ring. In this exemplary embodiment, the ring 104 is flexed during fastening and the load that is exerted to fasten the ring may help to lock the ring in place, permitting the rings to resist forces in all directions acting on the top of the ring, i.e., the rings to not become unfastened from the base, as further explained in the text accompanying the exemplary embodiment of FIGS. 14A-14O.

The binder device 100 structural member 120 preferably also includes various means that enable the member 120 to be secured to a binder casing. As best shown in FIG. 3D, the structural member 120 includes at least one aperture 148 that permits a fastener, such as a rivet, to pass therethrough and fasten the device 100 to the casing. In a preferred embodiment, the member 120 includes an aperture 148 disposed through the central planar portion 134 thereof, and another aperture 148 disposed through a forward portion of the member 120, generally in proximity to the face 144 aperture 146. In this configuration, the fastener apertures 148 are spaced apart relative to each other, thereby reinforcing the device 100 against physical dislocation relative to the casing when secured thereto.

Figure 7A:
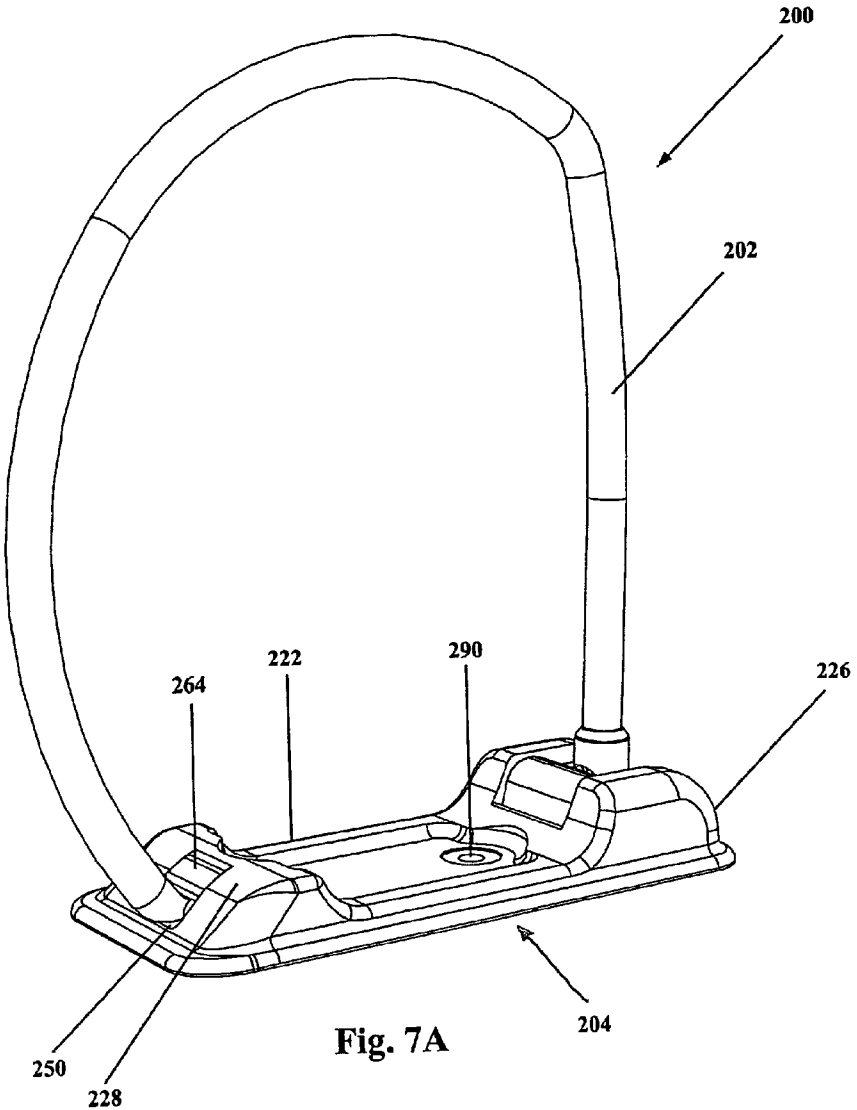
FIG. 7A is a perspective view of an exemplary binding device for a ring binder, wherein the binding device is in a closed, fastened, and upright configuration.
Figure 7B:
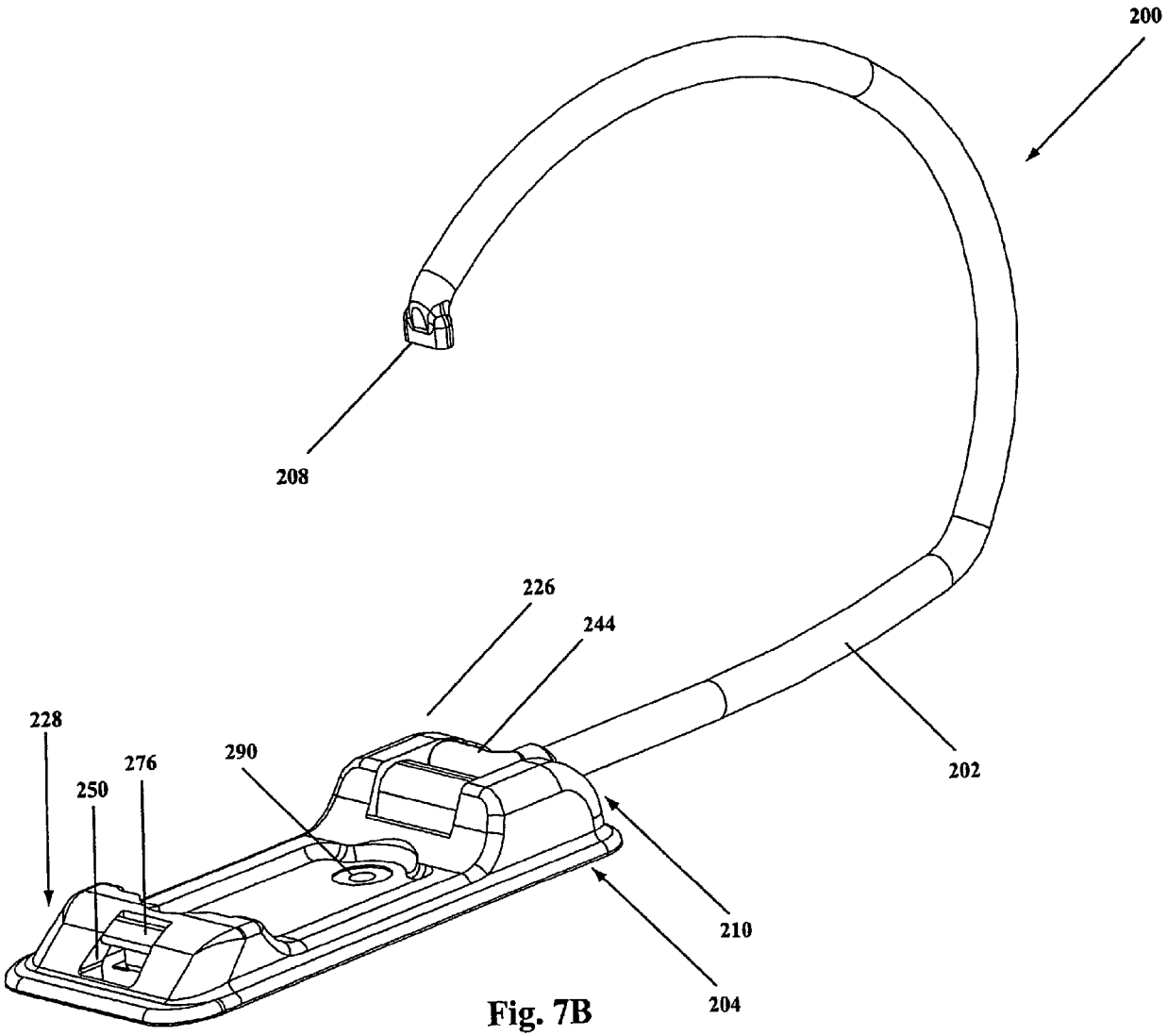
FIG. 7B is a perspective view of the exemplary binding device of FIG. 7A, wherein the binding device is in an open position.
Figure 7C:
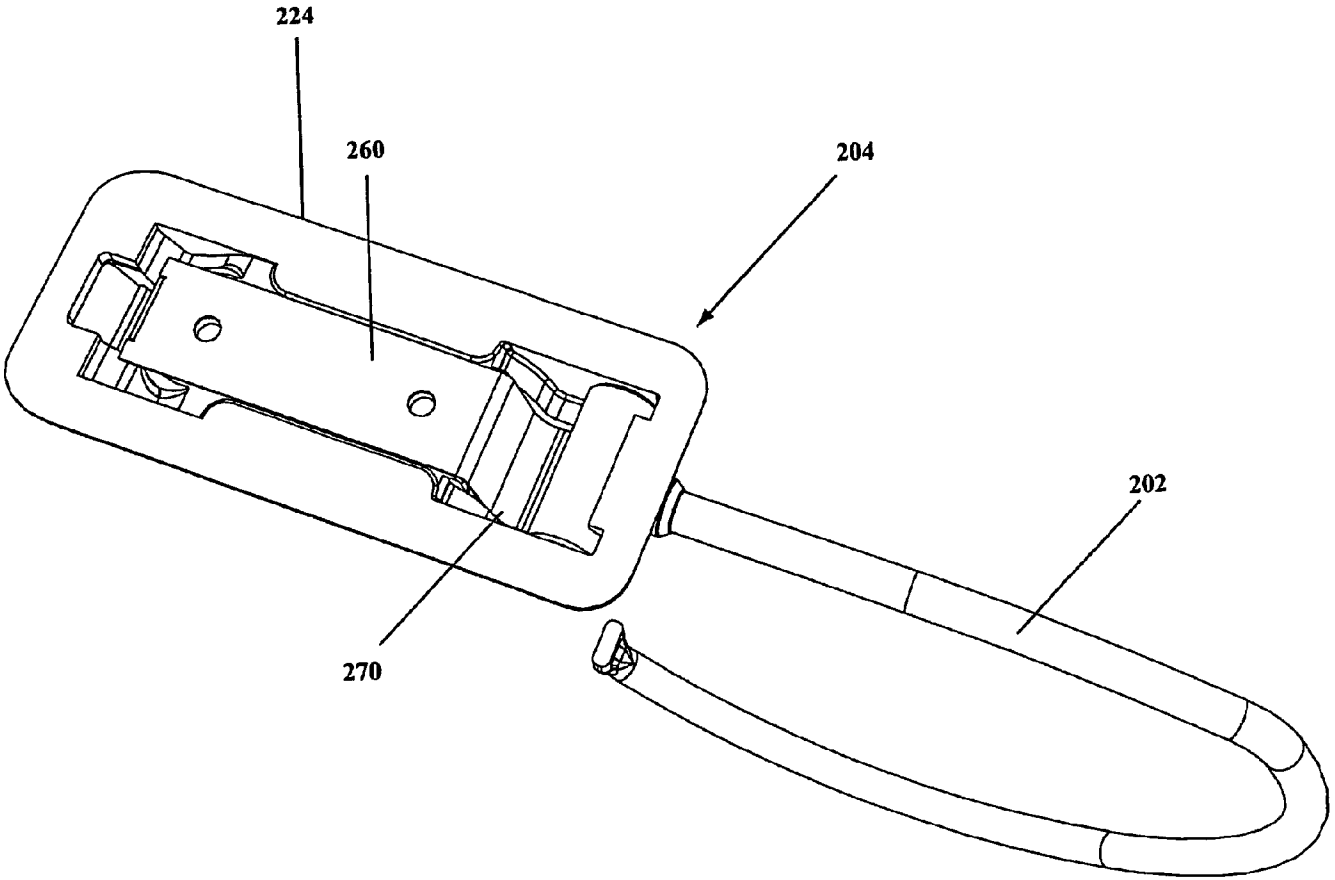
FIG. 7C is a bottom perspective view of the exemplary binding device of FIG. 7B.
Figure 7D:
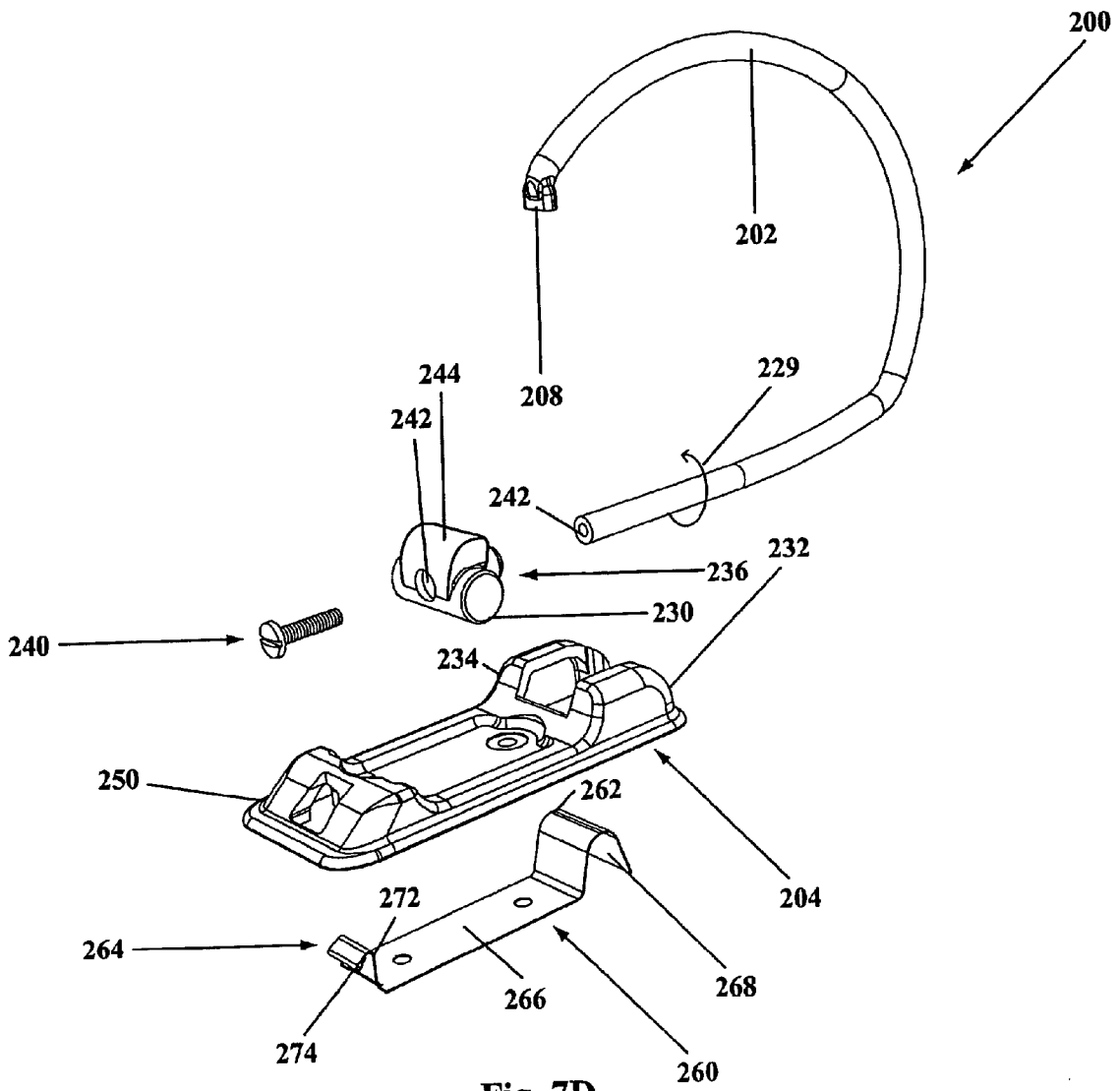
FIG. 7D is an exploded perspective view of the exemplary binding device of FIGS. 7A-7C.
Figure 8A:
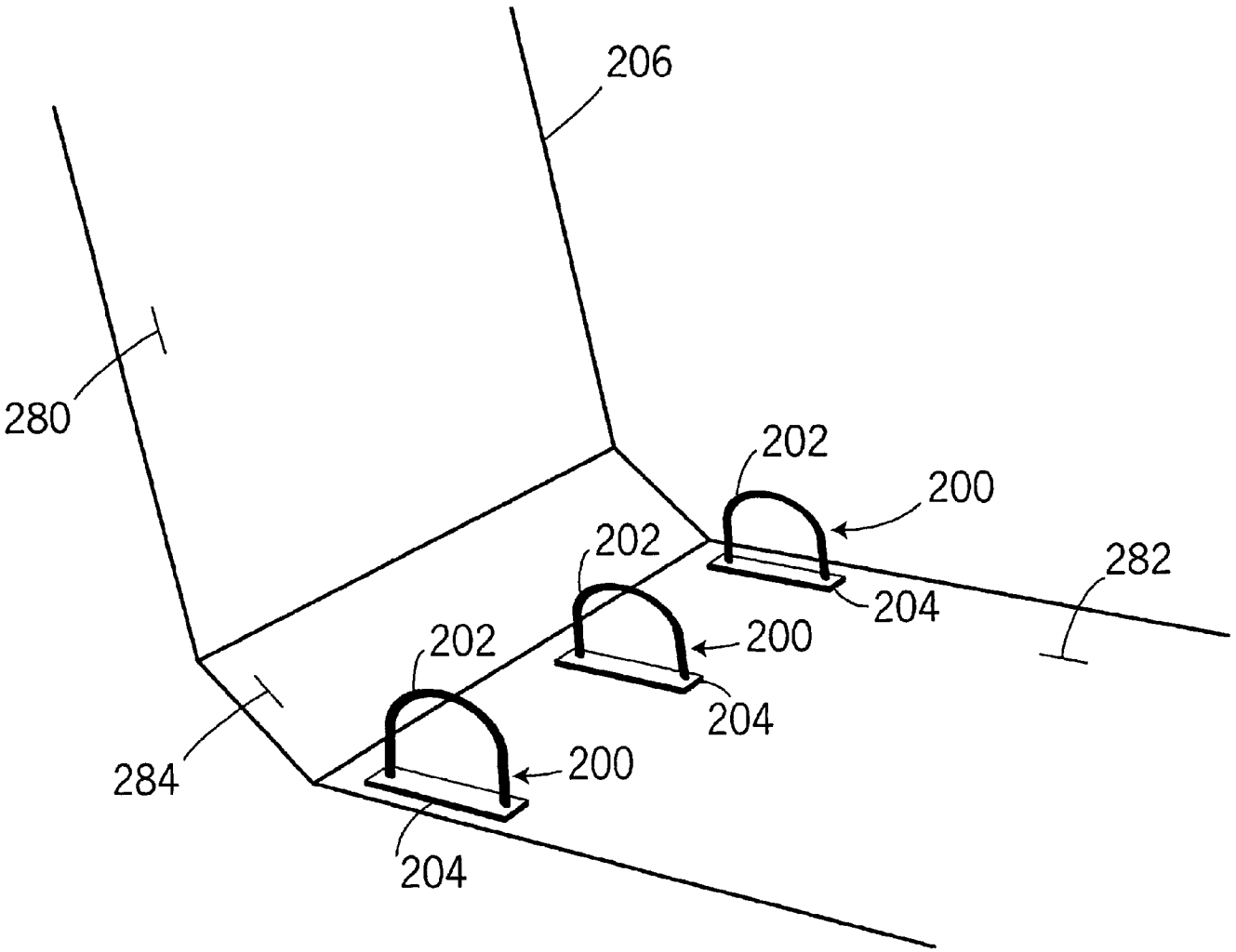
FIG. 8A is a perspective view of an exemplary ring binder having a plurality of the exemplary binding device of FIGS. 7A-7D associated therewith, and wherein the ring binder is in an open state and further wherein the exemplary binding devices are in a closed and upright configuration.

Turning to FIGS. 7A-7D, 8A-8D, and 9A-9B, illustrated is another exemplary embodiment of a collapsible binding device 200 according to the present invention. By way of overview, FIG. 7A generally illustrates the binding device 200 in an upright, fastened, and closed configuration, while FIG. 7B generally illustrates the binding device 200 in an open and partially collapsed configuration. FIG. 8A illustrates a preferred application of the binding device 200 in which a plurality of collapsible binding devices 200 are tandemly associated with a binder 206 to configure the binder 206 as a ringed binder for removably associating articles, such as sheets of paper, therewith.

With best reference to FIGS. 7A and 7D, the exemplary collapsible binding device 200 preferably includes a binding ring 202 and a ring base 204, relative to which the ring 202 is movably associated. The ring 202 generally provides a securing means for removably securing documents and other articles, such as sheets of paper, to the binder 206, generally in a manner consistent with rings of conventional ring binders. That is, the ring 202 secures articles to the binder 206 by being disposed in holes in the articles, with a free end 208 of the ring 202 being engaged with the ring base 204, thereby closing the ring 202 and preventing free dissociation of articles from the binder 206. Accordingly, the ring 202 is adapted to open and close relative to the base 204 for alternating between an article-secured configuration and a configuration adapted for associating and dissociating articles relative to the ring 202.

The ring 202 is preferably configured as a generally unitary structure having the free end 208 that is associable and dissociable from the base 204 for, inter alia, enabling removable association of the ring 202 with a plurality of articles, and a secured end 210 that remains in constant association with the base 204. Thus, in contrast to conventional rings of ring binders that typically include two opposed arcuate structures that move relative to each other, the ring 202 of the present invention is preferably configured as a unitary structure movable relative to the base 204 as a unit. The unitary structure of the ring 202 suitably overcomes the limitations of conventional rings of ring binders by eliminating the distortion-based complications of the same.

In addition to providing opening and closing functionality, the ring 202 is also adapted to collapse. More specifically, the ring 202 is adapted to alternate between an upright, fastened configuration for article securement and an unfastened, collapsed configuration for reducing the size profile of the binder 206. Aspects of the collapsibility of the ring 202 will be more fully described hereinafter.

The free end 208 may be adapted to associate with the ring base 204 through any suitable mechanism, preferably a mechanism that permits the free end 208 to repeatedly associate and dissociate with the base 204. In a preferred embodiment, the free end 208 includes a flange-like hook 212 angularly protruding therefrom that fastens to the base. As will be more fully described hereinafter, the hook 212 is adapted to securely engage and fasten to complementary receiving structure (a base connector) on the base 204. The hook 212 preferably extends arcuately from the free end 208 toward the secured end 210 of the ring 202. Additionally, the ring 202 is preferably constructed of a material, such as a polymer, a metal, an alloy, and the like, that is relatively rigid, but that also displays some resilient flexibility required for fastening the free end of the ring to and unfastening the free end of the ring from the base (base connector). Thus, in operation, when the free end 208 and/or hook 212 is engaged with the base 204, the free end 208 is flexed and/or generally pulled away from the secured end 210 to disengage the free end 208 from the base 204 and permit opening of the ring 202. When the free end 208 is released, the ring 202 returns to its resting state configuration.

The secured end 210 of the ring 202 is preferably adapted to be securely associated with the ring base 204 and/or an appropriate element thereof. While the free end 208 is adapted to releasably engage and fasten to the base 204, the secured end 210 is adapted to remain in constant association with the base 204 so as to generally anchor the ring 202 to the base 204. Various aspects of the secured end 210 and the means by which it remains in constant association with the base 204 will be more fully described hereinafter.

Returning to a general discussion of the overall configuration of the ring 202, the ring 202 is preferably configured in a generally loop-like shape that suitably facilitates manipulation of articles secured to the device 200. The loop configuration generally provides a path through which the articles may pass in a book-like page-turning manner. Also, the ring 202 may suitably be discontinuously looped. Thus, for example, the ring 202 may include a generally arcuate and looped portion and a generally straight portion. As best shown in FIGS. 7A and 7D, the straight portion may suitably extend from the secured end 210 and gradually transform into the arcuate portion, which portion terminates in the free end 208. In a preferred embodiment, the straight portion interfaces with the arcuate portion at a position slightly below the overall apex of the ring 202, so that the arcuate portion defines a substantial portion of the ring 202. The straight portion of the ring 202 suitably facilitates collapsing of the ring 202 in manners that will be more fully described hereinafter.

The collapsible binding device 200 of the present invention suitably also includes the ring base 204 for, inter alia, associating the ring 202 to the binder 206 and enabling the preferred multiple functionality (e.g., opening and closing, collapsing, and the like) of the ring 202. The base 204 in this example is generally provided as a rectangular member having a bottom surface 224 and a top surface 222. The bottom surface 224 is generally planar and rests atop a surface of the binder 206 when the device 200 is associated therewith. The top surface 222 is disposed in opposition to the bottom surface 224 and has associated therewith various features that provide the functionality of the binding device 200 of the present invention.

With best reference to FIGS. 7A and 7D, the base 204 top surface 222 generally includes a ring interfacing portion 226 and a ring engaging portion 228. As will be more fully explained hereinafter, the ring interfacing portion 226 is a portion of the base 204 adapted for, inter alia, securing the ring 202 to the base 204 and for enabling the movability of the ring 202 relative to the base. The ring engaging portion 222 is suitably a portion of the base 204 adapted for, inter alia, providing a substrate against which the free end 208 and/or hook 212 thereof is releasably secured.

The ring interfacing portion 226 preferably includes various features and/or elements that permit the movability of the ring 202 through a plurality of orientations and configurations. More specifically, the ring interfacing portion 226 enables the ring 202 to pivot along its vertical axis for opening and closing of the ring 202, and suitably also enables the ring 202 to rotate along the ring 202 secured end 210 for collapsing of the same.

Before a preferred embodiment of the ring interfacing portion 226 is discussed, it is to be appreciated that any structure and/or elements capable of permitting the movability of the ring 202 as previously described may be employed, and that the present invention is not to be construed as limited to the particular embodiments of the ring interfacing portion 226 hereinafter described. Turning to FIGS. 7A, 7B and 7D, the ring interfacing portion 226 is preferably disposed along an end of the base 204 top surface 222, and generally includes a shaft 230 rotatably disposed within a pair of engaging arms 232, 234. The interfacing portion 226 provides a first pivotal connection to the ring permitting the free end of the ring 208 to move toward and away from the ring engaging portion 228. The interfacing portion 226 also provides a second pivotal connection to the ring permitting the ring 202 to rotate as shown at arrow 229 (and/or in the opposite direction) into the collapsed position (e.g., FIGS. 8C-8D and 12D).

The shaft 230 suitably provides an interfacing element between the ring 202 and the base 204 that enables the multiple functionality and movability of the ring 202. The shaft 230 suitably also provides a substrate to which the ring 202 is mechanically or otherwise secured, and thereby generally anchors the ring 202 to the binder 206.

The shaft 230 is preferably provided as a generally right cylindrical member adapted to rotate, about its longitudinal axis, within the arms 232, 234. Additionally, the shaft 230 preferably terminates along its ends in circular end portions that are adapted to be rotatably secured within complementary receiving structure on inside surfaces of the arms 232, 234, thereby securing the shaft 230 to the base 204 and also enabling the free rotatability of the shaft 230 relative thereto. The association of the ring 202 to the shaft 230 is suitably configured to enable translation of the shaft's 230 rotation to the ring 202 for providing openability and closability of the ring 202 relative to the base 204.

As previously mentioned, the shaft 230 also provides a substrate against which the ring 202 is secured. FIGS. 7A-7D illustrate a preferred embodiment of various structure by which the ring 202 is secured to the shaft 230. Specifically, the shaft 230 preferably includes a boss-like receiving channel 236 extending from the shaft 230 along a midpoint thereof and transversely relative to the longitudinal axis of the shaft 230. The channel 236 preferably includes an open middle portion in which the secured end 210 of the ring 202 is received and secured. The channel 236 is suitably configured in a shape generally complementary to the cross sectional shape of the ring 202 to thereby increase the degree of engagement between the ring 202 and the channel 236. The ring 202 may be secured to the channel 236 through any suitable means. In one embodiment, a fastener, such as a mechanical fastener (e.g., a screw 240) may suitably be disposed transversely through a bore 242 of the shaft 230 that extends into association with the secured end 210 of the ring 202. Such fastener suitably operates to secure the ring 202 to the base 204 and prevent dissociation of the ring 202 from the shaft 230. Despite the discussion of the screw 240, it is to be appreciated that any suitably fastener and/or means for maintaining the ring 202 in constant association with the shaft 230 may be employed, such as various insert molding approaches, swedging, rivets, rivet-like fasteners and the like.

As previously mentioned, the ring 202 is preferably adapted to alternate between an upright and a collapsed configuration. As contemplated by the present invention, collapsing of the ring 202 generally involves first rotation of the shaft 230 away from the base 204 so as to generally separate the ring 202 free end 208 from the base 204. The free end 208 is preferably separated from the base 204 until a portion of the ring 202 generally proximate to the secured end 210 is disposed in generally abutting relationship with the binder 206. Once the ring 202 is so disposed, the ring 202 is then generally rotated (e.g., at arrow 229) along an axis coaxial with the ring 202 secured end 210, thereby disposing the length of the ring 202 in generally abutting relationship with the binder 206 and reducing the vertical size profile of the binding device 200 of the present invention. Accordingly, the secured end 210 of the ring 202 is preferably rotatably disposed within the channel 236 to permit rotation of the ring 202 relative to the shaft 230. Therefore, the means by which the ring 202 is associated with the shaft 230 is preferably a means, such as an appropriate oriented rivet-like fastener, that permits such rotatability, even more preferably frictional rotatability to prevent loose rotation of the ring 202.

As will be more fully described hereinafter, the binding device 200 preferably includes various features for biasing the ring 202 into an open position (i.e., a neutral or at rest position), in which the free end 208 thereof is dissociated from the ring engaging portion 228. More specifically, the device 200 preferably includes a biasing means that causes the shaft 230 to rotate away from the ring engaging portion 228 to thereby separate the free end 208 from the ring engaging portion 228.

Relative to the biasing means, the shaft 230 preferably includes a projection 244 on which the biasing means acts. More specifically, the projection 244 preferably extends transversely from the shaft 230 at an approximate 90 degree angle relative to the receiving channel 236. Various aspects of the projection 244 will be more fully described hereinafter in connection with a discussion of the biasing means.

The base 204 preferably also includes the arms 232, 234 for rotatably securing the shaft 230 thereto. The arms 232, 234 are preferably disposed along an end of the base 204 top surface 232, and extend upward therefrom. Additionally, the arms 232, 234 are preferably spaced apart and generally parallel relative to each other so as to define a space therebetween for rotatable disposition of the shaft 230. Further thereto, the arms 232, 234 preferably include on their inner surfaces (i.e., surfaces of the arms 232, 234 that face each other and the space therebetween) shaft-receiving portions and/or features generally complementary in shape to the ends of the shaft 230 for securely retaining the shaft 230 therewith.

The base 204 of the present invention preferably also includes the ring engaging portion 228 for, inter alia, releasably engaging the free end 208 of the ring 202. In general, the ring engaging portion 228 provides a surface against which the free end 208 and/or hook 212 thereof may engage to prevent free dissociation of the free end 208 from the base 204 and to maintain the ring 202 in a closed configuration.

In this exemplary embodiment, the ring engaging portion 228 fastens the free end of the ring to the base and is preferably disposed atop the base 204 top surface 222 and generally distal thereon to the ring interfacing portion 226. The portion 228 preferably includes an aperture-like opening 250 into which the ring 202 free end 208 suitably is disposed while the ring 202 is in a closed configuration. The aperture 250 generally provides a lip-like catch that operates to retain the free end 208 once so associated.

Returning to a discussion of the biasing means for biasing the ring 202 into an open configuration, the collapsible binding device 200 of the present invention preferably, albeit optionally, includes a bridge 260 adapted to act on the shaft 230 to bias it rotated away from the base 204. FIG. 7D illustrates a preferred embodiment of the bridge 260 in which the bridge 260 is configured as a unitary and ribbon-like member having a biasing portion 262 and a lip portion 264, both of which are interconnected by a connecting portion 266. The biasing portion 262 is preferably configured cross-sectionally in an inverted letter "U" shaped configuration, generally terminating in an actuating arm 268. The biasing portion 262 is preferably constructed of a material, such as metal, spring steel, and the like, that displays resilient flexibility. Accordingly, when the actuating arm 268 is suitably flexed toward the biasing portion 262 (e.g., inward), the actuating arm 268 tends to spring outward.

The biasing portion 262 is preferably disposed relative to the base 204 in a manner that causes the actuating arm 268 thereof to be in abutting contact with the shaft 230. Even more preferably, the biasing portion 262 is preferably disposed relative to the base 204 in a manner that causes the actuating arm 268 thereof to be in abutting contact with the projection 244 of the shaft 230. As best shown in FIGS. 7B and 7C, the base 204 preferably includes an opening 270 along the ring interfacing portion 226 that communicates with both the top surface 222 and the bottom surface 224 of the base 204. The biasing portion 262 of the bridge 260 is preferably oriented in the opening 270 with its apex penetrably disposed therein. Accordingly, in this configuration, the actuating arm 268 is positioned to actively engage the projection 244 of the shaft 230 and continuously bias the ring 202 into an open configuration.

Returning to a discussion of the projection 244, the projection 244 is preferably configured to receive the biasing of the actuating arm 268 in directing the shaft 230 to rotate away from the actuating arm 268. As previously mentioned, the actuating arm 268, through its general letter "U" shaped configuration, is generally disposed at a downwardly sloping angle in the base 204 opening 270. Accordingly, the projection 244 is preferably configured so as to actively engage the actuating arm 268 and be acted on thereby. In an exemplary embodiment, the projection 244, when viewed in cross section, gradually tapers outward and away from the longitudinal axis of the shaft 230. Therefore, when the ring 202 free end 208 is dissociated from the ring engaging portion 228, the actuating arm 268 suitably applies pressure to the projection 244 and causes the same to drive the shaft 230 to rotate away from the ring engaging portion 228, and thereby dispose the ring 202 in an open configuration. The biasing of the ring 202 into an open configuration suitably facilitates a user's interaction with the device 200 by disposing the free end 208 for ready association with an article, such as a sheet of paper.

It is to be appreciated that, despite the foregoing discussion, the biasing means may be provided as any feature and/or structure capable of biasing the ring 202 into an open configuration. It is also to be appreciated that the biasing means is an optional element of the present invention and may suitably be omitted therefrom.

Returning to a discussion of the bridge 260, the bridge suitably also includes the lip portion 264 for, inter alia, securely engaging the free end 208 and/or hook 212 thereof to maintain the ring 202 in a closed configuration. As best shown in FIG. 7D, the lip portion 264 is preferably fashioned in a manner generally similar to the biasing portion 262, albeit at reduced dimensions. More specifically, the lip portion 264 preferably includes a wall 272 that extends upward from a rear portion of the bridge 260 connecting portion 266 and which terminates in a downwardly angled and extended flange-like lip 274. Similar to the engagement of the base 204 with the biasing portion 262, the base 204 preferably also includes an opening 276 that communicates with both the top surface 222 and the bottom surface 224 of the base 204, in which opening 276 the lip portion 264 is disposed. The lip portion 264 is preferably disposed in the opening 276 in a manner that disposes the flange-like lip 274 in the aperture 250 for ready engagement with the ring 202 free end 208 and/or hook 212 thereof.

In operation, the user closes the ring 202 by bringing the free end 208 and/or hook 212 thereof into engagement with the lip portion 264 of the bridge 260. The free end 208 and/or hook 212 thereof preferably extends from the ring 202 inward and upward, generally endowing the ring 202, at least the arcuate portion thereof, in a generally letter "C" like manner. Thus, when a user pushes the ring 202 into engagement with the lip portion 264, the downward angle of the lip portion 264 suitably assists in orienting the free end 208 to slide in front of the lip portion 264 and then thereunder as the flexible material of the ring 202 causes the same to retract. Additionally, the upward disposition of the free end 208 and/or hook 212 suitably cooperates with the downwardly angled flange-like lip 274 to reinforce the fastening engagement between the ring 202 and the ring engaging portion 228 and prevent free dissociation of the same.

FIGS. 8A-8D and 9A-9B illustrate a exemplary applications of the collapsible binding device 200 of FIGS. 7A-7D, wherein a plurality of the devices 200 are secured to a binder 206 for use in releasably securing articles, such as sheets of paper, thereto. FIG. 8A illustrates an exemplary embodiment binder 206 generally including a front cover 280, a rear cover 282 and a spine 284 interconnecting the front and rear covers 280, 282 and providing for the openability of the same, and a plurality of binding devices 200 associated therewith. As evident, the binder 206 and associated binding devices 200 suitably operate in a manner generally consistent with conventional ring binders, wherein the devices 200 provide a means for releasably securing articles to the binder 206 for organization, storage and the like of the same.

FIG. 8A illustrates an embodiment in which three binding devices 200 are associated with the binder 206. However, it is to be appreciated that any desired number of binding devices 200 may be associated with a binder. Depending on the size and configuration of the binder 206, and the general norms and customs of the society for which it is intended use, the binder 206 may feature any number of binding devices 200 associated therewith, such as one, two, three, four, five, and any other convenient and suitable number. It is also to be appreciated that any size ring 202 may be employed with the present invention, such as one inch rings, two inch rings, three inch rings, four inch rings, five inch or larger rings, and the like.

FIG. 8A also illustrates an embodiment in which the binding devices 200 are secured to the rear cover 282 of the binder 206. It is also to be appreciated that the binding devices 200 may be disposed in any suitable location on the binder 206, given the particular needs and intended application of the same. Thus, for example, the devices 200 may suitably be secured to the binder 206 front cover 280, the rear cover 282, the spine 284 or any other manner, directly or indirectly associated therewith.

It is also to be appreciated that any suitable means may be employed for securing the binding devices 200 to the binder 206. In a preferred embodiment, the device 200 base 204 includes a plurality of bores 290 therein, as best shown in FIG. 7B. The bores 290, preferably present in a paired configuration, are generally disposed through the base 204 at positions generally between the ring interfacing portion 226 and the ring engaging portion 228. Any suitable fastener, such as a rivet, a screw, an adhesive, and the like, may be employed to secure the device 200 to the binder 206. As an optional alternative, it may be possible to mold the base or a portion of the base into position on a surface of the binder without the ring, and attach the ring and any remaining components of the base in any suitable means. It may also is also possible to insert mold the base by molding plastic material over some or all of the metal components. In further connection to the preferred bore 290 embodiment, the device 200 is preferably secured to the binder 206 through disposition of a rivet (not shown) in each of the bores 290.

Figure 8B:
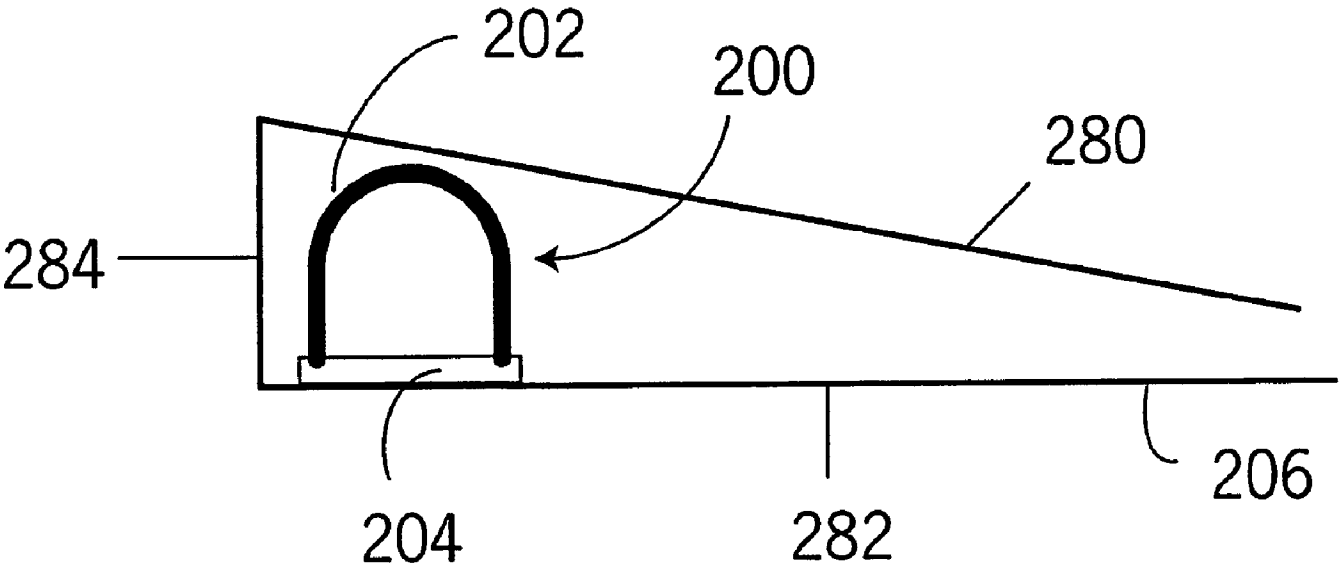
FIG. 8B is a side plan view of the ring binder and associated exemplary binding devices of FIG. 8A.

Returning to an operational discussion of the exemplary device 200, FIG. 8A illustrates the binder 206 in an open position and with the binding devices 200 in an upright, fastened, and closed configuration, as if a plurality of articles were being associated therewith (e.g., held by the rings). FIG. 8B provides a side illustration of the binder 206 in a closed position ready for storage on a shelf or similar element. FIG. 8B particularly illustrates the width of the binder 206 when the devices 200 are maintained in an upright configuration, which width is generally consistent with conventional ring binders.

Figure 8C:
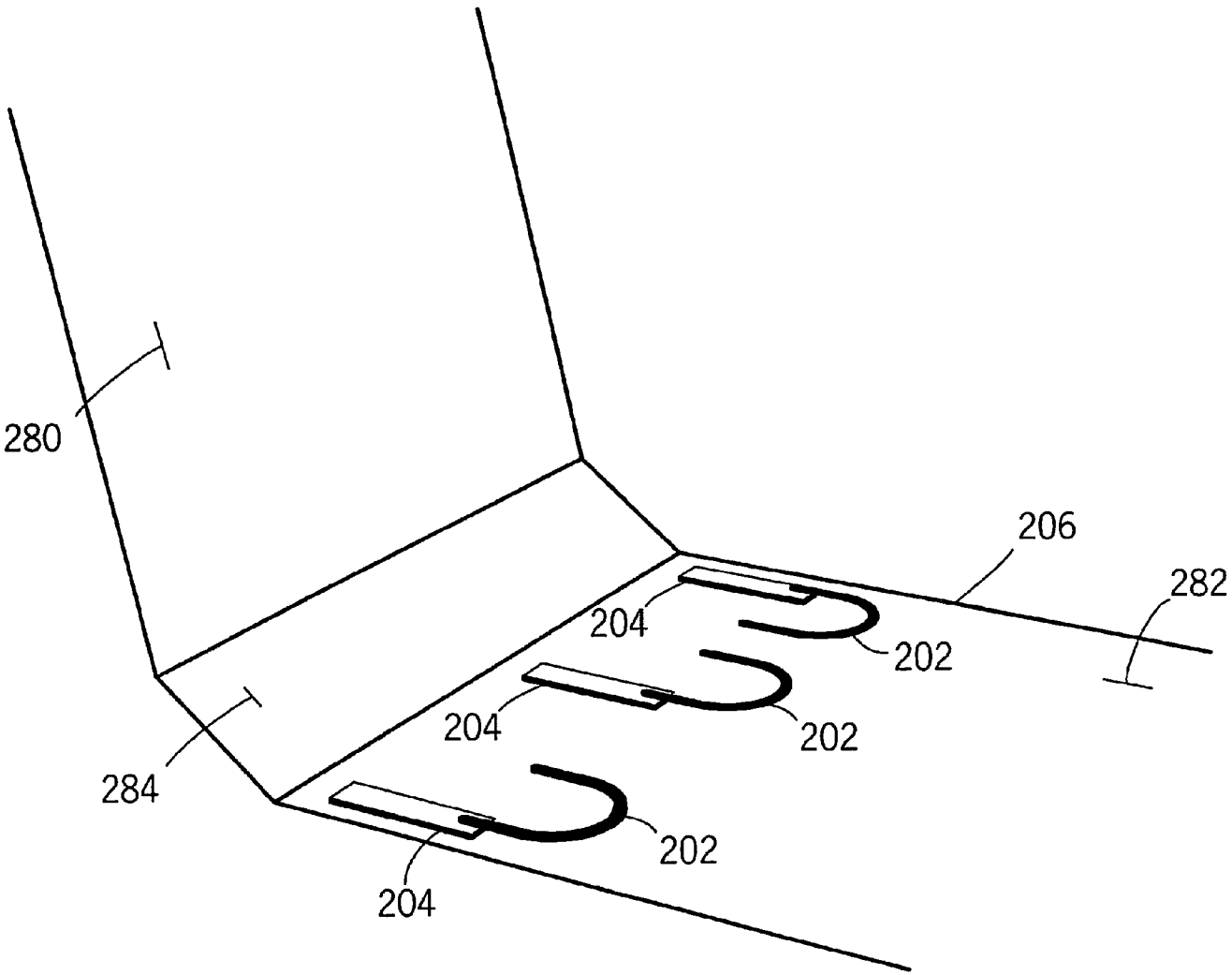
FIG. 8C is a perspective of the ring binder and associated exemplary binding devices of FIGS. 8A and 8B, wherein the exemplary binding devices are in a collapsed configuration.
Figure 8D:
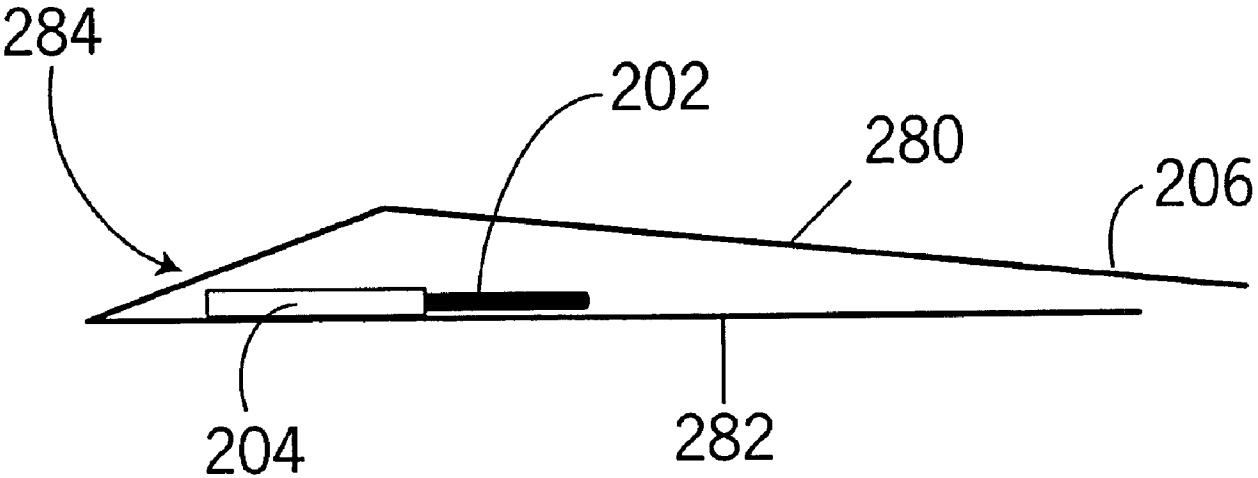
FIG. 8D is a side plan view of the ring binder and associated exemplary binding devices of FIG. 8C.

FIGS. 8C and 8D particularly illustrate an exemplary benefit of the collapsible binding device 200 of the present invention. FIG. 8C is an alternate view of the arrangement of FIG. 8A, wherein the devices 200 are in a collapsed state, i.e., the free end 208 of the ring 202 is dissociated from the ring engaging portion 228, the shaft 230 is outwardly rotated to dispose the ring 202 in generally abutting relationship with the binder 206, and the ring 202 is rotated so as to in its entirety lay flushly against the binder 206. FIG. 8D provides an alternate view of FIG. 8B. As evident, the width of the binder 206 is substantially decreased by orders of magnitude when the devices 200 are disposed in the collapsed configuration. As known to one of ordinary skill in the art, such width decrease provides numerous supply chain advantages, such as reduced space requirements for shipping, retail display, consumer-based storage and use, and the like.

Figure 9A:
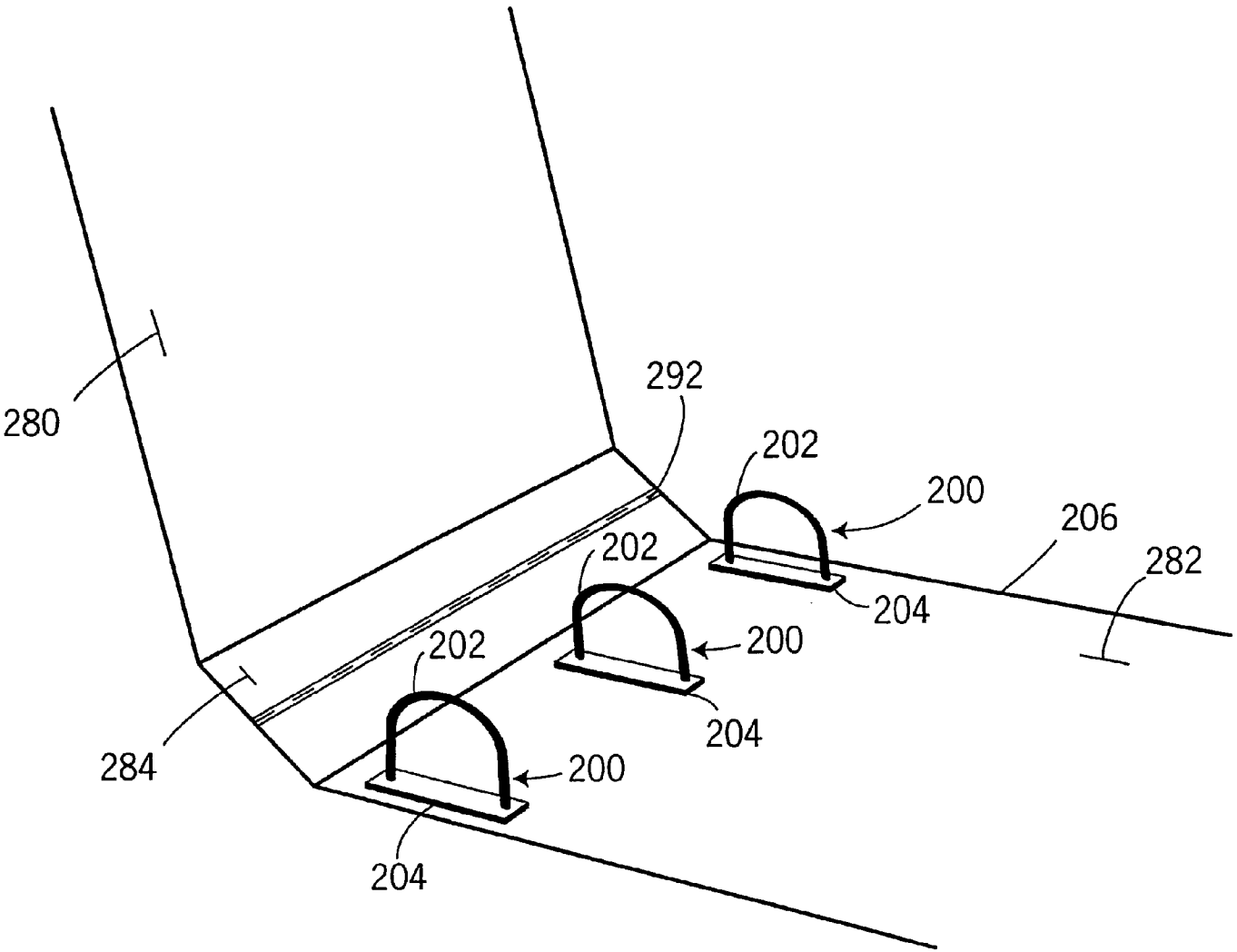
FIG. 9A is a perspective view of an alternate exemplary ring binder having a plurality of the exemplary binding devices of FIGS. 7A-7D associated therewith, and wherein the ring binder is in an open state and further wherein the exemplary binding devices are in a closed, fastened, and upright configuration.
Figure 9B:
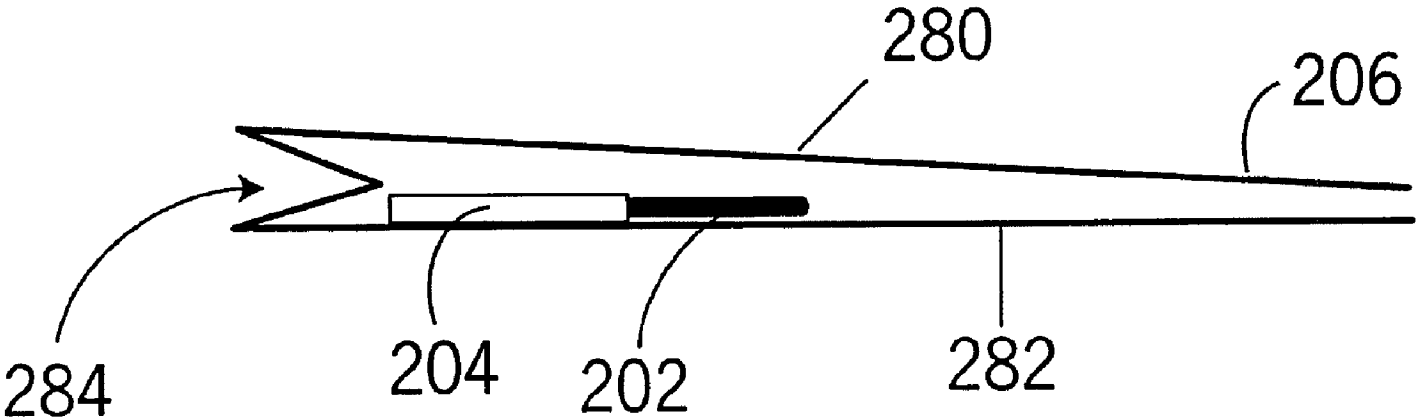
FIG. 9B is side plan view of the alternate exemplary ring binder and associated exemplary binding devices of FIG. 9A, wherein the exemplary ring binder is in a closed and collapsed state, and further wherein the exemplary binding devices are in a collapsed configuration.

FIG. 9A illustrates an alternate embodiment binder 206 that increases the size profile reduction aims of the present invention. In this embodiment, the spine 284 of the binder 206 is preferably provided with a hinge 292 that permits the spine 284 to fold about itself, as generally illustrated in FIG. 9B. The hinge 292 is preferably a foldable feature that extends along the entire longitudinal length of the spine 284, so that when the devices 200 are collapsed, the spine 284 folds on itself and reduces the overall width and size profile of the binder 206. Additionally, the hinge 292 is preferably a unidirectional hinge 292 that permits the spine 284 to only inwardly (i.e., toward the devices 200) flex. Accordingly, the spine 284 tends to flex only when the devices 200 are disposed in the collapsed configuration.

Figure 10A:
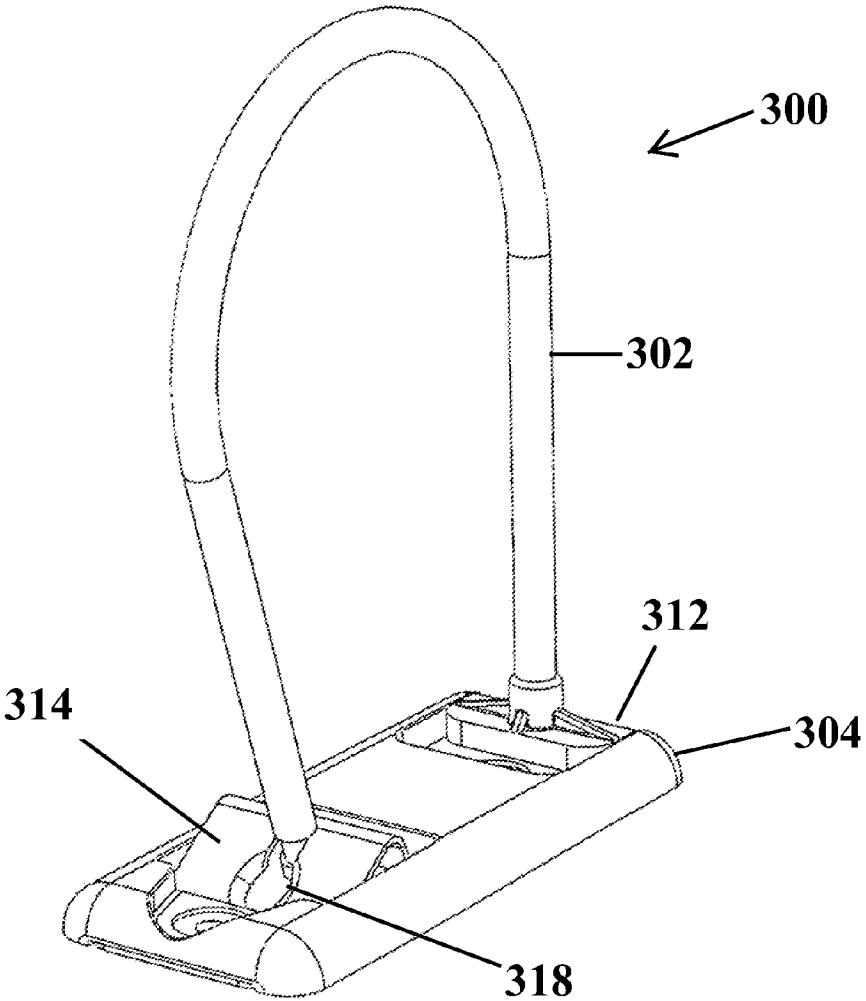
FIG. 10A is front perspective view of yet another exemplary binding device for a ring binder according to the present invention, wherein the binding device is in a closed, fastened, and upright configuration.
Figure 10B:
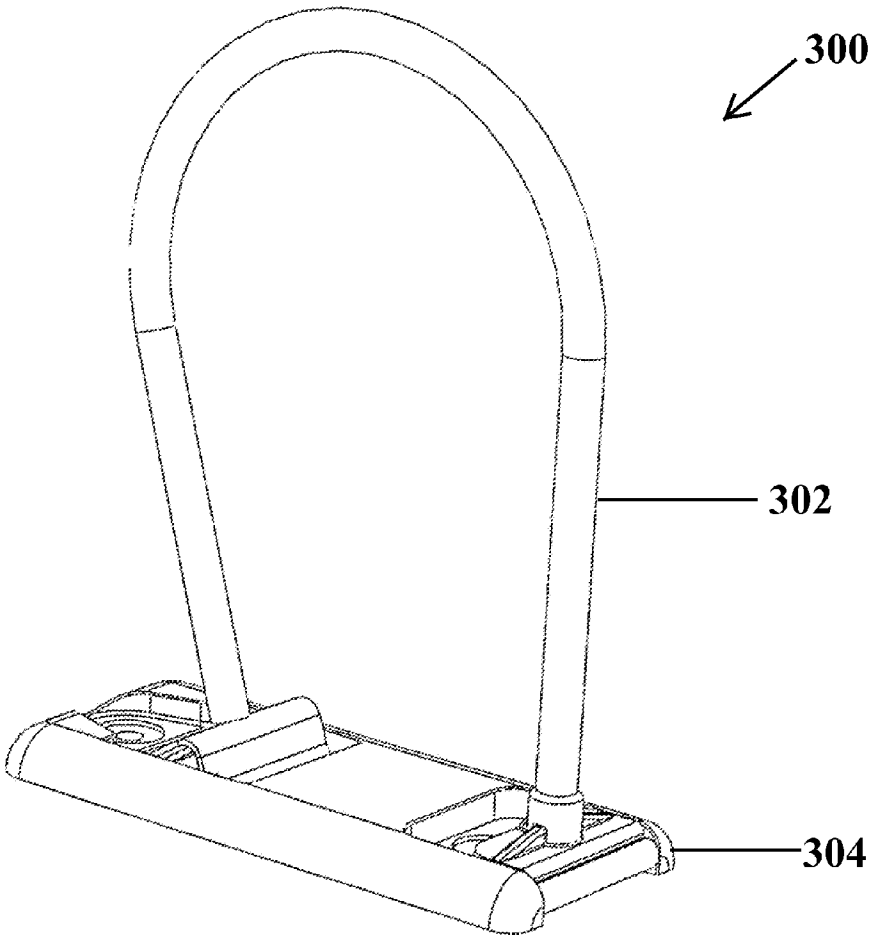
FIG. 10B is a rear perspective view of the exemplary binding device of FIG. 10A.
Figure 10C:
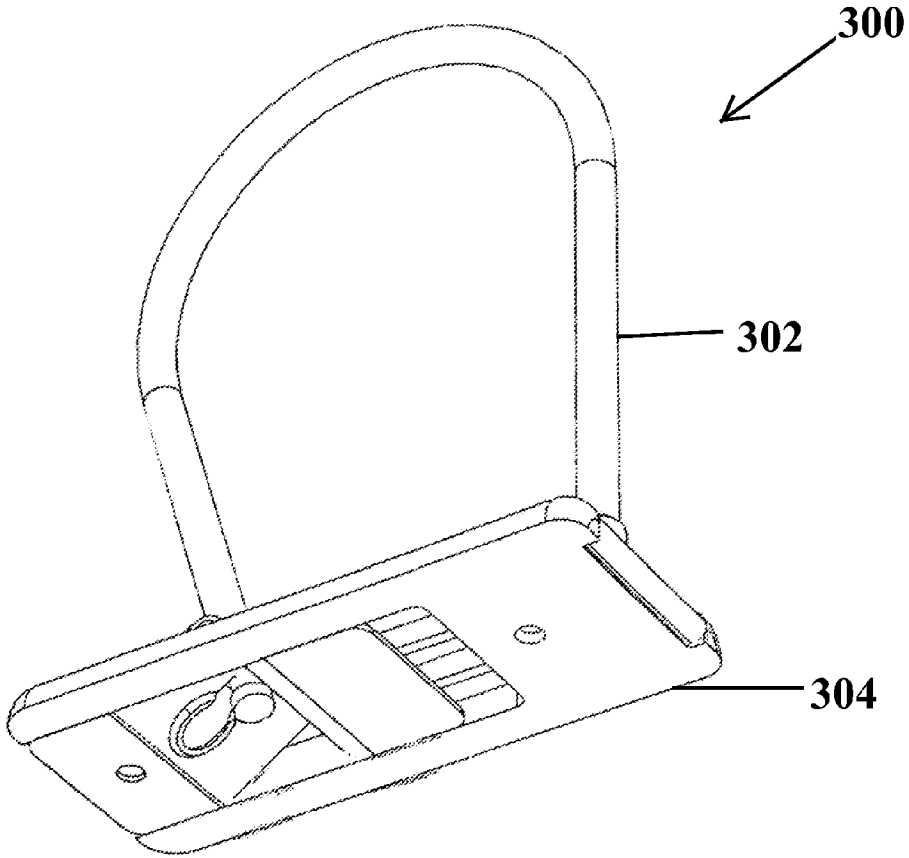
FIG. 10C is a bottom perspective view of the exemplary binding device of FIGS. 10A and 10B.
Figure 10D:
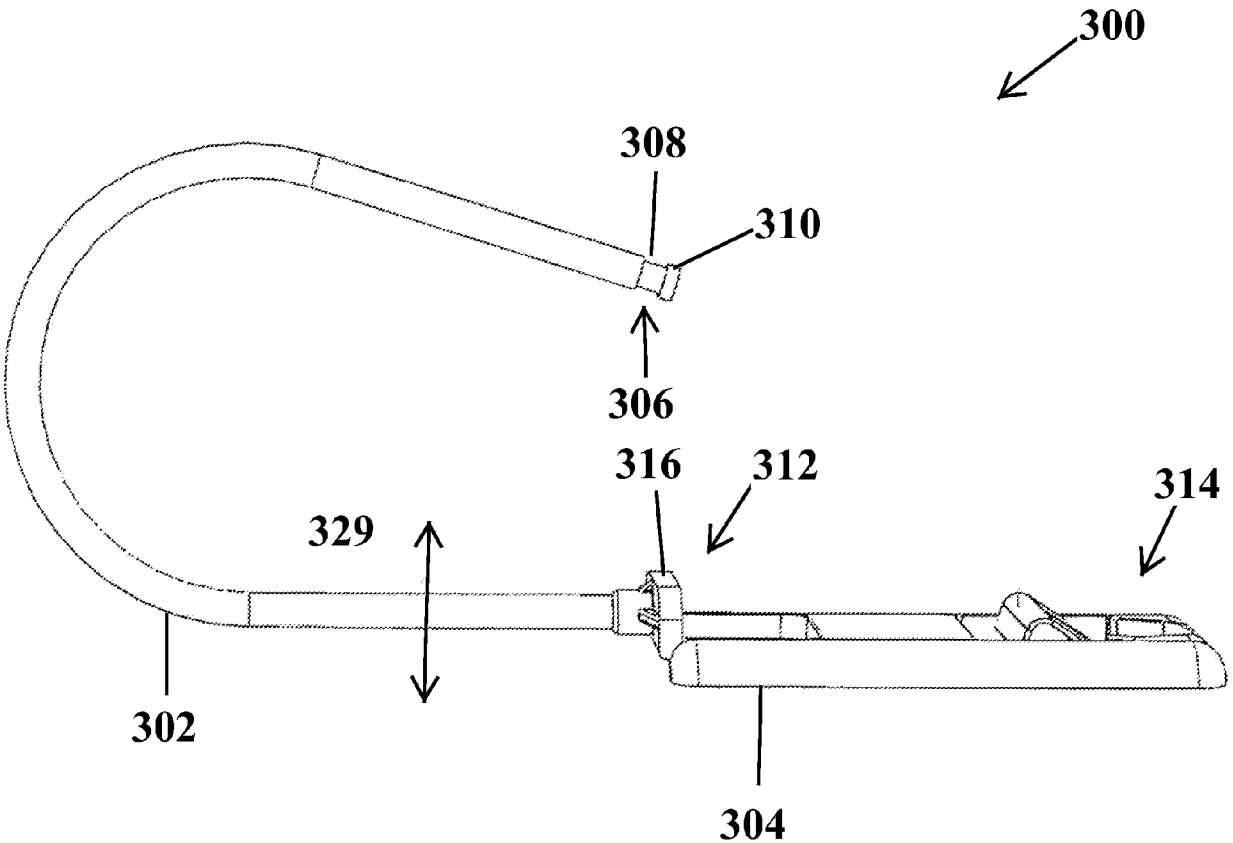
FIG. 10D is a side perspective view of the exemplary binding device of FIGS. 10A-10C, wherein the binding device is in an open state.
Figure 10E:
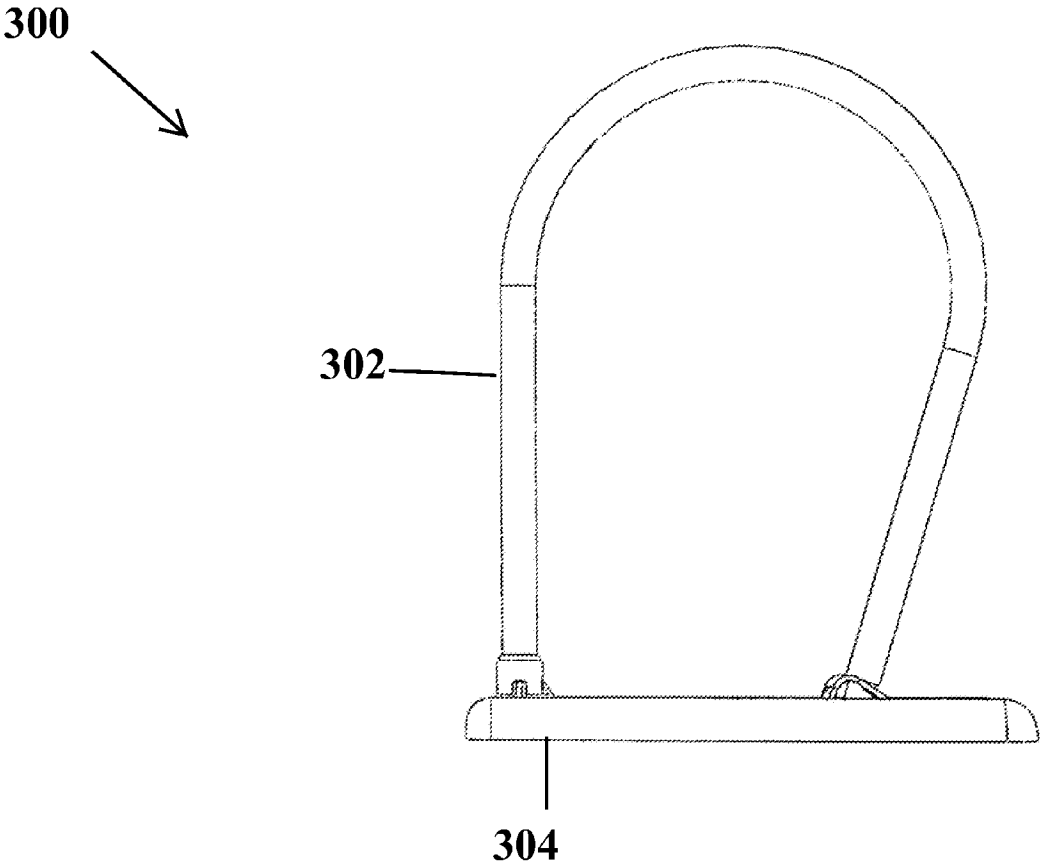
FIG. 10E is a side plan view of the exemplary binding device of FIGS. 10A-10D, wherein the device is in a closed, fastened, and upright configuration.

Turning now to FIGS. 10-10E, illustrated is yet another alternate exemplary binding device 300 according to the present invention. The exemplary binding device 300 presents an alternate configuration of the previously described binding device 100. Accordingly, it is to be appreciated that any of the discussion supra of the binding device 200 and/or various components thereof, is applicable to the discussion of the binding device 300, without necessitating any specific reference thereto.

The discussion of the alternate binding device 300 of FIGS. 10A-10E will be discussed in an abbreviated format, with regard being given to aspects that generally differ or are otherwise modified relative to the previously discussed binding device 200. Turning now to FIG. 10A, the exemplary binding device 300 generally includes a ring 302 and a ring base 304. The ring 302 preferably provides the same functionality as previously discussed, i.e., it provides a retaining mechanism by which sheets of paper or similar articles are associated with a binder or similar device. The ring 302 is preferably provided in any shape and/or configuration as previously described. Additionally, in one embodiment, the ring 302 may suitably terminate in a base engaging portion 306 (FIG. 10D) that enables the ring 302 to slidably engage complementary structure on the base 304. More specifically and by way of example, the base engaging portion 306 may suitably feature a circumferentially reduced portion 308 (FIG. 10D) disposed slightly upstream (i.e., away from the free end of the ring 302) of a circumferentially non-reduced portion 310. As will be more fully described hereinafter, the circumferentially reduced portion 308 is suitably adapted to interface with a complementary slot-like receiving portion on the ring base 304, while the circumferentially non-reduced portion 310 is adapted to retain the free end of the ring 302 in engagement with the slot-like receiving portion. The circumferentially non-reduced portion 310 is preferably configured in a circumference that generally and/or substantially mirrors the circumference of the remainder of the ring 302.

Turning now to a discussion of the ring base 304, the ring base 304 is provided as a generally planar member preferably featuring a ring interfacing portion 312 and a ring engaging portion 314, similar to the device 100 discussed above. The ring interfacing portion 312 provides a means by which the ring 302 is securely associated with the ring base 304, while the ring engaging portion 314 provides a means by which a free end of the ring 302 may suitably releasably engage and fasten to the ring base 304 for, e.g., inserting and/or removing sheets of paper to the ring 302.

The ring interfacing portion 312 suitably provides a means by which the ring 302 remains in constant engagement with the ring base 304, and which further permits the ring 302 to undergo movement along several axes, as previously described. With best reference to FIG. 10D, the ring interfacing portion 312 generally includes a panel 316 to which the ring 302 is securely associated, in a manner substantially as described above. In a different aspect, however, the panel 316 is preferably hingedly associated (preferably through a living hinge or other suitable structure) with a rear portion of the ring base 304, thereby enabling the panel 316 and associated ring 302 to pivot backward, as demonstrated in FIG. 10D. The ring interfacing portion 312 provides a first pivotal connection to the ring permitting the free end of the ring to move toward and away from the ring engaging portion 314. The interfacing portion 312 also provides a second pivotal connection to the ring permitting the ring to rotate as shown at arrow 329 (and/or in the opposite direction) into the collapsed position.

The ring engaging portion 314 preferably provides a function similar to the ring engaging portion 228 of the previously described device 200, namely it provides a means for the free end of the ring 302 to releasably engage and fasten the ring base 304. With best reference to FIG. 10A, the ring engaging portion 314 is preferably provided as having a receiving slot 318 adapted to engage the free end of the ring 302. More preferably, the slot 318 includes a circumferentially enlarged portion and a tapered portion therebehind. In operation and as evident from FIG. 10A, the ring 302 is brought into secure engagement with the ring engaging portion 314 by disposing the circumferentially non-reduced portion 310 of the ring 302 in the slot 318 circumferentially enlarged portion (which disposing may require force to overcome the tension of the ring 302), and thereafter permitting the ring 302 to adopt its resting state configuration, whereby the circumferentially reduced portion 308 of the ring 302 slides into the slot 318 tapered portion. In this state, the ring 302 is securely engaged with the ring base 304 so that any articles (e.g., sheets of paper) disposed about the ring 302 will remain associated therewith.

Figure 11A:
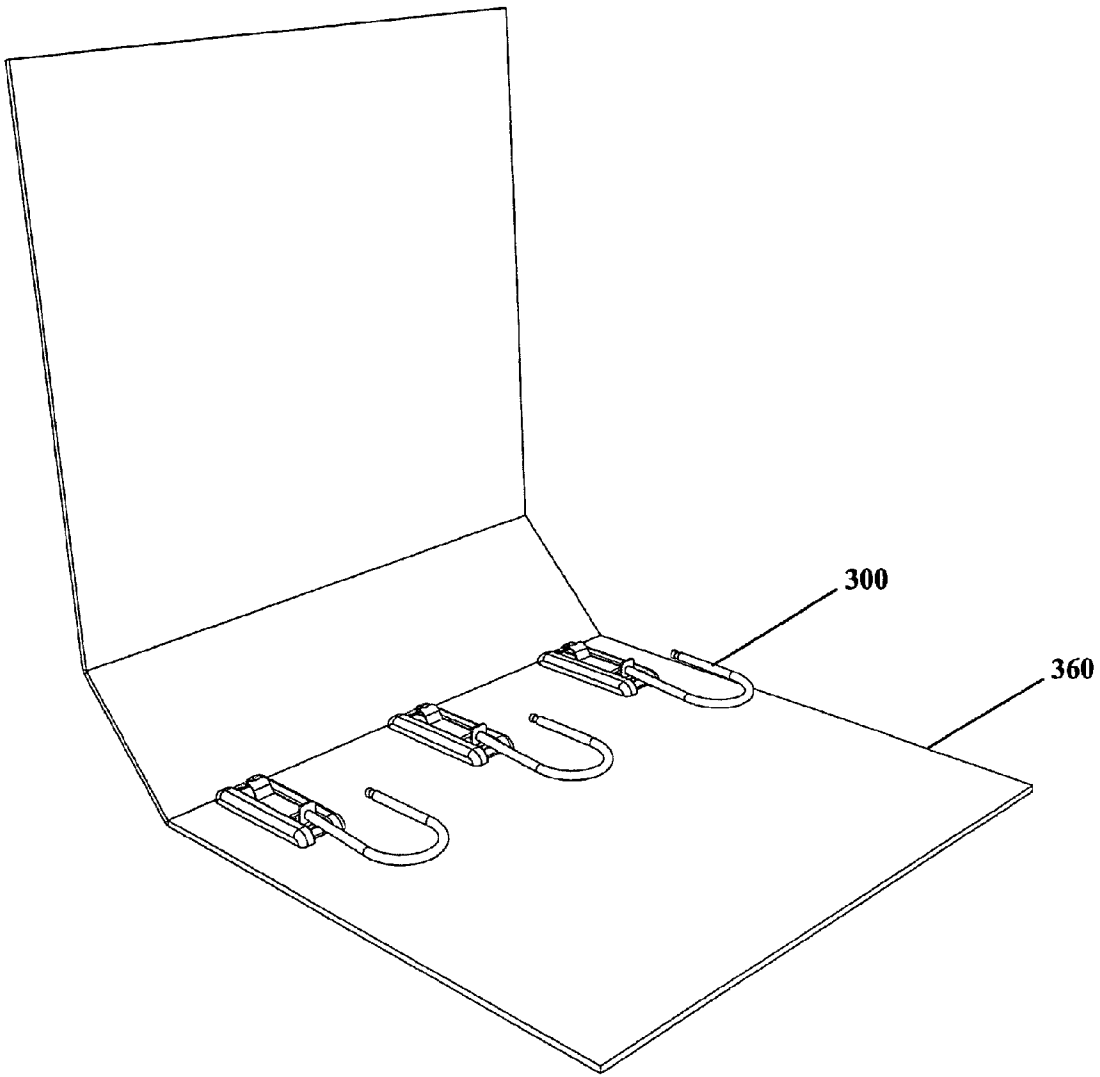
FIG. 11A is a perspective view of an exemplary binder using a plurality of binder devices of FIGS. 10A-10E, wherein the binder devices are in a collapsed position inside the binder, the front cover of which is partially open.
Figure 11B:
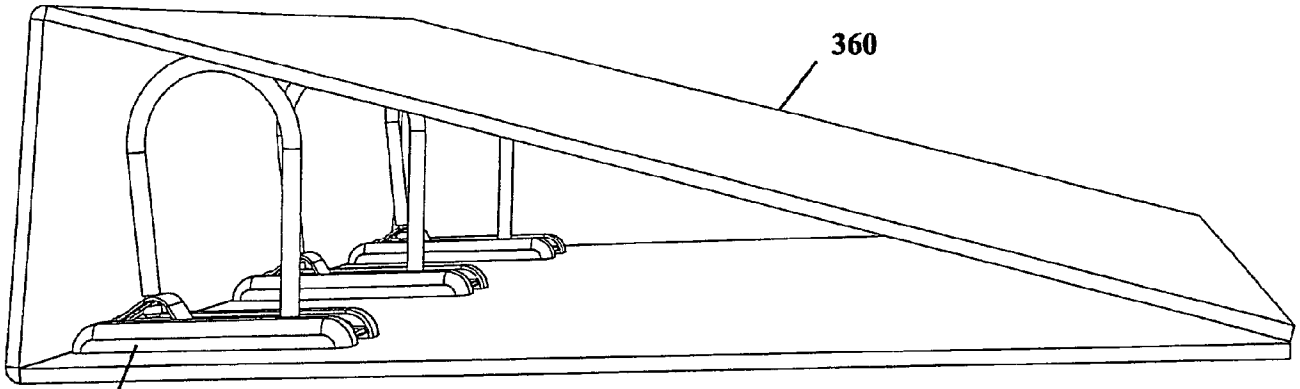
FIG. 11B is a side view of the binder of FIG. 11A, wherein the binder devices are in an upright position inside the binder, the front cover of which is closed.
Figure 11C:
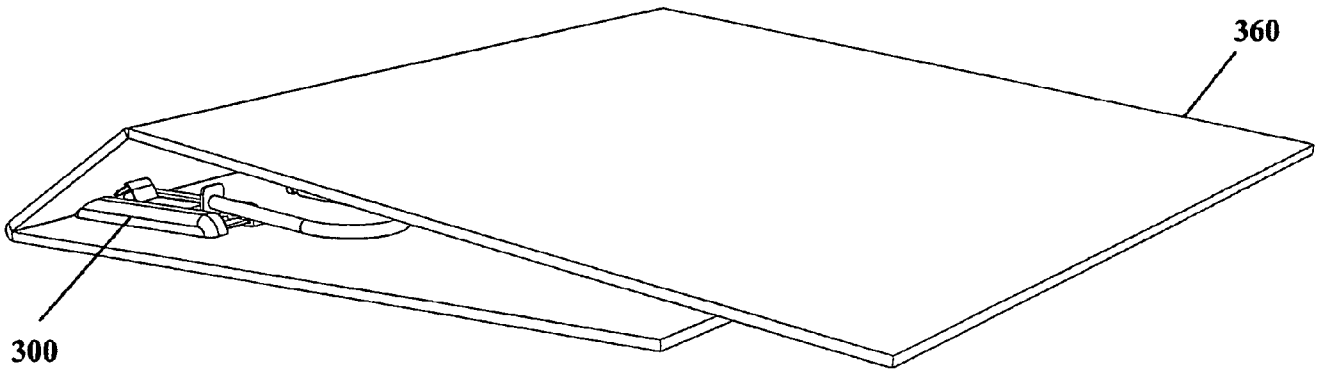
FIG. 11C is a side view of the binder FIGS. 11A-11B, wherein the binder devices are in a collapsed position inside the binder, the front cover of which is closed.

FIGS. 11A-11C show an exemplary binder 360 using a plurality of the binder devices 300 of FIGS. 10A-10E. FIG. 11A is a perspective view of the exemplary binder 360, wherein the binder devices 300 are shown in a collapsed position inside the binder 360 and the cover of the binder is partially open. FIG. 11B is a side view of the exemplary binder 360, wherein the binder devices 300 are shown in an upright position inside the binder 360 and the cover of the binder 360 is closed. FIG. 11C is a side view of the binder 360, wherein the binder devices 300 are shown in a collapsed position inside the binder 360 and the front cover of the binder 360 is closed.

Turning to FIGS. 12A-12E, illustrated is another collapsible binding device 400 according to an exemplary embodiment of the present invention. The embodiment illustrated in FIGS. 12A-12E is very similar to the embodiment illustrated in FIGS. 7A-7D. The differences between the embodiment of FIGS. 7A-7D and this embodiment correspond to the ring engaging portion 428 and the ring interfacing portion 426. With best reference to FIGS. 12A and 12E, the ring interfacing portion 426 is a portion of the base 404 adapted for, inter alia, securing the ring 402 to the base 404 and for enabling the movability of the ring 402 relative to the base 404. The ring engaging portion 428 is suitably a portion of the base 404 adapted for, inter alia, providing a substrate against which the free end 408 and/or hook 412 thereof is releasably secured.

The ring interfacing portion 426 preferably includes various features and/or elements that permit the movability of the ring 402 through a plurality of orientations and configurations. More specifically, the ring interfacing portion 426 enables the ring 402 to pivot along its vertical axis for opening and closing of the ring 402, and suitably also enables the ring 402 to rotate along the ring 402 secured end 410 for collapsing of the same. Turning to FIGS. 12A-12C and 12E, the ring interfacing portion 426 is preferably disposed along an end of the base 404 top surface 422, and generally includes a shaft 430 rotatably disposed within a pair of engaging arms 432, 434. The shaft 430 suitably provides an interfacing element between the ring 402 and the base 404 that enables the multiple functionality and movability of the ring 402. The shaft 430 suitably also provides a substrate to which the ring 402 is mechanically or otherwise secured, and thereby generally anchors the ring 402 to the binder 406.

The shaft 430 is preferably provided as a generally right cylindrical member adapted to rotate, about its longitudinal axis, within the arms 432, 434. Additionally, the shaft 430 preferably terminates along its ends in circular end portions that are adapted to be rotatably secured within complementary receiving structure on inside surfaces of the arms 432, 434, thereby securing the shaft 430 to the base 404 and also enabling the free rotatability of the shaft 430 relative thereto. The association of the ring 402 to the shaft 430 is suitably configured to enable translation of the shaft's 430 rotation to the ring 402 for providing openability and closability of the ring 402 relative to the base 404.

Figure 12A:
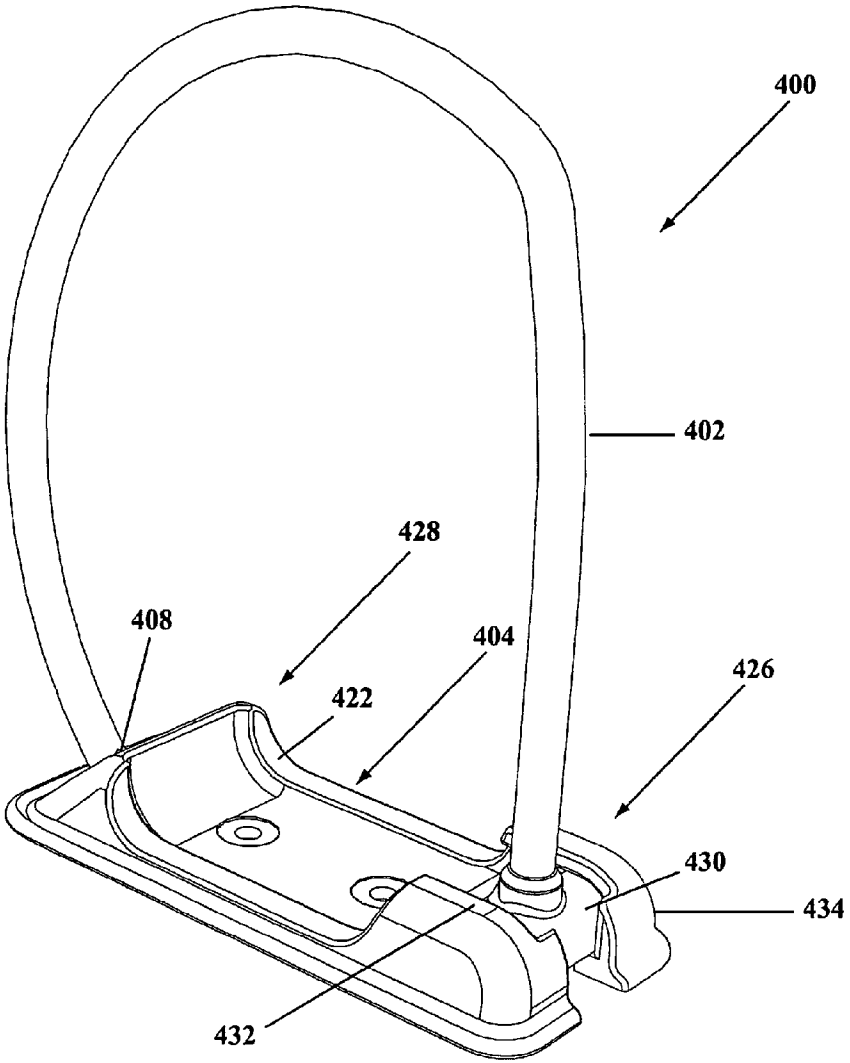
FIG. 12A is a perspective view of an alternate exemplary binding device for a ring binder, wherein the binding device is in a closed, fastened, and upright configuration.
Figure 12B:
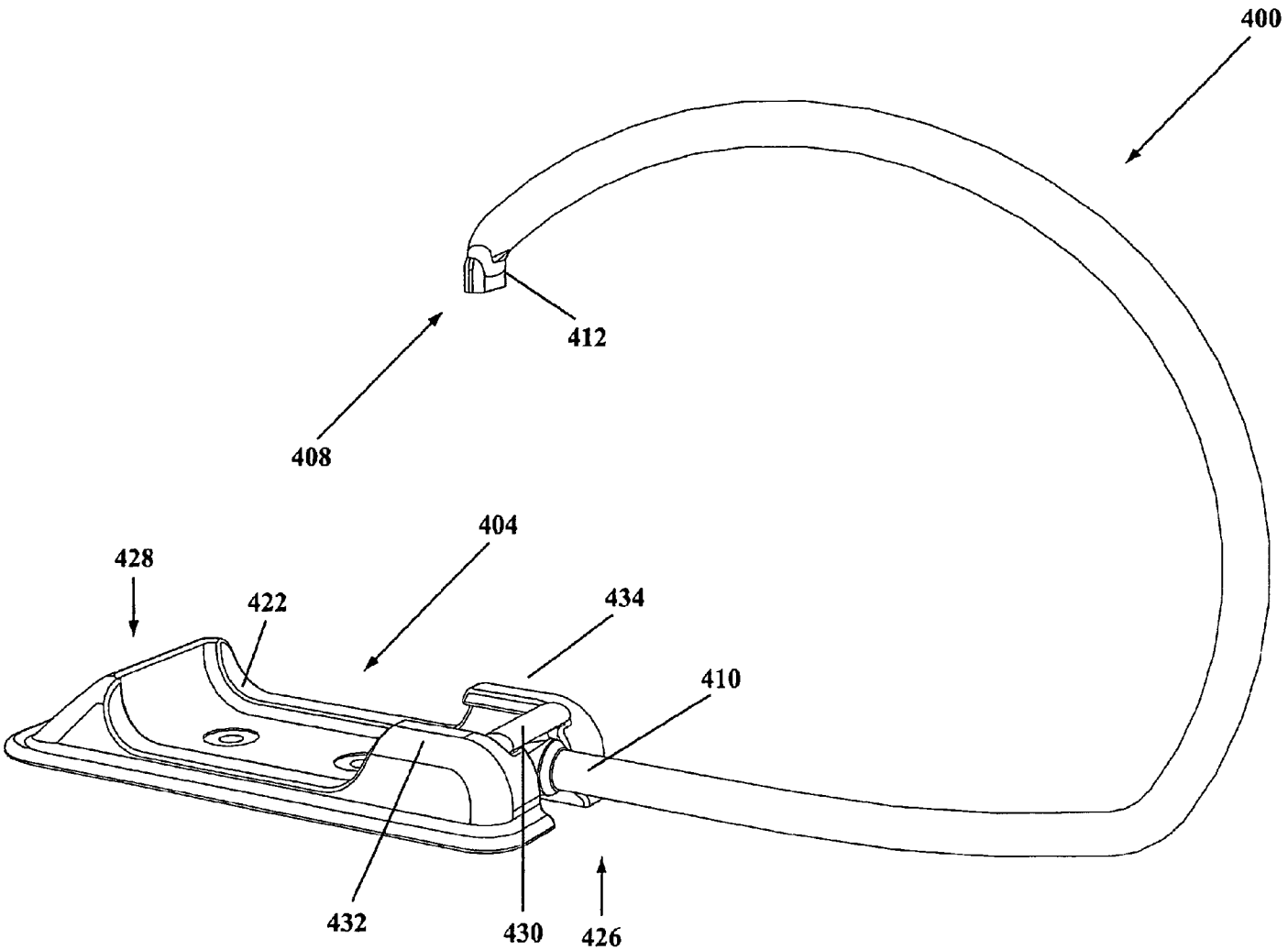
FIG. 12B is a perspective view of the alternate exemplary binding device of FIG. 12A, wherein the binding device is in an open and upright configuration.
Figure 12C:
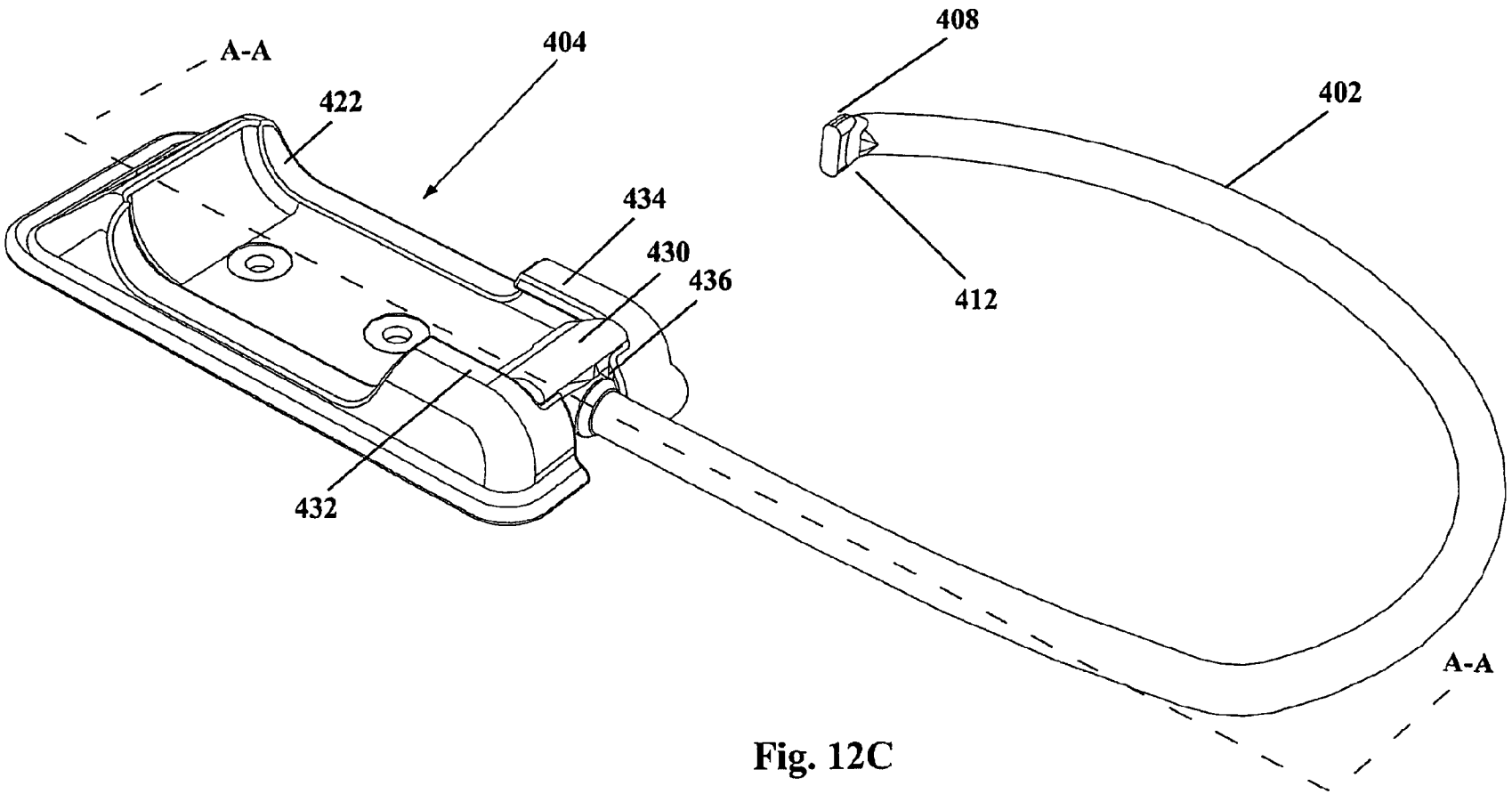
FIG. 12C is a perspective view of the alternate exemplary binding device of FIGS. 12A and 12B, wherein the binding device is in an open and collapsed configuration.
Figure 12D:
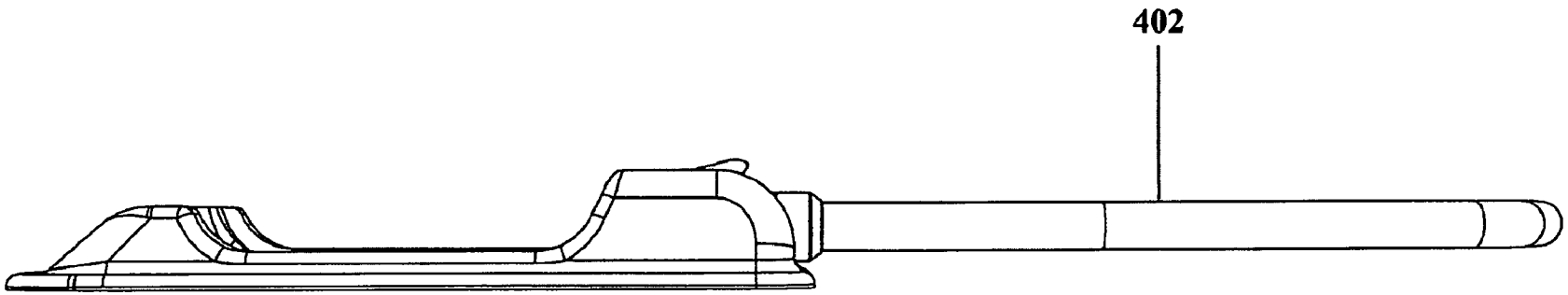
FIG. 12D is a side plan view of the alternate binding device of FIG. 12C.
Figure 12E:
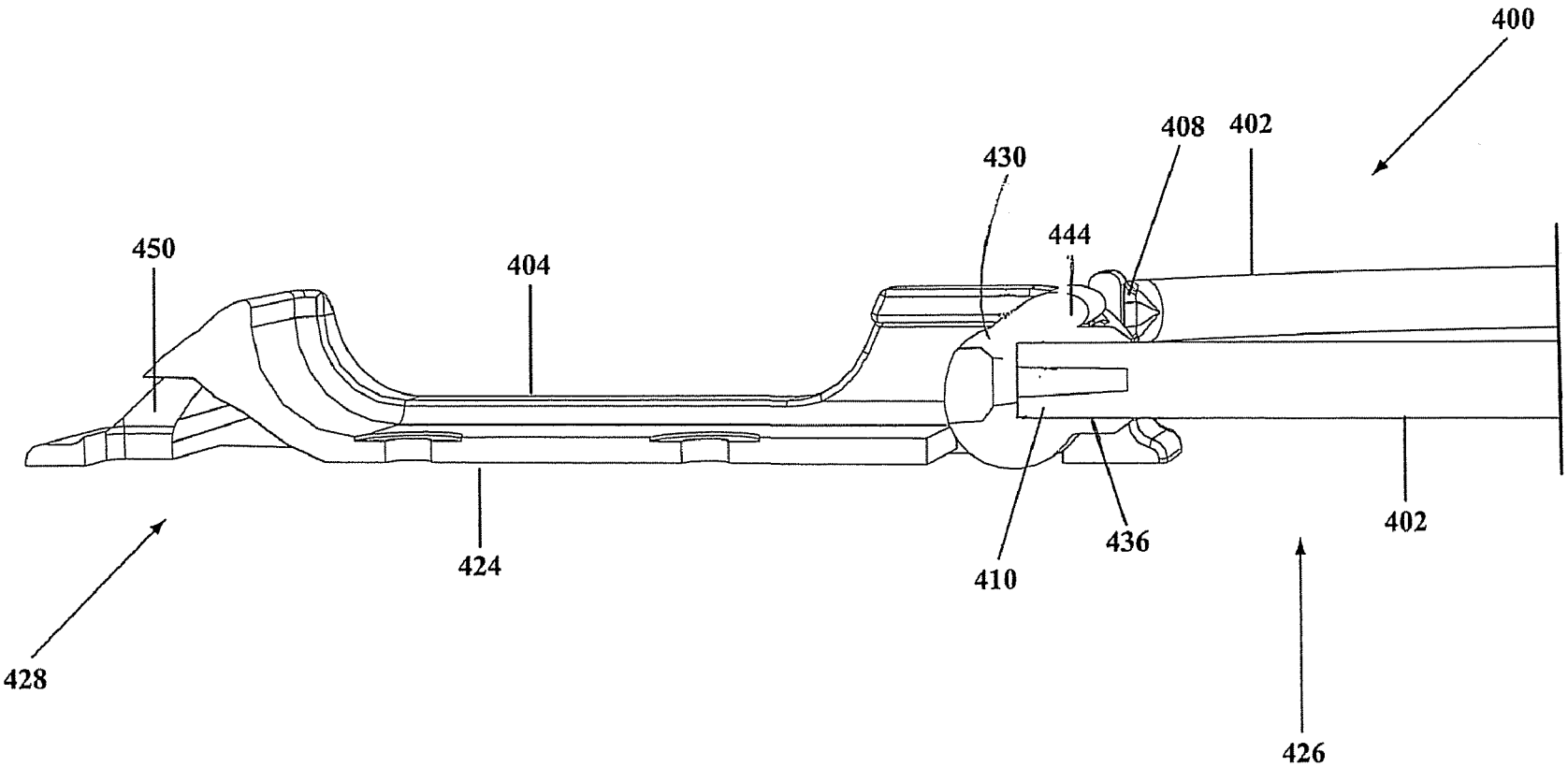
FIG. 12E is a cross sectional view of the alternate binding device of FIG. 12C, taken along line A-A thereof.

As previously mentioned, the shaft 430 also provides a substrate against which the ring 402 is secured. FIGS. 12C and 12E illustrate a preferred embodiment of various structure by which the ring 402 is secured to the shaft 430. Specifically, the shaft 430 preferably includes a receiving channel 436 extending into the shaft 430 along a midpoint thereof and transversely relative to the longitudinal axis of the shaft 430. The channel 436 receives and secures the secured end 410 of the ring 402. The channel 436 is suitably configured in a shape generally complementary to the cross sectional shape of the ring 402 to thereby increase the degree of engagement between the ring 402 and the channel 436. The ring 402 may be secured to the channel 436 through any suitable fastener and/or means for maintaining the ring 402 in constant association with the shaft 430, such as various insert molding approaches, rivet-like fasteners, a screw, and the like. The secured end 410 of the ring 402 is preferably rotatably disposed within the channel 436 to permit rotation of the ring 402 relative to the shaft 430. Therefore, the means by which the ring 402 is associated with the shaft 430 is preferably a means, such as an appropriate oriented rivet-like fastener, that permits such rotatability, even more preferably frictional rotatability to prevent loose rotation of the ring 402.

The exemplary binding device 400 preferably includes various features for biasing the ring 402 into an open position, in which the free end 408 thereof is dissociated from the ring engaging portion 428. More specifically, the device 400 preferably includes a biasing means that causes the shaft 430 to rotate away from the ring engaging portion 428 to thereby separate the free end 408 from the ring engaging portion 428. Relative to the biasing means, the shaft 430 preferably includes a projection 444 on which the biasing means acts. More specifically, the projection 444 preferably extends transversely from the shaft 430 at an approximate 90 degree angle relative to the receiving channel 436. It is to be appreciated, however, that the biasing means is an optional element of the present invention and may suitably be omitted therefrom.

The base 404 preferably also includes the arms 432, 434 for rotatably securing the shaft 430 thereto. The arms 432, 434 are preferably disposed along an end of the base 404 top surface 422, and extend upward therefrom. Additionally, the arms 432, 434 are preferably spaced apart and generally parallel relative to each other so as to define a space therebetween for rotatable disposition of the shaft 430. Further thereto, the arms 432, 434 preferably include on their inner surfaces (i.e., surfaces of the arms 432, 434 that face each other and the space therebetween) shaft-receiving portions and/or features generally complementary in shape to the ends of the shaft 430 for securely retaining the shaft 430 therewith.

The base 404 of the present invention preferably also includes the ring engaging portion 428 for, inter alia, releasably engaging the free end 408 of the ring 402. In general, the ring engaging portion 428 provides a surface against which the free end 408 and/or hook 412 thereof may engage to prevent free dissociation of the free end 408 from the base 404 and to maintain the ring 402 in a closed configuration. The ring engaging portion 428 is preferably disposed atop the base 404 top surface 422 and generally distal thereon to the ring interfacing portion 426. The portion 428 preferably includes an aperture-like opening 450 into which the ring 402 free end 408 suitably is disposed while the ring 402 is in a closed configuration. The aperture 450 generally provides a lip-like catch that operates to retain the free end 408 once so associated.

Figure 13:
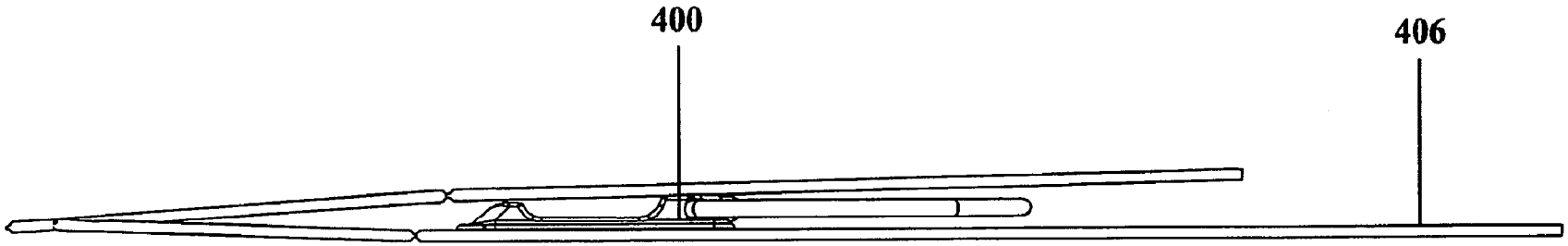
FIG. 13 is a side elevational view of an exemplary ring binder using the exemplary binding device of FIGS. 12A-12E associated therewith, wherein the ring binder is in a collapsed configuration.

FIG. 13 illustrates an exemplary binder using the exemplary collapsible binding device 400. FIG. 13 is a side plan view of the ring binder 406 and the binding device 400, wherein the binder device 400 is in a collapsed configuration inside the binder 406. In other words, the free end 408 of the ring 402 is dissociated from the ring engaging portion 428, the shaft 430 is outwardly rotated to dispose the ring 402 in generally abutting relationship with the binder 406, and the ring 402 is rotated so as to in its entirety lay flushly against the binder 406. As evident, the width of the binder 406 is substantially decreased by orders of magnitude when the devices 400 are disposed in the collapsed configuration. As known to one of ordinary skill in the art, such width decrease provides numerous supply chain advantages, such as reduced space requirements for shipping, retail display, consumer-based storage and use, and the like. Although the binder devices 400 are shown as being affixed to the back cover exemplary binder 426, as with the other exemplary embodiments herein, the binder device(s) 400 may be secured to the front cover, the back cover, or the spine of exemplary binders. Similarly, the front cover, the back cover, and/or the spine of exemplary binders may be divided into various portions, e.g., with hinges.

Figure 14A:
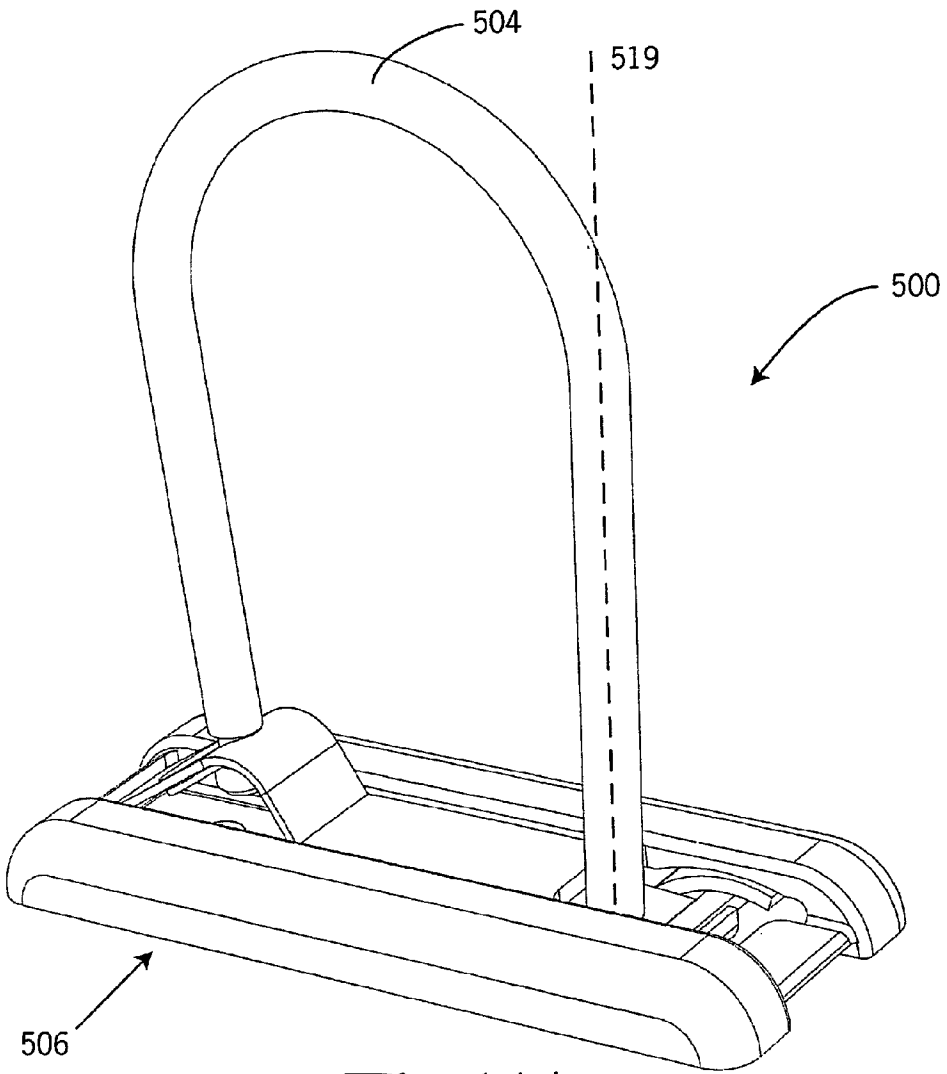
FIG. 14A is rear perspective view of yet another exemplary binding device for a ring binder, wherein the binding device is in a closed and upright configuration.

FIGS. 14A-14O illustrate an exemplary binder device 500 according to an embodiment of the present invention. As will be more fully described hereinafter, the binder device 500 is preferably (the term "preferably" is used herein to indicate exemplary structure of specific exemplary implementations and does not mean "necessarily") provided as a ring-bearing member adapted to be secured to a casing either alone or in a tandem array with other binder devices 500. For example, a casing may suitably feature a single binder device 500, thereby providing a single ring binder. By way of additional example, a casing may suitably feature two or three binder devices 500, thereby providing a two or three ring binder. The exemplary binder mechanism 500 illustrated may be used in exemplary binders often referred to as archival type binders (e.g., FIGS. 15A-15E). In general, a binder may be configured to feature any number of binder devices 500, and the present invention is not to be construed as limited to the exemplary arrangements provided herein.

Each binder device 500 is shown as an independent element. In contrast to conventional ring binders wherein the rings thereof collectively act together as a single unit, the illustrated binder device 500 is actuable (e.g., openable, closable, collapsible, etc.) separately from adjacent binder devices 500 of a binder. Thus, with reference to an exemplary casing incorporating three binder devices 500, when a user wishes to bind documents together, the user opens each individual binder device 500, positions the rings through the holes in each document, and then re-closes each individual binder device 500. Similarly, each binder device 500 is separately collapsible, as will be more fully described hereinafter. In the alternative, the binder devices may be modified so that the rings may be closed in unison.

Figure 14B:
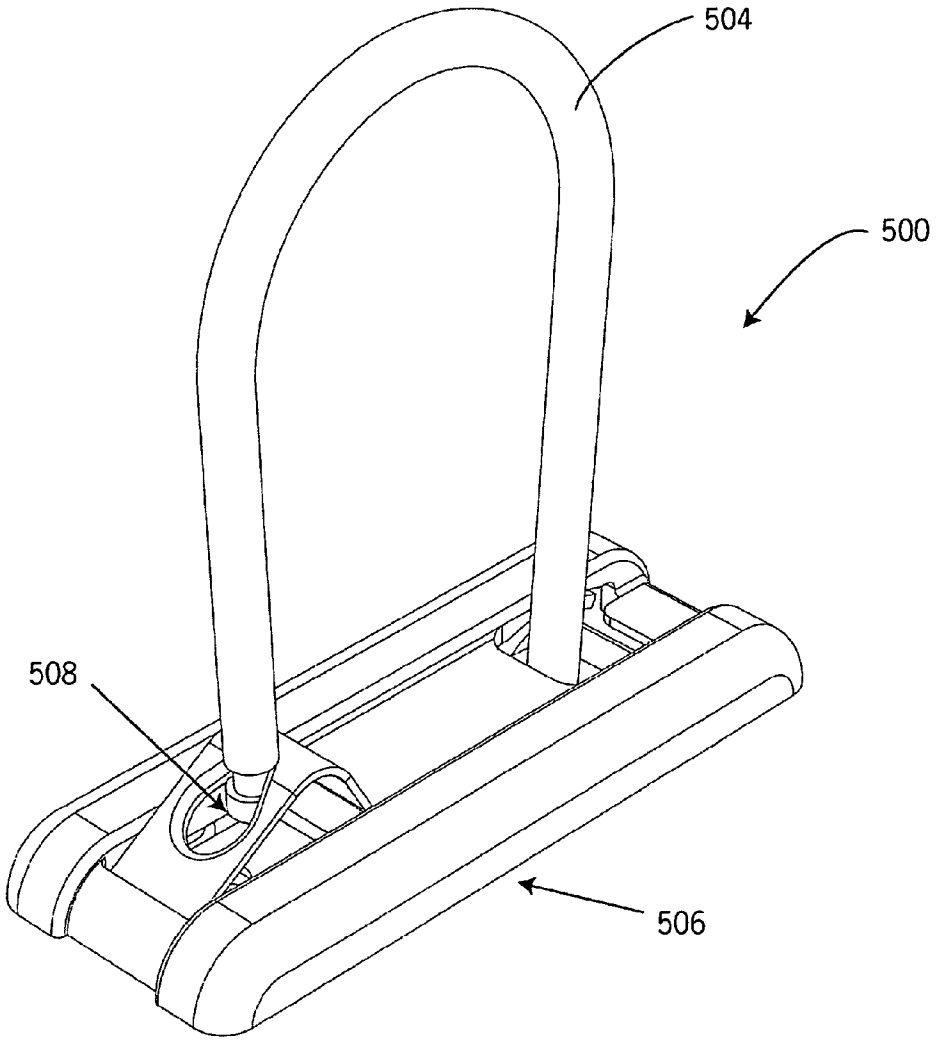
FIG. 14B is a front perspective view of the exemplary binding device of FIG. 14A.

With continued reference to FIGS. 14A and 14B, the binder device 500 generally includes a binding ring 504 and a ring base 506. The ring 504 is movably secured to the base 506. The ring 504 binds documents and other suitable configured, articles (e.g., media storage pages, photograph storage pages, etc.) to the device 500 by extending through holes formed through the documents and articles. A free end 508 of the ring 504 engages with and is fastened to the ring base 506, thereby closing the ring 504 and preventing separation of documents from the device 500. Accordingly, the ring 504 is adapted to move relative to the base 506 between a closed configuration for binding documents and an open configuration for adding/removing documents to/from the ring 504. Additionally, the ring base 506 may secure the ring 504 to a casing (e.g., FIGS. 15A-15E) such that the ring 504 may be opened and closed, and disposed in either an upright or a collapsed configuration.

Figure 14C:
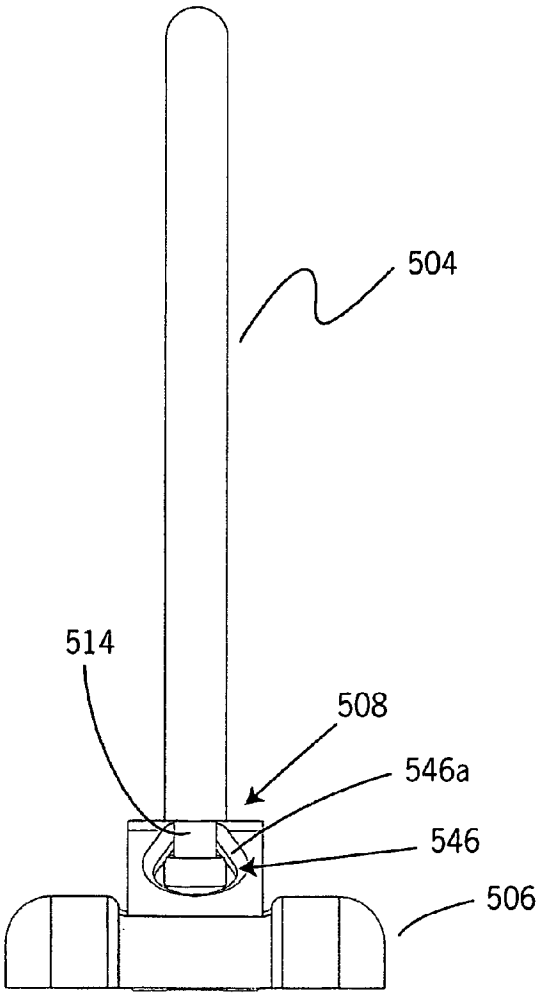
FIG. 14C is a front elevational view of the exemplary binding device of FIGS. 14A-14B.
Figure 14D:
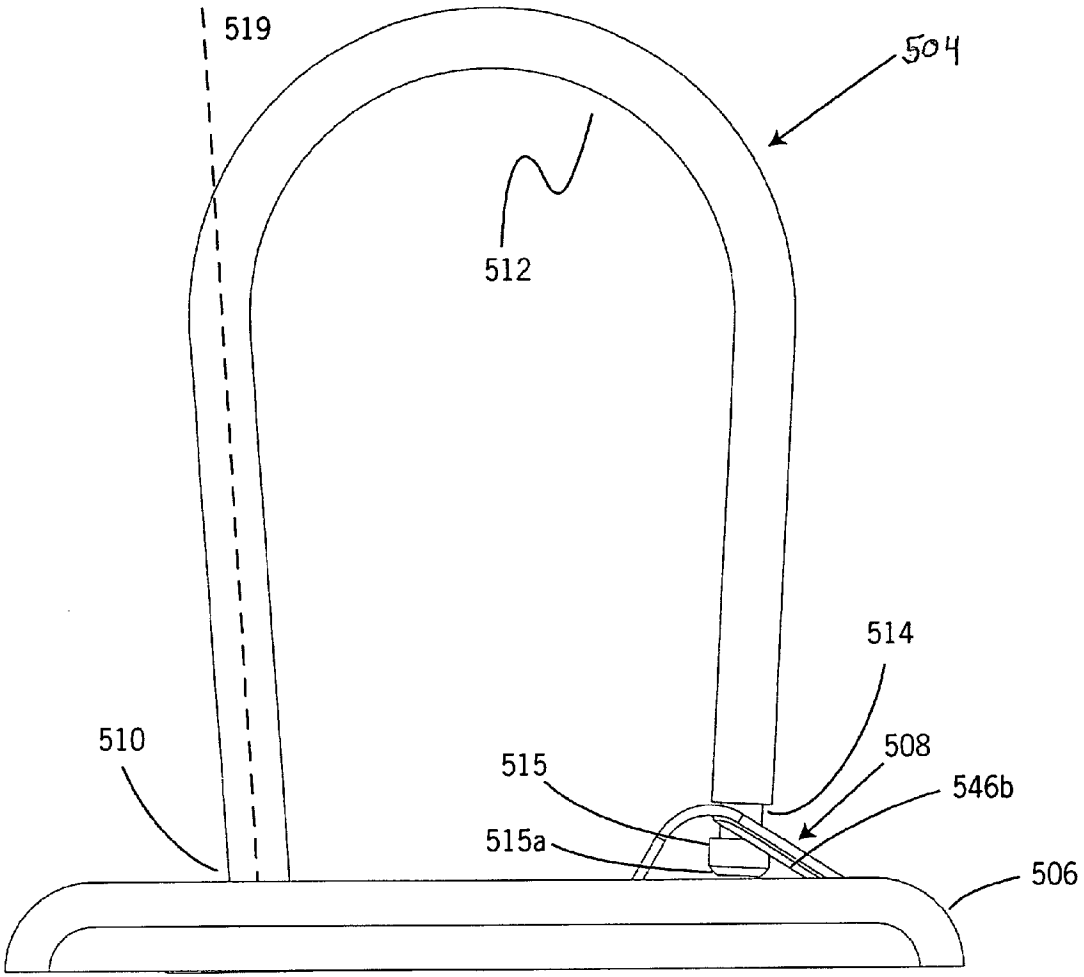
FIG. 14D is a side elevational view of the exemplary binding device of FIGS. 14A-14C.
Figure 14E:
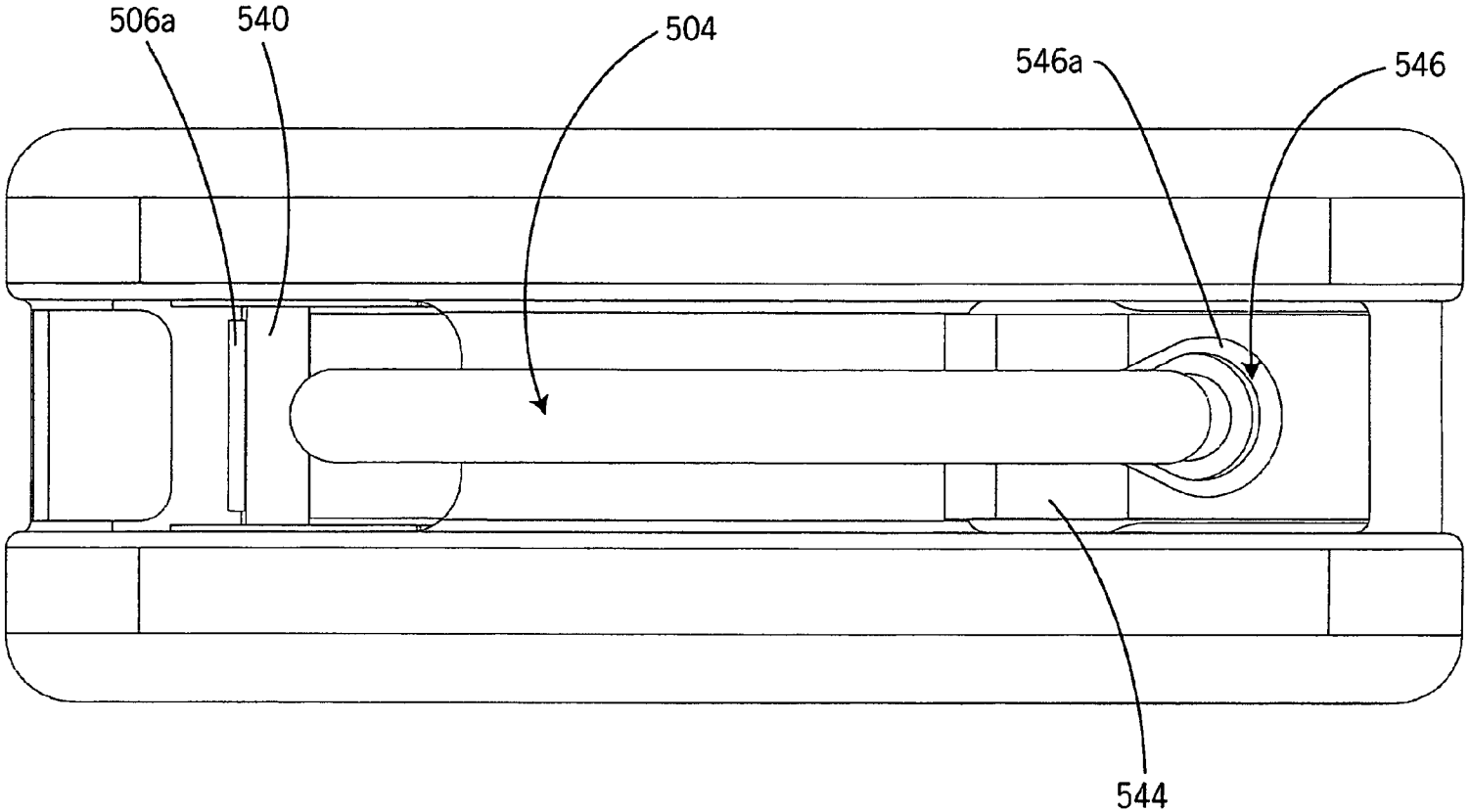
FIG. 14E is a top plan view of the exemplary binding device of FIGS. 14A-14D.

As shown in FIGS. 14C and 14D, the ring 504 may be configured as a generally unitary structure having a first free end 508, a second secured end 510, and an arcuate portion 512 interconnecting the ends 508, 510. The exemplary ring 504 shown is generally U-shaped and circular in cross-section. Thus, in contrast to rings of some conventional ring binders that typically include two opposed arcuate structures that move relative to each other, the exemplary ring 504 is preferably configured as a unitary U-shaped structure movable relative to the base 506 as a unit. The use of the unitary structure of the ring 504 avoids the ring alignment problems associated with some split-ring conventional binders.

The first end 508 is generally adapted to releasably engage and be fastened to the ring base 506 for opening and closing of the ring 504. The first end 508 may be adapted to engage the ring base 506 through any suitable mechanism, preferably a mechanism that permits the first free end 508 to repeatedly engage with (and fasten to) and disengage from (and be unfastened from) the base 506. In a preferred embodiment, the first end 508 includes a narrow portion proximate a distal wider portion, such as circumferentially reduced portion 514 (formed, e.g., by an annular groove or by one or more channels in the free end of the ring) that, as described below, is adapted to securely engage a connector 509 or another complementary fastening structure on the base 506. More specifically, the circumferentially reduced portion 514 leaves a distal wider portion 515 of the free end 508 of the ring 504, which distal wider portion 515 is fastened in aperture 546.

Figure 14F:
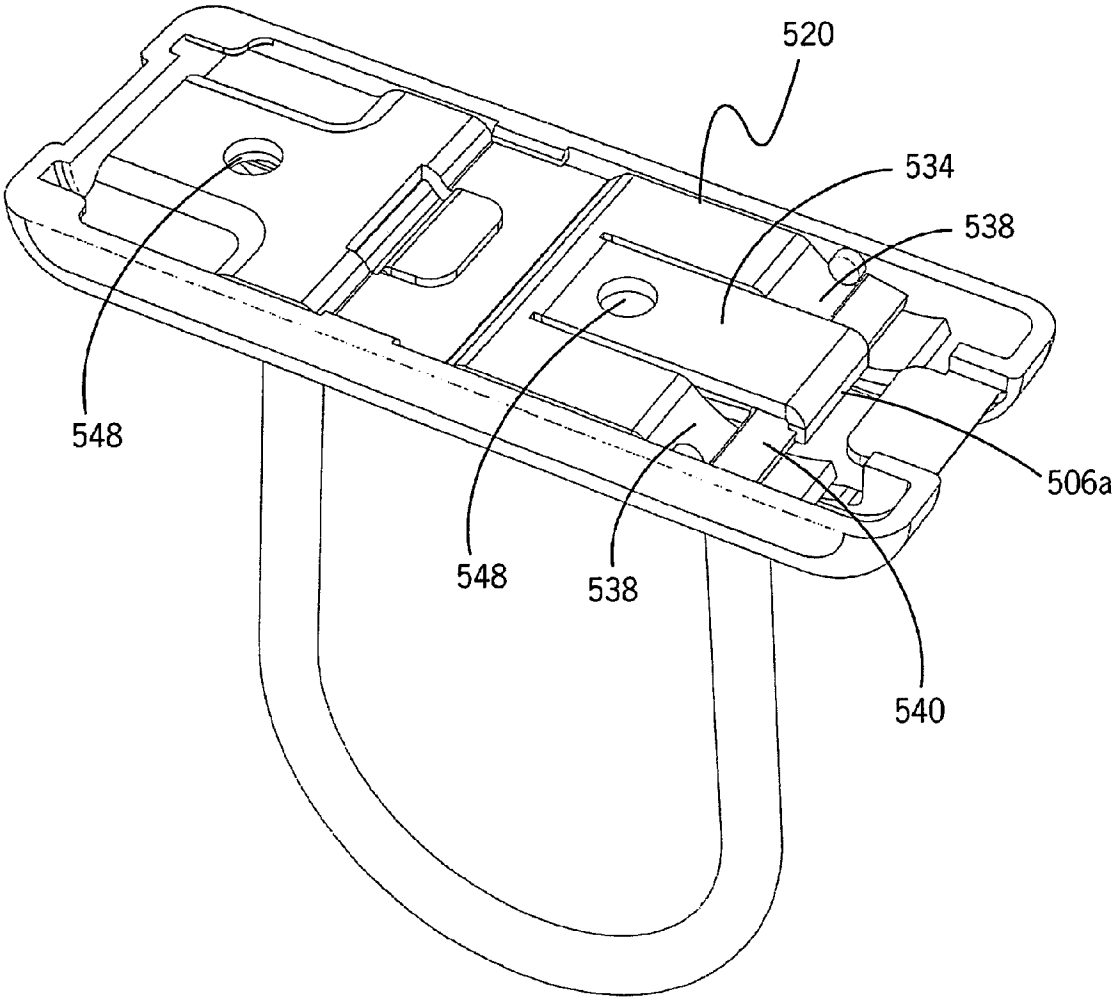
FIG. 14F is a bottom rear perspective view of the exemplary binding device of FIGS. 14A-14E.
Figure 14G:
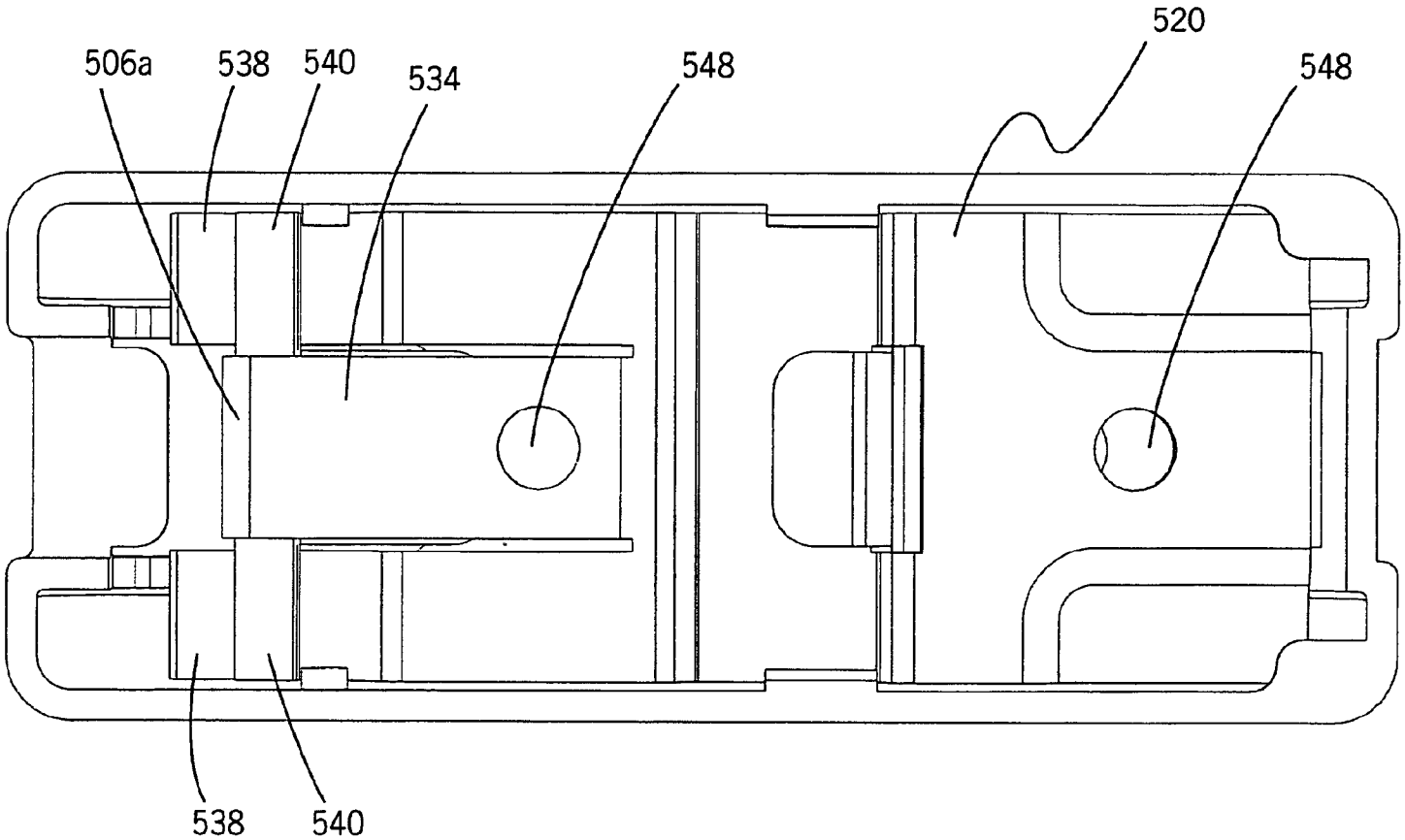
FIG. 14G is a bottom plan view of the exemplary binding device of FIGS. 14A-14F.
Figure 14H:
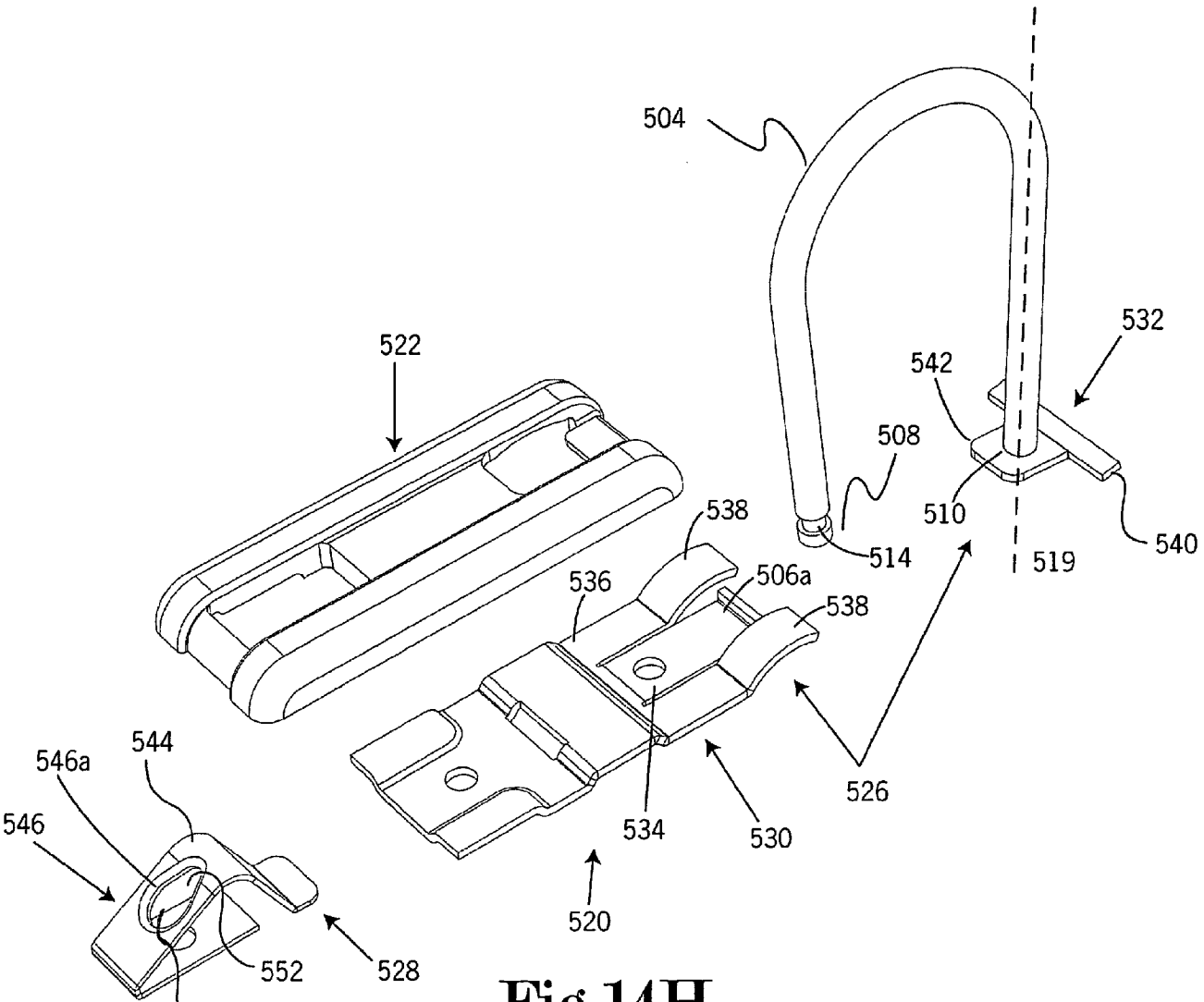
FIG. 14H is a top perspective exploded view of the exemplary binding device of FIGS. 14A-14G.
Figure 14I:
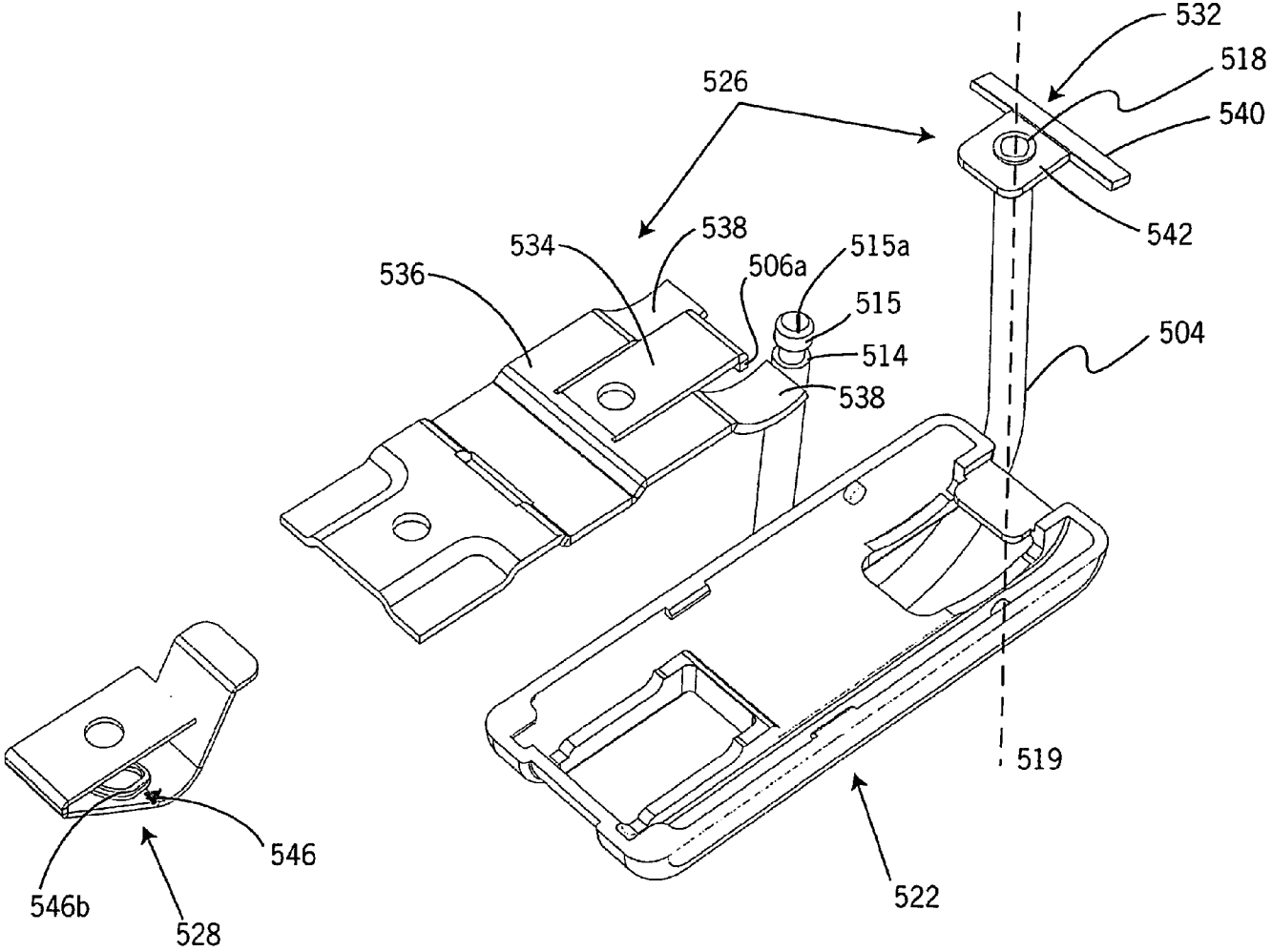
FIG. 14I is a bottom front perspective exploded view of the exemplary binding device of FIGS. 14A-14H.
Figure 14J:
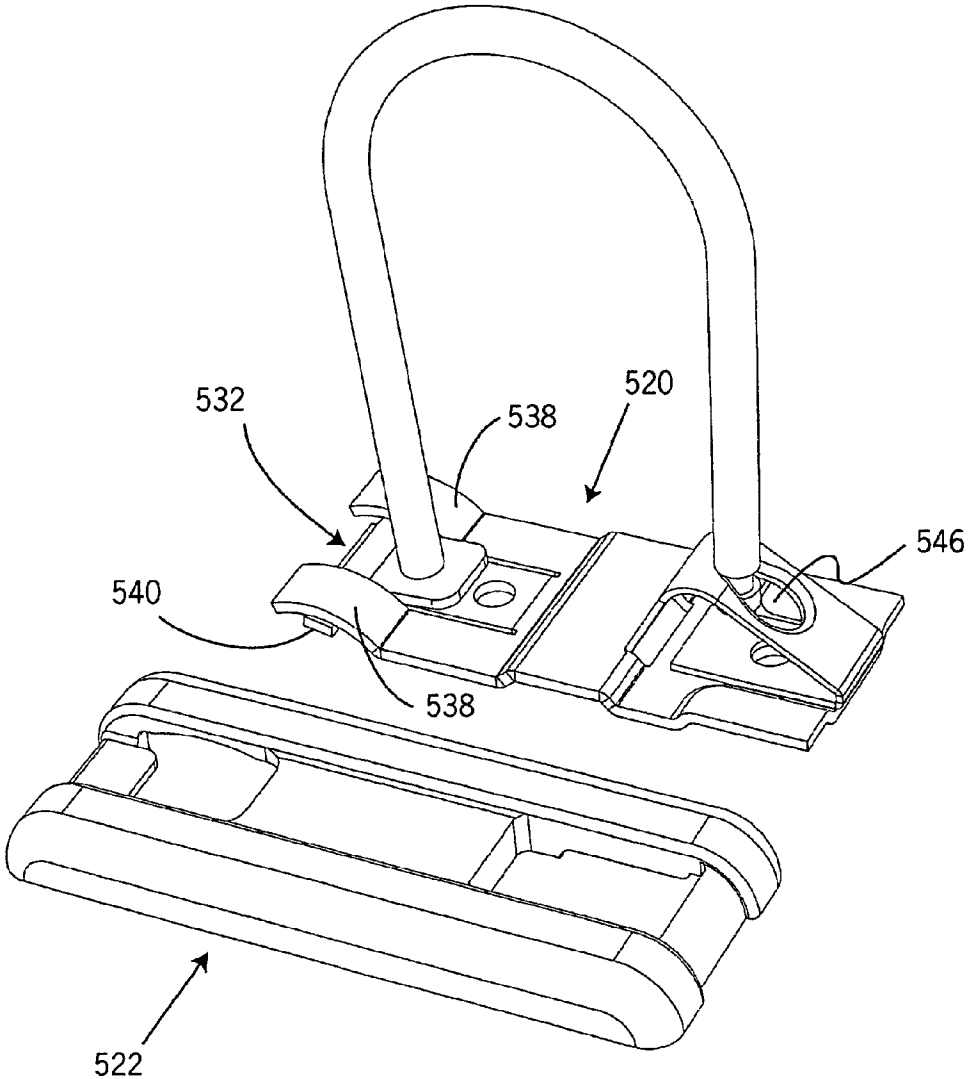
FIG. 14J is a front perspective view of the exemplary binding device of FIGS. 14A-14H, wherein the housing is separated from the binding device.
Figure 14K:
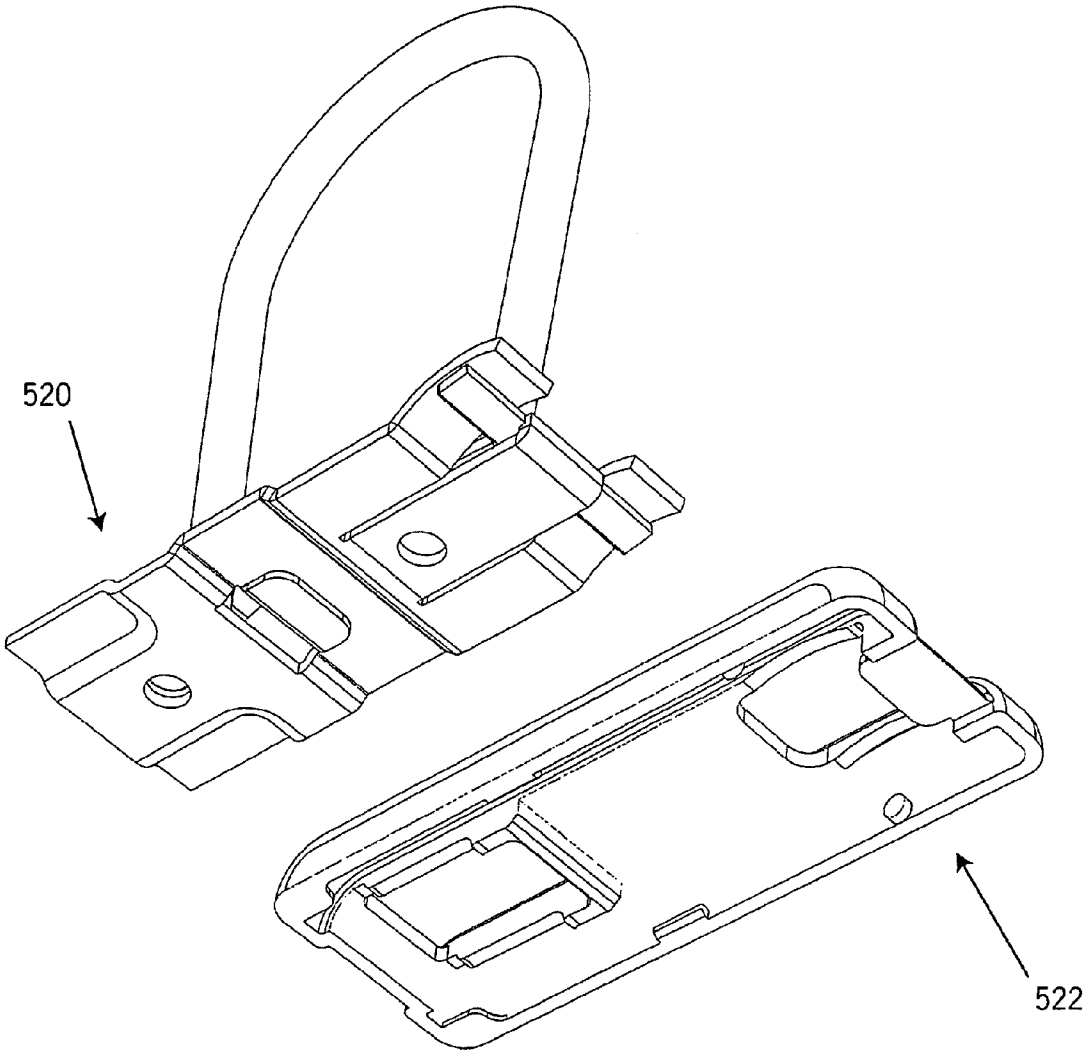
FIG. 14K is a bottom rear perspective view of the exemplary binding device of FIGS. 14A-14J, wherein the housing is separated from the binding device.

While the first free end 508 of the ring 504 is adapted to releasably engage the base 506, the second end 510 in this exemplary embodiment is generally adapted to remain in constant engagement with the base 506 to anchor the ring 504 to the base 506. As best shown in FIGS. 14H-14J, a fastener 518 (e.g., a threaded screw, a rivet, etc.) generally secures the second end 510 of the ring 504 to a ring support member 532. The ring support member 532 in this exemplary embodiment is "T" shaped with a transverse bridge 540 and a shoulder 542 extending from a midportion of the bridge 540 (FIG. 14H and 14I). The fastener 518 allows the ring 504 to rotate relative to the base 506 about an axis of the second end 510 (e.g., axis 519). More specifically, in this exemplary embodiment (as well as all the exemplary embodiments herein), the fastener (or other connection between the base and the secured end of the ring) may be configured permit the ring to rotate relative to the base about an axis of the secured end of the ring in response to a user grasping the ring and moving the ring about that axis relative to the base, but the fastener may secure the ring tightly enough (and/or provide sufficient friction) to prevent the ring from moving relative to the base about that axis merely under the force of gravity acting on the mass of the ring. In the alternative, swedging may be used in this embodiment (and in the other embodiments, as appropriate). More specifically to this embodiment, for example, the second (secured) end 510 of the ring 504 may be swedged to the ring support member 532 and provide the functionality mentioned immediately above with respect to the fastener holding the ring to the ring support member. In any event, the coupling between the secured end 510 of the ring 510 and the ring support member 532 may optionally be configured to allow the ring to swing into position, with the free end of the ring aligned with the aperture, and then stop in that desired position to allow fast and easy alignment. This may be accomplished with a detent (e.g., cooperating structures on the end 510 of the ring and on the ring support member) in that position. A detent may be optionally be used in the open and the two closed positions. Any one or more such detents may be used in virtually any of the embodiments herein. In any event, it may be desirable to have a certain friction on this joint to allow easy alignment without the stopping action so the parts stay in position all together while loading documents or other articles into a binder and don't move around while loading. Various aspects of the second end 510 and the means by which it remains secured to the base 506 will be more fully described hereinafter.

Returning to a general discussion of the overall configuration of the ring 504, the ring 504 is preferably configured in a generally loop-like or "U" shape that facilitates manipulation of documents bound in the device 500. The loop configuration generally provides a path through which the documents may pass in a book-like page-turning manner.

Furthermore, the ring 504 is preferably constructed of a resilient, somewhat flexible material, such as a polymer, a metal, spring steel, an alloy, and the like. Thus, in operation, when the first end 508 and/or circumferentially reduced portion 514 is engaged with the base 506, the ring is flexed as the first end 508 is moved or generally pulled away from the second end 510 to disengage the first end 508 from the base 506 and permit opening of the ring 506. When the first end 508 is released, the ring 504 elastically returns to its resting state configuration by virtue of the flexibility of the ring 504. In the alternative, the base may be configured so that the first end 508 is generally pulled toward the second end 510 to disengage the first end 508 from the base 506 and permit opening of the ring 506.

The base 506 in this exemplary embodiment is generally rectangular and includes a structural member 520 (FIGS. 14J-14L) and a housing 522 (FIGS. 14H-14K). As will be more fully explained hereinafter, in this example the structural member 520 generally enables the functionality of the ring base 506, while the housing 522 is generally adapted to be disposed about the ring base 506 and increase the aesthetic appeal of the same. Of course the base 506 may be constructed differently and have many different configurations.

Turning now to the base 506 structural member 520 and FIGS. 14H and 14I, the exemplary structural member 520 generally includes a ring securing portion 526 and a ring engaging portion 528. The ring securing portion 526 is generally a component of the structural member 520 that is configured to secure the ring 504 and retain the same to the base 506.

The exemplary ring securing portion 526 preferably includes a base portion 530 and a ring support member 532. The exemplary base portion 530 is generally a structure adapted to movably support the ring support member 532. The ring support member 532 is generally a structure to which the ring 504 is secured. With continued reference to FIGS. 14H and 14I, the exemplary base portion 530 is provided as a generally planar member with a central planar portion 534, a flange 536, and a pair of arcuate portions 538. The central planar portion 534 generally provides a surface relative to which the ring support member 532 pivots, as will be more fully explained hereinafter. The flange 536 preferably extends about a front edge and portions of side edges of the central planar portion 534, as generally shown in FIG. 14H, and is preferably slightly vertically offset relative to the central planar portion 534. The arcuate portions 538 are preferably disposed generally parallel to the longitudinal axis of the base 506, and extend rearward from terminal portions of the flange 536. The positioning of the arcuate portions 538 generally creates a channel defined by bottom faces of the arcuate portions 538 and a top face of the central planar portion 534, in which channel the ring support member 532 is generally pivotally disposed. A tab 506*a* extends upwardly from the central planar portion 534. The tab 506*a* is positioned to abut the transverse bridge 540 and stabilize the ring support member 532 when the ring support member 532 is in its closed or open positions.

Turning now to a discussion of the ring support member 532, and as previously mentioned, the ring support member 532 generally provides a structure to which the ring 504 is secured, and which enables the ring 504 to move for, e.g., ring 504 opening, closing, collapsing, etc. The ring support member 532 is preferably "T" shaped with a transverse bridge 540 and a shoulder 542 extending from a midportion of the bridge 540 (FIGS. 14H and 14I). The bridge 540 is preferably a generally rectangular planar member having a longitudinal dimension sufficient to enable opposite ends of the bridge 540 to be disposed within the arcuate portions 538. The exemplary ring support member 532 preferably also includes the shoulder 542 that extends from a side edge of the bridge 540 and generally transverse to the longitudinal axis of the bridge 540. The shoulder 542 is preferably a generally rectangular planar member that (in this exemplary embodiment) provides a substrate to which the ring 504, preferably the second end 510 thereof, is secured. More specifically, the shoulder 542 preferably includes a bore that permits the fastener 518 to pass therethrough. As best shown in FIGS. 14H and 14I, the ring 504 second end 510 is preferably flushly disposed against the shoulder 542. The fastener 518 (e.g., a threaded screw, a rivet, etc.) preferably extends through the shoulder 542 bore and into the ring 504 (e.g., into a threaded bore, a non-threaded bore, etc.), thereby physically securing the ring 504 to the shoulder 542. Accordingly, the fastener 518 connects the ring 504 to the base 506 via the ring support member 532 and arcuate portion 538.

According to one embodiment, the fastener 518 and the ring support member 532 to which it is attached are provided in a manner that permits the ring 504 to rotate relative to the base 506 about an axis of the fastener 519. As will be more fully explained hereinafter, the ring 504 is collapsible by first disengaging the ring 504 first end 508 from the base 506, pivoting the ring 504 rearward, and then rotating the ring 504 so that it comes into general abutting contact with the casing. The use of a rivet as the fastener 518 suitably provides a means by which the ring 504 may rotate relative to the base 506. However, it is to be appreciated that any suitable means may be employed for enabling the rotatability of the ring 504. Accordingly, the ring 504 second end 510 is preferably rotatably retained relative to the shoulder 542 so that the ring 504 may be repeatedly rotated relative thereto.

Figure 14L:
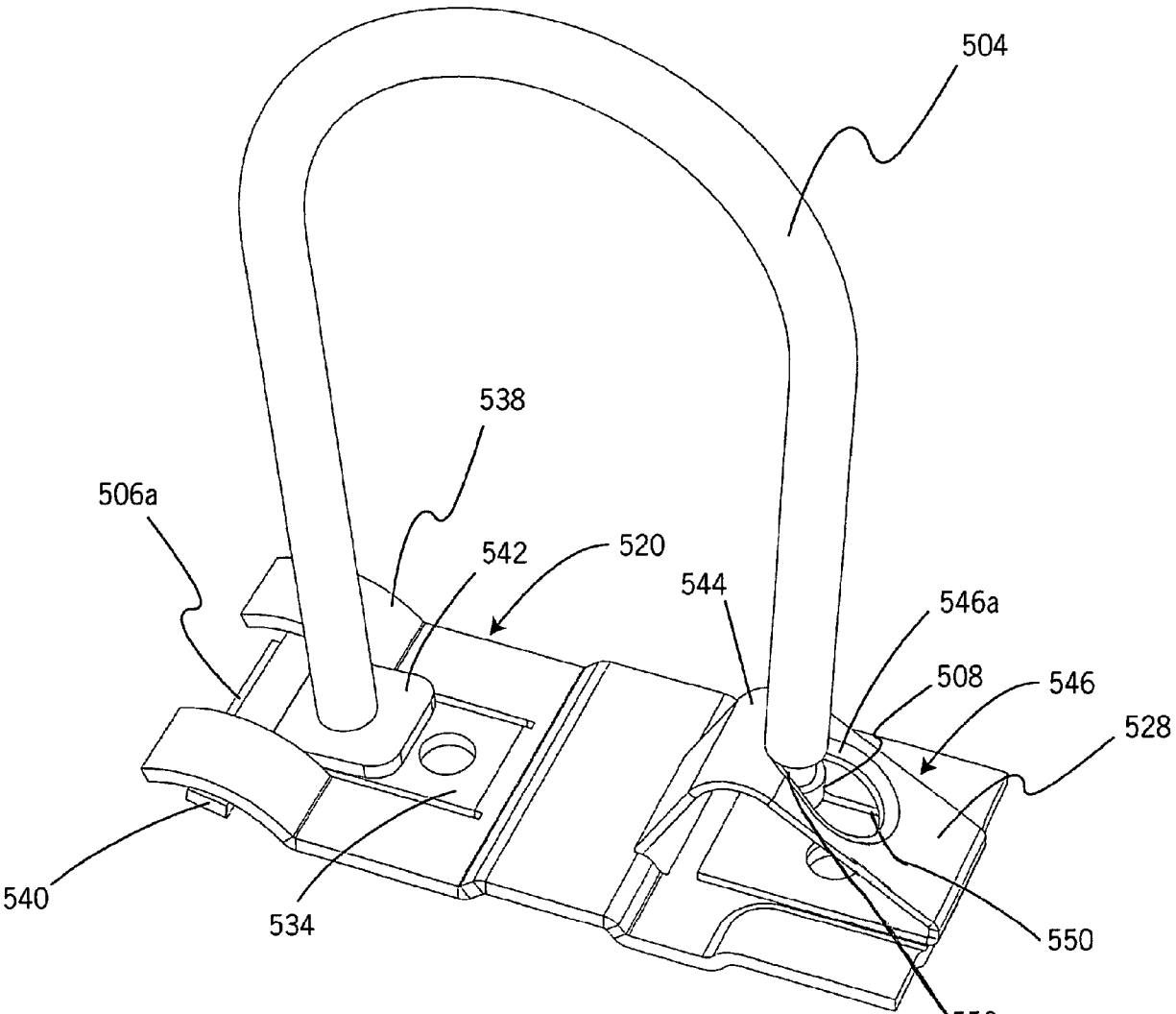
FIG. 14L is a front perspective view of the exemplary binding device of FIGS. 14A-14K, wherein the housing is removed from the binder device.

With continued reference to the ring support member 532, the shoulder 542 and bridge 540 are preferably provided as a unitary structure. Even more preferably, the shoulder 542 and the bridge 540 are angularly offset relative to each other. With best reference to FIGS. 14H-14J and 14L, the bridge 540 is preferably disposed at an upward angle relative to the shoulder 542. For example, FIG. 14L illustrates the ring 504 in an upright and closed configuration in which the shoulder 542 rests in substantially abutting contact with the central planar portion 534. In this state, the bridge 540 preferably slopes upward away from the shoulder 542. Thus, when the ring 504 first end 508 is disengaged from the base 506 and the ring 504 is pivoted rearward, the bridge 540 begins to rotate within the arcuate portions 538 along a rotational axis generally parallel to the bridge 540 longitudinal axis. In addition, once the first end 508 of the ring 504 is disengaged from the base 506, it will remain suspended at a certain distance above the base 506 until rotated by the user. This is a neutral position or at rest position of the ring 504, similar to that discussed above in the context of the exemplary embodiment of FIGS. 1A-1D. Thereafter, as the ring 504 continues to be pivoted rearward, the bridge 542 rotates within the arcuate portion 538 until side faces of the bridge 542 simultaneously contact both the central planar portion 534 and bottom surfaces of the arcuate portions 538. Further, the arcuate portions 538 are preferably dimensioned with a vertical profile that is slightly reduced relative to the width of the bridge 542, and are also preferably constructed of a flexible material (e.g., spring steel, etc.). Accordingly, once the bridge 542 contacts both the central planar portion 534 and the arcuate portions 538, the relatively reduced vertical profile of the arcuate portions 538 provides an impediment or resistance to the free rotation of the bridge 540 relative to the base 506. Applied force to continue the pivoting of the ring 504 suitably overcomes the impediment by causing the arcuate portions 538 to flex, thereby permitting the bridge 540 to continue its rotation within the arcuate portions 538 and dispose the ring 504 in a fully pivoted and collapsed configuration. The rotation impediment suitably provides a biasing effect that urges the ring 504 to remain in either an upright configuration or a collapsed configuration, absent a force directing the ring 504 otherwise.

The structural member 520 also includes the ring engaging portion 528, which acts as a connector that fastens the free end of the ring to the base. As previously mentioned and as best shown in FIGS. 14H-14J and 14L, the ring engaging portion 528 generally provides a structure against which the ring 504 first end 508 is releasably fastened for ring 504 opening and closing. In a preferred embodiment, the ring engaging portion 528 generally includes a face 544 (FIG. 14H) that is angularly offset relative to the generally horizontal structural member 520, and which face 544 is adapted to engage the ring 504 first end 508 for securely fastening and thus closing the ring 504. Even more preferably, a front edge of the face 544 is disposed in proximity to a front portion of the structural member 520, with the remainder of the face 544 extending upward therefrom. Additionally, as best shown in FIG. 14H, the face 544 preferably includes an aperture 546 therein, into which aperture 546 the ring 504 first end 508 is fastened. The aperture 546 may be stamped so as to form a rounded edge 546*a* on the top of face 544 (which may help guide the free end 508 of the ring 504 into the aperture 546) and a ridge 546*b* on the underside of face 544 (which may help retain the flared distal end 515 of the ring 504). In a preferred embodiment, the aperture 546 is defined by a lower wider portion 550—shown here as a circular portion—and an upper channel portion 552 that is narrower than the wider portion 550 and that extends from the lower wider portion 550. As such, the aperture 546 has what may generally be considered to be a keyhole type configuration. As previously mentioned, the ring 504 is preferably configured generally cylindrically. Accordingly, in operation, when a user wishes to dispose the ring 504 in an upright and closed configuration, the user pivots the ring 504 upward and ensures that the ring 504 first end 508 is in general proximity to the ring securing portion 528. Thereafter, the user pulls the first end 508 away from the second end 510 (suitably possible because of the flexible nature of the ring 504) and then releases the first end 508 into the aperture 546 lower circular portion 550. The specific aperture 546 shown (FIG. 14H) has a lower portion 550 that accepts the flared distal portion of the free end 508 and that is generally a section of a circle that tapers tangentially to an upper portion 552 that engages and fastens the circumferentially narrower portion and that is generally a section of a relatively smaller circle. Preferably, but not necessarily, the face 544 and upper channel portion 552 of the keyhole opening 546 may be configured so that a user desiring to dispose the ring 504 in an upright, fastened and closed configuration need only pivot the ring 504 upward, ensure that the ring 504 free end 508 is positioned generally over the aperture 546, and push down on the ring 504 (or rotate the ring by its top so the free end moves toward the face 544). In this scenario, as the ring 504 is pushed down (or rotated), the flared distal end of the free end 508 rides down the face 544 until a portion of the flared distal end enters the upper channel portion 522 at which time the flared distal end rides in the channel thereby moving the free end 508 away from the secured end 510 as the ring 504 is pushed further down (or rotated further) until the flared distal end 515 enters the lower portion 550, at which time, the ring may be released with the free end 508 fastened in the closed position by the aperture 546, the distal end 515 of the free end 508 of the ring 504 may be rounded or tapered, e.g., at 515*a*. Again, as the ring is released by the user, because of the resilient nature of the ring 504, the first end 508 rearwardly biases toward the second end 510, thereby bringing the ring's circumferentially reduced portion 514 within the aperture 546 upper channel portion 552. When the ring 504 first end 508 is so engaged with the upper channel portion 552, the ring 504 remains in an upright and closed configuration, thereby preventing release of documents from the ring 504.

To disengage the first end 508 from the ring engaging portion 528 so as to move the ring 504 into its open position, the user pulls the first end 508 away from the second end 510 so that the first end 508 can be pulled out of the aperture 546. Alternatively, a release clip may facilitate disengagement of the first end 508 from the ring engaging portion 528.

The binder device 500 structural member 520 preferably also includes various means that enable the member 520 to be secured to a binder casing. As best shown in FIGS. 14F and 14G, the structural member 520 includes at least one aperture 548 that permits a fastener, such as a rivet, to pass therethrough and fasten the device 500 to the casing. In a preferred embodiment, the member 520 includes an aperture 548 disposed through the central planar portion 534 thereof, and another aperture 548 disposed through a forward portion of the member 520, generally in proximity to the face 544 aperture 546. In this configuration, the fastener apertures 548 are spaced apart relative to each other, thereby reinforcing the device 500 against physical dislocation relative to the casing when secured thereto.

Figure 14M:
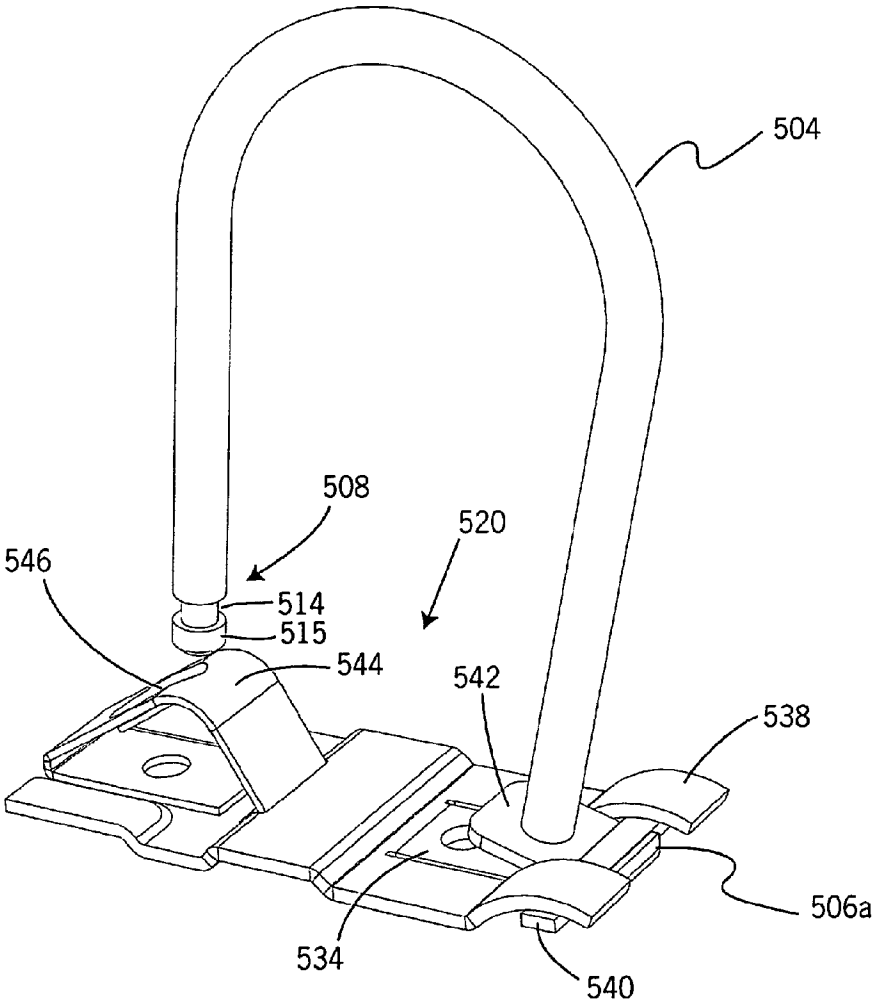
FIG. 14M is a rear perspective view of the exemplary binding device of FIGS. 14A-14L, wherein the housing is removed from the binder device and the ring is in an open and upright position.
Figure 14N:
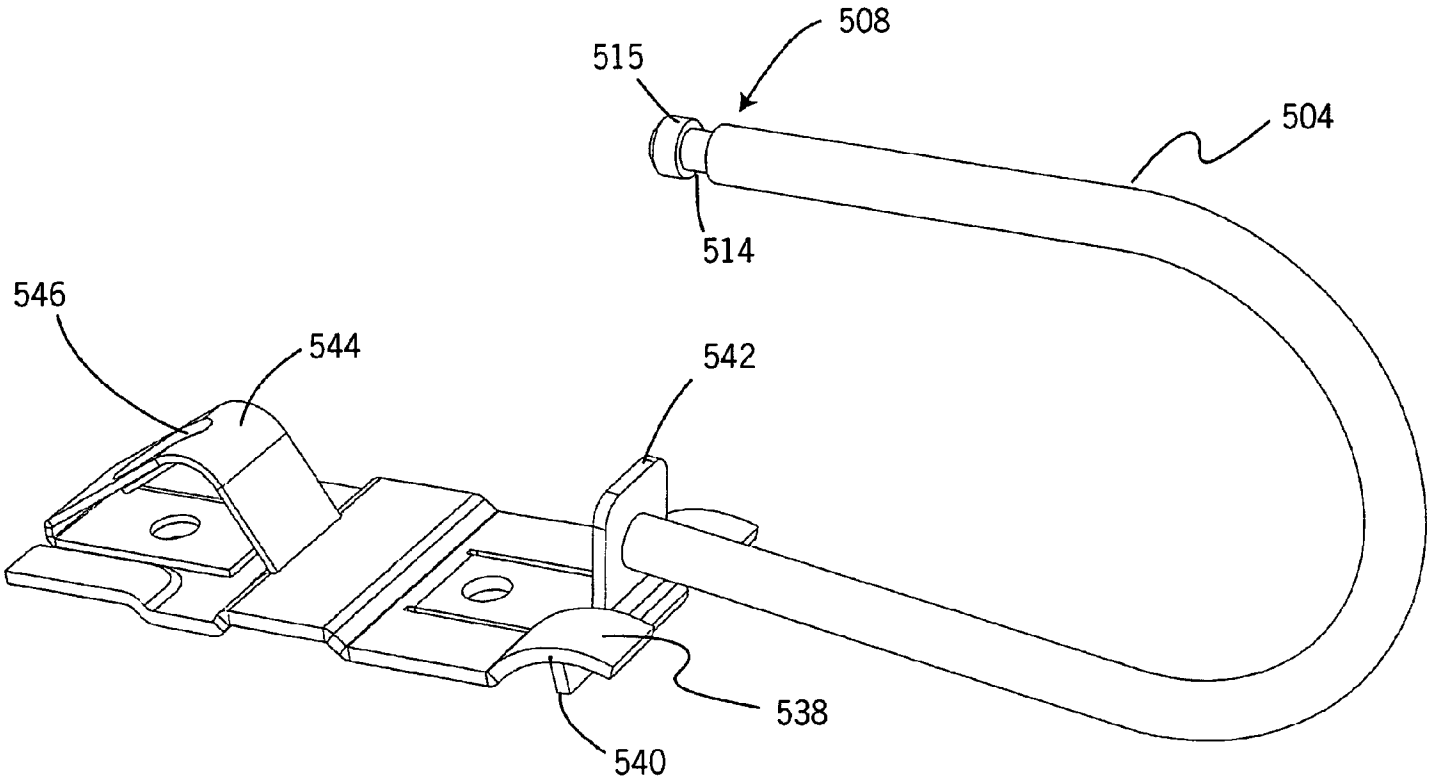
FIG. 14N is a rear perspective view of the exemplary binding device of FIGS. 14A-14M, wherein the housing is removed from the binder device and the ring is in an open position.
Figure 140:
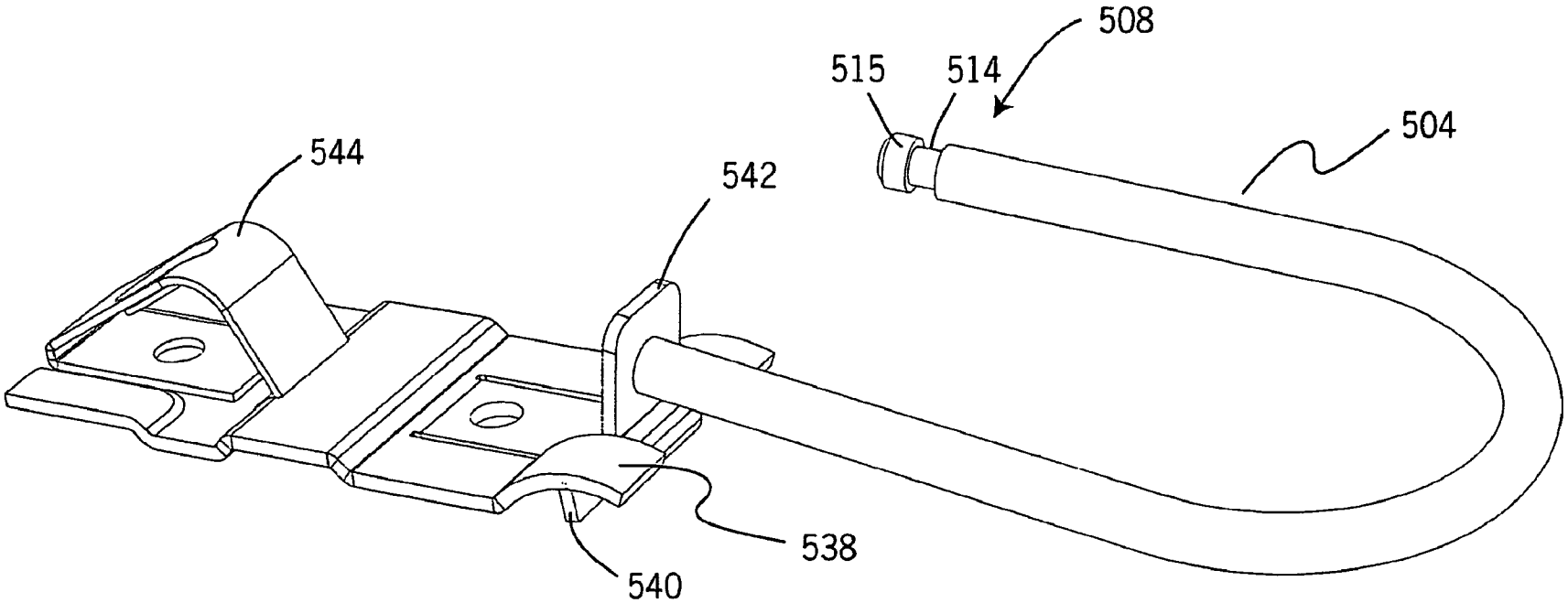

The ring 504 may be moved from the collapsed position of FIG. 14O into the fastened and upright position of FIGS. 14A-14G and 14L via the positions of FIGS. 14N and 14M. More specifically, the ring may be moved from the position of FIG. 14O to the position of FIG. 14N, then moved from the position of FIG. 14N to the position of FIG. 14M, and then moved from the position of FIG. 14M to the upright, fastened, and closed position of FIGS. 14A-14G and 14L. The position of FIG. 14M in this embodiment is a neutral position or at rest position that the ring 504 assumes naturally after the free end 508 of the ring 504 is unfastened from base connector 544, 546 and released. The distal end 515 of the free end 508 of the ring 504 is spaced from the base connector 544, 546 in the position of FIG. 14M, which may facilitate loading documents or other articles into a binder utilizing one or more binder devices 500. In this embodiment, the ring 504 is spring-biased into the position of FIG. 14M, as discussed above, such that a slight force (or larger force) is required to move the ring 14 toward either the position of FIG. 14N or the position of FIGS. 14A-14G and 14L. Similarly, the secured end 510 of the ring 504 may be coupled to the base 506 in such a manner that a slight force (or larger force) is required to move the free end 508 of ring 504 out of alignment with the base connector 544, 546. The slight forces (or larger forces) discussed herein are intended to mean a force stronger than the force gravity applies via the mass of the ring 504 in the orientation(s) shown.

In the exemplary embodiment of FIGS. 14A-14O, the free end 508 of the ring 504 is fastened to the base 504 and the ring(s) may be locked in the upright position (e.g., 90 degrees or about 90 degrees with respect to a surface—such as a binder casing portion—supporting the base) thus giving strength to the structure. The pivotal nature of this mechanism provides additional strength to the rings. Implementations using this embodiment may be configured so that the rings in a closed, fastened, and upright configuration together can support the weight of a loaded binder (e.g., the binders of FIGS. 15A-15I) standing upright on edge. Once the free ends 508 of the rings 504 are unfastened from the base, they may be weak but when locked (fastened), the rings may be configured to be firmly fastened, resisting all directions of force acting on the top of the ring. In this exemplary embodiment, the ring 504 is flexed during fastening and the load that is exerted to fasten the rings may help to lock the rings in place, permitting the rings to resist forces in all directions acting on the top of the ring, i.e., the rings to not become unfastened from the base. From the orientation of FIG. 14D, pushing the top of the ring down causes the free end 508 to bottom out against the upper surface of the base portion 530; pushing the top of the ring to the left or pulling up on the ring urges the narrow portion 514 and wider distal end 515 into further engagement with the edge of the narrow portion 552 of the aperture 546; pushing the top of the ring to the right causes the free end 508 to bottom out against the upper surface of the base portion 530. Similarly, if binder mechanism 500 is attached in a binder so that documents and other articles are located on the side of the ring with the secured end 510 (the side with axis 519 in the figures), as shown in FIGS. 15A-15I below, a mass of documents or other articles would not be able to unfasten the free end 508 from the base connector 544, 546 by exerting a force against that side of the ring. Thus, even if a full binder is stood on end, or even dropped, the rings may stay in the closed, fastened, and upright configuration. Other embodiments herein may be implemented with the same functionality.

Figure 15A:
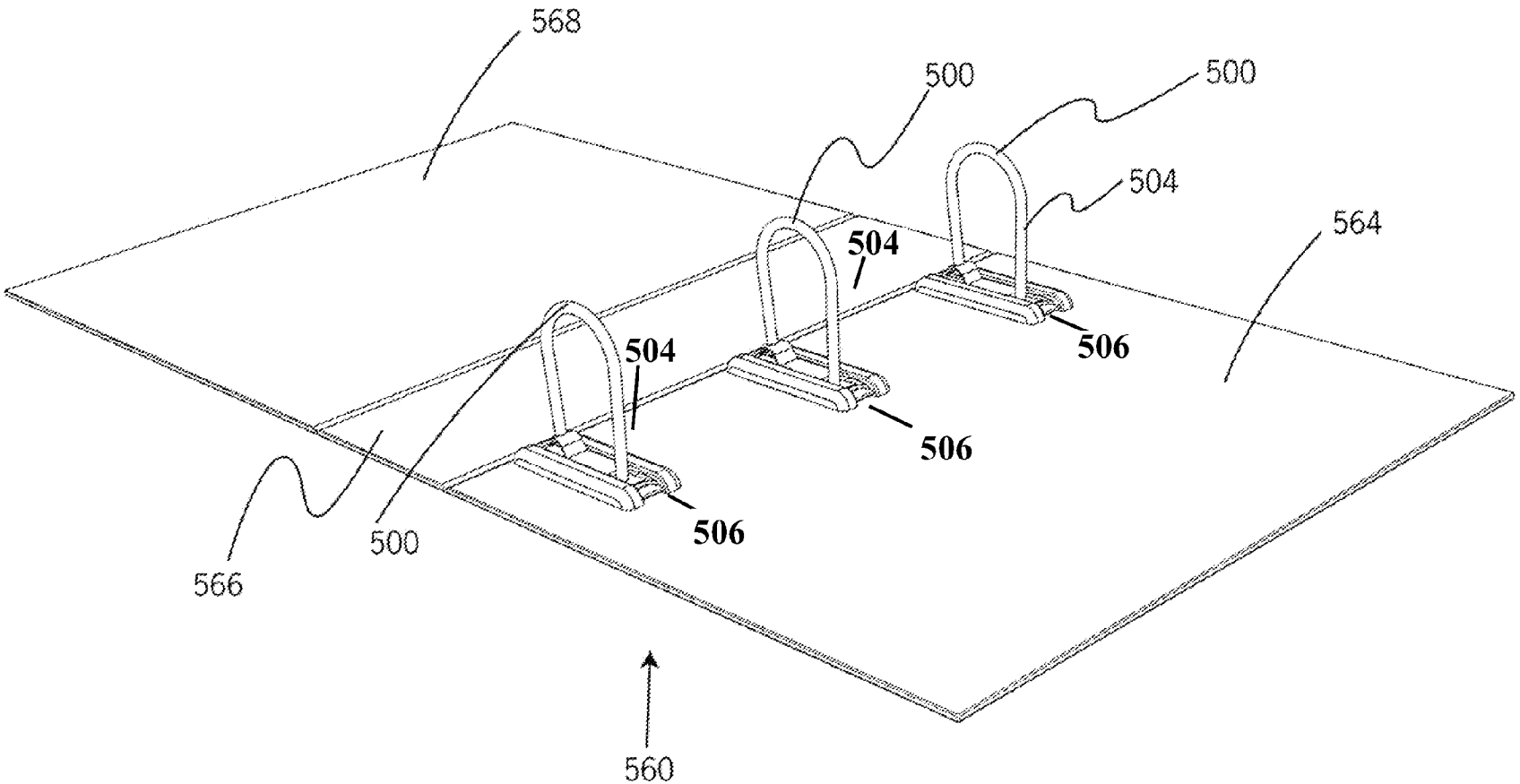
FIG. 15A is a rear perspective view of the binder device of FIGS. 14A-14O, wherein the binder device is in a closed, fastened, and upright position inside a binder.
Figure 15B:
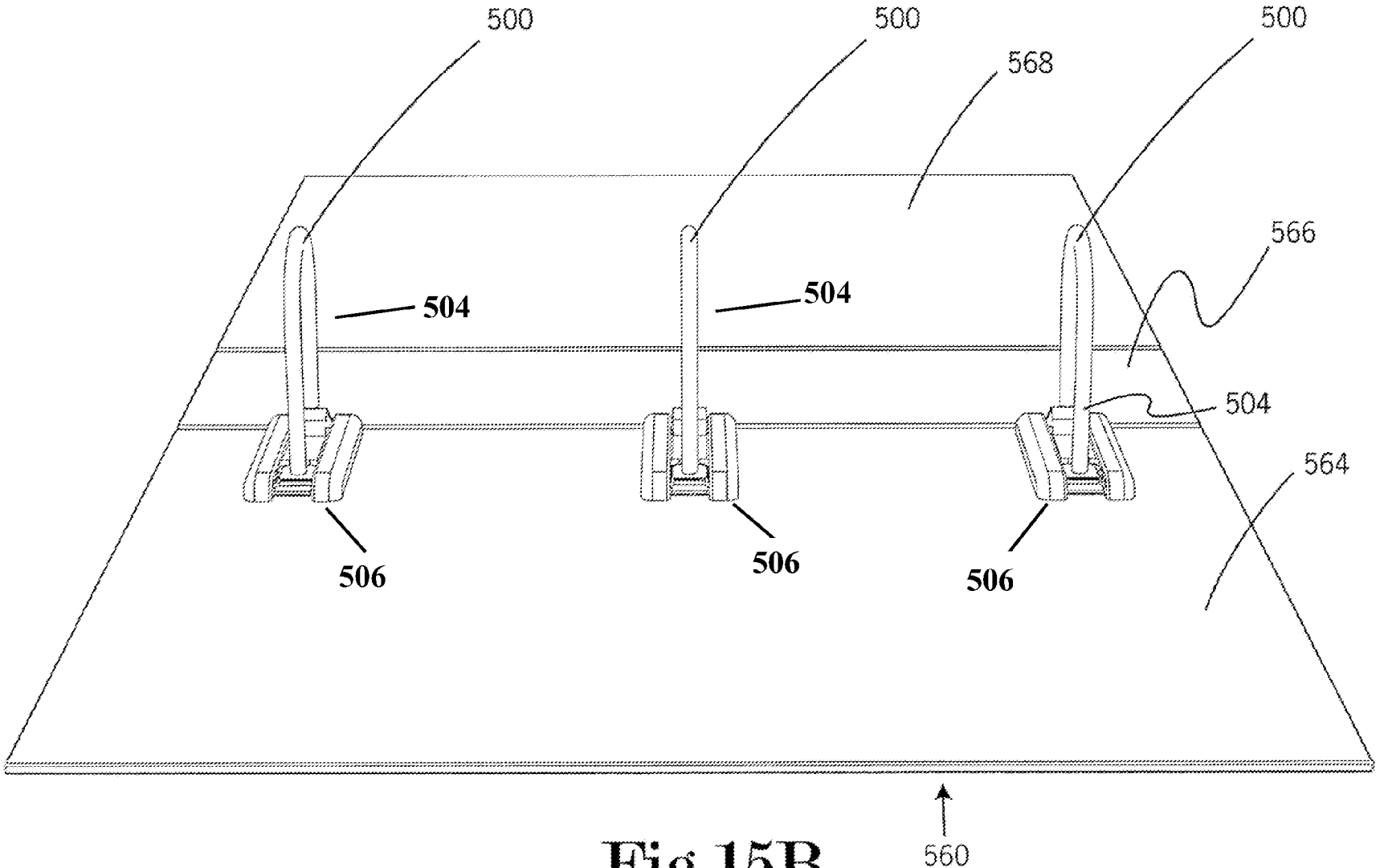
FIG. 15B is a rear view of the binder device of FIGS. 14A-14O, wherein the binder device is in a closed, fastened, and upright position inside a binder.

FIGS. 15A-15I illustrate exemplary applications of the exemplary collapsible binding device 500 shown in the FIG. 14 series of figures, wherein a plurality of the devices 500 are secured to a binder 560 for use in releasably securing articles, such as sheets of paper, thereto. FIGS. 15A and 15B illustrate an exemplary binder 560 generally including a front cover 564, a rear cover 568 and a spine 566 interconnecting the front and rear covers 564, 568 and providing for the openability of the same, and a plurality of binding devices 500 associated therewith. As evident, the binder 560 and associated binding devices 500 suitably operate in a manner generally consistent with conventional ring binders, wherein the devices 500 provide a means for releasably securing articles to the binder 560 for organization, storage and the like of the same.

FIGS. 15A and 15B illustrate an embodiment in which three binding devices 500 are associated with the binder 560. However, it is to be appreciated that any desired number of binding devices 500 may be associated with a binder. Depending on the size and configuration of the binder 560, and the general norms and customs of the society for which it is intended use, the binder 560 may feature any number of binding devices 500 associated therewith, such as one, two, three, four, five, and any other convenient and suitable number. It is also to be appreciated that any size ring 504 may be employed with the present invention, such as one inch rings 504, two inch rings 504, three inch rings 504, and the like.

FIGS. 15A and 15B also illustrate an embodiment in which the binding devices 500 are secured to the rear cover 568 of the binder 560. It is also to be appreciated that the binding devices 500 may be disposed in any suitable location on the binder 560, given the particular needs and intended application of the same. Thus, for example, the devices 500 may suitably be secured to the binder 560 front cover 564, the rear cover 568, the spine 566 or any other manner, directly or indirectly associated therewith.

It is also to be appreciated that any suitable means may be employed for securing the binding devices 500 to the binder 560. In a preferred embodiment, the device 500 base 506 includes a plurality of apertures 548 therein, as best shown in FIGS. 14F and 14G. The apertures 548, preferably present in a paired configuration, are generally disposed through the base 506 and permit a fastener to pass therethrough and fasten the device 500 to the casing. Any suitable fastener, such as a rivet, a screw, an adhesive, and the like, may be employed to secure the device 500 to the binder 560. As an optional alternative, it may be possible to mold the base or a portion of the base into position on a surface of the binder without the ring, and attach the ring and any remaining components of the base in any suitable means. It may also is also possible to insert mold the base by molding a cover over some or all of the metal components instead of adding the cover as a second part.

Figure 15C:
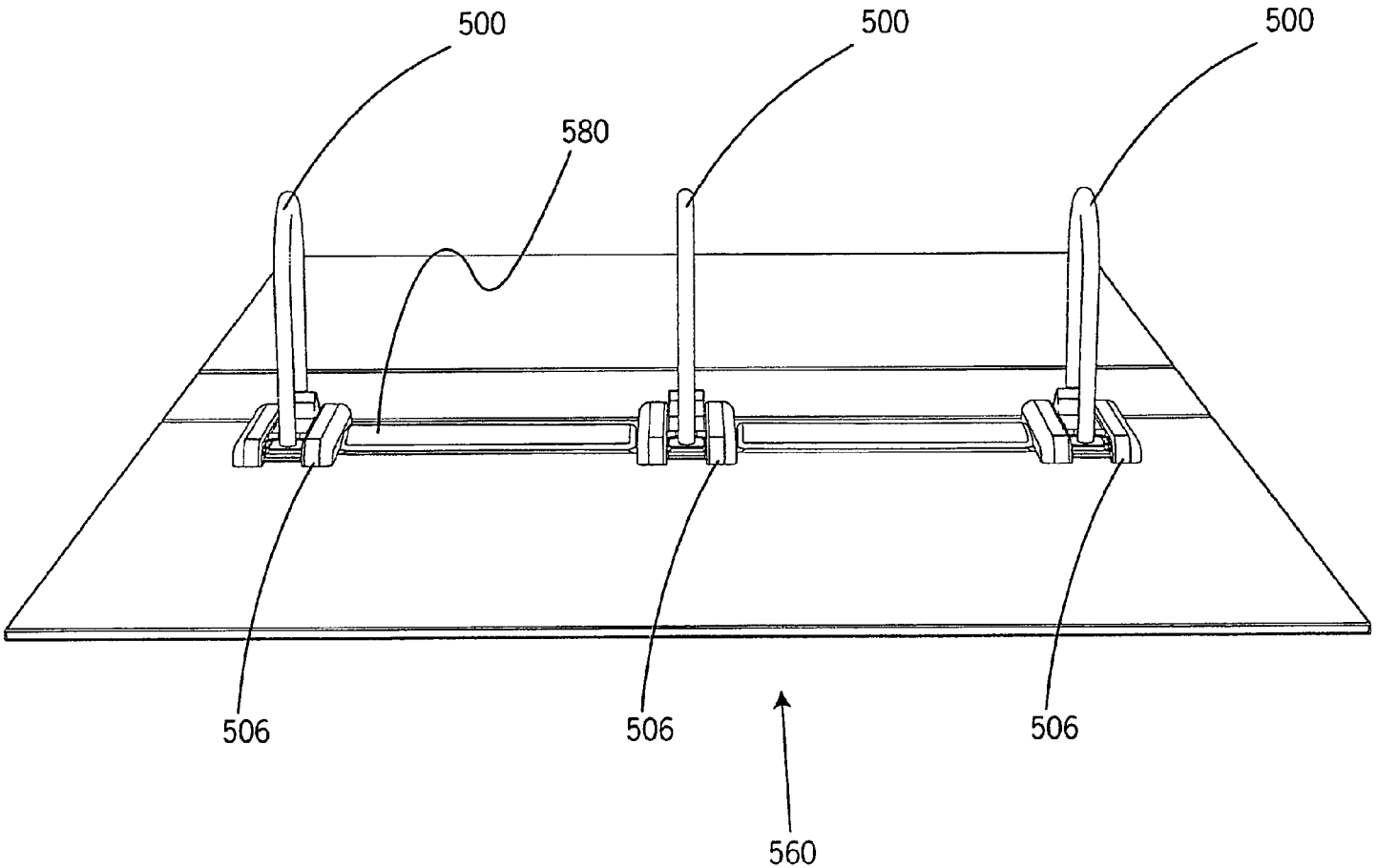
FIG. 15C is a rear view of the binder device of FIGS. 14A-14O, wherein the binder device is in a closed, fastened, and upright position, mounted on a base inside a binder.
Figure 15D:
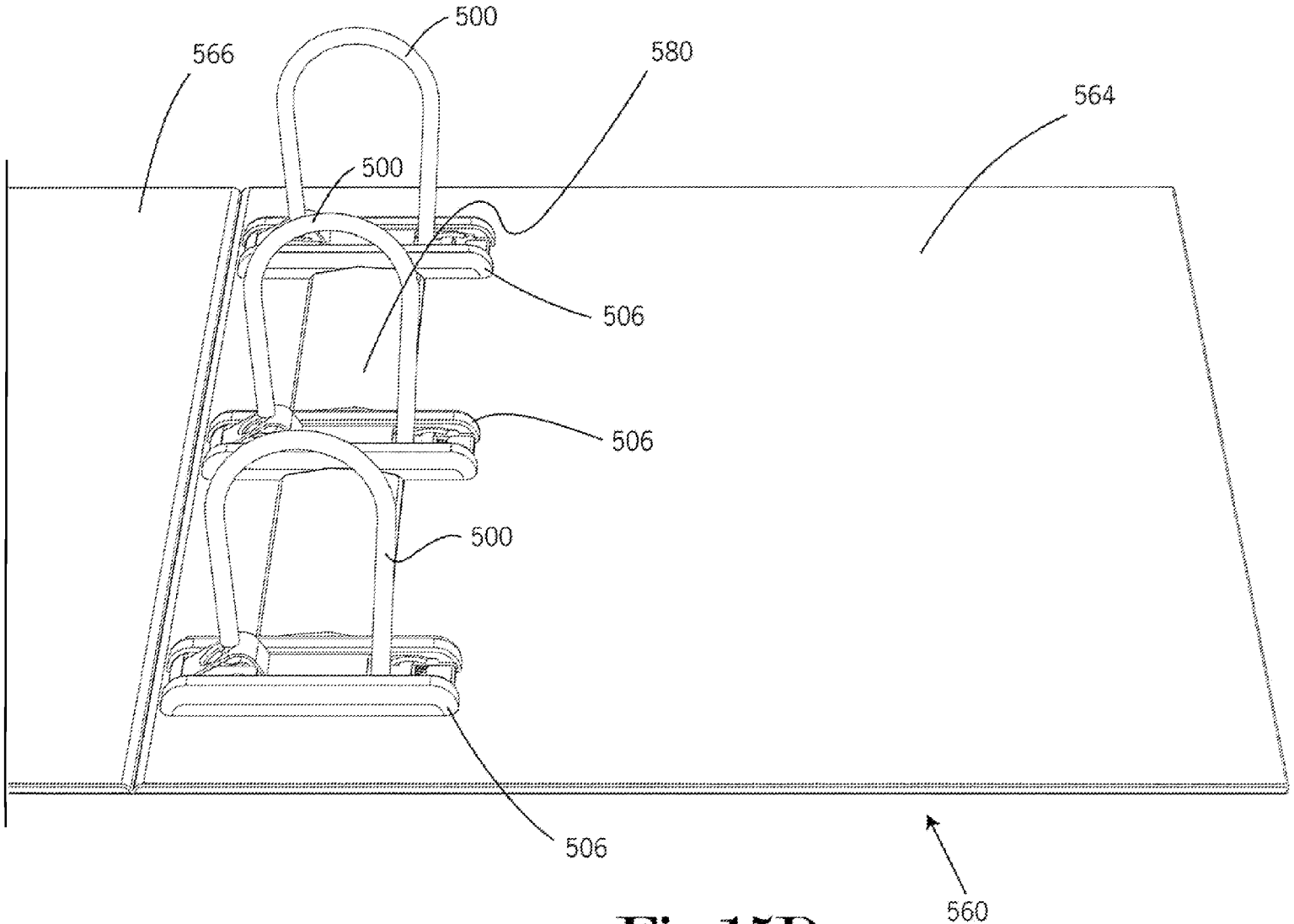
FIG. 15D is a side view of the binder device of FIGS. 14A-14O, wherein the binder device is in a closed, fastened, and upright position, mounted on a base inside a binder.
Figure 15E:
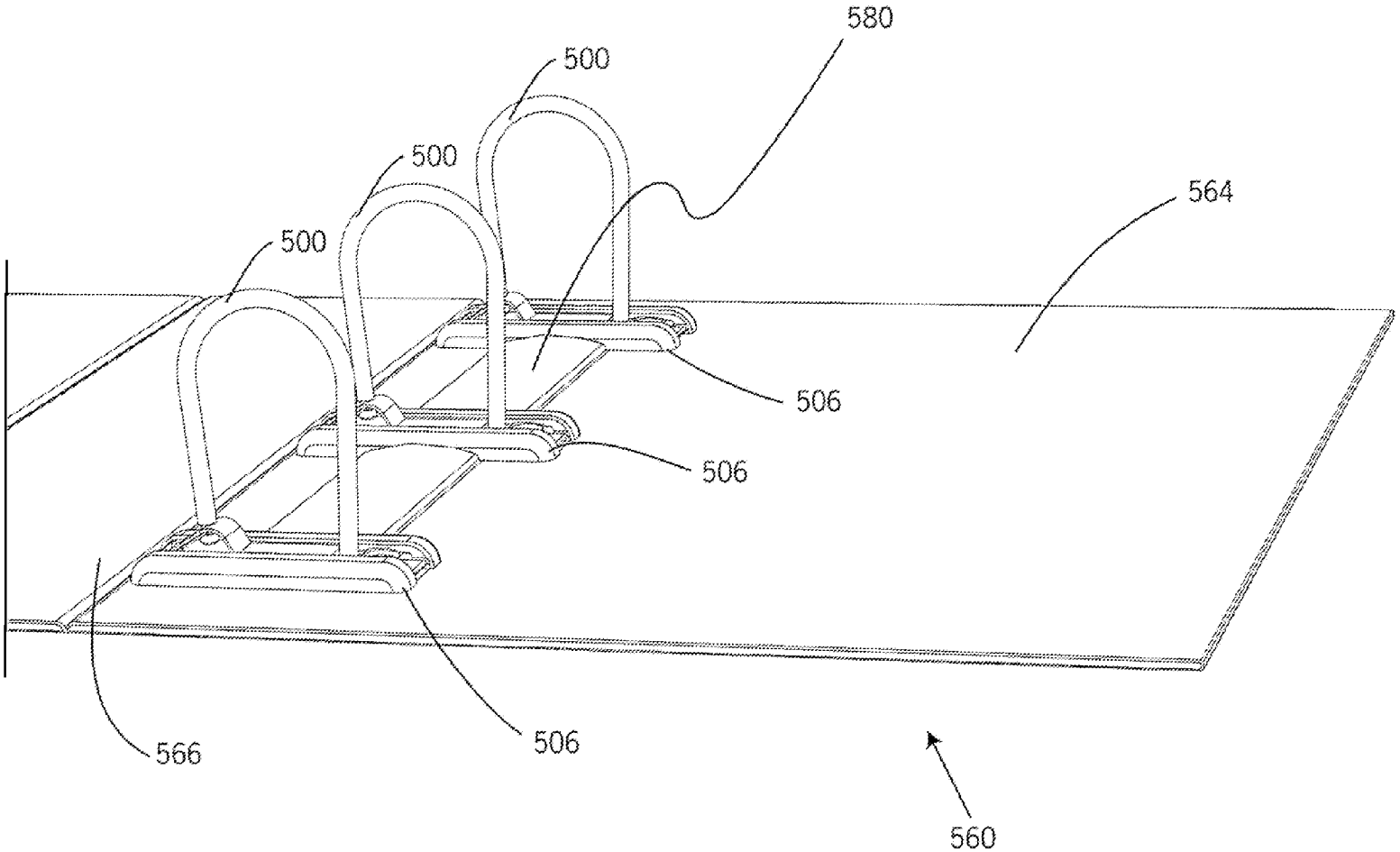
FIG. 15E is a rear perspective view of the binder device of FIGS. 14A-14O, wherein the binder device is in a closed, fastened, and upright position, mounted on a base inside a binder.
Figure 15F:
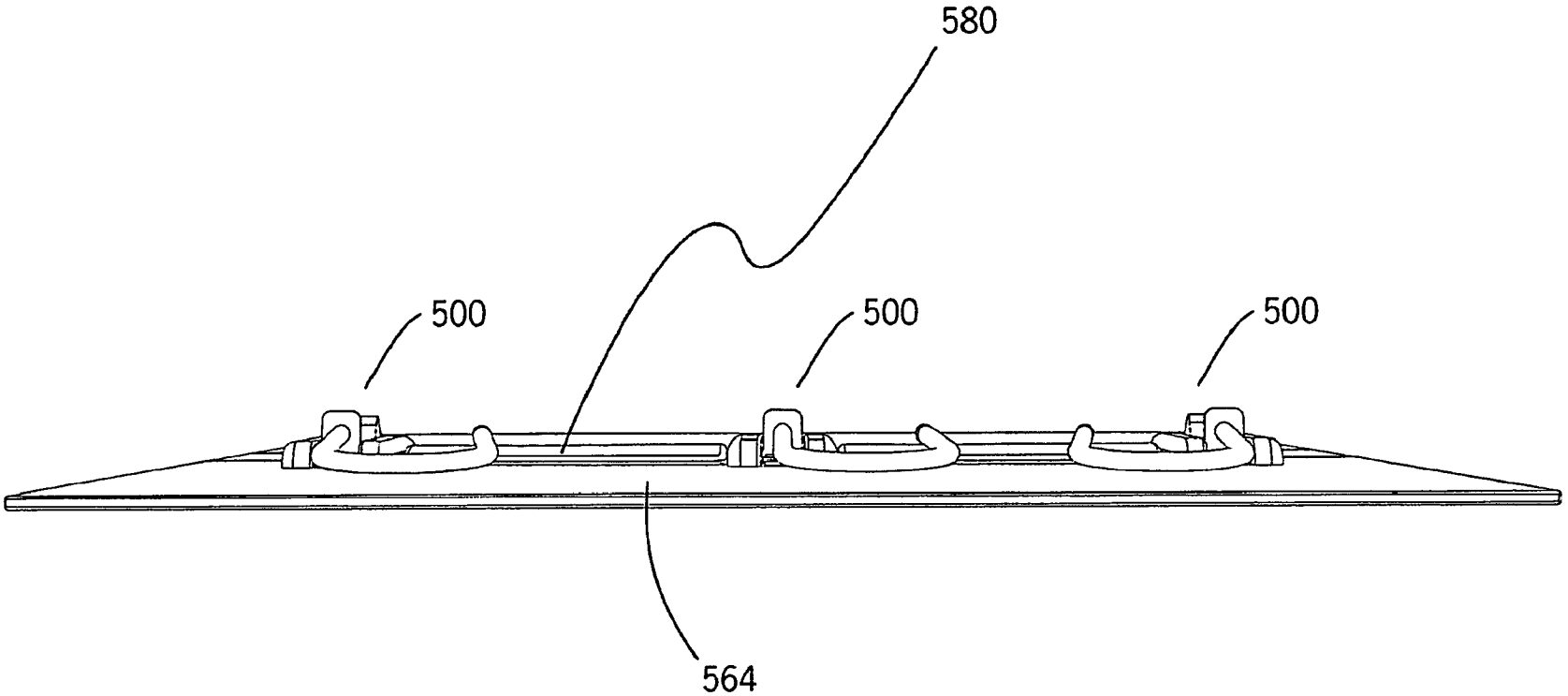
FIG. 15F is a rear view of the binder device of FIGS. 14A-14O, wherein the binder device is in an open, collapsed position, mounted on a base inside a binder.
Figure 15G:
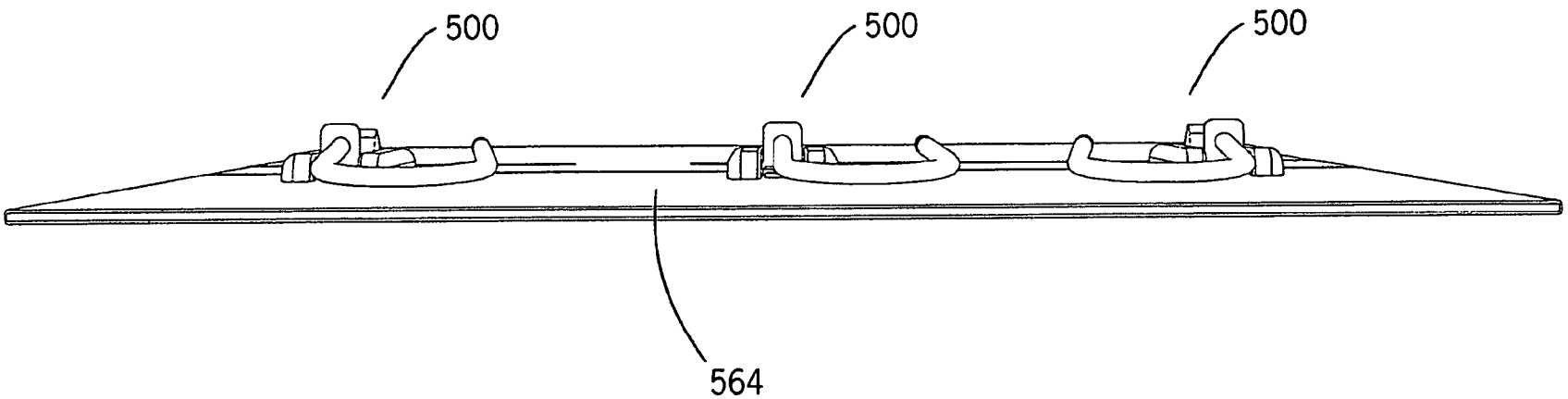
FIG. 15G is a rear view of the binder device of FIGS. 14A-14O, wherein the binder device is in an open, collapsed position, mounted inside a binder.
Figure 15H:
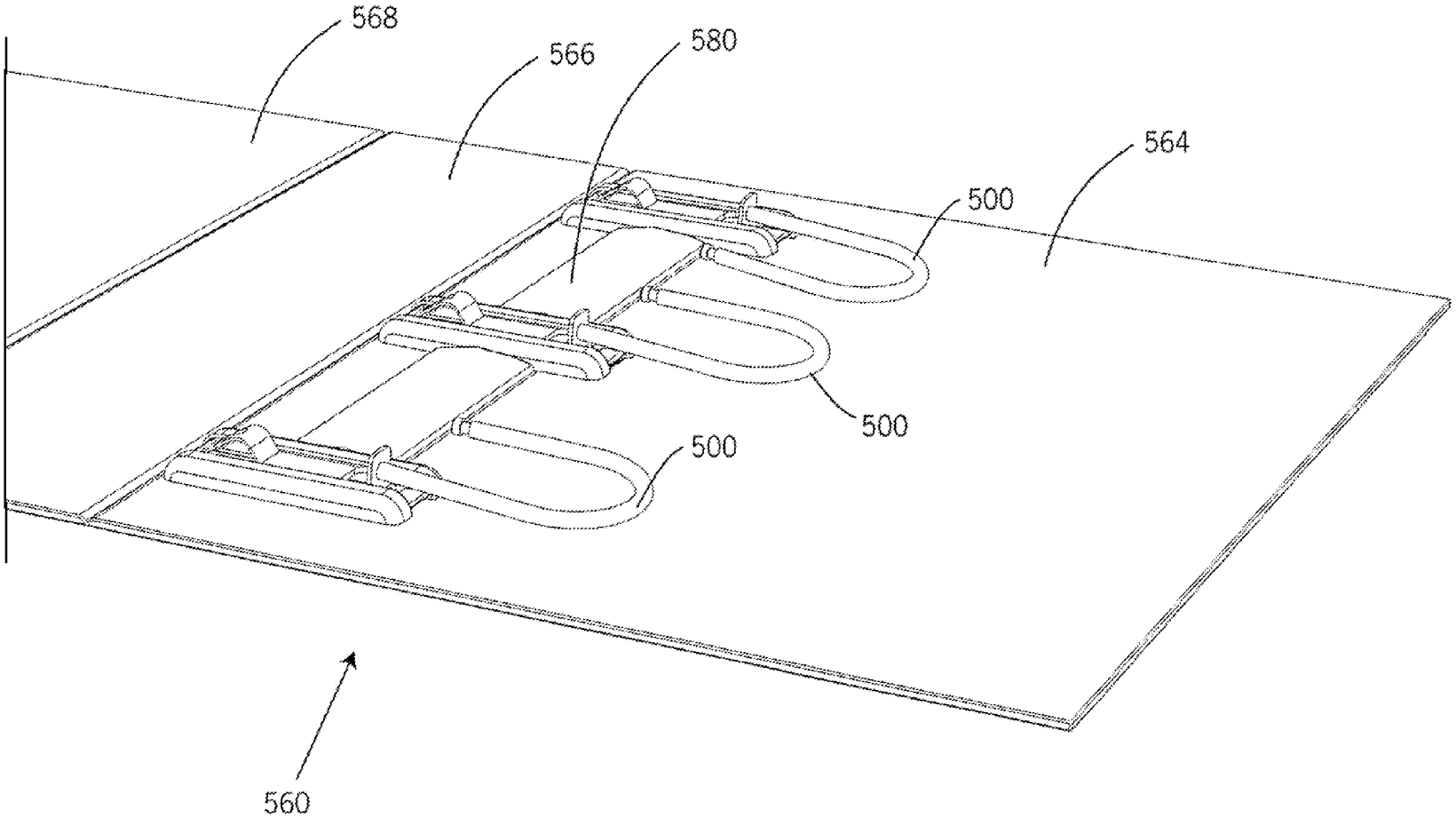
FIG. 15H is a rear perspective view of the binder device of FIGS. 14A-14O, wherein the binder device is in an open, collapsed position, mounted on a base inside a binder.
Figure 15I:
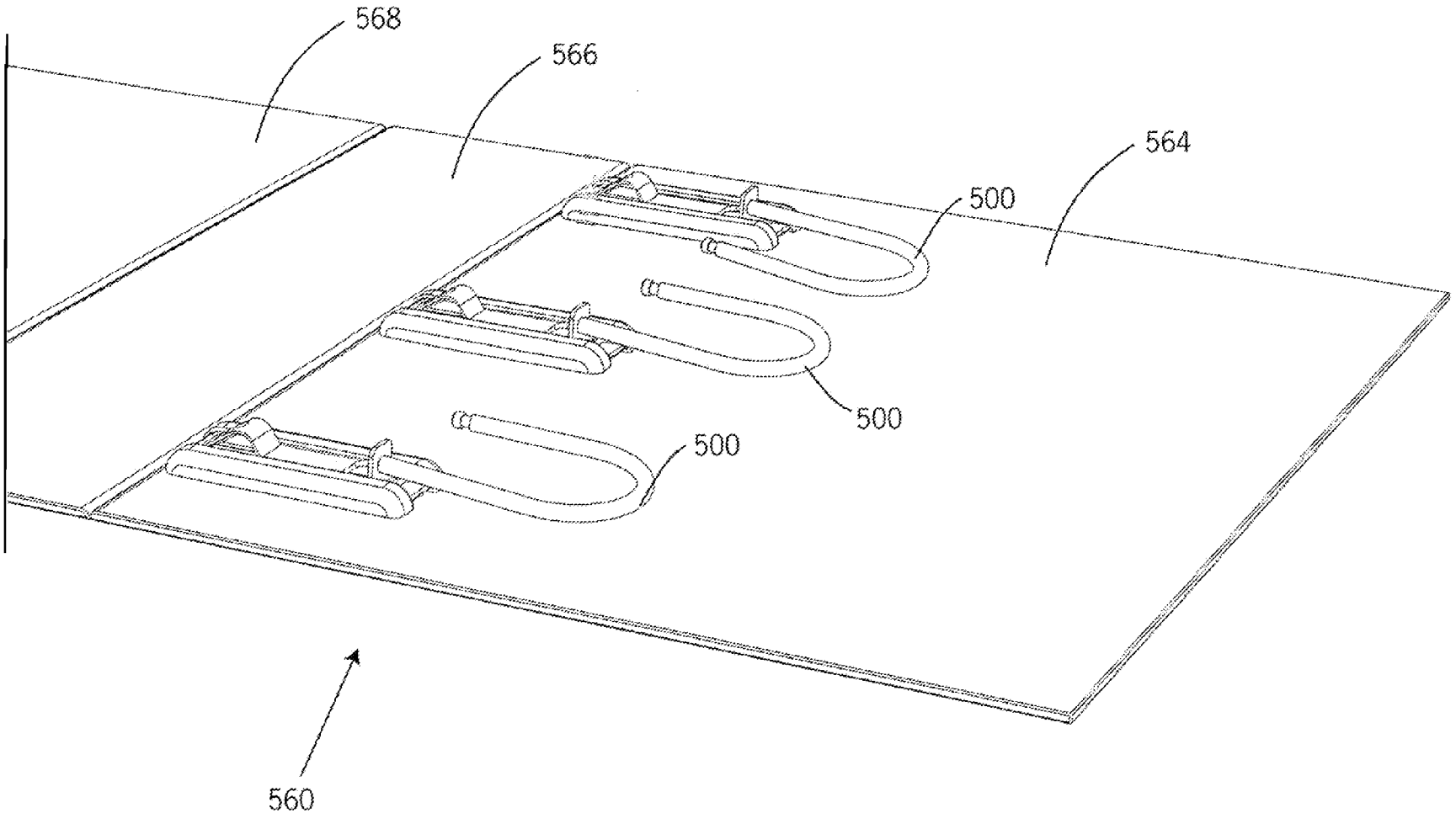
FIG. 15I is a rear perspective view of the binder device of FIGS. 14A-14O, wherein the binder device is in an open, collapsed position, mounted inside a binder.

FIGS. 15C-15E illustrate another means that may be employed to secure the binding devices 500 to the binder 560. In this embodiment, the binding devices 500 are secured to a base 580. The base 580 is then secured to the binder 560. The base 580 may be made of any suitable material, such as metal or plastic. The base 580 may be secured to the binder 560 by any suitable means, such as a rivet, a screw, an adhesive, or the like. In addition, the binding devices 500 may be secured to the base 580 by any suitable means, such as a rivet, a screw, an adhesive, or the like. One advantage of the base 580 is to help keep the binding devices 500 stable. In the preferred embodiment, the base 580 is made out of one piece of stamped metal and comprises flat portions sized to seat and retain a plurality of binding devices 500 spaced along its length. Apertures in the base 580 permit fasteners to pass therethrough and fasten the devices 500 to the base 580 and the binder 560. In the preferred embodiment, the apertures in the base 506 of the binding devices 500, the base 580, and the binder 560 are aligned so the same fastener may pass therethrough and fasten the devices 500 to the base 580 and the binder 560. In another embodiment, the base 580 is fastened to the binder 560 by fasteners passing through apertures on each end of the base 580. As such, the binding devices 500 are fastened to the base 580 by a separate set of fasteners.

FIGS. 15F-15I illustrate the exemplary binders 560 above having binding devices 500 with rings in the open, collapsed position.

Figure 16A:
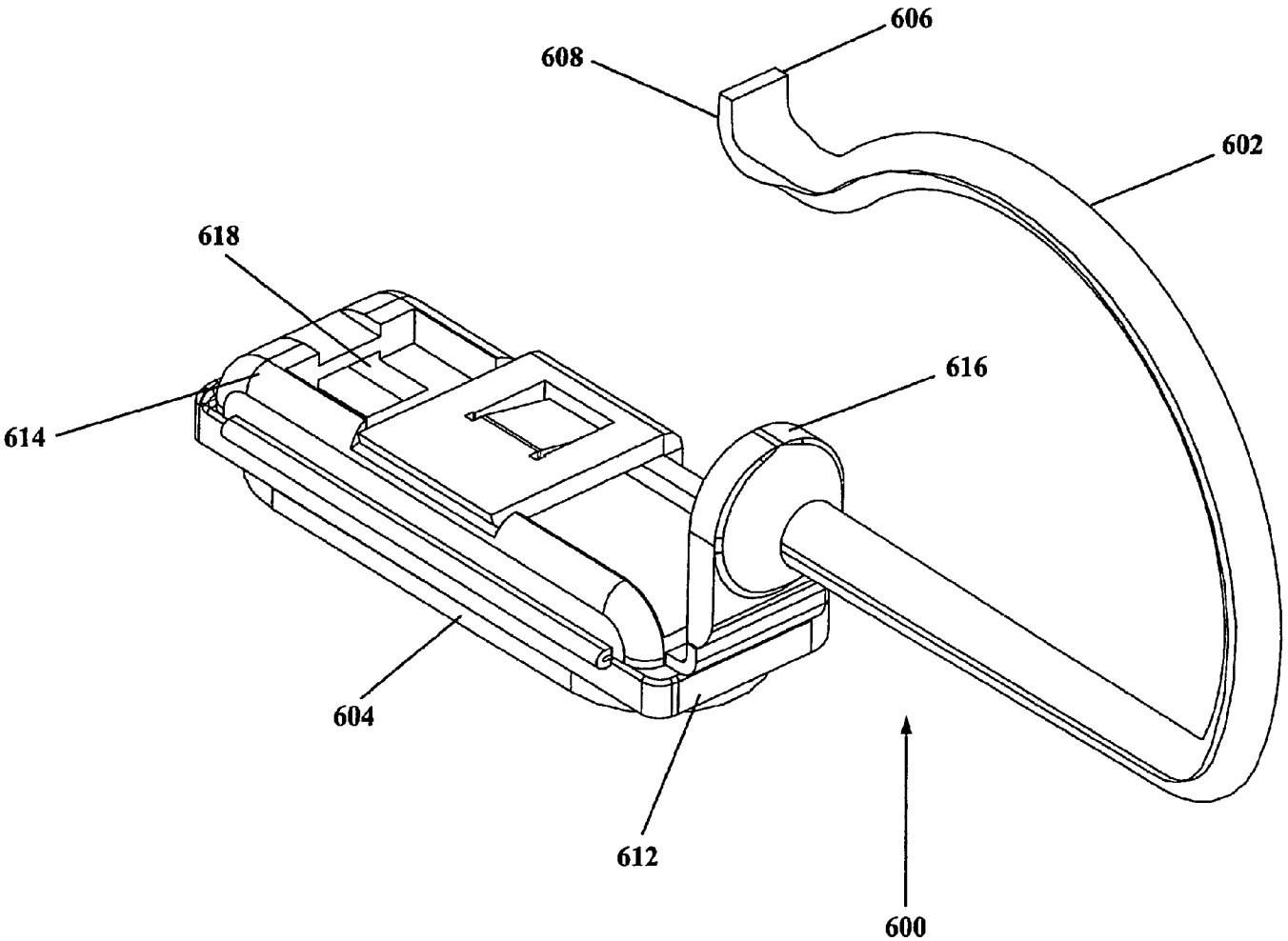
FIG. 16A is a another alternate exemplary binding device for a ring binder according to the present invention, wherein the binding device is in an open configuration.

The discussion of the alternate binding device 600 of FIGS. 16A-16F will be discussed in an abbreviated format, with regard being given to aspects that generally differ or are otherwise modified relative to the previously discussed binding device 300. Turning now to FIG. 16A, the exemplary binding device 600 generally includes a ring 602 and a ring base 604. The ring 602 preferably provides the same functionality as previously discussed, i.e., it provides a retaining mechanism by which sheets of paper or similar articles are associated with a binder or similar device. The ring 602 may be provided in any shape and/or configuration, as previously described. Additionally, in one embodiment, the ring 602 may suitably terminate in a base engaging portion 606 that enables the ring 602 to slidably engage complementary structure on the base 604. More specifically and by way of example, the base engaging portion 606 may suitably feature a hook portion 608 (FIG. 16A) at the free end of the ring. As will be more fully described hereinafter, the hook portion 608 is suitably adapted to interface with a complementary receiving portion on the ring base 604.

Turning now to a discussion of the ring base 604, the ring base 604 is provided as a generally planar member preferably featuring a ring interfacing portion 612 and a ring engaging portion 614, similar to the device 300 discussed above. The ring interfacing portion 612 provides a means by which the ring 602 is securely associated with the ring base 604, while the ring engaging portion 614 provides a means by which a free end of the ring 602 may suitably releasably engage and fasten to the ring base 604 for, e.g., inserting and/or removing sheets of paper to the ring 602.

The ring interfacing portion 612 suitably provides a means by which the ring 602 remains in constant engagement with the ring base 604, and which further permits the ring 602 to undergo movement along several axes, as previously described. With best reference to FIG. 16A, the ring interfacing portion 612 generally includes a panel 616 to which the ring 602 is securely associated, in a manner substantially as described above. In a different aspect, however, the panel 616 is preferably hingedly associated (preferably through a living hinge 676 or other suitable structure) with a rear portion of the ring base 604, thereby enabling the panel 616 and associated ring 602 to pivot backward, as demonstrated in FIG. 16A.

The ring engaging portion 614 preferably provides a means for the free end of the ring 602 to releasably engage and fasten to the ring base 604. With best reference to FIG. 16A, the ring engaging portion 614 is preferably provided as having a receiving portion 618 adapted to engage the hook portion 608 at the free end of the ring 602. More preferably, in this exemplary embodiment, the receiving portion 618 includes a lip that corresponds to the hook portion 608 at the free end of the ring 602. In operation and as evident from FIG. 16A, the ring 602 is brought into secure engagement with the ring engaging portion 614 by disposing the hook portion 608 of the ring 602 in the receiving portion 618 (which disposing may require force to overcome the tension of the ring 602), and thereafter permitting the ring 602 to adopt its resting state configuration, whereby the hook portion 608 of the ring 602 slides into the receiving portion 618. In this state, the ring 602 is securely engaged with the ring base 604 so that any articles (e.g., sheets of paper) disposed about the ring 602 will remain associated therewith.

Figure 16B:
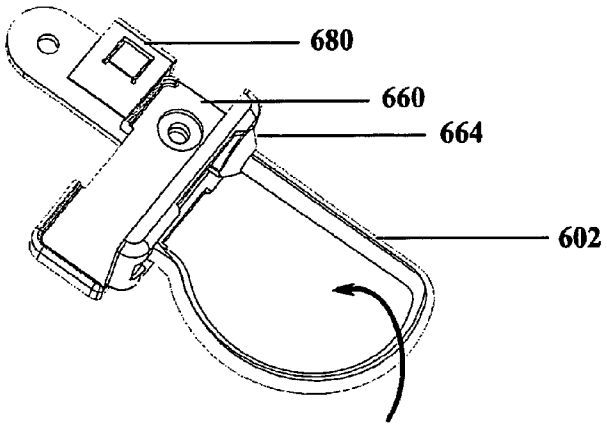
FIG. 16B is a perspective view of the binding device of FIG. 16A, wherein the device is in a collapsed configuration.
Figure 16C:
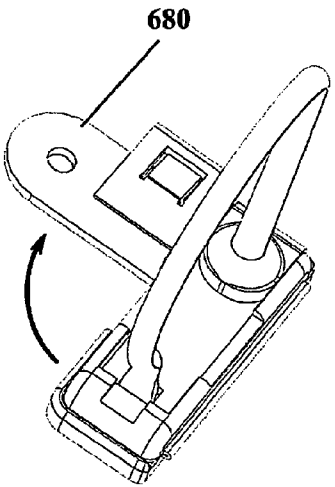
FIG. 16C is a perspective view of the binding device of FIGS. 16A and 16B, wherein the binding device is not securely associated with a stabilizing member.
Figure 16D:
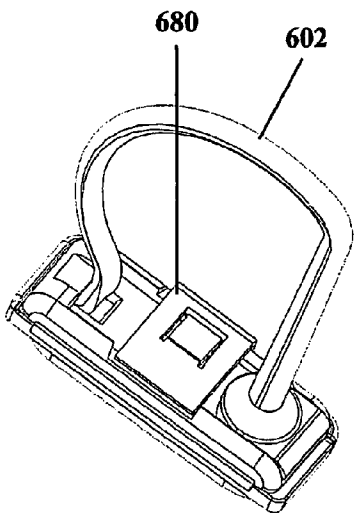
FIG. 16D is a perspective view of the binding device of FIG. 16A-16C, wherein the binding device is securely associated with the stabilizing member, and further wherein the binding device is in a closed, fastened, and upright configuration.

FIGS. 16B-16D are illustrations of how the exemplary binder device 600 of FIG. 16A is assembled to the upright position from the collapsed position. First, the ring 602 is rotated upright from the collapsed position in FIG. 16B to the upright position in FIG. 16C. The ring 602, along with the ring interfacing portion 612 and the ring engaging portion 614, are connected to a pivoting portion of the base 664. This pivoting portion of the base 664 is attached to a planar portion of the base 660, which is fastened by at least one end to the binder casing. The pivoting portion of the base 664 may be attached to the planar portion of the base 660 by any suitable means, preferably through a living hinge 675 or other suitable structure. Once the ring 602 is in the upright position, a stabilizing member 680 clamps the pivoting portion of the base 664 and the planar portion of the base 660 together. As shown in FIGS. 17C and 17E, the ring base 604 is rotated into the stabilizing member 680, clamping the pivoting portion of the base 664 and planar portion of the base 660 together. The stabilizing member 680 can be made out of any suitable material, such as metal or plastic.

FIGS. 16E-16G are additional views of the exemplary binder device 600 of FIG. 16A. FIG. 16E and 16G illustrate apertures 682 in the planar portion of the base 660 and the stabilizing member 680. These apertures 682 may be used in conjunction with a fastener, such as a rivet, to attach the binder device 600 to the casing of the binder. However, any type of fastening means, such as an adhesive, may be used. FIG. 16F is a perspective view of the base 604 of the binding device 600 and FIG. 16G is a perspective and exploded view of the binding device 600 of FIGS. 16A-16F, exemplarily illustrating the ring 602, the ring base 604 and the stabilizing member 680.

Figure 17A:
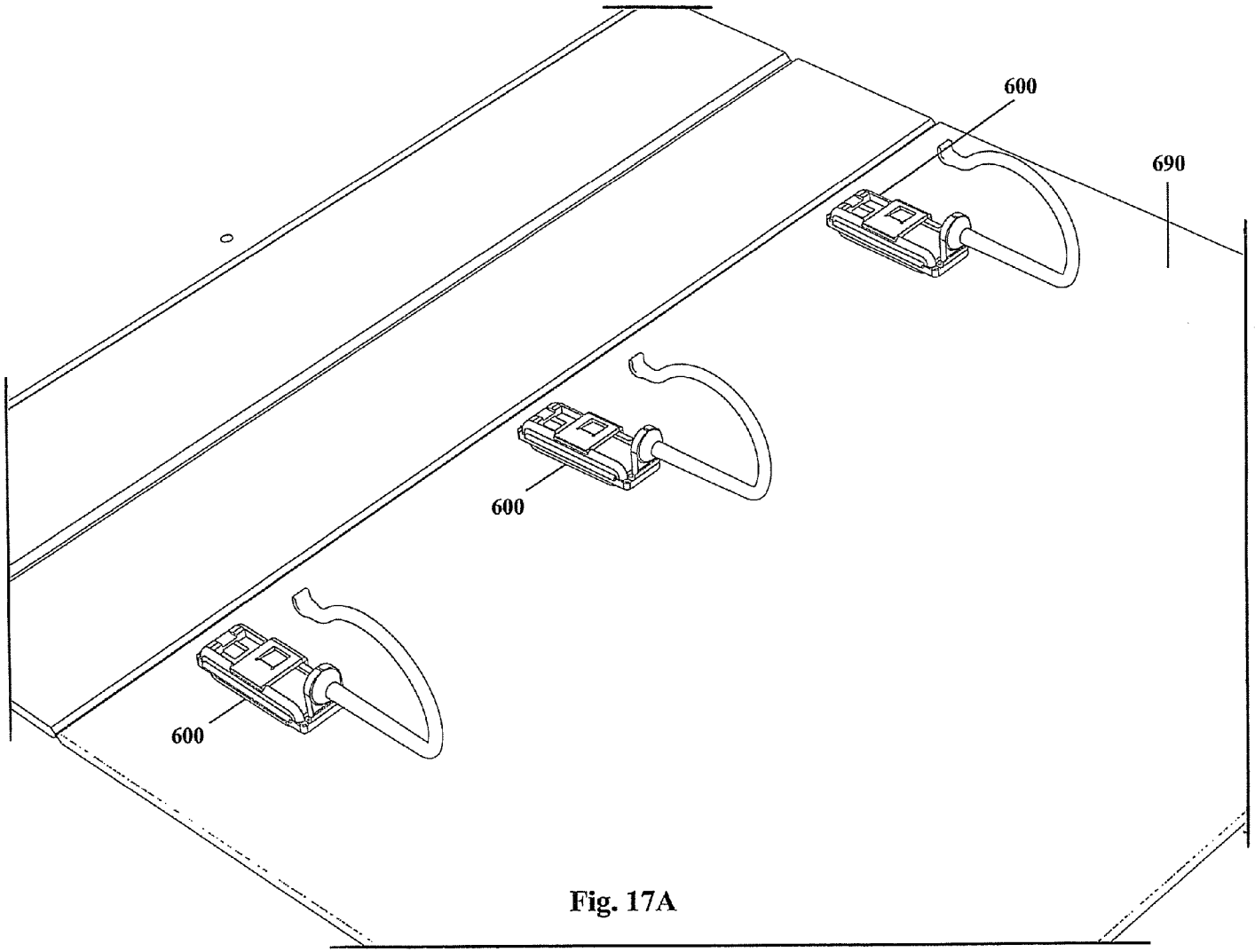
FIG. 17A is a perspective view of an exemplary ring binder having a plurality of binding devices of FIGS. 16A-16G associated therewith, wherein the binding devices are in an open configuration and further wherein the ring binder is in an open state.

FIGS. 17A-17E show various views of an exemplary binder 690 having a plurality of binding devices 600 of FIGS. 16A-16F in various configurations. The spine of exemplary binder 690 has two longitudinal portions that are hinged together. FIG. 17A is a perspective view of exemplary ring binder 690 wherein the binding devices 600 are in an open configuration and further wherein the ring binder is in an open configuration. FIGS. 17B-17C are perspective views of the exemplary ring binder 690 and associated binding devices 600, wherein the binding devices 600 are in a closed and upright configuration. In FIG. 17B the front cover of the binder is closed and in FIG. 17C the front cover of the binder is partially open. FIGS. 17D-17E are perspective views of the exemplary ring binder 690 and associated binding devices 600, wherein the binding devices 600 are in a collapsed configuration. In FIG. 17D the front cover of the binder is closed and in FIG. 17E the front cover of the binder is partially open. A comparison of FIG. 17B with FIG. 17D shows an example of the space savings possible with the collapsible binders disclosed herein.

FIGS. 18A-18G illustrate an exemplary binder device 702 according to an alternative embodiment of the present invention. As will be more fully explained hereinafter, the binder device 702 provides conventional ring binder functionality by integrating a plurality of rings 760 into a single structure, through which structure the plurality of rings 760 are simultaneously openable and closable. As will also be more fully explained, the binder device 702 is collapsible to reduce the size of the binder device 702 for transportation or storage.

Figure 18A:
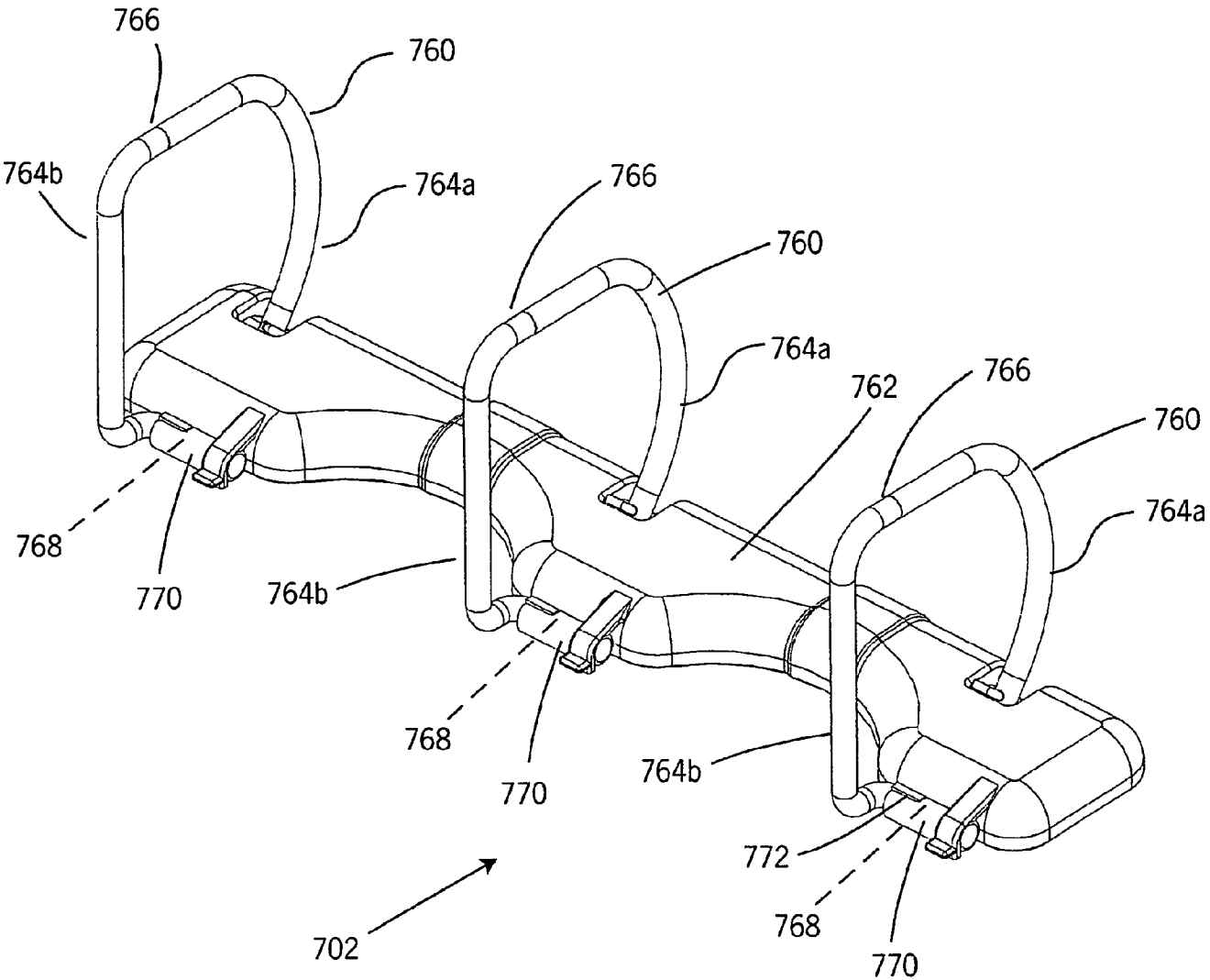
FIG. 18A is a perspective view of a binder device, wherein the device is in an upright and closed configuration.
Figure 18B:
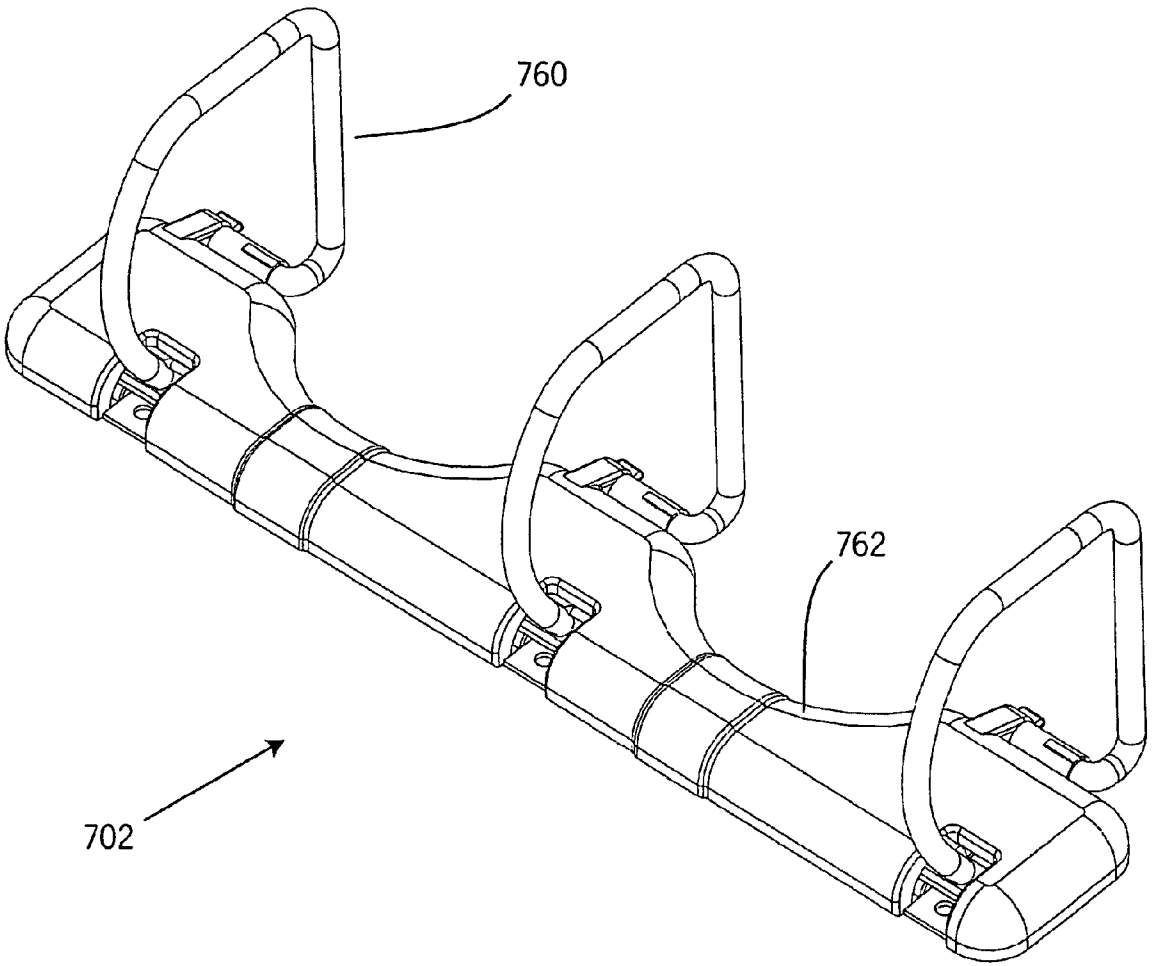
FIG. 18B is a perspective view of the device of FIG. 18A.
Figure 18C:
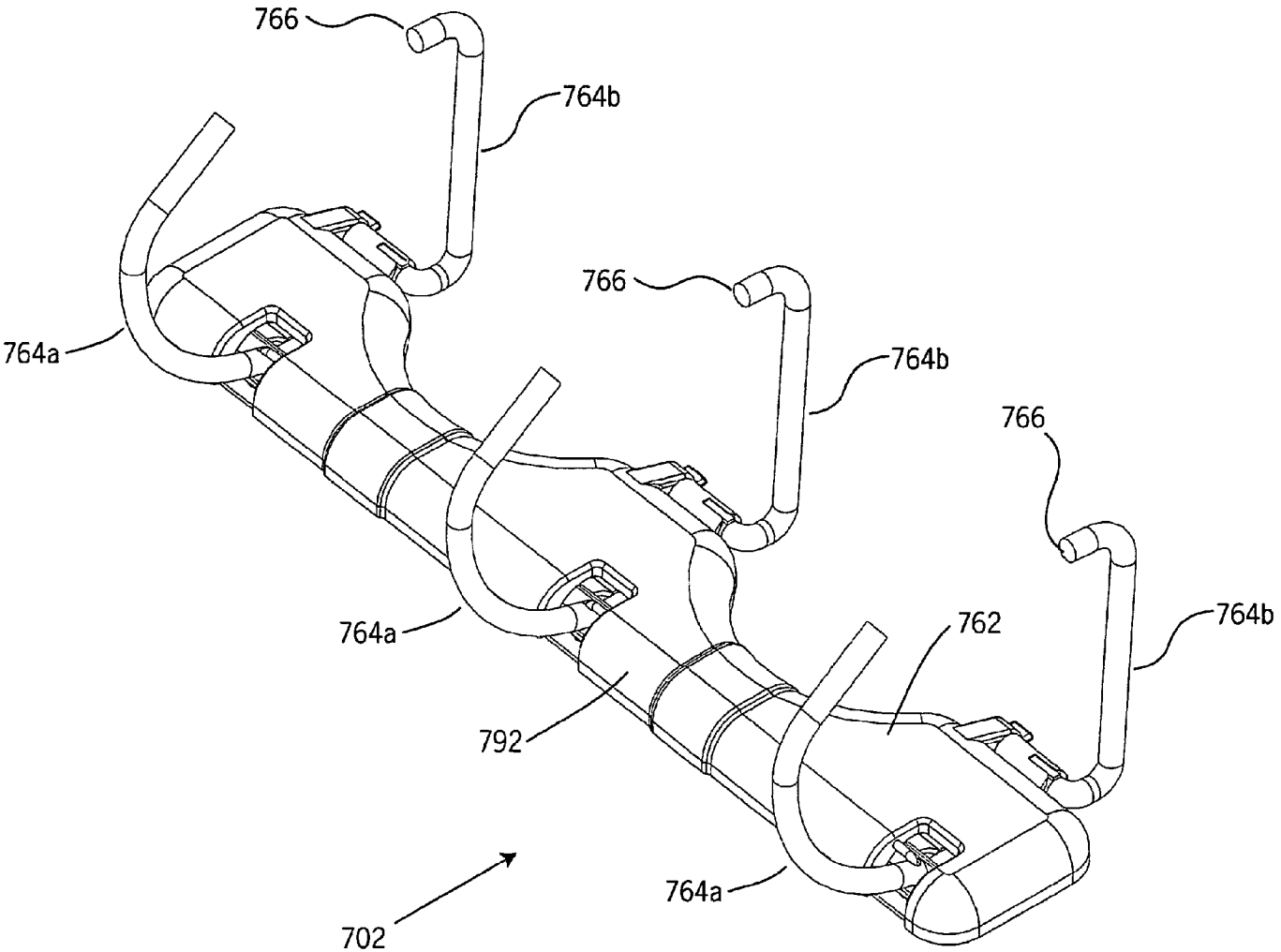
FIG. 18C is a perspective view of the binder device of FIG. 18A, wherein the device is in an upright and open configuration.

Turning now to FIG. 18A, the exemplary binder device 702 generally includes a plurality of rings 760 and a ring base 762 to which the rings 760 are operably connected. As shown in FIG. 18C, the rings 760 are preferably provided in a manner generally similar to conventional ring binder rings with each featuring a first arcuate portion 764*a* and a second arcuate portion 764*b*. The first and second arcuate portions 764*a*, 764*b* together generally define a ring 760, and are movably disposed relative to each other to alternate between an open configuration (FIG. 18C) for receiving and removing articles, and a closed configuration (FIG. 18A) for securely retaining articles.

The device 702 may feature any suitable number of rings 760. FIGS. 18A-18G illustrate an embodiment in which the device 702 includes three rings 760, thereby configuring a casing incorporating the device 702 generally as a three ring binder. However, it is to be appreciated that the device 702 may include, e.g., one ring 760, two rings 760, four rings 760, five rings 760, or any other suitable number of rings 760.

As will be more fully explained hereinafter, the first arcuate portion 764*a* is operably connected with the ring base 762, particularly a bracket 778 thereof in a manner that enables all first arcuate portions 764*a* to open and close as a single unit. Thus, in contrast to the previously described binder device 500 wherein each ring 504 is an independent element for opening and closing, the first arcuate portions 764*a* collectively function as a single unit able to simultaneously move away from the second arcuate portions 764*b* for opening the rings 760. Various additional aspects of the movability of the first arcuate portion 764*a* will be more fully described hereinafter.

The second arcuate portions 764*b* of the rings 760 are adapted to remain in a static position while the first arcuate portions 764*a* move relative thereto. FIG. 18A illustrates the device 702 in an upright and closed configuration in which the exposed ends of the first and second arcuate portions 764*a*, 764*b* generally meet at a central position. FIG. 18C illustrates the device 702 in a partially upright and open configuration in which the first arcuate portions 764*a* are collectively pivoted away from the second arcuate portions 764*b*. As shown, an exposed end of the second arcuate portion 764*b* generally remains at the central position, while an exposed end of the first arcuate portion 764*a* withdraws therefrom. Despite the foregoing, it is to be appreciated that the second arcuate portions 764*b* may suitably be configured to also pivot while the first arcuate portions 764*a* are being pivoted open.

Figure 18D:
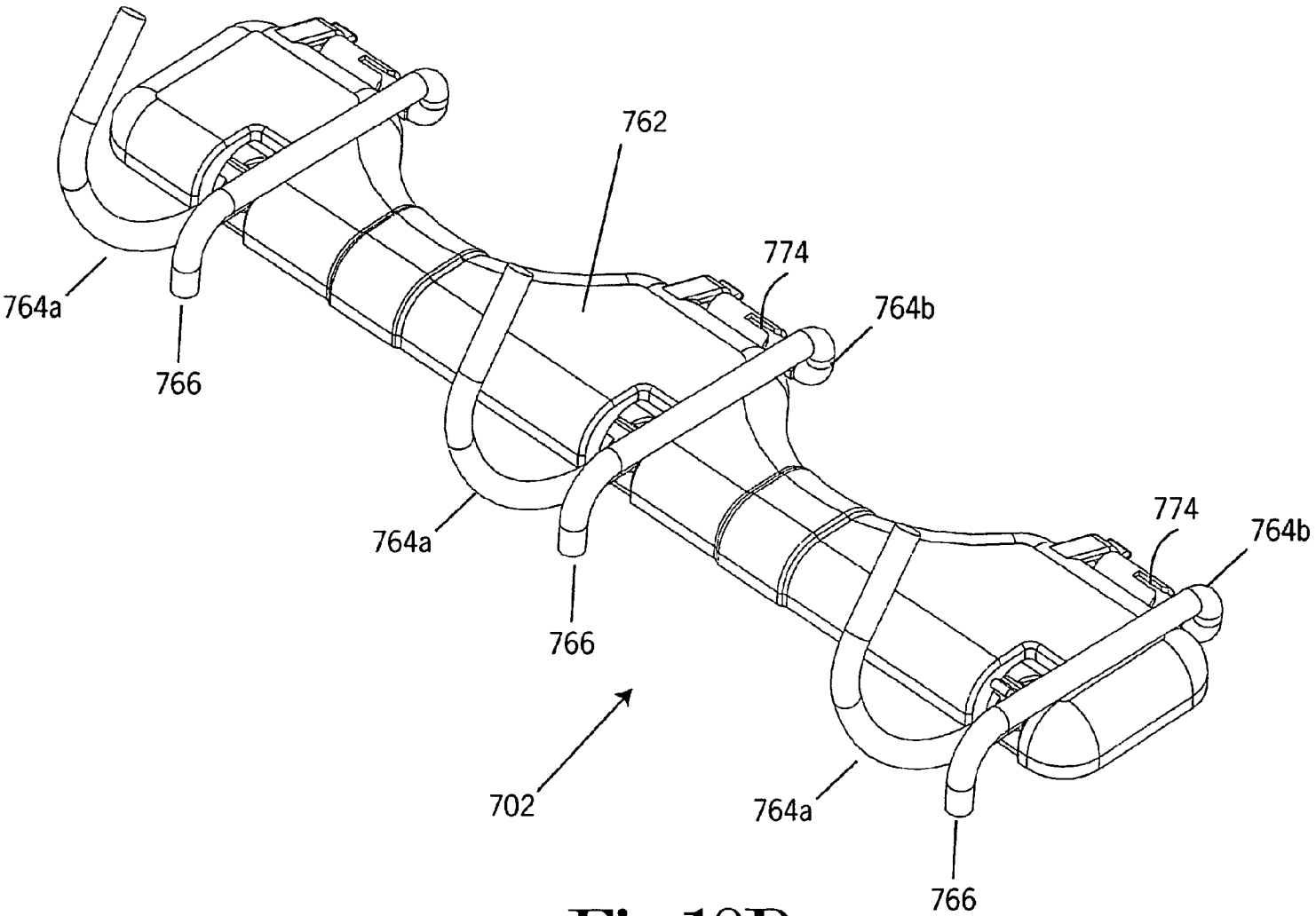
FIG. 18D is a perspective view of the binder device of FIGS. 18A-18C, wherein the device is in a partially collapsed configuration.
Figure 18E:
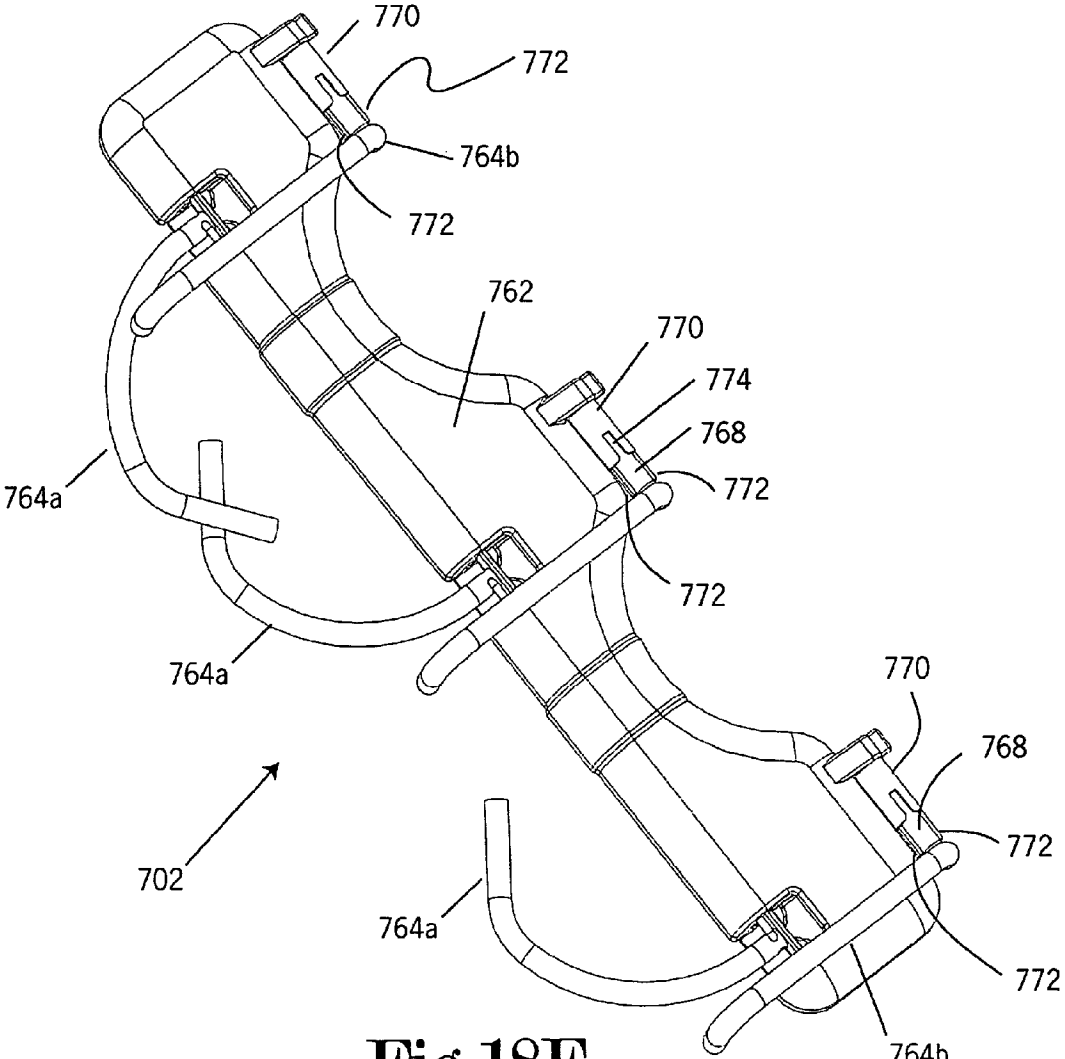
FIG. 18E is a perspective view of the binder device of FIGS. 18A-18D, wherein the device is in a collapsed configuration.
Figure 18F:
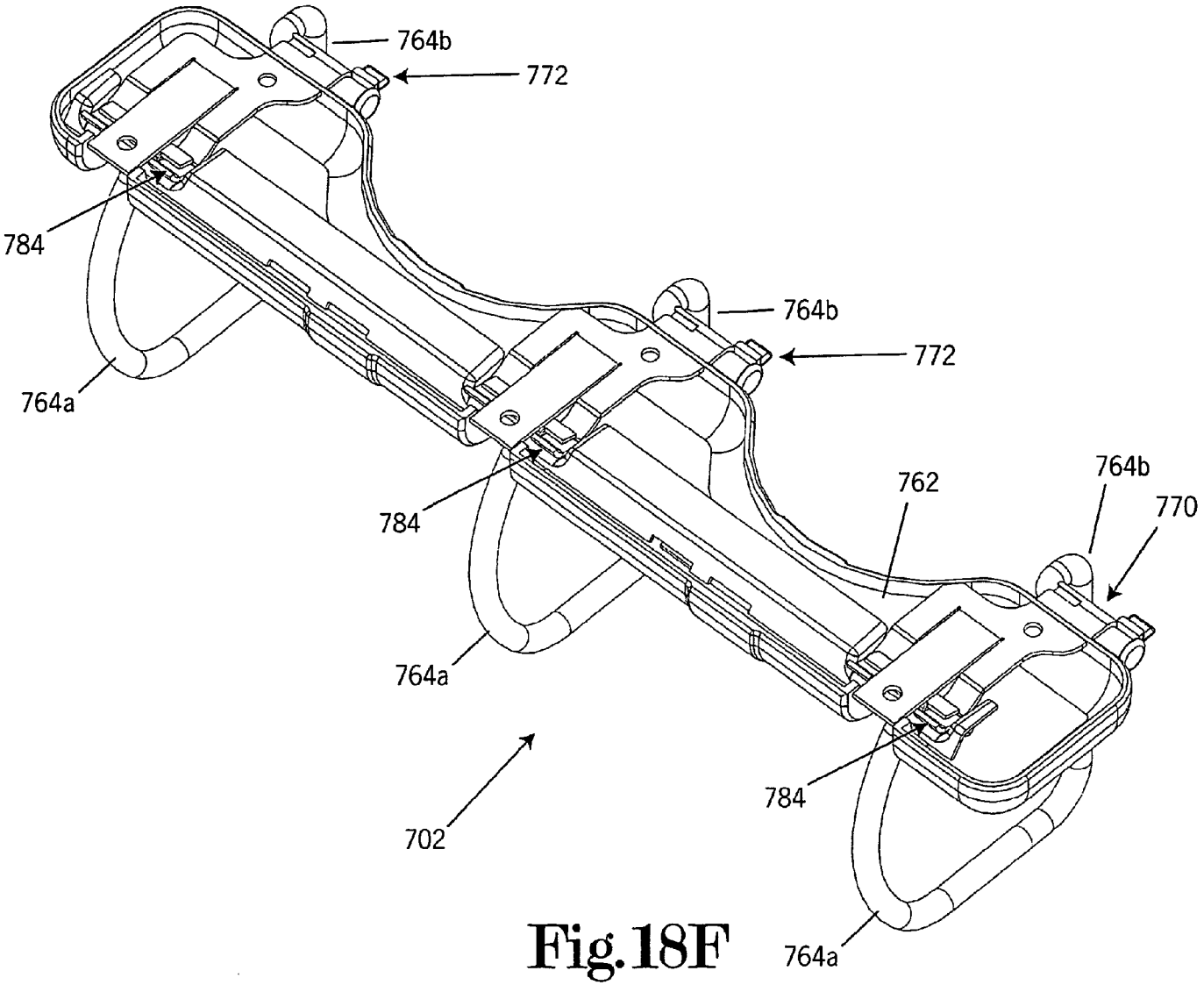
FIG. 18F is a bottom perspective view of the binder device of FIGS. 18A-18E.

The second arcuate portions 764*b* preferably include structures that permit the portions 764*b* to remain stationary while the first arcuate portions 764*a* are pivoted. As shown in FIGS. 18A and 18E, the second arcuate portions 764*b* preferably each include an arm 768 that extends perpendicularly from a bottom portion thereof. The arm 768 is preferably a generally cylindrical member rotatably and slidably disposed within a cylindrical housing 770 of the ring base 762. Even more preferably, the arm 768 includes a pair of flange-like ridges 772 (FIG. 18A) disposed on opposite circumferential sides of the arm 768. The cylindrical housing 770 preferably also includes a pair of correspondingly shaped and oriented slots 774 (FIG. 18E) in which the arm 768 ridges 772 are disposable. When the arm 768 ridges 772 are disposed within the cylindrical housing 770 slots 774, the second arcuate portion 764*b* is prevented from pivoting, thereby holding the portion 764*b* stationary relative to the first arcuate portions 764*a*.

The cylindrical housing 770 also permits the arm 768 to slide longitudinally relative thereto. As previously mentioned, the rings 760 are preferably collapsible so as to flatten the device 702. In that regard, the second arcuate portion 764*b* is preferably collapsible by first sliding the arm 768 away from the cylindrical housing 770 to disengage the arm 768 ridges 772 from the housing 770 slots 774. Once the ridges 772 are disengaged, the second arcuate portion 764*b* may be pivoted as desired for collapsing the device 702, as generally shown in FIG. 18D, with the second arcuate portions 764*b* overlying across the base 762.

The binder device 702 is preferably adapted to bias the arcuate portions 764*a*, 764*b* into a closed configuration when the rings 760 are uprightly disposed. With best reference to FIGS. 18A and 18C, an exposed end of the second arcuate portion 764*b* preferably includes a magnet 766 or similar feature associated therewith. Because the arcuate portions 764*a*, 764*b* are preferably constructed of a material (e.g., a metal, spring steel, etc.) that responds to the magnetic pull of a magnet, the disposition of the magnet 766 on the second arcuate portion 764*b* biases the first arcuate portion 764*a* into engagement with the second arcuate portion 764*b*. It is to be appreciated that any other suitable arrangement may be employed, such as disposing the magnet 766 at the first arcuate portion 764*a*, disposing magnets of opposite polarity on both arcuate portions 764*a*, 764*b*, or any other suitable arrangement.

The magnet 766 may be connected to the second arcuate portion 764*b* through any suitable means. In one aspect, an adhesive, particularly one adapted to interface between metallic elements, may be employed to retain the magnet 766 on the exposed end of the arcuate portion 764*b*. In another aspect, the magnet 766 may include a projection that extends from a rear surface thereof, and which projection is adapted to be received into a complementary cavity in the second arcuate portion 764*b*. Any other suitable means for connecting the magnet 766 to the arcuate portion 764*b* may be employed without deviating from the scope of the present invention.

Turning now to a discussion of the ring base 762, the base 762 provides an interface between the rings 760 and the casing to which the device 702 is secured. In one aspect, the base 762 suitably provides a means for connecting the rings 760 to a casing. In another aspect, the base 762 suitably includes structure that enables the multiple functionality of the rings 760, namely opening, closing and collapsing of the same.

Figure 18G:
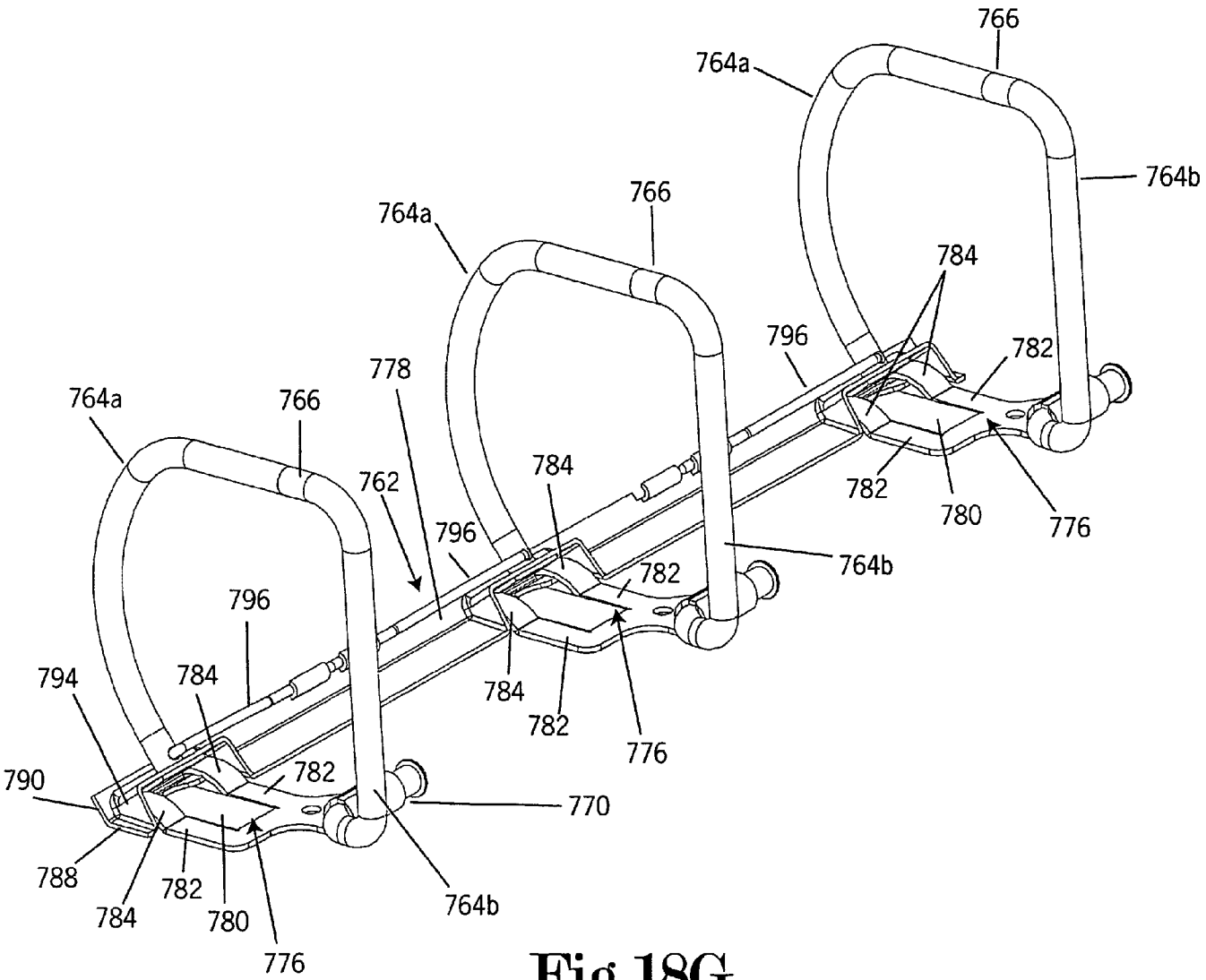
FIG. 18G is a perspective view of a portion of the binder device of FIGS. 18A-18F.

With reference to FIGS. 18A and 18G, the exemplary ring base 762 generally includes a plurality of arm support members 776 and a bracket 778 movably associated therewith. The exemplary arm support members 776 are preferably provided in a configuration that is similar to the base portion 530 of the previously described device 500, and are further provided in a quantity that corresponds to the desired number of rings 760. In that regard, the support members 776 preferably each include a central planar portion 780, a flange 782 disposed perimetrically about a portion thereof, a pair of arcuate portions 784, and the cylindrical housing 770. The support members' 776 elements are preferably configured in a manner substantially similar to the manner in which the device 500 base portion 530 elements are configured. Accordingly, reference should be made to the discussion provided above about the base portion 730 for an understanding of the support members 776.

Each support member 776 preferably includes the cylindrical housing 770 extending from an end thereof. As best shown in FIG. 18E, the housing 770 preferably extends from an edge of the flange 782 in a manner that configures the housing 770 to permit desired movability of the second arcuate portion 764*b*, as previously described.

The support member 776 also includes a shoulder and bridge assembly rotatably engaged with the support member 776 and its' arcuate portions 784. The shoulder and bridge assembly is preferably provided in a configuration substantially similar to the shoulder 542 and bridge 540 of the previously described device 500. Further similar to the device 500, the device 702 bridge rotates relative to the arcuate portions 784 to accomplish the biasing aims as previously described. An example illustrating how the bridge and shoulder cooperate with the device 702 will be more fully explained below.

The arm support members 776 also include means for enabling attachment to the casing. In a preferred embodiment, the members 776 include a pair of apertures disposed along opposite ends thereof, through which apertures a fastener (e.g., screws, a rivets, bolts, etc.) may extend to secure the members 776 to the casing. However, it is to be appreciated that any other suitable means may be employed for securing the members 776 to the casing, including, e.g., an appropriate adhesive.

Turning now to a discussion of the bracket 778, the bracket 778 enables the first arcuate portions 764*a* to move as a collective unit. The bracket 778 generally includes a first longitudinal member 788, a second longitudinal member 790, and arm support member 776 engaging portions 794. The longitudinal member 788, 790 are generally joined along their longitudinal sides and are preferably angularly offset relative to each other at an obtuse angle. As best shown in FIG. 18E, the first longitudinal member 788 is generally configured to abuttingly rest against the casing when the rings 760 are in an upright and closed configuration. The second longitudinal member 790, given its angularly offset nature relative to the first member 788, generally rotates into abutting contact with the casing when the first arcuate portions 764*a* are pivoted away from the second arcuate portions 764*b*.

The engaging portions 794 are generally adapted to overlie and pivot about the arm support members 776, preferably the arcuate portions 784 thereof. The engaging portions 794 are preferably defined by a pair of side walls that extend generally perpendicularly from the members 788, 790, and a top wall that extends atop the side walls. The side walls are generally triangular in overall shape, thereby disposing the engaging portion 794 top wall at an approximate 45 degree angle relative to the bracket 778 first longitudinal member 788.

The ring's first arcuate portion 764*a* is preferably secured to the engaging portion 794 top wall. Further thereto, the top wall generally includes an aperture therein that is adapted to communicate with a threaded bore the first arcuate portion 764*a*. The first arcuate portion 764*a* is preferably secured to the top wall by a fastener (e.g., a screw, a rivet, etc.) being engaged with both the top wall and the arcuate portion 764*a* threaded bore.

In a preferred embodiment, the first arcuate portion 764*a* is secured to the bridge and shoulder in a manner substantially similar to the manner as previously described in connection with the device 500. Further thereto, the shoulder is preferably disposed in a generally abutting relationship with a bottom face of the engaging portion 794 top wall, which bottom face is generally opposite the face against which the first arcuate portion 764*a* is secured. Even more preferably, the fastener generally extends through the shoulder, the top wall and the first arcuate portion 764*a* to secure the same together. The bridge preferably extends rearward from the shoulder so as to communicate with the arcuate portions 784, as previously described.

As previously mentioned, the rings 760 of the device 702 are generally adapted to collapse so as to permit the device 702 to assume a reduced size profile. FIG. 18E illustrates the device 702 in a collapsed configuration. As shown, the first arcuate portions 764*a* are generally first pivoted away from the second arcuate portions 764*b*, and then the first arcuate portions 764*a* are rotated relative to the bracket 778, in a manner generally similar to the means by which the ring 504 of the device 500 is collapsed. The first arcuate portions 764*a* are preferably each rotatable both clockwise and counterclockwise. Accordingly, two arcuate portions 764*a* may suitably be rotated to overlie each other, thereby eliminating one arcuate portion 764*a* from extending beyond the casing when the device 702 is in a collapsed configuration.

As shown in FIG. 18G, optional locking bars 796 releasably extend between the arcuate portions 764*a* and the bracket 778 to releasably secure the arcuate portions 764*a* in their upright, usable positions (shown in FIG. 18G), and prevent the arcuate portions 764*a* from pivoting into their collapsed positions (shown in FIG. 18E). Alternatively, any other suitable mechanism may be utilized to selectively lock the arcuate portions 764*a* in their upright usable positions (e.g., via tightening fasteners that connect the arcuate portions to the bracket 778, etc.).

With continued reference to the collapsibility of the device 702, the second arcuate portions 764*b* are axially moved to disengage the ridges 772 from the slots 774 in the cylindrical housings 770, as previously described, and pivoted toward the first arcuate portions 764*a*. When the second arcuate portions 764*b* are fully pivoted, they generally rest against the device 702, as shown in FIG. 18E.

The collapsibility of the device 702 provides particular benefits for pre-consumer considerations. More specifically, the ability to collapse the device 702 enables an increased number of binders incorporating the device 702 to be shipped in a single container and to be displayed in a given amount of retail space, relative to conventional ring binders. Thus, in one aspect, a consumer will typically purchase the casing and device 702 with the device 702 in a collapsed configuration. The consumer will generally dispose the device 702 in an upright configuration for use as a ring binder. To do so, the consumer generally follows a reverse procedure, whereby the second arcuate portions 764*b* are pivoted upward and brought into engagement with the housings 770, and the first arcuate portions 764*a* are rotated and then pivoted upward into engagement with the second arcuate portions 764*b*.

Figure 19:
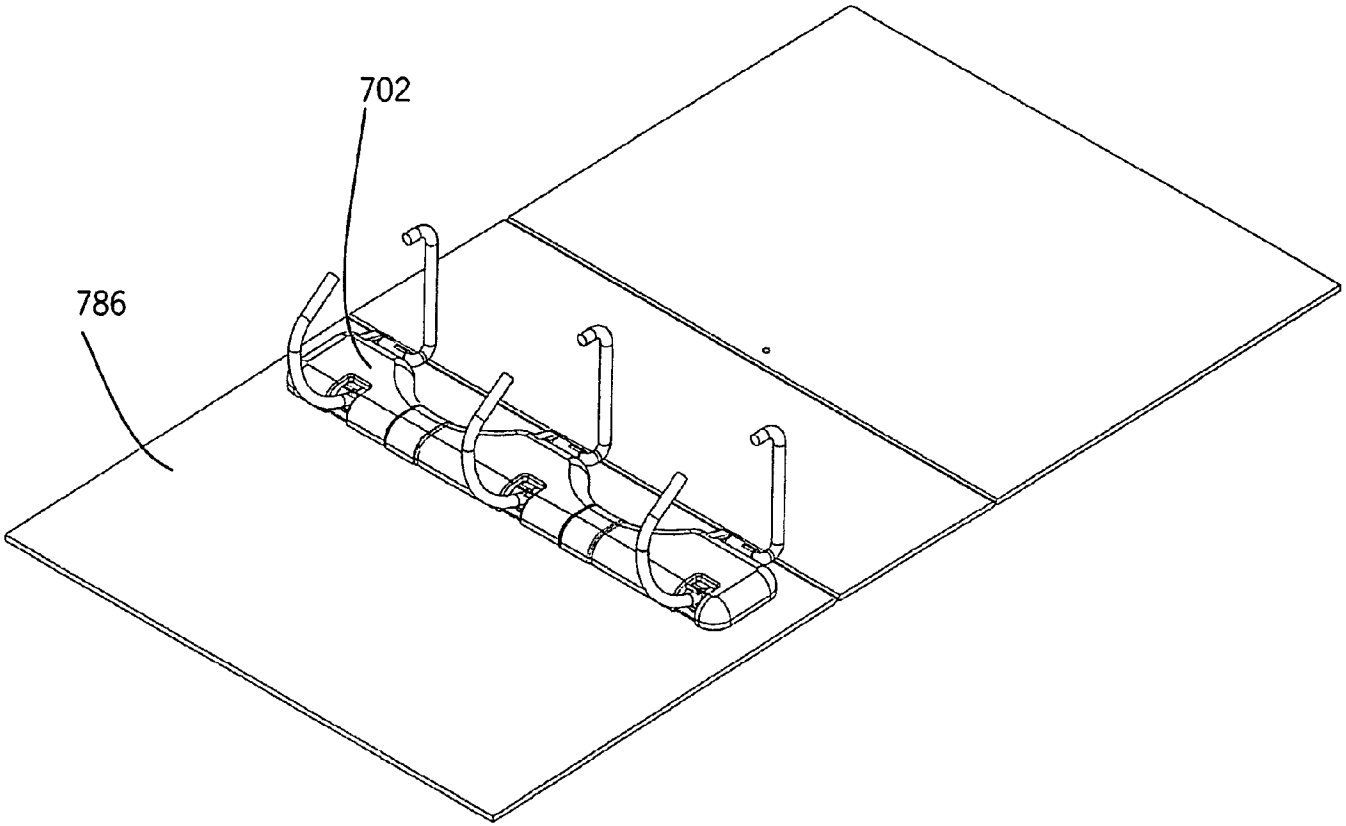
FIG. 19 is a perspective view of the binder device of FIGS. 18A-18G, wherein the device is in an upright and open position inside a binder.

FIG. 19A is a perspective view of an exemplary binder 786 using a plurality of binder devices 702 of FIGS. 18A-18G, wherein the devices 702 are in an upright and open position inside the binder 786.

FIGS. 20A-20E illustrate an exemplary binder device 802 according to an alternative embodiment of the present invention. As will be more fully explained hereinafter, the binder device 802 provides more conventional ring binder functionality by integrating a plurality of rings 860 into a single structure, through which structure the plurality of rings 860 are simultaneously openable and closable. As will also be more fully explained, the binder device 802 is collapsible to reduce the size of the binder device 802 for transportation or storage.

Figure 20A:
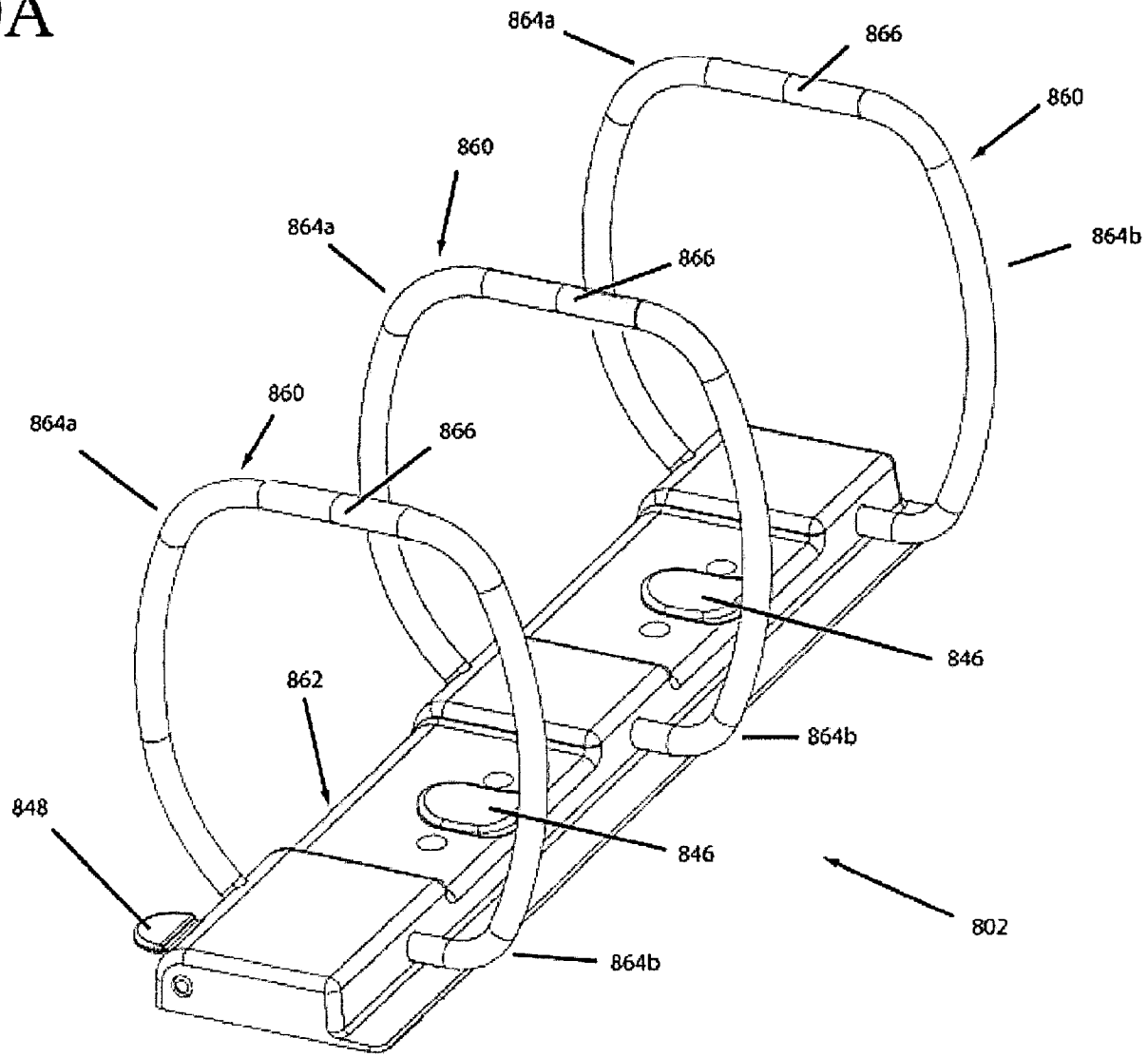
FIG. 20A is a perspective view of a binder device, wherein the device is in an upright and closed configuration.

Turning now to FIG. 20A, the binder device 802 generally includes a plurality of rings 860 and a ring base 862 to which the rings 860 are operably connected. As shown in FIG. 20C, the rings 860 are preferably provided in a manner generally similar to conventional ring binder rings with each featuring a first arcuate portion 864*a* and a second arcuate portion 864*b*. The first and second arcuate portions 864*a*, 864*b* together generally define a ring 860, and are movably disposed relative to each other to alternate between an open configuration (FIG. 20C) for receiving and removing articles, and a closed configuration (FIG. 20A) for securely retaining articles.

The device 802 may feature any suitable number of rings 860. FIGS. 20A-20E illustrate an embodiment in which the device 802 includes three rings 860, thereby configuring a casing incorporating the device 802 generally as a three ring binder. However, it is to be appreciated that the device 802 may include, e.g., one ring 860, two rings 860, four rings 860, five rings 860, or any other suitable number of rings 860. A binder may, for example, include one device 802 with three rings, or three devices 802 each with one ring, positioned along a side edge. A binder may, for example, include one device 802 with two rings positioned along an upper edge.

As will be more fully explained hereinafter, the first arcuate portion 864*a* is operably connected with the ring base 862, particularly by a common shaft 878 in a manner that enables all first arcuate portions 864*a* to open and close as a single unit. Thus, in contrast to the previously described binder device 500 wherein each ring 504 is an independent element for opening and closing, the first arcuate portions 864*a* collectively function as a single unit able to simultaneously move away from the second arcuate portions 864*b* for opening the rings 860. Various additional aspects of the movability of the first arcuate portion 864*a* will be more fully described hereinafter.

The second arcuate portions 864*b* of the rings 860 are adapted to remain in a static position while the first arcuate portions 864*a* move relative thereto. FIG. 20A illustrates the device 802 in an upright and closed configuration in which the exposed ends of the first and second arcuate portions 864*a*, 864*b* generally meet at a central position. FIG. 20C illustrates the device 802 in a partially upright and open configuration in which the first arcuate portions 864*a* are collectively pivoted away from the second arcuate portions 864*b*. As shown, an exposed end of the second arcuate portion 864*b* generally remains at the central position, while an exposed end of the first arcuate portion 864*a* withdraws therefrom. Despite the foregoing, it is to be appreciated that the second arcuate portions 864*b* may suitably be configured to also pivot while the first arcuate portions 864*a* are being pivoted open.

The second arcuate portions 864*b* preferably include structures that permit the portions 864*b* to remain stationary while the first arcuate portions 864*a* are pivoted. As shown in FIGS. 20D and 20E, a locking bar 868 is used to prevent the second arcuate portions 864*b* from pivoting or rotating while the first arcuate portions 864*a* are pivoted. The locking bar 868 is attached to the base 862 and slides to lock the second arcuate portions 864*b* in place. The locking bar 868 may be attached to the base 862 by any suitable means that allows the locking bar 868 to slide, for example rivets 870 connected to the base 862 corresponding to guides 872 in the locking bar 868. In order to lock the second arcuate portions 864*b* in place, the locking bar slides into a notch 874 in the secured end of the second arcuate portion 864*b*. The locking bar 868 may be slid into place by moving buttons 846 that protrude through the base 862 and are attached to the locking bar 868. The configuration of the notch 874 prevents the second arcuate portion 864*b* from pivoting or rotating. Once the locking bar 868 is disengaged from the notch 874, the second arcuate portion 864*b* is free to rotate and collapse. Accordingly, the secured end of the second arcuate portion 864*b* is preferably rotatably disposed within a channel to permit rotation of the second arcuate portion 864*b* relative to the base 862.

The binder device 802 is preferably adapted to bias the arcuate portions 864*a*, 864*b* into a closed configuration when the rings 860 are uprightly disposed. With best reference to FIGS. 20A and 20C, an exposed end of the second arcuate portion 864*b* preferably includes a magnet 866 or similar feature associated therewith, which fastens the ends of the ring portions 864*a*, 864*b* together. Because the arcuate portions 864*a*, 864*b* are preferably constructed of a material (e.g., a metal, spring steel, etc.) that responds to the magnetic pull of a magnet, the disposition of the magnet 866 on the second arcuate portion 864*b* biases the first arcuate portion 864*a* into engagement with the second arcuate portion 864*b*. It is to be appreciated that any other suitable arrangement may be employed, such as disposing the magnet 866 at the first arcuate portion 864*a*, disposing magnets of opposite polarity on both arcuate portions 864*a*, 864*b*, or any other suitable arrangement.

The magnet 866 may be connected to the second arcuate portion 864*b* through any suitable means. In one aspect, an adhesive, particularly one adapted to interface between metallic elements, may be employed to retain the magnet 866 on the exposed end of the arcuate portion 864*b*. In another aspect, the magnet 866 may include a projection that extends from a rear surface thereof, and which projection is adapted to be received into a complementary cavity in the second arcuate portion 864*b*. Any other suitable means for connecting the magnet 866 to the arcuate portion 864*b* may be employed without deviating from the scope of the present invention.

Turning now to a discussion of the ring base 862, the base 862 provides an interface between the rings 860 and the casing to which the device 802 is secured. In one aspect, the base 862 suitably provides a means for connecting the rings 860 to a casing. In another aspect, the base 862 suitably includes structure that enables the multiple functionality of the rings 860, namely opening, closing and collapsing of the same.

Figure 20B:
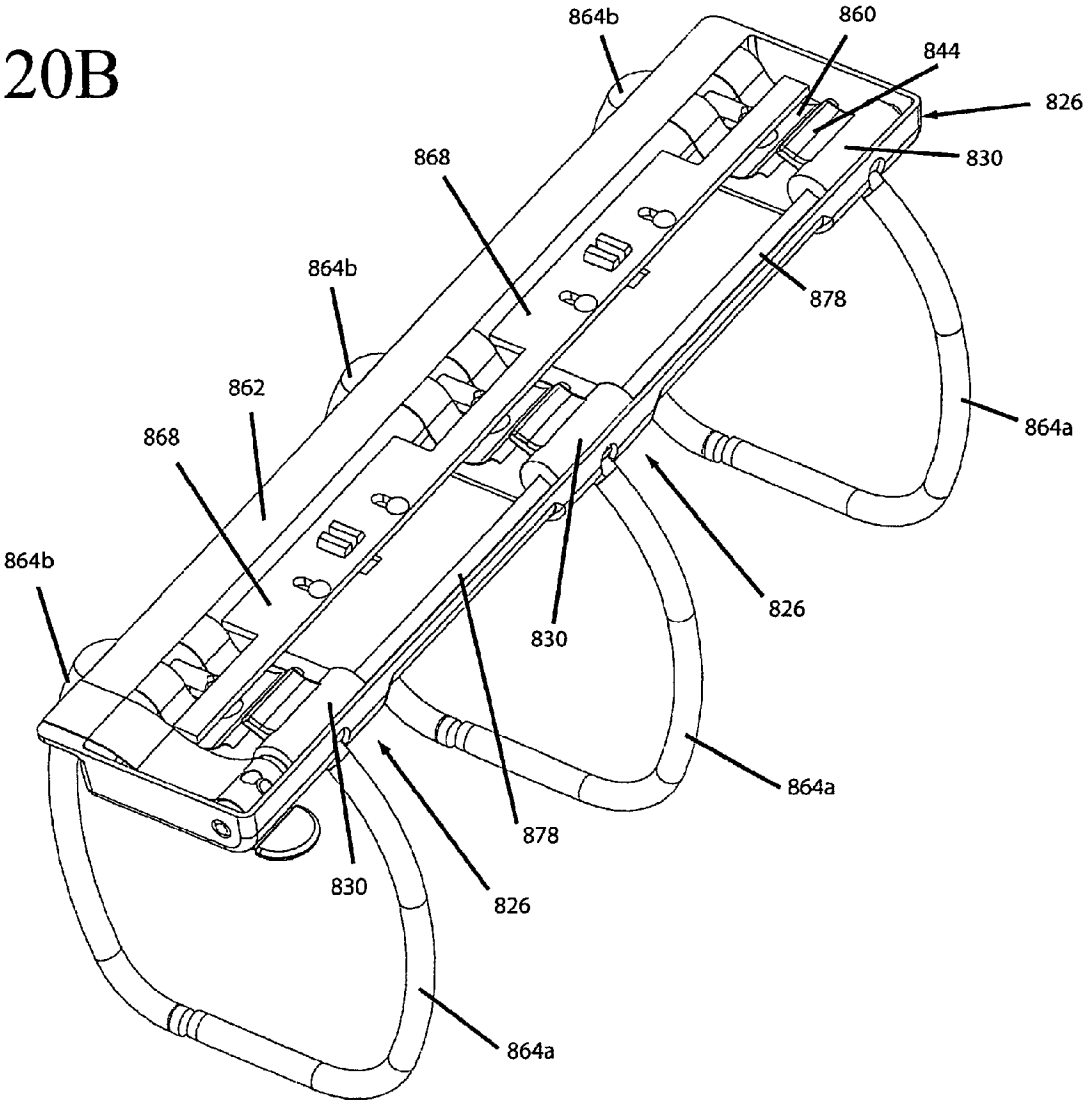
FIG. 20B is a bottom perspective view of the binder device of FIG. 20A.
Figure 20C:
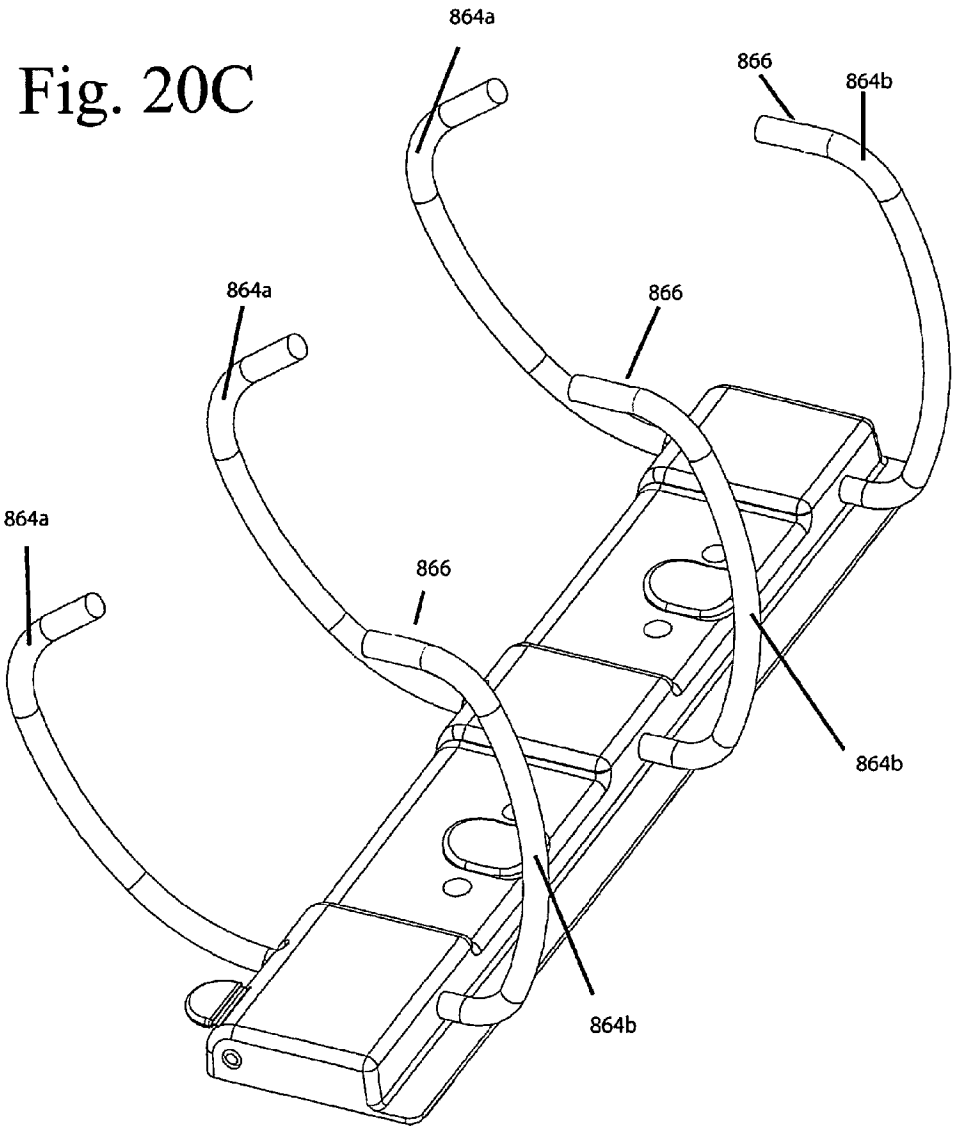
FIG. 20C is a perspective view of the binder device of FIGS. 20A-20B, wherein the device is in an upright and open configuration.
Figure 20D:
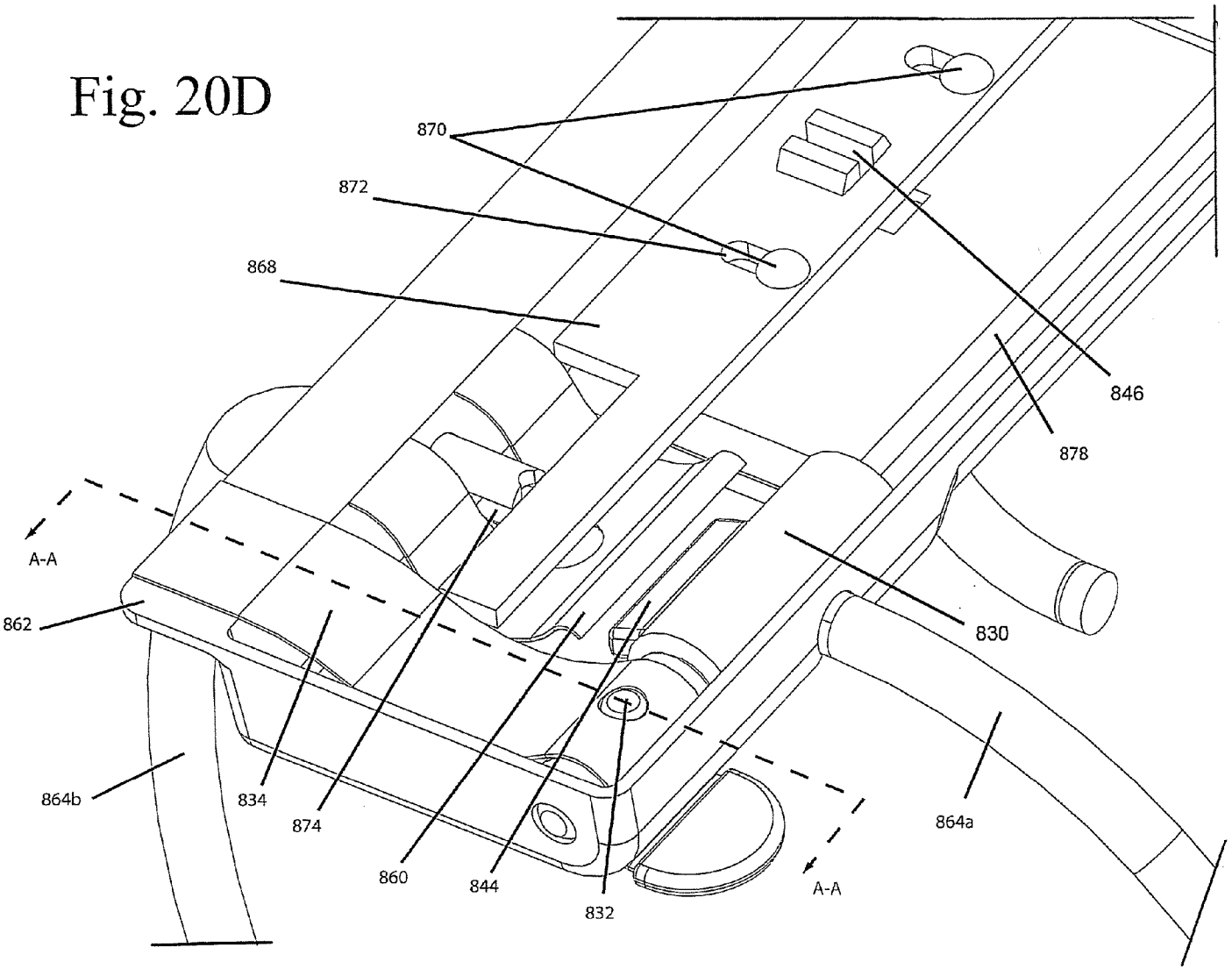
FIG. 20D is a partial bottom perspective view of the binder device of FIGS. 20A-20C according to an embodiment of the present invention.
Figure 20E:
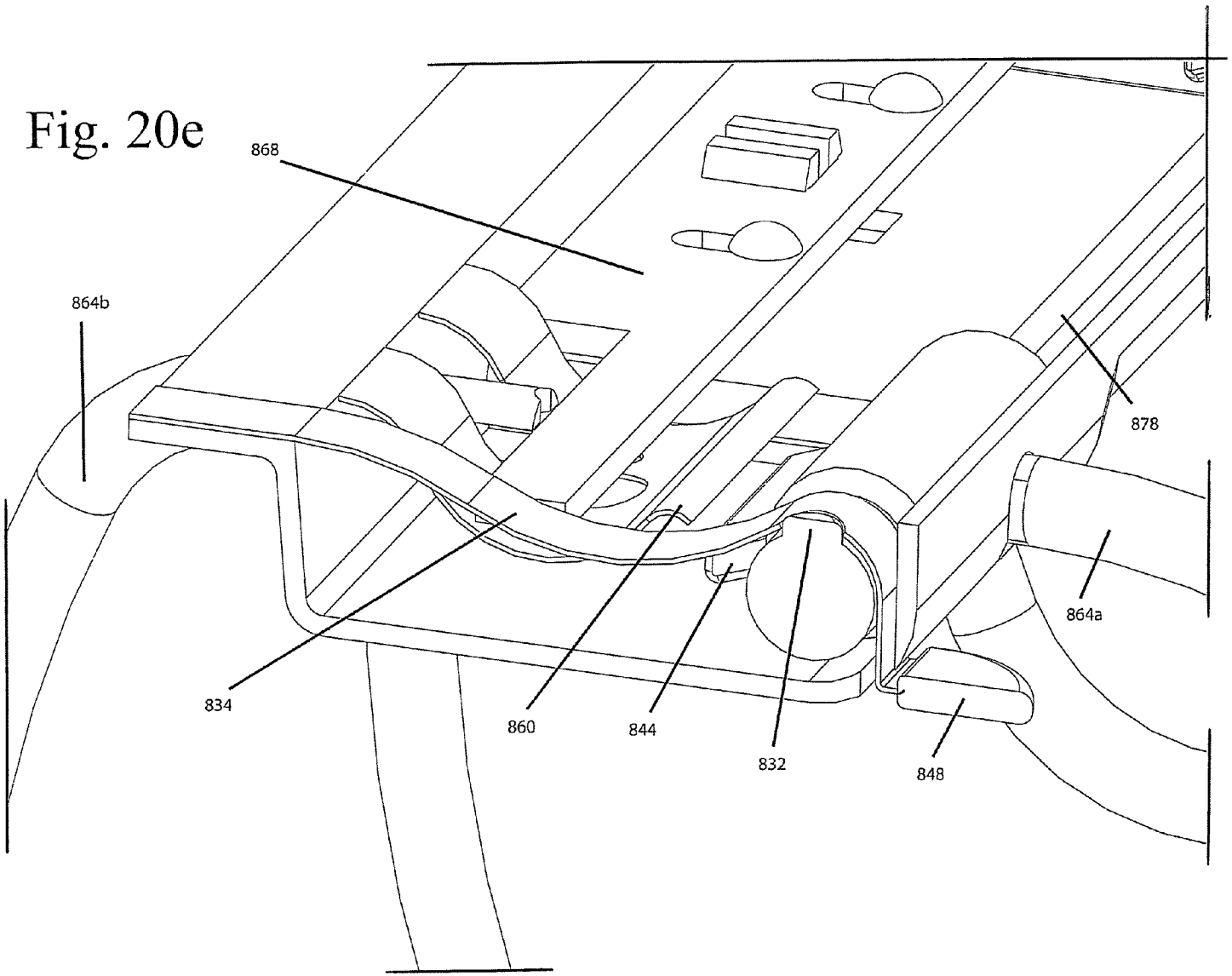
FIG. 20E is a cross sectional view of the binder device of FIG. 20D, taken along line A-A thereof.

Turning to FIGS. 20B, 20D, and 20E, the interfacing portions 826 of the first arcuate portions 864*a* are preferably disposed along a common shaft 878 that is attached to the base 862. The interfacing portions 826 generally include a cylindrical shaft 830, rotatably disposed on the common shaft 878, a projection 844, and a bridge 860.

The shaft 830 suitably provides an interfacing element between the first arcuate portion 864*a* and the base 862 that enables the multiple functionality and movability of the first arcuate portion 864*a*. The shaft 830 suitably also provides a substrate to which the first arcuate portion 864*a* is mechanically or otherwise secured, and thereby generally anchors the first arcuate portion 864*a* to the base 862.

The shaft 830 is preferably provided as a generally right cylindrical member adapted to rotate, about its longitudinal axis. Additionally, the shaft 830 preferably is attached to the common shaft 878, thereby securing the shaft 830 to the base 862 and also enabling the free rotatability of the shaft 830 relative thereto. The association of the first arcuate portion 864*a* to the shaft 830 is suitably configured to enable translation of the shaft's 830 rotation to the first arcuate portion 864*a* for providing openability and closability of the first arcuate portion 864*a* relative to the base 862.

As previously mentioned, the shaft 830 also provides a substrate against which the first arcuate portion 864*a* is secured. FIGS. 20D-20E illustrate a preferred embodiment of various structure by which the first arcuate portion 864*a* is secured to the shaft 830. Specifically, the shaft 830 preferably includes a receiving channel extending from the shaft 830 along a midpoint thereof and transversely relative to the longitudinal axis of the shaft 830. The channel is configured so that the secured end of the first arcuate portion 864*a* is received and secured. The channel is suitably configured in a shape generally complementary to the cross sectional shape of the first arcuate portion 864*a* to thereby increase the degree of engagement between the first arcuate portion 864*a* and the channel. The first arcuate portion 864*a* may be secured to the channel through any suitable means. In one embodiment, a fastener, such as a mechanical fastener (e.g., a screw) may suitably be disposed transversely through a bore of the shaft 830 that extends into association with the secured end of the first arcuate portion 864*a*. Such fastener suitably operates to secure the first arcuate portion 864*a* to the base 862 and prevent dissociation of the first arcuate portion 864*a* from the shaft 830. Despite the discussion of the screw, it is to be appreciated that any suitably fastener and/or means for maintaining the first arcuate portion 864*a* in constant association with the shaft 830 may be employed, such as various insert molding approaches, rivet-like fasteners and the like.

As previously mentioned, the first arcuate portion 864*a* is preferably adapted to alternate between an upright and a collapsed configuration. As contemplated by the present invention, collapsing of the first arcuate portion 864*a* generally involves first rotation of the shaft 830 away from the base 862 so as to generally separate the first arcuate portion 864*a* free end from the second arcuate portion 864*b* free end. Once the first arcuate portion 864*a* is so disposed, the first arcuate portion 864*a* is then generally rotated along an axis coaxial with the first arcuate portion 864*a* secured end, thereby disposing the length of the first arcuate portion 864*a* in generally abutting relationship with the binder and reducing the vertical size profile of the binding device 802 of the present invention. Accordingly, the secured end of the first arcuate portion 864*a* is preferably rotatably disposed within the channel to permit rotation of the first arcuate portion 864*a* relative to the shaft 830. Therefore, the means by which the first arcuate portion 864*a* is associated with the shaft 830 is preferably a means, such as an appropriate oriented rivet-like fastener, that permits such rotatability, even more preferably frictional rotatability to prevent loose rotation of the first arcuate portion 864*a*.

The first arcuate portion 864*a* preferably includes various features for biasing the first arcuate portion 864*a* into an open position, shown in FIG. 20C. More specifically, a biasing means causes the shaft 830 to rotate the free end of the first arcuate portion 864*a* away from the free end of the second arcuate portion 864*b*. Relative to the biasing means, the shaft 830 preferably includes a projection 844 on which the biasing means acts. More specifically, the projection 844 preferably extends transversely from the shaft 830 at an approximate 90 degree angle relative to the receiving channel. A bridge 860, adapted to act on the shaft 830 to bias it, rotates the shaft 830 away from the base 862. FIG. 20B illustrates a preferred embodiment of the bridge 860 in which the bridge 860 is configured as a unitary and ribbon-like member. The bridge 860 is preferably constructed of a material, such as metal, spring steel, and the like, that displays resilient flexibility. Similar biasing features can be found in binder device 200 previously described.

It is to be appreciated that, despite the foregoing discussion, the biasing means may be provided as any feature and/or structure capable of biasing the free end of the first arcuate portion 864*a* into an open configuration. It is also to be appreciated that the biasing means is an optional element of the present invention and may suitably be omitted therefrom.

As previously mentioned, the rings 860 of the device 802 are generally adapted to collapse so as to permit the device 802 to assume a reduced size profile. The first arcuate portions 864*a* are generally first pivoted away from the second arcuate portions 864*b*, and then the first arcuate portions 864*a* are rotated relative to the base 862, in a manner generally similar to the means by which the ring 202 of the device 200 is collapsed. The first arcuate portions 864*a* are preferably each rotatable both clockwise and counterclockwise. Accordingly, two arcuate portions 864*a* may suitably be rotated to overlie each other, thereby eliminating one arcuate portion 864*a* from extending beyond the casing when the device 802 is in a collapsed configuration.

As shown in FIGS. 20D and 20E, an optional locking mechanism may be used to releasably secure the first arcuate portions 764*a* in their upright, usable positions. For example, as shown in FIGS. 20D and 20E, a boss 832 on the common shaft 878 is releasably inserted into an aperture in a spring like lever 834 attached to the base 862 when the first arcuate portions 864*a* are in their upright, usable positions. The lever 834 will prevent the common shaft 878 from rotating relative to the base 862. To release the boss 832 from the aperture on the common shaft, a button 848 attached to the end of the spring like lever 834 is pushed, releasing the boss 832 from the aperture and allowing the common shaft 878 to freely rotate.

Figure 21:
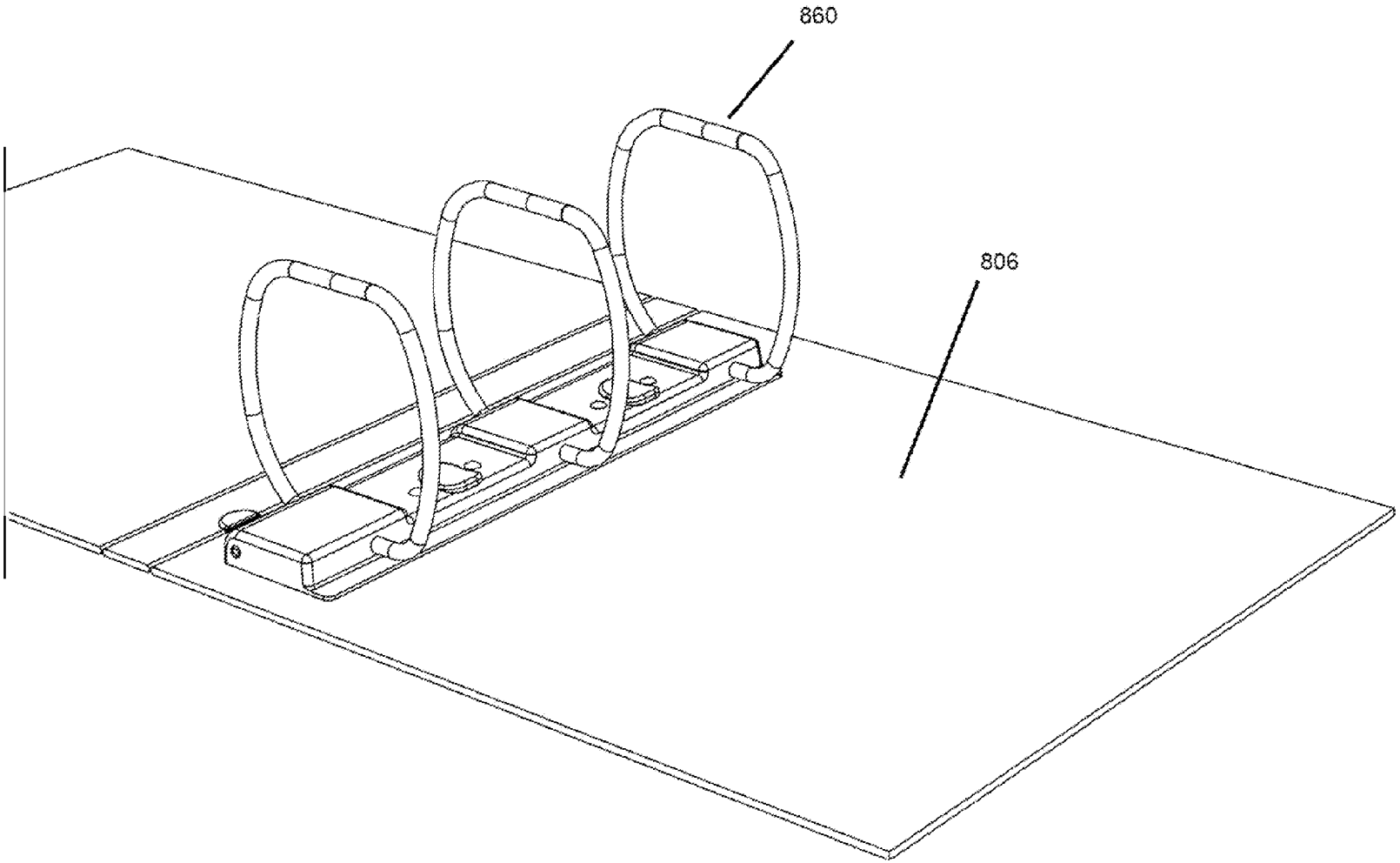
FIG. 21 is a perspective view of the binder device of FIGS. 20A-20E, wherein the device is in an upright and closed configuration inside a binder.

The collapsibility of the device 802 provides particular benefits for pre-consumer considerations. More specifically, the ability to collapse the device 802 enables an increased number of binders incorporating the device 802 to be shipped in a single container and to be displayed in a given amount of retail space, relative to conventional ring binders. Thus, in one aspect, a consumer will typically purchase the casing and device 802 with the device 802 in a collapsed configuration. The consumer will generally dispose the device 802 in an upright configuration for use as a ring binder 806, as shown in FIG. 21. To do so, the consumer would rotate the second arcuate portions 864*b* upright and lock them in their upright positions, then the consumer would rotate and then pivot the first arcuate portions 864*a* upward into engagement with the second arcuate portions 864*b*.

Figure 22A:
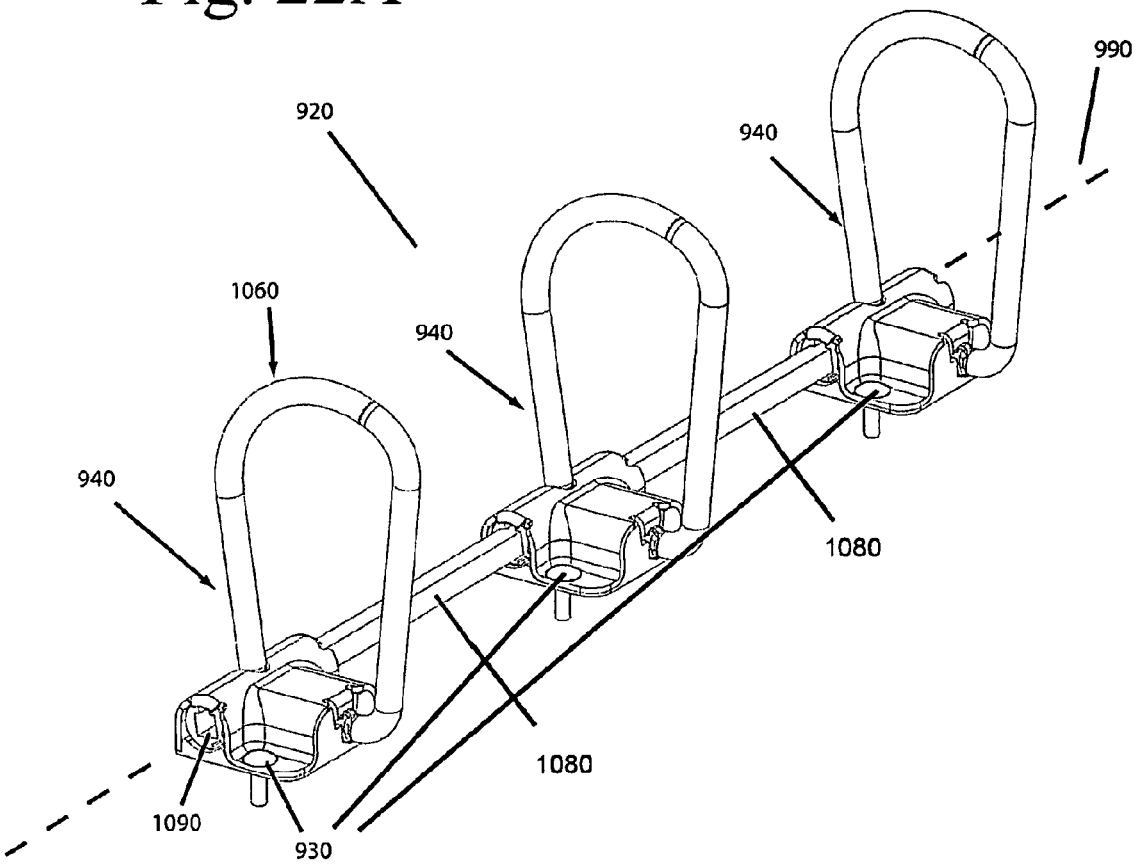
FIG. 22A is a perspective view of an exemplary collapsible three ring binder device according to an alternative embodiment of the present invention, shown in a closed position.
Figure 22B:
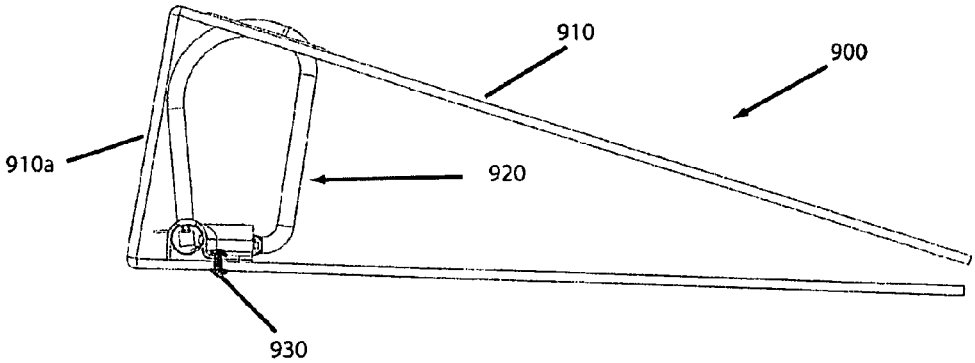
FIG. 22B is a side view of an exemplary three ring binder that incorporates the three ring binder device of FIG. 22A.

FIGS. 22A-22J illustrate another exemplary binder device 920 and another exemplary collapsible binder 900 according to an alternative embodiment of the present invention. As shown in FIG. 22B, the binder 900 comprises a casing 910 and a binder device 920 mounted thereto via any suitable fastening mechanism (e.g., rivets 930, screws, bolts, glue, welding, etc.).

The binder device 920 comprises a plurality of interconnected binder ring assemblies 940. As shown in FIG. 22D, each binder ring assembly 940 comprises a base 950, a cover 960, a movable member 980, and a ring 1060.

Figure 22C:
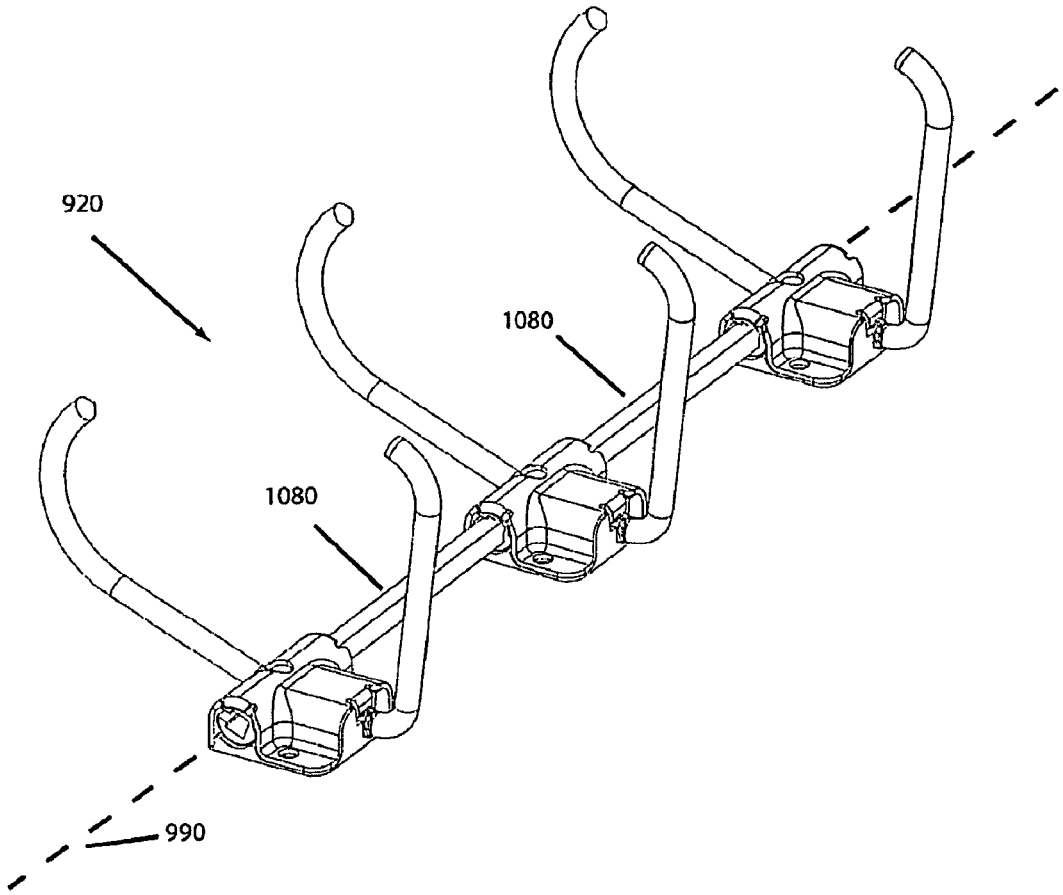
FIG. 22C is a perspective view of the collapsible three ring binder device of FIG. 22A, shown in an open position.
Figure 22D:
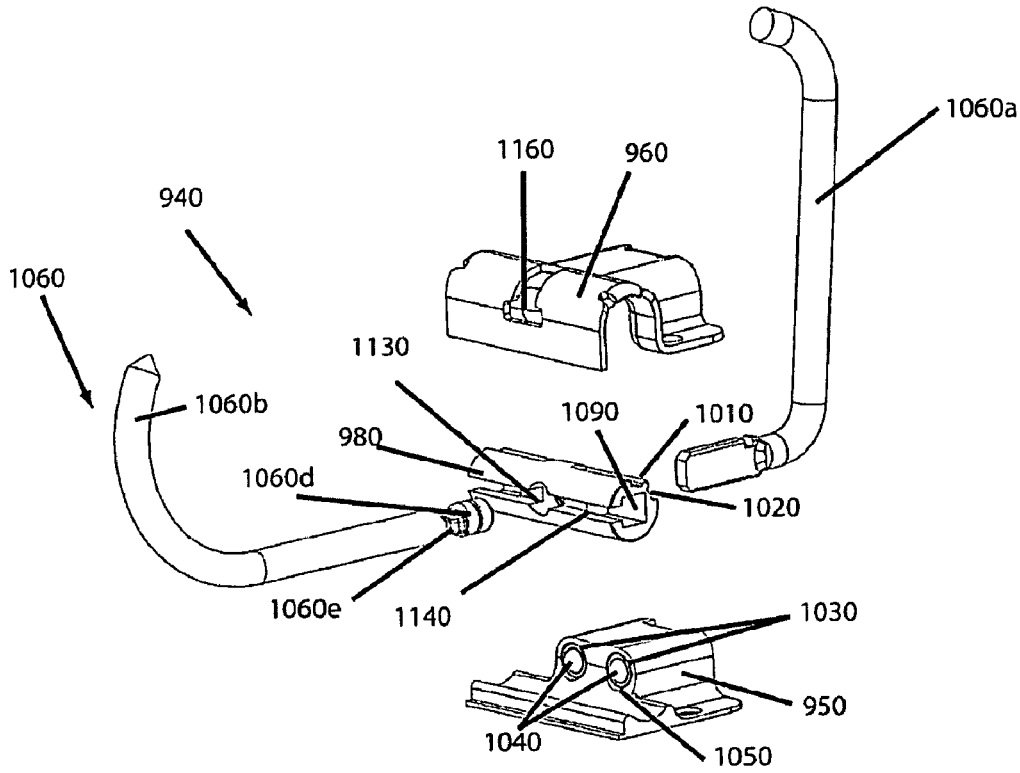
FIG. 22D is an exploded view of a binder ring assembly of the binder device of FIG. 22A.
Figure 22E:
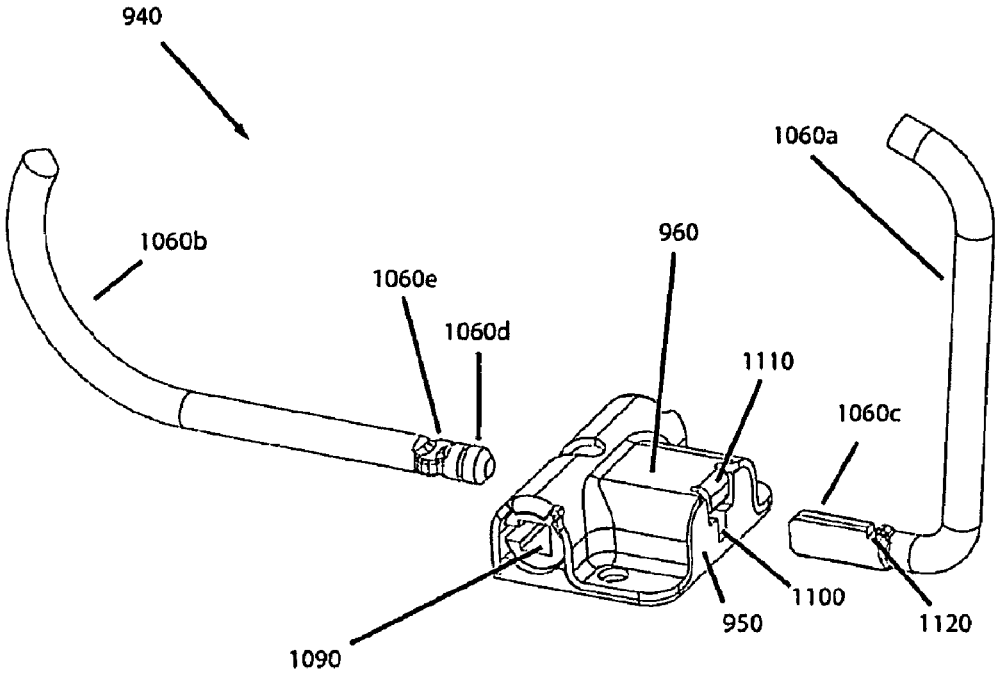
FIG. 22E is a perspective view of the binder ring assembly of FIG. 22D in a partially disassembled configuration.
Figure 22F:
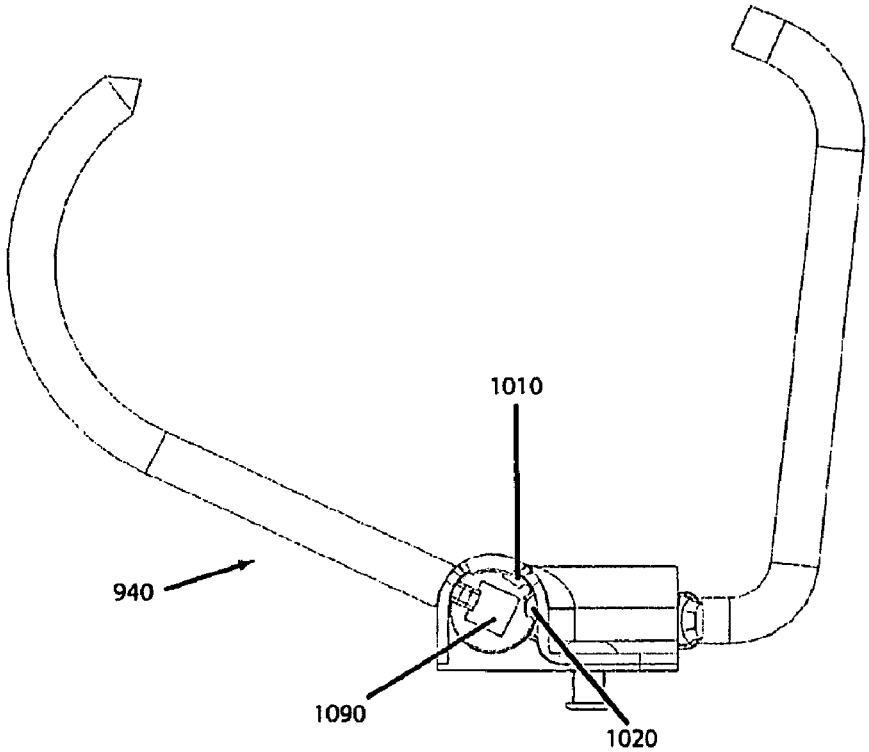
FIG. 22F is a side view of the binder ring assembly of FIG. 22D in an open position.
Figure 22H:
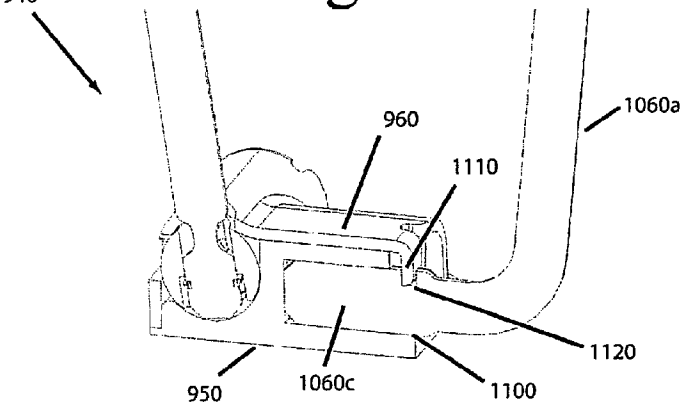
FIG. 22H is a cross-sectional view of the binder ring assembly of FIG. 22D in a closed position.
Figure 22J:
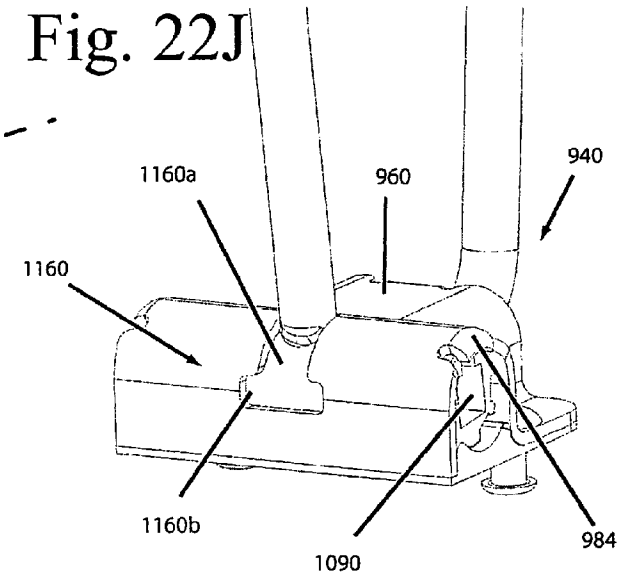
FIGS. 22I and 22J are partial perspective views of the binder ring assembly of FIG. 22D in a closed position.
Figure 22G:
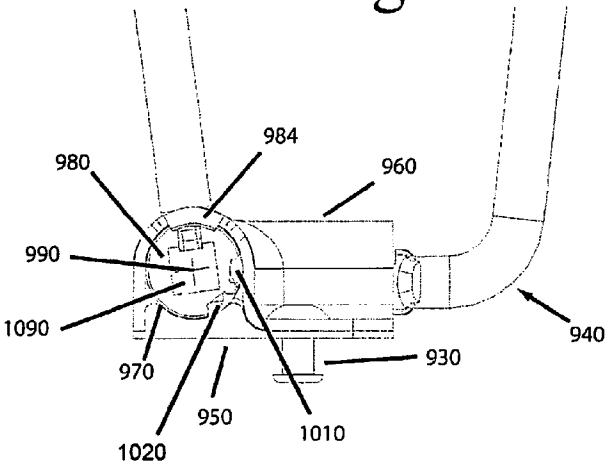
FIG. 22G is a partial side view of the binder ring assembly of FIG. 22D in a closed position.
Figure 22I:
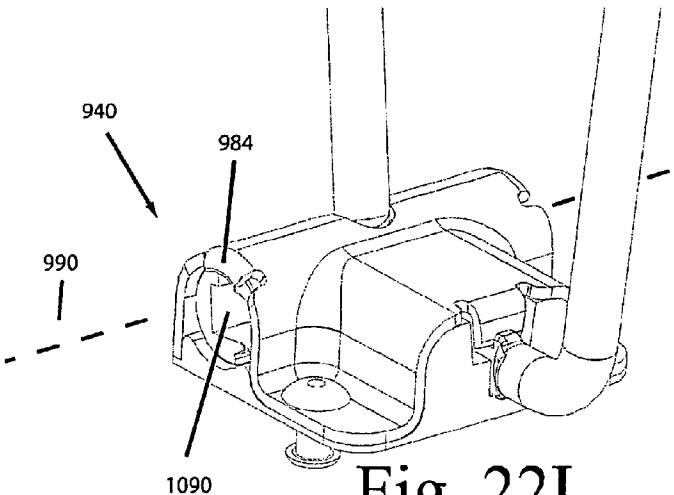

As shown in FIG. 22G, the cover 960 rigidly mounts to the base 950 via two rivets 930 or other suitable fasteners. The base 950 and cover 960 are shaped so as to create a generally cylindrical passage 970. The movable member 980 is correspondingly generally cylindrically shaped and fits into the cylindrical passage 970 such that the movable member 980 can pivot relative to the base 950 and cover 960 about a longitudinally extending axis 990. Protrusions 984 extend from the cover 960 (or the base 950) into the passage 970 to limit axial movement of the movable member 980 relative to the base 950.

The movable member 980 is movable about the axis 990 between an open position (shown in FIGS. 22C and 22F) and a closed position (shown in FIGS. 22A, 22B, and 22G-22J). The binder ring assembly 940 includes a biasing mechanism that biases the movable member 980 into the open and closed positions. As shown in FIG. 22G, the biasing mechanism comprises two retaining grooves 1010, 1020 that are circumferentially spaced from each other on the movable member 980. As shown in FIG. 22D, the biasing mechanism also includes two sets of springs 1030 and ball detents 1040 that fit into laterally-extending bores 1050 in the base 950. The springs 1030 urge the ball detents 1040 into the passage 970. When the ball detents 1040 align with one of the grooves 1010, 1020, the detents 1040 tend to keep the movable member 980 in that pivotal position. As shown in FIG. 22F, alignment of the ball detents 1040 and groove 1020 corresponds to an open position of the movable member 980. As shown in FIG. 22G, alignment of the ball detents 1040 and groove 1010 corresponds to a closed position of the movable member 980. The movable member 980 may be manually moved between the open and closed positions against the biasing force of the springs 1030.

The ring 1060 comprises a static ring portion 1060*a* and a movable ring portion 1060*b*. The static ring portion 1060*a* rigidly mounts to the base 950. The movable ring portion 1060*b* rigidly mounts to the movable member 980 for movement with the movable member 980 relative to the base 950 and static ring portion 1060*a* between open and closed positions.

As shown in FIGS. 22A and 22C, the binder device 920 comprises three longitudinally spaced binder ring assemblies 940. The movable ring portions 1060*b* of the three binder ring assemblies 940 move together relative to the bases 950 and static ring portions 1060*a* between the open and closed positions. To facilitate such synchronous movement, the movable members 980 of adjacent binder ring assemblies 940 connect to each other via a square rod 1080. Opposing square ends of the rod 1080 fit into correspondingly shaped square bores 1090 in the adjacent movable members 980. While the illustrated cross-sectional shape of the rod 1080 and bores 1090 is square, the cross-sectional shape may alternatively comprise any other suitable non-circular shape without deviating from the scope of the present invention. Alternatively, the shape may be circular, and an additional structure may be provided to prevent relative rotation of the rods 1080 and movable members 980 (e.g., set screw, etc.).

Figure 23:
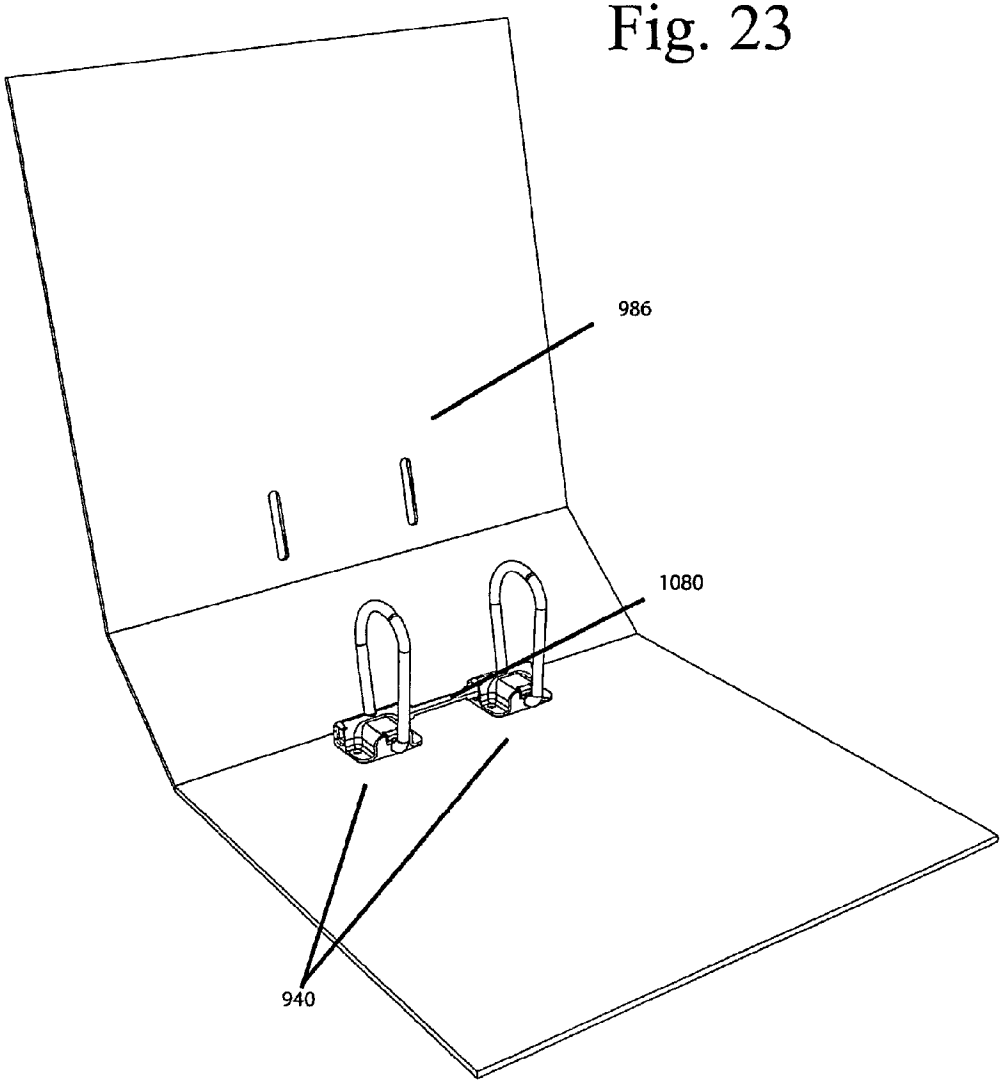
FIG. 23 is a perspective view of an exemplary two-ring binder that incorporates the binder device of FIG. 22D according to an alternative embodiment of the present invention.

While the illustrated binder device 920 utilizes three spaced binder ring assemblies 940, the binder device 920 may alternatively comprise greater or fewer binder ring assemblies 940 without deviating from the scope of the present invention. For example, FIG. 23A illustrates an alternative two-ring binder 986 that utilizes just two binder ring assemblies 940 with a single square rod 1080 extending therebetween.

Returning to the explanation of the binder 900, to facilitate compact shipping and/or storage of the binder 900, the rings 1060 may be detached from the remainder of the binder ring assembly 940. When detached, the binder 900 takes up significantly less space. The binder ring assemblies 940 are designed to facilitate easy and secure attachment of the rings 1060 to the remainder of the binder ring assemblies 940.

Attachment of the static ring portion 1060*a* to the base 950 is explained with reference to FIG. 22E. A proximal end 1060*c* of the static ring portion 1060*a* has a non-circular cross-section. In the illustrated embodiment, the cross-sectional shape of the proximal end 1060*c* is generally rectangular, but may alternatively comprise a variety of other non-circular shapes without deviating from the scope of the present invention. The base 950 and/or cover 960 define a laterally extending slot 1100 with a cross-sectional shape that compliments the cross-sectional shape of the proximal end 1060*c* in such a way as to discourage the proximal end 1060*c* from pivoting relative to the slot 1100 when the proximal end 1060*c* is extended into the slot 1100.

As shown in FIG. 22E binder ring assembly 940 includes a locking mechanism to lock the static ring portion 1060*a* in an upright position to the base 950 when the proximal end 1060*c* is inserted into the slot 1100. The cover 960 includes a flange 1110 that resiliently extends into the slot 1100. The proximal end 1060*c* includes a correspondingly shaped notch 1120. When the proximal end 1060*c* is pushed into the slot 1100, a slanted surface at a forward end of the proximal end 1060*c* resiliently pushes the flange 1110 out of the slot 1100 to allow the proximal end 1060*c* to be inserted therein. As shown in FIG. 22H, when the flange 1110 and notch 1120 become aligned, the flange 1110 resiliently moves back into the slot 1100 and into the notch 1120 to lock the static ring portion 1060*b* to the base 950 in an upright usable position.

The binder ring assembly 940 also includes a locking mechanism to lock the movable ring portion 1060*b* to the movable member 980. As shown in FIGS. 22D and 22E, the movable ring portion 1060*b* includes a proximal end 1060*d* that is separated from the remainder of the movable ring portion 1060*b* by a flattened portion 1060*e*. The flattened portion 1060*e* has a generally rectangular cross-sectional shape with a height that is smaller than the proximal end 1060*d* and a width that is larger than the proximal end 1060*d*. As shown in FIG. 22D, the movable member 980 includes a lateral bore 1130 into which the proximal end 1060*d* fits. A groove 1140 extends longitudinally from the bore 1130. The groove 1140 has a width in the circumferential direction of the movable member 980 that is slightly larger than the height of the flattened portion 1060*e*. Accordingly, when the movable proximal end 1060*d* is inserted into the bore 1130 and the flattened portion 1060*e* is inserted into the groove 1140, the groove 1140 and flattened portion 1060*e* interact to prevent the movable ring portion 1060*b* from pivoting relative to the movable member 980 about an axis of the bore 1130.

As shown in FIG. 22J, the cover 960 includes a T shaped aperture 1160 through which the movable ring portion 1060*b* extends to mount to the movable member 980. A base 1160*a* of the T-shaped aperture 1160 has a width that is sized to accommodate the diameter of the movable ring portion 1060*b* but is smaller than the width of the flattened portion 1060*e*. A top 1160*b* of the T-shaped aperture 1160 has a width that is wide enough to accommodate extension of the flattened portion 1060*e* therethrough.

Hereinafter, attachment of the movable ring portion 1060*b* to the movable member 980 is described with reference to FIGS. 22D-22G. To attach the movable ring portion 1060*b* to the movable member 980, a user must first pivot the movable member 980 into a releasing position (shown in FIG. 22E) in which the base 1160*b* of the aperture 1160 aligns with the bore 1130. Because the ball detents 1040 tend to discourage pivotal movement of the movable member 980 from its open position (shown in FIG. 22F) to its released position (shown in FIG. 22E), the user may insert a square-ended tool into the bore 1090 to help the user pivot the movable member 980 into the released position. The user then inserts the proximal end 1060*d* through the aperture 1160 into the bore 1130, and inserts the flattened portion 1060*e* through the top 1160*b* of the aperture 1160 and into the slot 1140. The user then moves the movable member 980 to its open position, as shown in FIG. 22F.

The base 1160*a* of the T-shaped aperture 1160 is narrower than the flattened portion 1060*e* is wide such that the aperture 1160 prevents the movable ring portion 1060*b* from disengaging from the movable member 980 as the movable member moves between its open position (shown in FIG. 22F) and its closed position (shown in FIG. 22G).

The easy, manual attachment of the rings 1060 to the binder ring assemblies 940 facilitates disassembled transportation and storage of the binder 900. Without the rings 1060 attached, the binder 900 takes up significantly less space such that more disassembled binders 900 can be shipped and/or stored in a less space.

The detachability of the rings 1060 also facilitates the interchangeable use of differently sized sets of rings 1060. For example, a set of 1" rings 1060 may be attached to the binder ring assemblies 940. The 1" rings 1060 may be replaced by larger or smaller rings 1060, as desired. A spine 910*a* (see FIG. 22B) of the casing 910 may have an adjustable width to match the size of the selected rings 1060.

FIGS. 24A-25B illustrate an exemplary collapsible binder 5000 according to an alternative embodiment of the present invention. As shown in FIG. 25A, the collapsible binder 5000 comprises a casing 5010 with a binder device 5020 mounted thereto. The binder device 5020 comprises a subbase plate 5030 that fastens to a rear cover 5010*a* of the casing 5010. The binder device 5020 also comprises three spaced binder ring assemblies 5040 mounted to the subbase plate 5030. Greater or fewer binder ring assemblies 5040 may be used without deviating from the scope of the present invention.

Figures 24A, 24B:
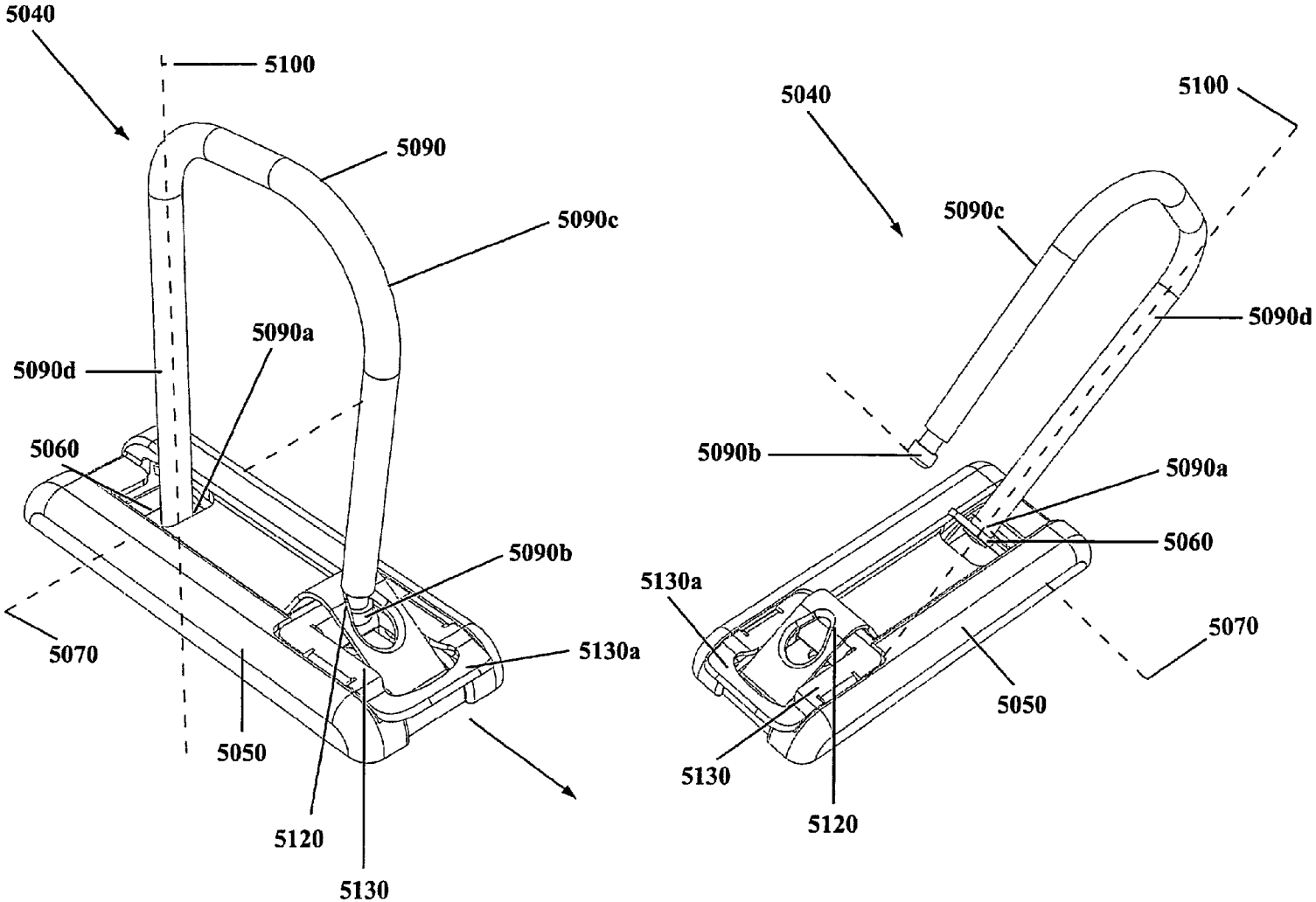
FIG. 24A is a perspective view of an exemplary binder ring assembly according to an alternative embodiment of the present invention in a closed, upright, and fastened position.
FIG. 24B is a perspective view of the binder ring assembly of FIG. 24A in an open position.

As shown in FIGS. 24A and 24B, each binder ring assembly 5040 comprises a base 5050, a movable member 5060, a ring 5090, and a locking mechanism 5110.

Figure 25B:
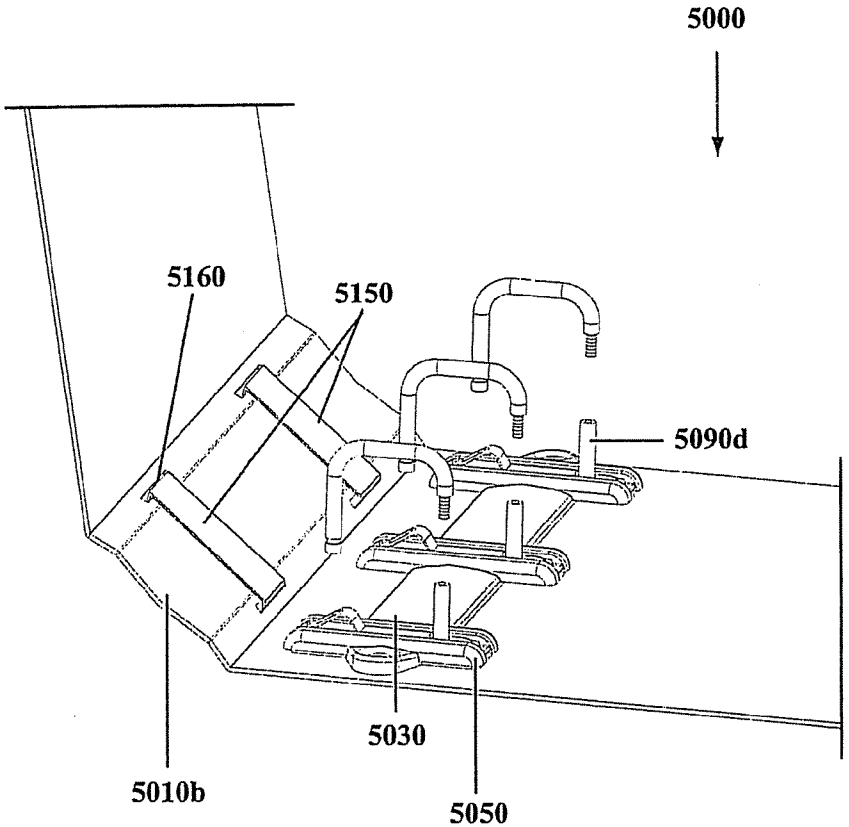
FIG. 25B is a partially disassembled perspective view of the binder of FIG. 25A.
Figure 25A:
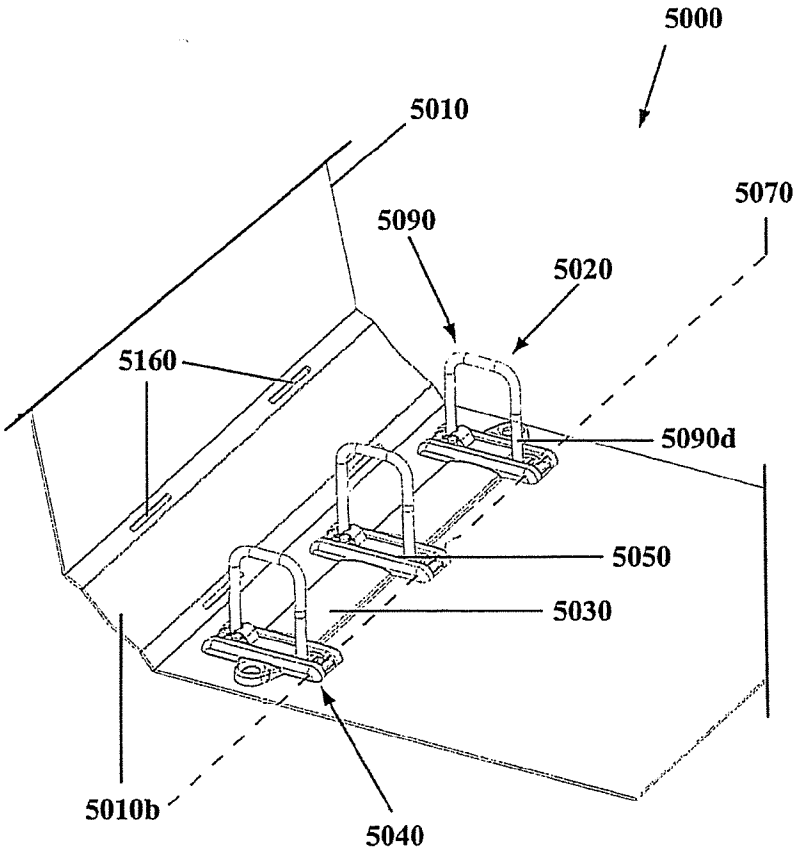
FIG. 25A is a partial perspective view of an exemplary binder with three of the binder ring assemblies of FIG. 24A-24B mounted to the binder.

As shown in FIG. 25A, the base 5050 fastens to the subbase plate 5030 via any suitable mechanism (e.g., rivets, integral formation, screws, adhesive, snap connections, etc.). The movable member 5060 pivotally connects to the base 5050 for relative movement about an opening axis 5070 as described above with respect to the binder device 100.

The ring 5090 is generally U-shaped and includes proximal and distal ends 5090*a*, 5090*b*. The proximal end 5090*a* is secured to the movable member 5060 for relative pivotal movement about a collapsing axis 5100.

The locking mechanism 5110 comprises a ring engaging portion 5120 that selectively fastens and releases the distal end 5090*b* of the ring 5090 in the manner described above with respect to other ring engaging portions. The locking mechanism 5110 also includes a release clip 5130 that slidingly connects to the ring engaging portion 5120 and/or the base 5050. The release clip 5130 includes a manually graspable handle 5130*a*. To release the ring 5090 from the ring engaging portion 5120, a user pulls the handle 5130*a* in the direction of the arrow shown in FIG. 24A, which causes the release clip 5130 to contact the distal end 5090*b* and pull it out of engagement with the ring engaging portion 5120. The other embodiments herein may be modified to include a similar release clip.

As shown in FIGS. 25A and 25B, the size of the binder 5000 is adjustable. FIG. 25A illustrates the maximum size of the binder 5000. Each ring 5090 has a height (e.g., 2", 1½, 3", etc.). A spine 5010*b* of the casing 5010 has a width that accommodates the height of the rings 5090. As shown in FIG. 25B, the binder 5000 may be converted into a smaller binder 5000 by reducing a height of the rings 5090 and reducing a width of the spine 5010*b*. The height of each ring 5090 is reduced by replacing a J-shaped distal portion 5090*c* of the ring 5090 with a shorter J-shaped distal portion 5090*c*' (e.g., ½", 1", etc.). The J-shaped distal portions 5090*c*, 5090*c*' each include a threaded proximal end that threads into a threaded bore in a proximal portion 5090*d* of the ring 5090.

To reduce the width of the spine 5010*b*, the user flexes the spine 5010*b* to reduce its width and then attaches appropriately sized gusset clips 5150 to apertures 5160 at opposite sides of the spine 5010*b* to retain the spine 5010*b* in its reduced width position. Appropriately sized gusset clips 5150 may be provided for each ring 5090 size so as to reduce a thickness of the binder 5000 to match the chosen ring 5090 size.

While the size of the illustrated rings 5090 is changed by replacing J-shaped portions of the rings, the ring 5090 size may alternatively be changed by replacing the entire ring. In such an alternative embodiment, the ring may comprise a unitary U-shaped member that detachably engages the movable member 5060 via a suitable non-permanent attachment mechanism (e.g., a screw, a bolt, etc.).

In the illustrated embodiment of the binder 5000, the rings 5090 are collapsed by pivoting each movable member 5060 about the axis 5070 about 90 degrees away from its closed position and pivoting each ring 5090 about the axis 5100 about 90 degrees to lay each ring 5090 generally flat and parallel to the underlying casing 5010. According to an alternative embodiment of the present invention, however, the rings 5090 are flattened by disconnecting the J-shaped portion 5090*c* from the proximal portion 5090*d* and pivoting the proximal portion 5090*d* and movable member 5060 about the axis 5070 into the collapsed position. In such an embodiment, the proximal portion 5090*d* may be rigidly connected to the movable member 5060 such that the proximal portion 5090*d* is not pivotal relative to the movable member 5060 about the axis 5100.

According to an alternative embodiment of the present invention, the attachment mechanism comprises a single-use permanent attachment mechanism that easily fastens the ring to the movable member 5060. Accordingly, numerous binders 5000 may be shipped in a flattened position with the rings detached. At an appropriate location, an operator decides which sized binder 5000 is desired and permanently attaches the correspondingly sized ring to the binder. The binders 5000 are therefore adaptable until specifically sized rings are chosen and attached to the binder.

What is claimed is:

1. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position; and wherein the secured end of the ring cooperates with the base such that the base biases the free end of the ring into an open position in which the free end of the ring is spaced from and proximate the base connector.

2. The binder mechanism of claim 1, wherein the base connector releasably fastens the free end of the ring, permitting the free end of the ring to be repeatedly connected to the base to put the binder mechanism in a closed configuration and repeatedly disconnected from the base to put the binder mechanism in an open configuration; and wherein the first pivotal connection permits the ring to pivot permitting the free end of the ring to be moved away from the base connector when unfastened.

3. The binder mechanism of claim 2, wherein the second pivotal connection permits the ring to pivot into a collapsed position that significantly reduces the height of an upper portion of the ring relative to the base.

4. The binder mechanism of claim 1, wherein the first pivotal connection comprises a transverse member;

wherein the base further comprises a central portion, and at least first and second other portions on either side of the central portion; and wherein the transverse member is positioned between the central portion and the first and second other portions of the base to permit pivotal movement of the free end of the ring away from the base connector.

5. The binder mechanism of claim 4, wherein the transverse member cooperates with at least the central portion and the first and second other portions to bias the free end of the ring into an open position in which the free end of the ring is spaced from and proximate the base connector.

6. The binder mechanism of claim 4, wherein the second pivotal connection comprises a fastener coupling the transverse member to the secured end of the ring permitting the ring to pivot into a collapsed position that significantly reduces the height of an upper portion of the ring relative to the base.

7. The binder mechanism of claim 6, wherein the fastener extends through an opening in a flange of the transverse member.

8. The binder mechanism of claim 1, wherein the first pivotal connection comprises a transverse member;

wherein the base further comprises a central portion, a flange portion, a pair of arcuate portions on either side of the central portion, and a tab connected to the central portion of the base; and wherein the transverse member is positioned between the central portion and the arcuate portions of the base to permit pivotal movement of the free end of the ring away from the base connector.

9. The binder mechanism of claim 8, wherein the transverse member cooperates with the central portion, the flange portion, the pair of arcuate portions, and the tab of the base to bias the free end of the ring into an open position in which the free end of the ring is spaced from and proximate the base connector.

10. The binder mechanism of claim 8, wherein the arcuate portions of the base further comprise a notch that assists with pivoting the transverse member.

11. The binder mechanism of claim 1, wherein the second pivotal connection comprises a flange coupled to the secured end of the ring with a fastener.

12. The binder mechanism of claim 11, wherein the flange comprises a shoulder of a transverse member.

13. The binder mechanism of claim 11, wherein the flange comprises a shoulder of a transverse member, and wherein the transverse member cooperates with the base to form the first pivotal connection.

14. The binder mechanism of claim 11, wherein the secured end of the ring further comprises an opening into which the fastener is inserted.

15. The binder mechanism of claim 14, wherein the fastener is a threaded fastener.

16. The binder mechanism of claim 11, wherein the fastener is a rivet.

17. The binder mechanism of claim 11, wherein the secured end of the ring further comprises a threaded opening into which the fastener is inserted and the fastener is a threaded fastener.

18. The binder mechanism of claim 1, wherein the base connector comprises a flange shaped to engage the free end of the ring and hold the ring in the closed position.

19. The binder mechanism of claim 18, wherein the flange comprises a lip shaped to engage the free end of the ring and hold the ring in the closed position.

20. The binder mechanism of claim 1, wherein the base connector comprises an aperture generally shaped to engage the free end of the ring to fasten the free end of the ring to the base connector.

21. The binder mechanism of claim 20, wherein the aperture has an upper channel portion and a lower wider portion to fasten the free end of the ring to the base connector.

22. The binder mechanism of claim 21, wherein the free end of the ring comprises a circumferentially reduced portion that seats in the upper channel portion of the aperture to fasten the free end of the ring to the base connector.

23. The binder mechanism of claim 22, wherein the base connector further comprises a release for unseating the circumferentially reduced portion of the ring from the upper channel portion of the aperture.

24. The binder mechanism of claim 20, wherein a portion of the base connector is sloped with respect to the generally horizontal base permitting the free end of the ring to be fastened to the base connector by positioning the free end of the ring generally over the aperture and rotating the ring by the top of the ring in a direction so the free end of the ring moves toward the sloped portion so that the free end of the ring is fastened to the base connector.

25. The binder mechanism of claim 20, wherein the portion of the base connector with the aperture is sloped with respect to the generally horizontal base.

26. The binder mechanism of claim 1, wherein the second pivotal connection comprises a flange coupled to the secured end of the ring with a fastener and the base connector comprises an aperture generally shaped to engage the free end of the ring to fasten the free end of the ring to the base connector.

27. The binder mechanism of claim 26, wherein the secured end of the ring further comprises an opening into which the fastener is inserted and a portion of the base connector is sloped with respect to the generally horizontal base permitting free end of the ring to be fastened to the base connector by positioning the free end of the ring generally over the aperture and rotating the ring by the top of the ring in a direction so the free end of the ring moves toward the sloped portion so that the free end of the ring is fastened to the base connector.

28. The binder mechanism of claim 27, wherein a transverse member cooperates with a central portion, a flange portion, a pair of arcuate portions, and a tab of the base to bias the free end of the ring into an open position in which the free end of the ring is spaced from and proximate the base connector.

29. The binder mechanism of claim 1, wherein the base connector and free end of the ring are characterized by permitting the free end of the ring to be fastened to the base connector by positioning the free end of the ring generally over the base connector and rotating the ring by the top of the ring in a direction so the free end of the ring moves toward a sloped portion of the base connector so that the free end of the ring is fastened to the base connector.

30. A binder, comprising:

a binder casing; and a plurality of binder mechanisms affixed to the binder casing, wherein each binder mechanism comprises:

a base;

a ring comprising a free end and a secured end, with the secured end being movably secured to the base; and a base connector for fastening the free end of the ring; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position; and wherein the secured end of the ring cooperates with the base such that the base biases the free end of the ring into an open position in which the free end of the ring is spaced from and proximate the base connector.

31. The binder of claim 30, wherein the base connector releasably fastens the free end of the ring, permitting the free end of the ring to be repeatedly connected to the base to put the binder mechanism in a closed configuration and repeatedly disconnected from the base to put the binder mechanism in an open configuration; and wherein the first pivotal connection permits the ring to pivot permitting the free end of the ring to be moved away from the base connector when unfastened.

32. The binder of claim 31, wherein the second pivotal connection permits the ring to pivot into a collapsed position that significantly reduces the height of an upper portion of the ring relative to the base.

33. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position;

wherein the base connector releasably fastens the free end of the ring, permitting the free end of the ring to be repeatedly connected to the base to put the binder mechanism in a closed configuration and repeatedly disconnected from the base to put the binder mechanism in an open configuration;

wherein the first pivotal connection permits the ring to pivot permitting the free end of the ring to be moved away from the base connector when unfastened;

wherein the second pivotal connection permits the ring to pivot into a collapsed position that significantly reduces the height of an upper portion of the ring relative to the base;

wherein the first pivotal connection comprises a transverse member;

wherein the base further comprises a central portion, and at least first and second other portions on either side of the central portion;

wherein the transverse member is positioned between the central portion and the first and second other portions of the base to permit pivotal movement of the free end of the ring away from the base connector; and wherein the transverse member cooperates with at least the central portion and the first and second other portions to bias the free end of the ring into an open position in which the free end of the ring is spaced from and proximate the base connector.

34. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position;

wherein the base connector releasably fastens the free end of the ring, permitting the free end of the ring to be repeatedly connected to the base to put the binder mechanism in a closed configuration and repeatedly disconnected from the base to put the binder mechanism in an open configuration;

wherein the first pivotal connection permits the ring to pivot permitting the free end of the ring to be moved away from the base connector when unfastened;

wherein the second pivotal connection permits the ring to pivot into a collapsed position that significantly reduces the height of an upper portion of the ring relative to the base;

wherein the first pivotal connection comprises a transverse member;

wherein the base further comprises a central portion, a flange portion, a pair of arcuate portions on either side of the central portion, and a tab connected to the central portion of the base; and wherein the transverse member is positioned between the central portion and the arcuate portions of the base to permit pivotal movement of the free end of the ring away from the base connector.

35. The binder mechanism of claim 34, wherein the transverse member cooperates with the central portion, the flange portion, the pair of arcuate portions, and the tab of the base to bias the free end of the ring into an open position in which the free end of the ring is spaced from and proximate the base connector.

36. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position;

wherein the base connector releasably fastens the free end of the ring, permitting the free end of the ring to be repeatedly connected to the base to put the binder mechanism in a closed configuration and repeatedly disconnected from the base to put the binder mechanism in an open configuration;

wherein the first pivotal connection permits the ring to pivot permitting the free end of the ring to be moved away from the base connector when unfastened;

wherein the second pivotal connection permits the ring to pivot into a collapsed position that significantly reduces the height of an upper portion of the ring relative to the base;

wherein the second pivotal connection comprises a flange coupled to the secured end of the ring with a fastener; and wherein the secured end of the ring further comprises an opening into which the fastener is inserted.

37. The binder mechanism of claim 36, wherein the fastener is a threaded fastener.

38. The binder mechanism of claim 36, wherein the fastener is a rivet.

39. The binder mechanism of claim 36, wherein the opening is a threaded opening and the fastener is a threaded fastener.

40. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position;

wherein the base connector releasably fastens the free end of the ring, permitting the free end of the ring to be repeatedly connected to the base to put the binder mechanism in a closed configuration and repeatedly disconnected from the base to put the binder mechanism in an open configuration;

wherein the first pivotal connection permits the ring to pivot permitting the free end of the ring to be moved away from the base connector when unfastened;

wherein the second pivotal connection permits the ring to pivot into a collapsed position that significantly reduces the height of an upper portion of the ring relative to the base;

wherein the base connector comprises an aperture generally shaped to engage the free end of the ring to fasten the free end of the ring to the base connector;

wherein the aperture has an upper channel portion and a lower wider portion to fasten the free end of the ring to the base connector;

wherein the free end of the ring comprises a circumferentially reduced portion that seats in the upper channel portion of the aperture to fasten the free end of the ring to the base connector; and wherein the base connector further comprises a release ring for unseating the circumferentially reduced portion of the ring from the upper channel portion of the aperture.

41. The binder mechanism of claim 40, wherein the portion of the base connector with the aperture is sloped with respect to the generally horizontal base.

42. A binder mechanism, comprising:

a base;

a ring comprising a free end and a secured end, with the secured end being movably secured to the base; and a base connector for fastening the free end of the ring in a closed position; and wherein the secured end of the ring is pivotally connected to the base via a first pivotal connection permitting the ring to pivot between an upright open position and an upright closed position relative to the base connector, with the upright closed position permitting sheets to be held by the ring and with the upright open position permitting sheets to be added to the ring;

wherein the secured end of the ring is pivotally connected to the base via a second pivotal connection permitting the ring to pivot from a collapsed position into an upright position;

wherein the base connector releasably fastens the free end of the ring, permitting the free end of the ring to be repeatedly connected to the base to put the binder mechanism in a closed configuration and repeatedly disconnected from the base to put the binder mechanism in an open configuration;

wherein the first pivotal connection permits the ring to pivot permitting the free end of the ring to be moved away from the base connector when unfastened;

wherein the second pivotal connection permits the ring to pivot into a collapsed position that significantly reduces the height of an upper portion of the ring relative to the base;

wherein the second pivotal connection comprises a flange coupled to the secured end of the ring with a fastener and the base connector comprises an aperture generally shaped to engage the free end of the ring to fasten the free end of the ring to the base connector; and wherein the secured end of the ring further comprises an opening into which the fastener is inserted and a portion of the base connector is sloped with respect to the generally horizontal base permitting free end of the ring to be fastened to the base connector by positioning the free end of the ring generally over the aperture and rotating the ring by the top of the ring in a direction so the free end of the ring moves toward the sloped portion so that the free end of the ring is fastened to the base connector.

43. The binder mechanism of claim 42, wherein a transverse member cooperates with a central portion, a flange portion, a pair of arcuate portions, and a tab of the base to bias the free end of the ring into an open position in which the free end of the ring is spaced from and proximate the base connector.

* * * * *

UNITED STATES PATENT AND TRADEMARK OFFICE

CERTIFICATE OF CORRECTION

PATENT NO. : 7,736,081 B2
APPLICATION NO. : 11/544465
DATED : June 15, 2010
INVENTOR(S) : Curtis Patrick Taylor and Anthony J. DeCarlo It is certified that error appears in the above-identified patent and that said Letters Patent is hereby corrected as shown below:

Column 7, line 35, after "claim" please delete "11" and insert -- 14 --.

Signed and Sealed this

Thirty-first Day of August, 2010

David J. Kappos

David J. Kappos
*Director of the United States Patent and Trademark Office*